US007410745B2

(12) United States Patent
Ohzeki et al.

(10) Patent No.: US 7,410,745 B2
(45) Date of Patent: Aug. 12, 2008

(54) PHOTOTHERMOGRAPHIC MATERIAL AND IMAGE FORMING METHOD USING SAME

(75) Inventors: Tomoyuki Ohzeki, Kanagawa (JP); Eiichi Okutsu, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 10/736,561

(22) Filed: Dec. 17, 2003

(65) Prior Publication Data

US 2004/0131983 A1 Jul. 8, 2004

(30) Foreign Application Priority Data

Dec. 19, 2002 (JP) ..... 2002-367663
Mar. 5, 2003 (JP) ..... 2003-058440

(51) Int. Cl.
*G03C 5/16* (2006.01)
*G03C 1/619* (2006.01)

(52) U.S. Cl. ..... 430/139; 430/512; 430/600; 430/603; 430/611; 430/613; 430/619

(58) Field of Classification Search ..... 430/619, 430/567, 600, 603, 611, 139, 512, 613, 614
See application file for complete search history.

(56) References Cited

U.S. PATENT DOCUMENTS 3,885,968 A 5/1975 Shinpei et al.
4,332,889 A * 6/1982 Siga et al. ..... 430/583
4,435,499 A 3/1984 Reeves
5,017,469 A 5/1991 Mowforth et al.
5,958,668 A * 9/1999 Matsumoto et al. ..... 430/619
5,965,343 A * 10/1999 Nishimura ..... 430/567
6,093,529 A * 7/2000 Tsuzuki et al. ..... 430/619
6,120,983 A * 9/2000 Okada et al. ..... 430/619
6,143,488 A 11/2000 Uytterhoeven et al.
6,413,710 B1 * 7/2002 Shor et al. ..... 430/569
6,440,649 B1 * 8/2002 Simpson et al. ..... 430/351
6,576,410 B1 * 6/2003 Zou et al. ..... 430/350
6,787,298 B2 * 9/2004 Goto et al. ..... 430/619

FOREIGN PATENT DOCUMENTS

EP 1310825 A 5/2003
GB 1422057 A 1/1976

* cited by examiner

*Primary Examiner*—Thorl Chea
(74) *Attorney, Agent, or Firm*—Margaret A. Burke; Sheldon J. Moss

(57) ABSTRACT

The invention provides a photothermographic material including: a support and an image-forming layer including a non-photosensitive silver salt, a photosensitive silver halide, a binder, and a reduction agent disposed on the support, wherein a silver iodide content in the photosensitive silver halide is in a range from 40 mol % to 100 mol %; and an average sphere-equivalent diameter of the photosensitive silver halide is in a range from 0.3 μm to 5.0 μm. The photothermographic material may further include a silver iodide complex forming agent as a compound which substantially reduces visible light absorption caused by the photosensitive silver halide after thermal development. At least 50%, in terms of a projected area, of the photosensitive silver halide may be occupied by tabular silver halide grains having an aspect ratio of from 2 to 50 and being deposited with a silver salt in an epitaxial growth manner.

16 Claims, 6 Drawing Sheets

FIG. 3
FIG. 3A
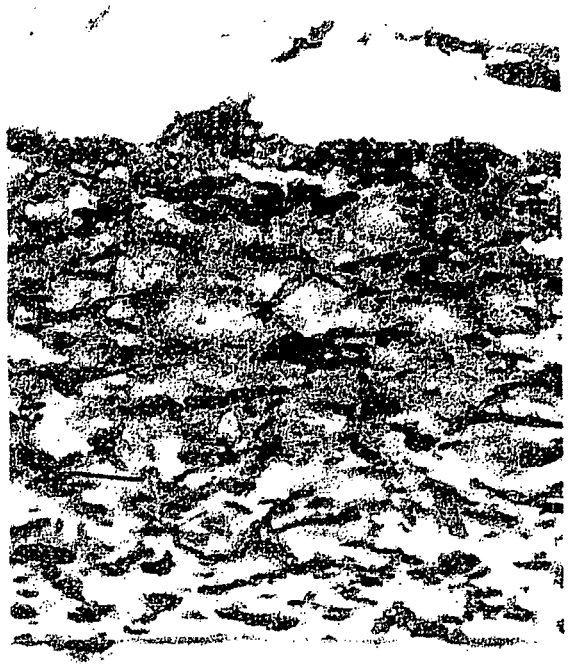
FIG. 3B
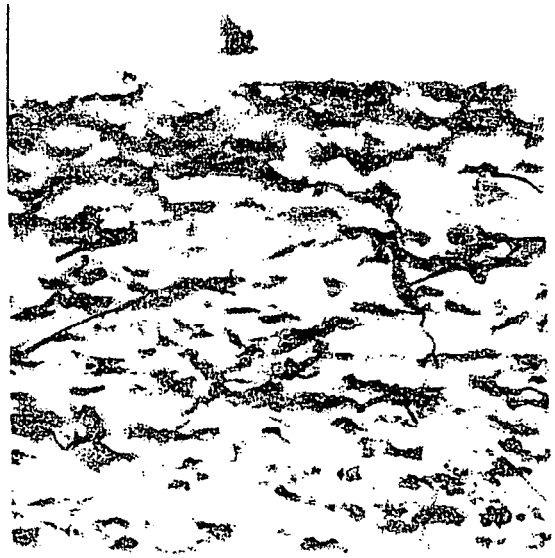

PHOTOTHERMOGRAPHIC MATERIAL AND IMAGE FORMING METHOD USING SAME

CROSS-REFERENCE TO RELATED APPLICATIONS

This application claims benefit of and priority to Japanese Patent Application Nos. 2002-367663 filed on Dec. 19, 2002, 2003-58440 filed on Mar. 5, 2003, which are incorporated herein by reference in their entirety for all purposes.

BACKGROUND OF THE INVENTION

1. Field of Invention

The present invention relates to photothermographic materials and image-forming methods using photothermographic materials and, particularly, to a photothermographic material containing a silver halide emulsion having a high silver iodide content and an image-forming method using the photothermographic material. More specifically, the present invention relates to a photothermographic material in which sensitivity is substantially improved, fog is low, and storability of images after development is excellent, and an image-forming method using the photothermographic material.

2. Description of the Related Art

In recent years, in the fields of medical diagnosis and printing plate forming from the standpoints of environmental protection and space saving, photographic development processing performed in a dry state has been strongly demanded. These fields have seen an increase in digitalization, as well as systems in which image information is fed into a computer and stored and then optionally processed, transmitted, and outputted, by a laser image setter or a laser imager, to a photosensitive material at a position required, and duly developed to form images. Photosensitive materials are now expected to have a capability of being recorded by laser exposure of high illuminance, and a capability to form clear black images having high resolution and sharpness. As for digital imaging recording materials, various types of hard copy systems using pigments and dyes, such as ink jet printers and electronic photographic systems, are available as ordinary image-forming systems. However, none of these hard copy systems is satisfactory either in terms of aspects of image quality which determine the diagnostic capacity of the images as images for medical uses, such as for example sharpness, graininess, gradation, and color tone, or in respect of the recording speed (i.e. sensitivity of the images), nor have any of these systems yet attained a level of which it can be used to replace the conventional wet-development-type silver salt film used in medical diagnosis.

On the other hand, thermally developable image forming systems utilizing organic silver salts are already known in, for example, U.S. Pat. Nos. 3,152,904, and 3,457,075, and in D. H. Klosterboer, "Thermally Processed Silver Systems" (see *Imaging Processes and Materials, Neblette,* 8th Ed. compiled by J. Sturge, V. Walworth and A. Shepp, Chap. 9, page 279, 1989). The photothermographic material comprises an image-forming layer in which a photosensitive silver halide, a reduction agent, a reducible silver salt (for example, organic silver salt) and, optionally, a color toning agent for controlling the color tone of silver are ordinarily dispersed in a binder matrix.

When the photothermographic material is exposed and heated at a high temperature (for example, 80° C. or more), a monochromatic black silver image is produced by an oxidation-reduction reaction between the silver halide, or the reducible silver salt (functioning as an oxidizing agent), and the reduction agent. The oxidation-reduction reaction is accelerated by catalytic action of a latent image of the silver halide generated by such exposure. Therefore, monochromatic silver images are formed in areas of the material which have been exposed. Such photothermographic materials are disclosed in many documents (see, for example, U.S. Pat. No. 2,910,377 and JP-B No. 43-4924) and, further, the Fuji Medical Dry Imager FM-DP L has been commercially available for practical use as an image-forming system for medical diagnosis. However, since such image-forming systems utilizing organic silver salt have no fixing step that allows the silver halide to remain in a layer after thermal development, the systems have serious drawbacks.

One drawback has been image storability after development processing, particularly, printout degeneration caused by exposure to light. A method utilizing silver iodide is known as a means to alleviating printout degeneration. Compared with silver bromide or silver iodobromide having an iodine content of 5 mol % or less, silver iodide has a property which makes it extremely difficult for print out to be generated and in consequence silver iodide has the potential to drastically solve the problem. However, a silver iodide grain which has been known so far has a sensitivity so low that it is still a long way from being capable of being applied to a practical system. Further, an additional problem inherent in the grain has been that, when, in order to enhance sensitivity, a step has been taken to prevent a reunion of a photon and a hole, a property excellent in preventing printout has thereby been lost.

As a method of increasing sensitivity of a silver iodide photographic emulsion, it has been recorded in literature that sensitization can be achieved either by using halogen receptors such as sodium nitrite, pyrogallol, and hydroquinone, by immersion in a silver nitrate aqueous solution, or by sulfur sensitization at pAg 7.5 (see, for example, *The Journal of Photographic Science*, Vol. 8, p. 119, (1960), *The Journal of Photographic Science*, Vol. 28, p. 163, (1980), and *Photographic Science and Engineering*, Vol. 5, page 216 (1961). However, the sensitizing effects at these halogen receptors on photothermographic materials intended by the present invention has been minimal and conspicuously inadequate.

Another drawback is that, because of light scattering caused by residual silver halide, a layer becomes clouded and falls into a state between translucence and opacity, thus causing a deterioration in images. In order to solve this problem, a practical measure has been adopted in which photosensitive silver halide is mae into a state of fine grain (from 0.15 μm to 0.08 μm in an area actually used) and then the quantity of photosensitive silver halide added is reduced as far as possible, thus minimising cloudiness. However, a compromise measure of this kind results in a further decrease in sensitivity and has not completely solved the problem of cloudiness. Opacity has still remained in the layer and haze has remained imparted therein.

In the case of a wet developent processing system, residual silver halide is removed by performing, after the development process, a process using a fixing liquid containing a silver halide medium. As regards such silver halide media, various types of inorganic and organic compounds which can form a complex with a silver ion are known.

In the case of a dry thermal development process also, incorporation of a similar fixing measure has in the past been attempted. For example, a method has been proposed in which a compound capable of forming a complex with a silver ion is contained in a layer to allow the silver halide to be solubilized by thermal development (ordinarily known as fixing: see JP-A No. 8-76317). However, this method is a system associated with silver bromide or silver chlorobromide, and post-heating is also necessary for the fixing, requiring, as a heating condition, a temperature as high as from 155° C. to 160° C., in which it is difficult to conduct the fixing. Further, another method has been proposed in which a separate sheet (fixing sheet) containing a compound capable of forming a complex with a silver ion is prepared and, then, after the photothermographic material is thermally developed to form an image, the photothermographic material developed is superposed on the fixing sheet and heated to dissolve the remaining silver halide. Thereafter, the silver halide which has been dissolved is removed (see JP-A No. 9-166845). However, since in this method two sheets are used, the treatment process becomes complicated and it has proved difficult to secure operational stability. Further, it is necessary to dispose of the fixing sheet after use in the fixing process. Waste is thereby generated and from a point of view of practicability this becomes a barrier.

Further, as for fixing methods in thermal development other than those described above, a method has been proposed in which a fixing agent of a silver halide is first microencapsulated and then the fixing agent is released to act at the time of thermal development (JP-A No. 8-82886). However, for this method, it is difficult to arrive at a design that allows the fixing agent to be effectively released. Still another method has been proposed in which fixing is performed by using a fixing liquid after thermal development (JP-A Nos. 51-104826, and 62-133454). However, in this method a wet-type treatment needs to be performed, and thus this method is not appropriate for a completely dry process.

As described above, there have been known drawbacks to various known methods of improving opacity of the layer that there have invariably been obstacles in the way of putting them to practical use.

Further, although it is a liquid development process system, a method is known in which a silver salt be deposited in an epitaxial growth manner on a silver halide grain which acts a host. Another method is also known in which higher sensitivity is obtained by making a silver halide have a dislocation line (see, for example, JP-A Nos. 59-119344 (corresponding to U.S. Pat. No. 5,017,469) and 59-119350 (corresponding to U.S. Pat. No. 4,435,499), and Japanese Patent No. 2664272).

However, in a silver halide photosensitive material which it is intended to subject to a liquid development process, a silver image is generally formed by reducing silver halide by means of a developing agent (reduction agent) contained in a liquid of the liquid development process. Alternatively, a color image is formed by making use of an oxidized form of the developing agent generated as a by-product. In either case a fundamental reaction is a reduction of the silver halide by the developing agent. On the other hand, in the photothermographic material, the silver halide forms a latent image only by being exposed to light and, while a silver ion supplied from a non-photosensitive organic silver salt is reduced, the silver halide itself is not reduced by the reduction agent. In the case of the liquid development process reduction agents are ionic reduction agents such as hydroquinone, and p-phenylene diamines, while in the case of a photothermographic material reduction agents are hindered phenol derivatives, generally known as radical reaction agents.

As described above, in the photosensitive material for the liquid development process and the photothermographic material, the mechanisms of development reactions (reduction reaction) are completely different from each other, and the systems of compounds used in the respective materials are also completely different. Accordingly, it can not be assumed that a compound which has been effective in a liquid development process will automatically also be effective in a photothermographic material. Further, when the compound is applied to the photothermographic material, it can not be predicted whether the same effects will be obtained or whether completely different effects can be expected moreover, it is not possible to recall an instance of a compound being applied to a photothermographic material using a high silver iodide emulsion and, it is therefore impossible to foresee the effects of such a compound on a photothermographic material.

On the other hand, an attempt has been proposed to apply the photothermographic material to a photosensitive material for photographing. The term "photosensitive material for photographing" as used herein does not mean a material in which image information is written in by a scanning exposure by means of, for example, laser light, but rather means a material in which an image is recorded by a planar exposure. Since conventionally photothermographic materials have been commonly used in the field of wet development photosensitive materials, a direct or an indirect X-ray film, a mammography film or the like in medical diagnosis applications, various types of plate-making films in printing applications, a recording film in an industrial application, a film for photographing by general-use cameras and the like are all known. For example, disclosed in patent documents have been a photothermographic material for an X-ray application making use of a blue fluorescent sensitizing paper of a both-sides-coated type (see, for example, Japanese Patent No. 3,229,344), a photothermographic material using a tabular grain of silver iodobromide (see, for example, JP-A No. 59-142539), and a photosensitive material for a medical diagnosis application which has a (100) main face and in which a tabular grain having a high silver chloride content is applied on each surface of a support (see, for example, JP-A No. 10-282602). Further, the photothermographic material of a both-sides-coated type has also been disclosed in patent documents other than those described above (see, for example, JP-A Nos. 2000-227642, 2001-22027, 2001-109101, and 2002-90941.). However, in these known examples, when a fine grain silver halide having a size of 0.1 μm or less is used, haze does not deteriorate, but sensitivity remains low and in consequence the photothermographic material is not able to stand up to practical use. On the other hand, when a silver halide grain having a size of 0.5 μm or more is used, image quality is severely damaged by a deterioration in haze and printout degradation both caused by residual silver halide, thus preventing the photothermographic material from standing up to practical use.

Although a photosensitive material using a tabular grain of silver iodide as a silver halide grain has been known in the wet development field (see, for example, JP-A Nos. 59-119344, and 59-119350), no example is known of a photothermographic material in such applications. The reasons for this are that are taken the photothermographic material has low sensitivity, that no effective sensitizing measures and that, in the case of thermal development, the technical barrier is raised even higher.

In order to use the photothermographic material in the application of the photosensitive material for photographing, a higher sensitivity is required and a level of image quality one-step higher than normal is required, with regard both to haze and to the aspects.

SUMMARY OF THE INVENTION

An object of the present invention is to provide a photothermographic material using a high silver iodide, and an image-forming method using the photothermographic material and, particularly, a photothermographic material having a high sensitivity, a low fog, and an excellent storability of an image, and an image-forming method using the photothermographic material.

The above-stated object has been attained by measures described below. Namely, one aspect of the present invention is a photothermographic material comprising: a support and an image-forming layer comprising a non-photosensitive silver salt, a photosensitive silver halide, a binder, and a reduction agent disposed on the support, wherein a silver iodide content in the photosensitive silver halide is in a range from 40 mol % to 100 mol %; and an average sphere-equivalent diameter of the photosensitive silver halide is in a range from 0.3 μm to 5.0 μm.

In one embodiment, the photothermographic material further comprises a compound which after thermal development substantially reduces visible light absorption caused by the photosensitive silver halide.

In another embodiment, at least 50%, in terms of a projected area, of the photosensitive silver halide is occupied by tabular grains having an aspect ratio of from 2 to 100.

In still another embodiment, the tabular silver halide grains having an aspect ratio of from 2 to 50 are deposited with a silver salt in an epitaxial growth manner or have one or more dislocation line respectively.

BRIEF DESCRIPTION OF THE DRAWINGS

FIGS. 3A and 3B show electron micrographs of ultrathin sections of photothermographic materials according to the invention before and after thermal development, respectively, in which FIG. 3A shows an electron micrograph of a specimen thereof before the thermal development and FIG. 3B shows an electron micrograph of a specimen thereof after the thermal development.

DETAILED DESCRIPTION OF THE INVENTION

1. Photothermographic Material

Figure 1:
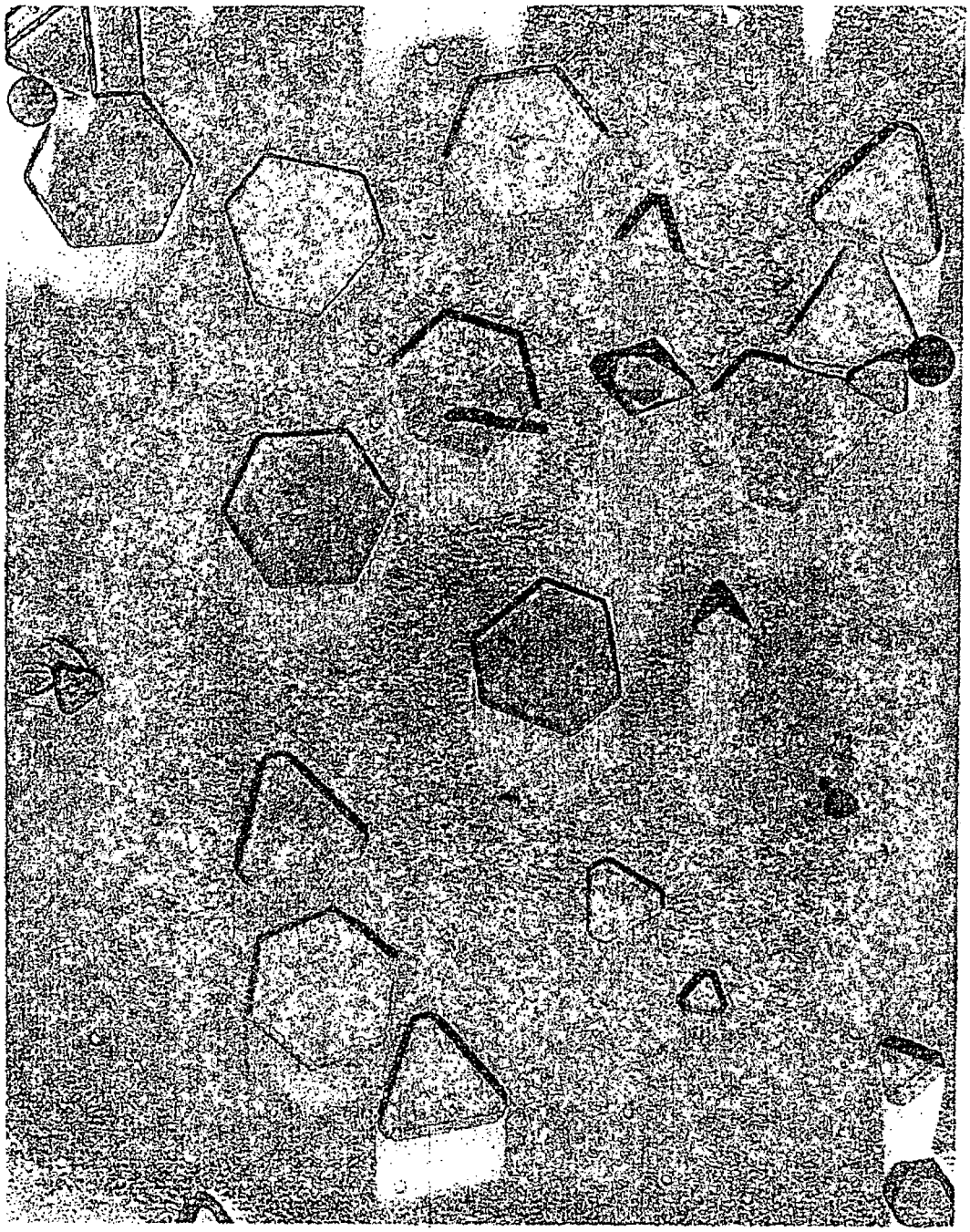
FIG. 1 shows an electron micrograph of a silver iodide emulsion according to the present invention.

A photothermographic material according to the present invention comprises an image-forming layer comprising a photosensitive silver halide, a non-photosensitive organic silver salt, a reduction agent, and a binder on at least one surface of a support. Further, the photothermographic material according to the invention may comprise a surface protective layer on the image-forming layer, or a back layer or a back protective layer on an opposite surface of the support.

Constitutions of these layers and a preferable constitution thereof will be described in detail below.

Photosensitive Silver Halide

A photosensitive silver halide according to the invention has a silver iodide content in a range from 40 mol % to 100 mol % and an average sphere-equivalent diameter in a range from 0.3 μm to 5.0 μm.

The photosensitive silver halide is explained below in detail.

1) Halogen Composition

It is important that a photosensitive silver halide according to the invention has a composition in which a silver iodide content is as high as 40 mol % to 100 mol %. As a silver halide composition, a remaining component is not particularly limited and can be selected from silver chloride, silver bromide, and organic silver salts such as silver thiocyanate and silver phosphate, in which particularly silver bromide or silver chloride is preferable. By using the silver halide having a composition in which the silver iodide content is high as described above, a favorable photothermographic material in which image storability after subjected to a development process is enhanced, particularly in a point that an increase of fogging to be caused by light irradiation is remarkably small can be designed.

Further, the silver iodide content is preferably in a range from 70 mol % to 100 mol %, more preferably from 80 mol % to 100 mol % and particularly preferably from 90 mol % to 100 mol % from the standpoint of the image storability against light irradiation after the development process.

Distribution of a halogen composition within a grain may be uniform, changed stepwise, or changed continuously. Further, a silver halide grain having a core/shell structure can also favorably be used. As for structures, a 2- to 5-fold structure is preferably used, and a core/shell grain having a 2- to 4-fold structure can more preferably be used. Still further, a core high silver iodide structure in which a silver iodide content in a core portion is high, or a shell high silver iodide structure in which a silver iodide content in a shell portion is high can also be favorably used.

Silver iodide according to the invention may have a given β-phase or γ-phase content. The term "β-phase" as used herein is intended to denote a high silver iodide structure having a hexagonal wurtzite structure while the term "γ-phase" as used herein is intended to denote a high silver iodide structure having a cubic zincblend structure. The γ-phase content can be determined by using a technique proposed by C. R. Berry. The technique performs such determination based on peak ratios between any one of silver halide β-phase (100), (101), and (002) faces and silver halide γ-phase (111) face and details of the technique can be referred to *Physical Review*, Vol. 161, No. 3, pp. 848 to 851 (1967).

2) Grain Size and Grain Form

As far as the silver halide of high silver iodide according to the invention is concerned, a grain size which is large enough for attaining a high sensitivity can be selected. According to the invention, an average sphere-equivalent diameter of the silver halide is preferably in a range from 0.3 μm to 5.0 μm and, more preferably from 0.4 μm to 3.0 μm. The term "sphere-equivalent diameter" as used herein is intended to mean a diameter of a sphere having a same volume as that of one silver halide grain. In regard to a measuring method, the sphere-equivalent diameter can be determined by first obtaining a grain volume based on a projected area and thickness of each grain observed by an electron microscope and, then, converting the form of the grain into a sphere having a same volume as the thus-obtained volume.

The silver halide having a composition in which a silver iodide content is high according to the invention can take a complicated form; however, examples of preferable forms thereof include a joint grain as described in R. L. Jenkins et al., *The Journal of Photographic Science*, Vol. 28, p. 164, FIG. 1 (1980). Further, a grain in tabular form as shown in ibid., FIG. 1, can also preferably be used. The silver halide grain having a round corner can also be preferably used. There is no particular restriction on a face index (Miller index) of an outer surface of the photosensitive silver halide grain; however, a proportion of [100] face, which is high in spectral sensitization efficiency when a spectral sensitizing dye is adsorbed thereon, is preferably high. The proportion is preferably 50% or more, more preferably 65% or more, and still more preferably 80% or more. The proportion of Miller index [100] face can be determined by using a method, as described in T. Tani, J. Imaging Sci., 29, 165 (1985), which utilizes adsorption dependency of [111] face and [100] face when a sensitizing dye is adsorbed.

Examples of forms of silver halide grains according to the invention include a cubic form, an octahedral form, a tetradecahedral form, a dodecahedral form, a tabular form, a spherical form, a rod-like form, and a potato-like form. Particularly, the silver halide grain is preferably dodecahedral, tetradecahedral, and tabular.

The term "dodecahedral grain" as used herein is intended to denote a grain having (001), {1 (−1) 0}, and {101} faces, while the term "tetradecahedral grain" as used herein is intended to denote a grain having (001), {100} and {101} faces, in which {100} and {101} faces represent a crystalline face group having equivalent face indices to those of (100) and (101) faces, respectively.

The dodecahedral, tetradecahedral, and octahedral forms of silver iodide can be prepared with reference to Japanese Patent Application Nos. 2002-81020, 2002-87955, and 2002-91756.

The silver halide grain according to the invention is particularly preferably a grain in tabular form.

In the grain in tabular form, an aspect ratio is 2 or more. The aspect ratio is preferably in a range from 2 to 100, and more preferably in a range from 2 to 50.

According to the invention, it is preferable to use a silver halide in which 50% or more, in terms of a projected area, of the silver halide is such that, on a tabular silver halide grain having an aspect ratio in a range from 2 to 50, (1) a silver salt is deposited in an epitaxial growth manner or (2) at least one dislocation line is contained.

50% or more, in terms of a projected area, of the silver halide is occupied by a tabular grain having an aspect ratio preferably in a range from 3 to 30, and more preferably from 5 to 20.

The terms "epitaxy" and "epitaxial" are herein used within the meanings accepted in the art for pointing out that a silver salt is in a crystal form having an orientation to be controlled by a tabular host grain.

In order to form a sensitization site on the tabular host grain, the silver salt deposited thereon in an epitaxial growth manner can be utilized. By controlling the site on which the silver salt is deposited in the epitaxial growth manner, a selective local sensitization of the tabular host grain can be performed. Therefore, at least one sensitization site can be provided on one or a plurality of regular sites. The term "regular" as used herein is intended to mean that the sensitization site has a predictable orderly relation to a main crystal face of the tabular grain, preferably in an interrelated manner. A number of the sensitization site and a space between any two of such sensitization sites in a horizontal direction can be controlled by controlling epitaxial deposition on the main face of the tabular grain.

Particularly, it is preferable that silver salt epitaxy is controlled on at least one part of the main crystal face of the tabular host grain to substantially eliminate the epitaxial deposition. In the tabular host grain, there is a tendency in which epitaxial deposition of the silver salt is likely to occur on at least one of an edge and a corner of the grain.

When the epitaxial deposition is limited to a selected site of the tabular grain, sensitivity becomes better than that to be obtained when the silver salt is irregularly deposited on the main face of the tabular grain in an epitaxial growth manner. Therefore, the silver salt is allowed to be deposited on a selected site in a restricted area such that substantial epitaxial deposition of the silver salt does not occur on at least one site of the main crystal face. It goes without saying that the restricted area can be changed in a wide range without departing from the scope of the invention. Ordinarily, the less an epitaxial quantity to cover the main crystal face, the more the sensitivity. The silver salt to be deposited in an epitaxial growth manner is restricted to preferably less than a half of an area of the main crystal face of the tabular grain, and more preferably less than 25% thereof. Further, when the silver salt is deposited on a corner of a tabular silver halide grain in an epitaxial growth manner, the silver salt is restricted to preferably less than 10% of the area of the main crystal face of the tabular grain, and more preferably less than 5% thereof. In one aspect, it has been observed that the epitaxial deposition starts on a surface of an edge of the tabular grain. Therefore, depending on conditions, epitaxy is restricted to a selected edge site to effectively eliminate the epitaxy on the main crystal face.

When a grain having a latent image center is completely developed, a site and number of the latent image center can not be determined. However, when such development is stopped before an area to be developed is spread from a nearby area of the latent image center and, then, the grain thus partially developed is observed by enlarging it, the partially developed site can clearly be seen. Such sites ordinarily correspond to the latent image center, while the latent image center ordinarily corresponds to the sensitization site.

The silver salt to be deposited by the epitaxy is ordinarily capable of performing the epitaxial growth on the silver halide grain and is selected from given silver salt conventionally known to be effective in photographs. Particularly, it is favorable to select the silver salt from the given silver salts conventionally known to be effective in shell formation of a core/shell silver halide emulsion. Examples of such silver salts include, not only all of the known silver halides which are photographically effective, but also other silver salts which are known to be capable of being precipitated on the silver halide grain as a silver salt, such as silver thiocyanate, silver cyanide, silver carbonate, silver ferricyanide, silver arsenate or silver arsenite, and silver chromate. Among other things, silver chloride or silver bromide is preferable.

In accordance with the silver salts to be selected and applications to be intended, the silver salt can effectively be deposited by allowing not only the tabular silver halide grain but also a modified compound to be present.

An iodide can be introduced from the host grain to the silver salt epitaxy. The host grain can contain an anion except an iodine ion up to a maximum of solubility thereof into the silver iodide.

The silver halide according to the invention has preferably one dislocation line, more preferably 5 or more dislocation lines, and particularly preferably 10 or more dislocation lines. The tabular grain having one or more dislocation lines occupies 50% or more and preferably 80% or more, in terms of a projected area, of an entire silver halide grain. Particularly, the tabular grain having 10 dislocation lines preferably occupies 80% or more, in terms of the projected area, of the entire silver halide grain.

The dislocations of silver halide crystals are described, for example, in the following literatures:

1) C. R. Berry. *J. Appl. Phys.,* 27, 636 (1956);

2) C. R. Berry, D. C. Skilman, *J. Appl. Phys.,* 35, 2165 (1964);

3) J. F. Hamilton, *Phot. Sci. Eng.,* 11, 57 (1967);

4) T. Shiozawa, *J. Soc. Phot. Sci. Japan,* 34, 16 (1971); and

5) T. Shiozawa, *J. Soc. Phot. Sci. Japan,* 35, 213 (1972).

It is described therein that the dislocation in the crystal can be observed by an X-ray diffraction method or using a low-temperature transmission-type electron microscope and various types of dislocations are generated in the crystal by imparting the crystal with strain.

On the other hand, effects which dislocations have on photographic properties are described in G. C. Farnell, R. B. Flint, and J. B. Chanter, *J. Phot. Sci.,* 13, 25 (1965). This literature demonstrates that, in a large tabular silver bromide grain with a high aspect ratio, a site at which a latent image nucleus is formed is closely related to a defect in the grain.

The tabular silver halide grain into which the dislocation is intentionally introduced is described in JP-A Nos. 63-220238, and 1-201649. Compared to the tabular grain having no dislocation, the tabular grain into which the dislocation has been introduced is superior in photographic properties such as sensitivity and reciprocity law characteristics and, when the tabular grain is used in a photosensitive material, it is demonstrated that the resultant photosensitive material is excellent in sharpness and graininess. However, in the tabular grain, the dislocation line has irregularly been introduced on the edge part of the tabular grain and the number of such dislocation lines differs from one grain to another.

3) Applied Quantity

Ordinarily, in a case of the photothermographic material in which the silver halide remains after thermal development, when a quantity of the silver halide to be applied is increased, transparency of a film is reduced to deteriorate an image quality. Since this situation is not favorable, sensitivity is forced to be low regardless of a request for enhancing the sensitivity. However, in a case of the invention, since haze of the film to be caused by the silver halide can be reduced by performing a thermally development process, the silver halide can be applied in more quantity than in a conventional case. According to the invention, a quantity of the silver halide grain to be applied is, based on 1 mol of silver of a non-photosensitive organic silver salt, in a range from 0.5 mol % to 100 mol % and preferably from 5 mol % to 50 mol %.

4) Grain-Forming Method

A method for forming a photosensitive silver halide is well known in the art; for example, methods as described in *Research Disclosure* No. 17029 (June, 1978) and U.S. Pat. No. 3,700,458 can be used and, specifically, a method in which firstly a photosensitive silver halide is prepared by adding a silver-supplying compound and a halogen-supplying compound to gelatin or at least one of other polymer solutions and, then, the thus-prepared photosensitive silver halide is added with an organic silver salt is used. Further, a method as described in paragraphs [0217] to [0224] of JP-A No. 11-119374, or methods as described in JP-A No. 11-352627 and Japanese Patent Application No. 2000-42336 are preferably used. As for methods for forming tabular grains of silver iodide, methods as described in JP-A Nos. 59-119350 and 59-119344 are preferably used.

5) Heavy Metal

The photosensitive silver halide grain according to the invention can contain a metal belonging to groups 3 to 14, preferably 3 to 11, and more preferably 8 to 10 in the periodic table (displaying groups 1 to 18) or a complex thereof. The metal or a center metal of the metal complex belonging to groups 8 to 10 of the periodic table is preferably rhodium, ruthenium, or iridium. One type of these metal complexes may be used or, otherwise, 2 or more types of complexes of same or different metals may simultaneously be used. A content thereof is preferably in the range, based on 1 mol of silver, of from $1\times10^{-9}$ mol to $1\times10^{-3}$ mole. Such heavy metals and metal complexes and, also, addition methods thereof are described in JP-A No. 7-225449, paragraphs [0018] to [0024] of JP-A No. 11-65021, and paragraphs [0227] to [0240] of JP-A No. 11-119374.

According to the invention, the silver halide grain which allows a hexacyano metal complex to be present on an outermost surface thereof is preferable. Examples of such hexacyano metal complexes include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. According to the invention, a hexacyano Fe complex is preferable.

Although a counter cation of the hexacyano metal complex is not important because the hexacyano metal complex exists in ionic form in an aqueous solution, it is preferable to use an alkaline metal ion such as a sodium ion, a potassium ion, a rubidium ion, a cesium ion or a lithium ion; an ammonium ion; or an alkyl ammonium ion (for example, a tetramethyl ammonium ion, a tetraethyl ammonium ion, a tetrapropyl ammonium ion or a tetra (n-butyl)ammonium ion), which are each individually easily compatible with water and appropriate for a precipitation operation of a silver halide emulsion.

The hexacyano metal complex can be mixed with water, a mixed solvent of water and an appropriate organic solvent compatible with water (for example, alcohols, ethers, glycols, ketones, esters, and amides), or gelatin and, then, added.

A quantity of the hexacyano metal complex to be added is, based on 1 mol of silver, preferably in a range from $1\times10^{-5}$ mol to $1\times10^{-2}$ mol, and more preferably from $1\times10^{-4}$ mol to $1\times10^{-3}$ mol.

In order to allow the hexacyano metal complex to be present on the outermost surface of the silver halide grain, the hexacyano metal complex is directly added in any stage of: before a loading step which is from completion of an addition of an aqueous silver nitrate solution to be used for grain formation to before a chemical sensitization step in which chalcogen sensitization such as sulfur sensitization, selenium sensitization or tellurium sensitization, or precious metal sensitization such as gold sensitization is performed; during a washing step; during a dispersion step; and before the chemical sensitization step is performed. To inhibit the growth of the silver halide grain, the hexacyano metal complex is preferably added immediately after the grain is formed and, accordingly, preferably before the loading step is completed.

Further, an addition of the hexacyano metal complex may be started after 96% by mass of an entire quantity of silver nitrate to be added for the grain formation is added, preferably started after 98% by mass thereof is added, and particularly preferably started after 99% by mass thereof is added.

When any of these hexacyano metal complexes is added during a period of time between after an addition of the aqueous silver nitrate solution is performed and immediately before grain formation is completed, the hexacyano metal complex can be adsorbed on the outermost surface of the silver halide grain and most of such hexacyano metal complexes each form an insoluble salt with a silver ion on a grain surface. Since a silver salt of hexacyanoiron (II) is a more insoluble salt than AgI, it can prevent redissolving to be caused by fine grains; as a result, it has become possible to manufacture a silver halide fine grain having a small grain size.

Other metal atoms (for example, $[Fe(CN)_6]^{4-}$) capable of being contained in the silver halide grain according to the invention, a desalination method and a chemical sensitization method of the silver halide emulsion are described in paragraphs [0046] to [0050] of JP-A No. 11-84574, paragraphs [0025] to [0031] of JP-A No. 11-65021, and paragraphs [00242] to [0250] of JP-A No. 11-119374.

6) Gelatin

Various types of gelatin can be used as gelatin to be contained in the photosensitive silver halide emulsion according to the invention. In order to maintain a favorable dispersion state of the photosensitive silver halide emulsion in a coating solution containing an organic silver salt, it is preferable to use low molecular weight gelatin having a molecular weight in a range from 500 to 60,000. These types of gelatin may be used at the time of grain formation or at the time of dispersion after a desalting treatment is performed; however, they are preferably used at the time of dispersion after the desalting treatment is performed.

7) Chemical Sensitization

The photothermographic material according to the invention may chemically be unsensitized; however, the photothermographic material according to the invention is preferably chemically sensitized by at least one method of chalcogen sensitization method, a gold sensitization method, and a reduction sensitization method. As for such chalcogen sensitization methods, mentioned are a sulfur sensitization method, a selenium sensitization method and a tellurium sensitization method.

In the sulfur sensitization method, an unstable sulfur compound is used; examples of such unstable sulfur compounds capable of being used include those as described, for example, in P. Grafkides, Chimie et Physique Photographique, 5th ed., Paul Momtel, (1987), and Research Disclosure, Vol. 307, No. 307105.

Specifically, known sulfur compounds such as thiosulfates (for example, hyposulfite), thioureas (for example, diphenyl thiourea, triethyl thiourea, N-ethyl-N'-(4-methyl-2-thiazolyl) thiourea, and carboxymethyl trimethyl thiourea), thioamides (for example, thioacetamide), rhodanines (for example, diethyl rhodanine, 5-benzylidene-N-ethyl rhodanine), phosphine sulfides (for example, trimethyl phosphine sulfide), thiohydantoins, 4-oxo-oxazolidine-2-thiones, disulfides or polysulfides (for example, dimorpholine disulfide, cystine, and lenthionine), polythionates, elemental sulfur and, active gelatin and the like can be used. Particularly, the thiosulfates, the thioureas, and the rhodanines are preferable.

In the selenium sensitization, an unstable selenium compound is used. Examples of such selenium compounds capable of being used include those as described, for example, in JP-B Nos. 43-13489, and 44-15748, JP-A Nos. 4-25832, 4-109340, 4-271341, 5-40324, and 5-11385, Japanese Patent Application Nos. 4-202415, 4-330495, 4-333030, 5-4203, 5-4204, 5-106977, 5-236538, 5-241642, and 5-286916.

Specifically, colloidal metal selenium, selenoureas (for example, N,N-dimethyl selenourea, trifluoromethyl carbonyl-trimethyl selenourea, and acetyl-trimethyl selenourea), selenamides (for example, selenamide, and N,N-diethylphenyl selenamide), phosphine selenides (for example, triphenyl phosphine selenide, and pentafluorophenyl-triphenyl phosphine selenide), selenophosphates (for example, tri-p-tolylselenophosphate, and tri-n-butylselenophosphate), selenoketones (for example, selenobenzophenone), isoselenocyanates, selenocarboxylates, selenoesters, diacyl selenides and the like may be used. Further, non-unstable selenium compounds (for example, selenious acid, selenocyanates, selenazoles and selenides) as described in JP-B Nos. 46-4553, 52-34492 and the like can also be used and, particularly, phosphine selenides, selenoureas and selenocyanates are preferable.

In the tellurium sensitization, an unstable tellurium compound is used. Examples of such unstable tellurium compounds capable of being used include those as described, for example, in JP-A Nos. 4-224595, 4-271341, 4-333043, 5-303157, 6-27573, 6-175258, 6-180478, 6-208186, 6-208184, 6-317867, 7-140579, 7-301879, and 7-301880.

Specifically, phosphine tellurides (for example, butyl-diisopropyl phosphine telluride, tributyl phosphine telluride, tributoxy phosphine telluride, and ethoxy-diphenyl phosphine telluride), diacyl (di) tellurides (for example, bis(diphenylcarbamoyl)ditelluride, bis(N-phenyl-N-methyl carbamoyl)ditelluride, bis(N-phenyl-N-methylcarbamoyl)telluride, bis(N-phenyl-N-benzylcarbamoyl)telluride, and bis(ethoxycarbonyl)telluride), telluroureas (for example, N,N'-dimethylethylene tellurourea, and N,N'-diphenylethylene tellurourea), telluroamides, telluroeaters, and the like may be used. Particularly, the diacyl (di)tellurides and the phosphine tellurides are preferable and, further, compounds as described in paragraph [0030] of JP-A No. 11-65021 and compounds represented by the formulas (II), (III), and (IV) of JP-A NO. 5-313284 are more preferable.

Particularly, in the chalcogen sensitization according to the invention, the selenium sensitization and the tellurium sensitization are preferable, and the tellurium sensitization is particularly preferable.

In the gold sensitization, gold sensitizers as described in P. Grafkides, *Chimie et Physique Photographique,* 5th ed., Paul Momtel, (1987), and *Research Disclosure*, Vol. 307, No. 307105 can be used. Specific examples of the gold sensitizers include chloroauric acid, potassium chloroaurate, potassium aurithiocyanate, gold sulfide and gold selenide, and, further, gold compounds as described, for example, in U.S. Pat. Nos. 2,642,361, 5,049,484, 5,049,485, 5,169,751, and 5,252,455, and Belgian Patent No. 691857. Further, salts of other noble metals than gold such as platinum, palladium, and iridium as described in P. Grafkides, *Chimie et Physique Photographique,* 5th ed., Paul Momtel, (1987), and *Research Disclosure*, Vol. 307, No. 307105 can also be used.

Although the gold sensitization can be used alone, it is preferably used in combination with the chalcogen sensitization. Specific examples thereof include gold-sulfur sensitization, gold-selenium sensitization, gold-tellurium sensitization, gold-sulfur-selenium sensitization, gold-sulfur-tellurium sensitization, gold-selenium-tellurium sensitization, and gold-sulfur-selenium-tellurium sensitization.

According to the invention, the chemical sensitization can be performed at any time so long as it is performed in a period of from after the grain is formed to before application is performed and timing of performing the chemical sensitization can be, after desalination, for example, (1) before spectral sensitization, (2) simultaneously with the spectral sensitization, (3) after the spectral sensitization, or (4) immediately before application.

A quantity of the chalcogen sensitizer to be used according to the invention is, though varying depending on the silver halide grain to be used, chemical ripening conditions and the like, in a range from $10^{-8}$ mol to $10^{-1}$ mol, and preferably approximately from $10^{-7}$ mol to $10^{-2}$ mol per mol of silver halide in each case.

In a same manner as in the chalcogen sensitizer, a quantity of the gold sensitizer to be used according to the invention is, though varying depending on various types of conditions, as approximate numbers, in a range from $10^{-7}$ mol to $10^{-2}$ mol, and preferably from $10^{-6}$ mol to $5\times10^{-3}$ mol per mol of silver halide in each case. As for environmental conditions under which the emulsion is chemically sensitized, any condition can be selected; however, pAg is 8 or less, preferably 7.0 or less, more preferably 6.5 or less, and particularly preferably 6.0 or less; pAg is 1.5 or more, preferably 2.0 or more, and particularly preferably 2.5 or more; pH is in a range from 3 to 10, and preferably from 4 to 9; and temperature is in a range from 20° C. to 95° C. and preferably approximately from 25° C. to 80° C.

According to the invention, reduction sensitization can be used simultaneously with the chalcogen sensitization or the gold sensitization. It is particularly preferable that the reduction sensitization is used simultaneously with the chalcogen sensitization.

Specific examples of preferred compounds which can be used in a reduction sensitization method include ascorbic acid, thiourea dioxide, and dimethylamine borane, as well as stannous chloride, aminoiminomethane sulfinic acid, hydrazine derivatives, borane compounds, silane compounds, and polyamines. Further, addition of a reduction sensitizer may be performed at any step in a manufacturing process of the photosensitive emulsion, that is, in a preparation process of from crystal growth to immediately before application. Still further, the reduction sensitization is preferably performed by ripening the emulsion while maintaining the pH thereof at 8 or more, or the pAg thereof at 4 or less. Furthermore, the reduction sensitization is preferably performed by introducing a single addition portion of a silver ion during grain formation.

A quantity of the reduction sensitizer to be added is, though varying depending on various types of conditions in a same manner as in the chalcogen sensitizer or gold sensitizer, as approximate numbers, preferably in a range from $10^{-7}$ mol to $10^{-1}$ mol, and more preferably from $10^{-6}$ mol to $5\times10^{-2}$ mol per mol of silver halide in each case.

In the silver halide emulsion according to the invention, a thiosulfonic acid compound may be added by a method as described in EP-A No. 293,917.

It is preferable from the standpoint of designing a high sensitive photothermographic material that the photosensitive silver halide grain according to the invention is chemically sensitized by at least one of the gold sensitization method and the chalcogen sensitization method.

8) Sensitizing Dye

As for sensitizing dyes applicable to the invention, a sensitizing dye capable of spectrally sensitizing the silver halide grain in a desired wavelength region when adsorbed on the silver halide grain and having spectral sensitivity appropriate to spectral characteristics of an exposure light source can advantageously be selected. It is preferable that the photothermographic material according to the invention is spectrally sensitized such that it has a spectral sensitive peak, particularly, in a range from 600 nm to 900 nm, or in a range from 300 nm to 500 nm. The sensitizing dyes and addition methods thereof are described in paragraphs [0103] to [0109] of JP-A No. 11-65021, as compounds represented by the formula (II) in JP-A No. 10-186572, as dyes represented by the formula (I) in JP-A No. 11-119374, in paragraph [0106] of JP-A No. 11-119374, U.S. Pat. No. 5,510,236, as dyes mentioned in Example 5 in U.S. Pat. No. 3,871,887, in JP-A No. 2-96131, as dyes disclosed in JP-A No. 59-48753, in pp. 19 (line 38) to 20 (line 35) of EP-A No. 0803764, Japanese Patent Application Nos. 2000-86865, 2000-102560, and 2000-205399, and the like. These sensitizing dyes may be used either alone or in combination of 2 or more types.

A quantity of the sensitizing dye according to the invention to be added is, though desirably varying depending on sensitivity or fogging performance, preferably in a range from $1\times10^{-6}$ mol to 1 mol, and more preferably from $1\times10^{-4}$ mol to $1\times10^{-1}$ mol, based on 1 mol of silver halide in an image-forming layer in each case.

According to the invention, in order to enhance spectral sensitizing efficiency, a super-sensitizer can be used. As for such super-sensitizers according to the invention, mentioned are compounds as described in, for example, EP-A No. 587, 338, U.S. Pat. Nos. 3,877,943 and 4,873,184, JP-A Nos. 5-341432, 11-109547 and 10-111543.

The spectral sensitizing dye according to the invention is preferably in a state of being sufficiently adsorbed to the silver halide. Assuming that a quantity of the spectral sensitizing dye adsorbed to the photosensitive silver halide in the presence of the organic silver salt is taken as $S_1$, an adsorption ratio of the spectral sensitizing dye against the total content $S_0$ thereof is represented by $S_1/S_0$, in which a relation of $S_1>S_0>0.5$ is preferable and the relation of $S_1>S_0>0.8$ is more preferable.

A value of $S_1/S_0$ is obtained by a method described below. (1) an aqueous solution of a silver halide emulsion desirous to be evaluated which has been diluted to an appropriate concentration (referred to as "solution (1)"), and (2) a solution of a sensitizing dye desirous to be evaluated which has been dissolved in an appropriate solvent (referred to as "solution (2)") are prepared and, then, the solutions (1) and (2) are mixed with each other and sufficiently stirred. Thereafter, the resultant mixture is centrifuged until silver halide emulsion grains are sufficiently precipitated. After such centrifugation, spectral absorption of a supernatant thereof is measured and a value obtained at that time is set as $S_2$ Next, a gelatin solution having a same concentration as that of the silver halide emulsion in place of the silver halide emulsion, and the sensitizing dye solution are mixed with each other and centrifuged under a same condition. Thereafter, spectral absorption of a supernatant thereof is measured and a value obtained at that time is set as $S_0$, thereby constructing an equation of $S_1/S_0=(S_0-S_2)/S_0$.

9) Simultaneous Use of Silver Halides

In the photosensitive silver halide emulsion in the photothermographic material according to the invention, one type thereof may be used, or 2 or more types thereof (for example, those having different average grain sizes, different halogen compositions, different crystal habits or different chemical sensitization conditions from one another) may simultaneously be used. Using a plurality of types of photosensitive silver halides having different extents of sensitivity from one another allows gradation to be adjusted. Related technologies are described in, for example, JP-A Nos. 57-119341, 53-106125, 47-3929, 48-55730, 46-5187, 50-73627 and 57-150841. Sensitivity difference between any two emulsions is preferably 0.2 log E or more.

10) Mixing of Silver Halide and Organic Silver Salt

It is particularly preferable that the photosensitive silver halide grain according to the invention is formed under a condition in which a non-photosensitive organic silver salt is not present and, then, chemically sensitized. Such procedure is taken because a method in which the silver halide is formed by adding a halogenating agent to the organic silver salt can not attain sufficient sensitivity in some cases.

As for methods for mixing the silver halide and the organic silver salt, mentioned is a method in which the photosensitive silver halide and the organic silver salt which have separately been prepared from one the other are mixed by, for example, a high-speed stirrer, a ball mill, a sand mill, a colloid mill, a vibration mill or a homogenizer, a method in which the photosensitive silver halide which has previously been prepared is mixed at an appropriate timing in the process of preparing the organic silver salt or the like to prepare the organic silver salt. Any of these methods can favorably obtain an effect according to the invention.

11) Mixing of Silver Halide to Coating Solution

A preferable timing at which the silver halide according to the invention is added to a coating solution for an image-forming layer may be during a period of from 180 minutes before coating is performed till immediately before the coating is performed, and preferably during a period of from 60 minutes before the coating is performed till 10 seconds before the coating is performed; however, a method and a condition of such addition is not particularly limited, so long as an effect according to the invention can sufficiently be exhibited. Specific mixing methods include, for example, a method of mixing in a tank such that an average dwelling time, as calculated from an adding flow rate and a supplying flow rate to a coater, is allowed to be within a predetermined duration, and a method of using a static mixer or the like as described, for example, in N. Harnby, M. F. Edwards & A. W. Nienow, (translated by Koji Takahashi), "*Liquid Mixing Technology*" Chap. 8, The Nikkan Kogyo Shimbun, Ltd. (1989). Compound Capable of Substantially Reducing Visible Light Absorption Caused by Photosensitive Silver Halide after Thermal Development According to the invention, it is preferable to contain a compound which substantially reduces visible light absorption caused by the photosensitive silver halide after thermal development instead of that before the thermal development.

According to the invention, as for such compounds which substantially reduce the visible light absorption caused by the photosensitive silver halide after thermal development, a silver iodide complex forming agent is particularly preferably used.

Description of Silver Iodide Complex Forming Agent

The silver iodide complex forming agent according to the invention is capable of contributing to a Lewis acid-base reaction in which at least one of a nitrogen atom and a sulfur atom contained in the compound supplies an electron to a silver ion as a coordination atom (electron donor: Lewis base). Stability of the complex is defined in terms of either a stepwise stability constant or a total stability constant and depends on combinations of 3 factors, namely, a silver ion, an iodine ion, and the silver iodide complex forming agent. As an ordinary indication, a large stability constant can be obtained by a chelate effect caused by intramolecular chelate ring formation, or a measure of, for example, increasing an acid-base dissociation constant of a ligand.

Although an action mechanism of the silver iodide complex forming agent according to the invention has not clearly been elucidated, it is considered that silver iodide is allowed to be solubilized by forming a stable complex comprising components of at least 3 elements including an iodine ion and silver ion. Though deficient in capability of solubilizing silver bromide or silver chloride, the silver iodide complex forming agent according to the invention specifically acts on silver iodide.

Although a detail of the mechanism in which an image storability is improved by the silver iodide complex forming agent according to the invention is not elucidated, the mechanism is considered as that at least one portion of the photosensitive silver halide and the silver iodide complex forming agent according to the invention are allowed to react with each other at the time of thermal development to form a complex and, accordingly, photosensitivity is reduced or lost, thereby greatly improving the image storability under a light irradiation. At the same time, opacity of a film caused by the silver halide is reduced and, as a result, it is marked characteristics that the image having a high image quality can be obtained. Such reduction of the opacity of the film can be confirmed by measuring the reduction of ultraviolet visible absorption of spectral absorption spectrum.

According to the invention, the ultraviolet visible absorption spectrum of the photosensitive silver halide can be measured by a transmittance method or a reflection method. When absorption caused by another compound added to the photothermographic material and absorption caused by the photosensitive silver halide are superimposed, the ultraviolet visible absorption spectrum of the photosensitive silver halide can be observed by using differential spectrum and a measure of, for example, removal of other compounds by a solvent each individually or in combination.

It is essential from the standpoint of forming a stable complex by an iodine ion that the silver iodide complex forming agent according to the invention is clearly different from a conventional silver ion complex forming agent. There is marked characteristics in that, contrary to the conventional silver ion complex forming agent which performs a dissolution action on a salt having a silver ion such as silver bromide, silver chloride, or an organic silver salt, for example, silver behenate, the silver iodide complex forming agent according to the invention does not perform such action unless silver iodide is present.

Preferable compounds as the silver iodide complex forming agents according to the invention are those represented by the following formulas (1) and (2):

Formula (1)

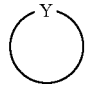

Formula (2)

$S(Z)_n$

In the formula (1), Y represents a non-metallic atomic group necessary for forming a 5- to 7-membered heterocycle having at least one of a nitrogen atom and a sulfur atom. The heterocycle to be formed by Y may be saturated or unsaturated and, also, may have a substituent or may not have a substituent. Such substituents on the heterocycle to be formed by Y may be combined with each other to form a ring.

Examples of such 5- to 7-membered heterocycles to be formed by Y each having at least one of a nitrogen atom and a sulfur atom include thiophene, pyrrole, pyridine, oxazole, isooxazole, thiazole, isothiazole, imidazole, pyrazole, pyrazine, pyrimidine, pyridazine, indole, isoindole, indolidine, quinoline, isoquinoline, benzimidazole, 1H-imidazole, quinoxaline, quinazoline, cinnoline, phthalazine, 1,8-naphthyridine, purine, pteridine, carbazole, acrydine, phenanthridine, 1,10-phenathroline, phenazine, phenoxazine, phenothiazine, benzothiazole, benzoxazole, benzimidazole, 1,2,4-triazine, 1,3,5-triazine, pyrrolidine, imidazolidine, pyrazolidine, piperidine, piperazine, morpholine, indoline, and isoindoline.

These rings may each have a substituent; examples of preferable substituents include a halogen atom (a fluorine atom, a chlorine atom, a bromine atom, or an iodine atom), an alkyl group (inclusive of a straight-chain, branched-chain, or cyclic alkyl group inclusive of a bicycloalkyl group and an active methine group), an alkenyl group, an alkynyl group, an aryl group, a heterocyclic group (a position to be substituted is not limited), an acyl group, an alkoxycarbonyl group, an aryloxycarbonyl group, a heterocycloxycarbonyl group, a carbamoyl group, an N-acylcarbamoyl group, an N-sufonylcarbamoyl group, an N-carbamoylcarbamoyl group, a thiocarbamoyl group, an N-sulfamoylcarbamoyl group, a carbazoyl group, a carboxyl group or a salt thereof, an oxalyl group, an oxamoyl group, a cyano group, a carbonimidoyl group, a formyl group, a hydroxyl group, an alkoxy group (inclusive of a group having a recurring unit of an ethyleneoxy group or a propyleneoxy group), an aryloxy group, a heterocycloxy group, an acyloxy group, an (alkoxy or aryloxy)carbonyloxy group, a carbamoyloxy group, a sufonyloxy group, an amino group, (an alkyl, aryl, or a heterocycle)amino group, an acylamino group, a sulfonamide group, a ureido group, a thioureido group, an imido group, an (alkoxy or aryloxy)carbonylamino group, a sufamoylamino group, a semicarbazide group, a thiosemicarbazide group, an ammonio group, an oxamoylamino group, an N-(alkyl or aryl)sufonylureido group, an N-acylureido group, an N-acylsulfamoylamino group, a nitro group, a heterocyclic group having a quaternized nitrogen atom (for example, a pyridinio group, an imidazolio group, a quinolinio group, or an isoquinolinio group), an isocyano group, an imino group, a mercapto group, (an alkyl, aryl, or a heterocyclo)thio group, (an alkyl, aryl, or a heterocyclo)dithio group, an (alkyl or aryl)sulfonyl group, an (alkyl or aryl)sulfinyl group, a sulfo group or a salt thereof, a sulfamoyl group, an N-acylsulfamoyl group, an N-sulfonylsulfamoyl group or a salt thereof, a phosphino group, a phosphinyl group, a phosphinyloxy group, a phosphinylamino group, and a silyl group. Further, the term "active methine" as used herein is intended to mean a methine group substituted by two electron-attracting groups; the term "electron-attracting group"as used herein is intended to mean an acyl group, an alkoxycarbonyl group, an aryloxycarbonyl group, a carbamoyl group, an alkylsulfonyl group, an arylsulfonyl group, a sufamoyl group, a trifluoromethyl group, a cyano group, a nitro group, or a carbonimidoyl group. Two electron-attacting groups may be combined with each other to form a cyclic configuration. Further, the term "salt" as used herein is intended to mean a cation of, for example, an alkaline metal, an alkaline earth metal, or a heavy metal, or an organic cation such as an ammonium ion, and a phosphonium ion. The above-described substituents may each further be substituted by any of these substituents. A heterocycle formed by Y may further be condensed with a given ring.

Compounds represented by the formula (1) are each preferably a nitrogen-containing heterocyclic compound. An acid dissociation constant (pKa) of a conjugate acid thereof in a tetrahydrofuran-water mixed solution (tetrahydrofuran:water=3:2) at 25° C. is preferably in a range from 3 to 8, and more preferably 4 to 7.

The compounds represented by the formula (1) preferably each have a pyridine ring, a pyrimidine ring, or a pyridazine ring (inclusive of a condensed pyridazine such as phthalazine) and, also preferably, each have at least one mercapto group as a substituent. It is particularly preferable that the compounds represented by the formula (1) each have a pyridine ring or a phthalazine ring.

In the formula (2), Z represents a hydrogen atom or a substituent. n represents an integer of 1 or 2 and, when n is 1, S and Z are combined with each other by a double bond, while, when n is 2, S and each of two Z's are combined with each other by a single bond. Further, when n is 1, Z does not represent a hydrogen atom, while, when n is 2, two Z's may be same with or different from each other but none of two Z's represents a hydrogen atom. Still further, it is preferable that Z forms a single bond or a double bond with S by a carbon atom thereof.

When n is 1, examples of Z include methylene, ethylidene, and vinylidene and, further, these groups may each have a substituent; examples of such substituents include the examples of substituents of heterocycles formed by Y in the formula (1). Examples of compounds formed by allowing Z having a substituent to be combined with S include thiourea, tetramethyl thiourea, N-ethyl-N'-propyl thiourea, N,N'-dimethyl thiourea.

When n is 2, examples of substituents represented by Z include an alkyl group (inclusive of a cycloalkyl group such as a bicycloalkyl group), an alkenyl group (inclusive of a cycloalkenyl group such as a bicycloalkenyl group), an alkenyl group, an aryl group, a heterocyclic group, an acyl group, an aryloxycarbonyl group, an alkoxycarbonyl group, a carbamoyl group and an imido group.

More particularly mentioned are an alkyl group (preferably an alkyl group having from 1 to 30 carbon atoms, such as a methyl group, an ethyl group, an n-propyl group, an isopropyl group, a t-butyl group, an n-octyl group, an eicosyl group, a 2-chloroethyl group, a 2-cyanoethyl group or a 2-ethylhexyl group), a cycloalkyl group (preferably a substituted or unsubstituted cycloalkyl group having from 3 to 30 carbon atoms, such as a cyclohexyl group, a cyclopentyl group or a 4-n-dodecylcyclohexyl group), a bicycloalkyl group (preferably a substituted or unsubstituted bicycloalkyl group having from 5 to 30 carbon atoms, such as a bicyclo[1,2,2]heptan-2-yl group or a bicyclo[2,2,2]octan-3-yl group), an alkenyl group (preferably a substituted or unsubstituted alkenyl group having from 2 to 30 carbon atoms, such as a vinyl group, an allyl group, a prenyl group, a geranyl group or an oleyl group), an alkynyl group (preferably a substituted or unsubstituted alkynyl group having from 2 to 30 carbon atoms, such as an ethynyl group, a propargyl group or a trimethylsilylethynyl group), an aryl group (preferably a substituted or unsubstituted aryl group having from 6 to 30 carbon atoms, such as a phenyl group, a p-tolyl group, a naphthyl group, a m-chlorophenyl group or an o-hexadecanoylaminophenyl group); a heterocyclic group (preferably a monovalent group generated by removing one hydrogen atom from a 5- or 6-membered, substituted or unsubstituted, aromatic or non-aromatic heterocyclic compound, and more preferably a 5- or 6-membered, aromatic heterocyclic group having from 3 to 30 carbon atoms, such as a 2-furyl group, a 2-thienyl group, a 2-pyrimidinyl group or a 2-benzothiazolyl group), an acyl group (preferably a formyl group, a substituted or unsubstituted alkylcarbonyl group having from 2 to 30 carbon atoms, a substituted or unsubstituted arylcarbonyl group having from 7 to 30 carbon atoms or a substituted or unsubstituted heterocyclocarbonyl group having from 4 to 30 carbon atoms combined with a carbonyl group by a carbon atom thereof, such as an acetyl group, a pivaloyl group, a 2-chloroacetyl group, a stearoyl group, a benzoyl group, a p-n-octyloxyphenylcarbonyl group, a 2-pyridylcarbonyl group or a 2-furylcarbonyl group), an aryloxycarbonyl group (preferably a substituted or unsubstituted aryloxycarbonyl group having from 7 to 30 carbon atoms, such as a phenoxycarbonyl group, an o-chlorophenoxycarbonyl group, an m-nitrophenoxycarbonyl group or a p-t-butylphenoxycarbonyl group), an alkoxycarbonyl group (preferably a substituted or unsubstituted alkoxycarbonyl group having from 2 to 30 carbon atoms, such as a methoxycarbonyl group, an ethoxycarbonyl group, a t-butoxycarbonyl group or an n-octadecyloxycarbonyl group), a carbamoyl group (preferably a substituted or unsubstituted carbamoyl group having from 1 to 30 carbon atoms, such as a carbamoyl group, an N-methylcarbamoyl group, an N,N-dimethylcarbamoyl group, an N,N-di-n-octylcarbamoyl group or an N-(methylsulfonyl)carbamoyl), and an imido group (preferably an N-succinimido group or an N-phthalimidogroup). Among these substituents, those which have a hydrogen atom may be deprived of the hydrogen atom and, further, substituted. Examples of complex substituents include a hydroxyethoxyethyl group, a hydroxyethylthioethyl group, and dimethylaminocarbonyl group.

The compounds represented by the formula (1) are pyridine derivatives represented by the following formula (3):

Formula (3)

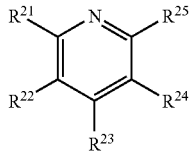

In the formula (3), $R^{21}$ to $R^{25}$ each independently represent a hydrogen atom or a substituent. Examples of such substituents represented by $R^{21}$ to $R^{25}$ include the examples of substituents of heterocycles formed by Y in the formula (1) When the compounds represented by the formula (3) each have a substituent, a preferable substitution site of the substituent is any one of $R^{22}$ to $R^{24}$. $R^{21}$ to $R^{25}$ may be combined with one another to form a saturated or unsaturated ring.

In the compounds represented by the formula (3), an acid dissociation constant (pKa) thereof at 25° C. in a tetrahydrofuran-water mixed solution (tetrahydrofuran:water=3:2) is preferably from 3 to 8, and more preferably 4 to 7.

The compounds represented by the formula (1) are also preferably pyridazine derivatives represented by the following formula (4):

Formula (4)

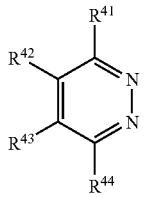

In the formula (4), $R^{41}$ to $R^{44}$ each independently represent a hydrogen atom or a substituent. $R^{41}$ to $R^{44}$ may be combined with one another to form a saturated or unsaturated ring. Examples of such substituents represented by $R^{41}$ to $R^{44}$ include the examples of substituents of heterocycles formed by Y in the formula (1), and more preferably an alkyl group, an alkenyl group, an alkynyl group, an aryl group, a hydroxyl group, an alkoxy group, an aryloxy group, a heterocycloxy group, and a phthalazine cycle formed by means of benzene condensed ring. When a hydroxyl group is substituted to a carbon atom adjacent to a nitrogen atom in the compound represented by the formula (4), an equilibrium is present between the compound and pyridazinone.

The compound represented by the formula (4) may particularly preferably form a phthalazine ring which may further have a substituents. Examples of preferable substituents of the phthalazine ring include an alkyl group, an alkenyl group, an alkynyl group, an aryl group, a hydroxyl group, an alkoxy group, and an aryloxy group.

The compounds represented by the formula (1) are also preferably pyridazine derivatives represented by any of the following formulas (5), (6), and (7):

Formula (5)

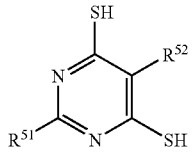

Formula (6)

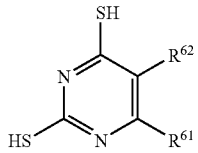

Formula (7)

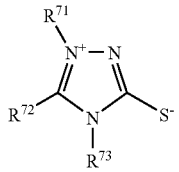

In the formulas (5) to (7), $R^{51}$ and $R^{52}$, $R^{61}$ and $R^{62}$, and $R^{71}$ to $R^{73}$ each independently represent a hydrogen atom or a substituent. Examples of such substituents represented by $R^{51}$ and $R^{52}$, $R^{61}$ and $R^{62}$, and $R^{72}$ include the examples of substituents of heterocycles formed by Y in the formula (1).

Examples of substituents represented by $R^{71}$ and $R^{72}$ include an alkyl group (inclusive of a cycloalkyl group, such as a bicycloalkyl group) an alkenyl group (inclusive of a cycloalkenyl group, such as a bicycloalkenyl group), an alkynyl group, an aryl group, and a heterocyclic group. $R^{51}$ and $R^{52}$, $R^{61}$ and $R^{62}$, and $R^{71}$ to $R^{73}$ may, in each combination, be combined with each other or one another to form a saturated or unsaturated ring.

The compounds represented by the formula (2) are preferably those represented by any one of the following formulas (8), and (9):

Formula (8)

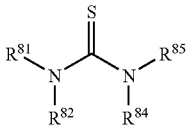

Formula (9)

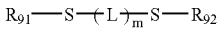

In the formulas (8) and (9), $R^{81}$ to $R^{85}$, and $R^{91}$ and $R^{92}$ each independently represent a hydrogen atom or a substituent. L represents a divalent linking group. Examples of such substituents represented by $R^{81}$ to $R^{85}$, $R^{91}$ and $R^{92}$ include an alkyl group (inclusive of a cycloalkyl group, such as a bicycloalkyl group), an alkenyl group (inclusive of a cycloalkenyl group, such as a bicycloalkenyl group), an alkynyl group, an aryl group, a heterocyclic group, an acyl group, an aryloxycarbonyl group, an alkoxycarbonyl group, a carbamoyl group, and an imido group.

The divalent linking group represented by L is a group which has, preferably, a length corresponding to from 1 to 6 atoms, and more preferably a length corresponding to from 1 to 3 atoms and, further, may have a substituent. Preferable examples of such substituents include —$CH_2$—, —$CH_2CH_2$—, —$CH(CH_3)$—, —$CH(OH)CH_2$—, and —$CH(CH_2CH_3)CH_2$—. m represents 0 or 1.

Preferable examples of the compounds represented by the formulas (1) and (2) are described below; however, the invention is by no means limited thereto.

F-101

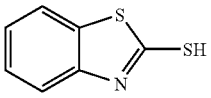

F-102

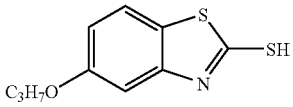

F-103

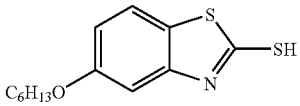

F-104

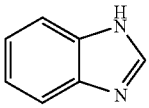

-continued

F-105

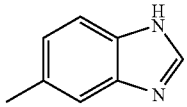

F-106

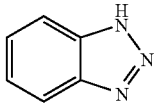

F-107

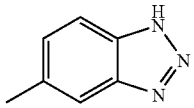

F-108

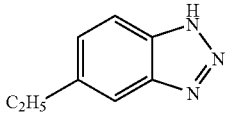

F-109

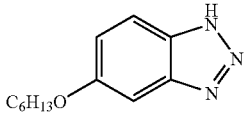

F-110

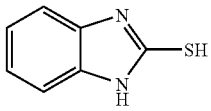

F-111

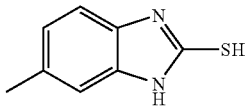

F-112

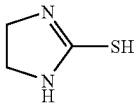

F-113

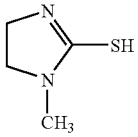

F-114

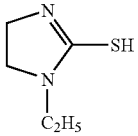

F-115

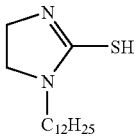

F-116

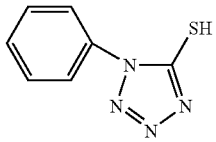

-continued

F-117

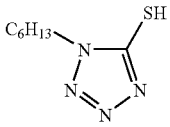

F-118

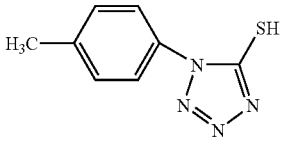

F-119

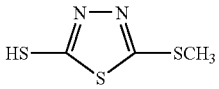

F-120

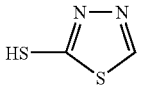

F-121

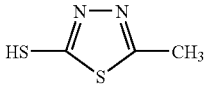

F-122

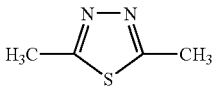

F-123

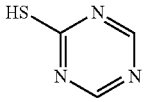

F-124

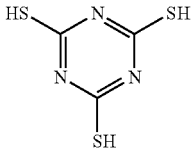

F-125

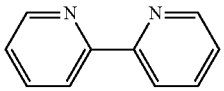

F-126

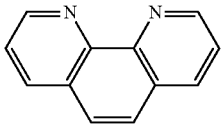

F-127

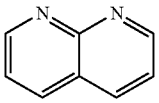

F-128

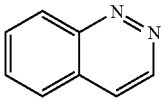

F-129

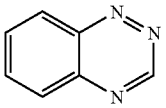

-continued

F-130

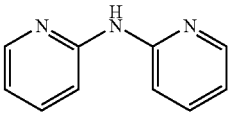

F-131

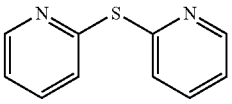

F-132

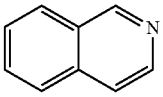

F-133

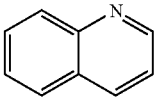

| Compound | V |
|---|---|
| | 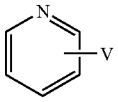 |
| F-301 | H |
| F-302 | 4-methyl |
| F-303 | 4-ethyl |
| F-304 | 4-propyl |
| F-305 | 2-methyl |
| F-306 | 2,6-dimethyl |
| F-307 | 3,4-dimethyl |
| F-308 | 2,4-dimethyl |
| F-309 | 3,5-dimethyl |
| F-310 | 2,4,6-trimethyl |
| F-311 | 4-phenyl |
| F-312 | 4-benzyl |
| F-313 | 4-phenethyl |
| F-314 | 4-methoxy |
| F-315 | 4-benzyloxy |
| F-316 | 4-phenoxy |
| F-317 | 4-(4-chlorophenyl)oxy |
| F-318 | 4-(4-chlorobenzyl)oxy |
| F-319 | 4-(4-methylbenzyl)oxy |
| F-320 | 4-(4-methoxybenzyl)oxy |
| F-321 | 4-amino |
| F-322 | 4-dimethylamino |
| F-323 | 2-dimethylamino |
| F-324 | 4-acetylamino |
| F-325 | 4-benzoylamino |
| F-326 | 4-(4-pyridyl) |
| F-327 | 4-phenoxycarbonyl |
| | 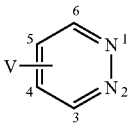 |
| F-401 | H |
| F-402 | 4-methyl |
| F-403 | 4,5-dimethyl |
| F-404 | 3,4,5,6-tetramethyl |
| F-405 | 4-phenyl |
| F-406 | 4-nitro |
| F-407 | 4-chloro |
| F-408 | 4-amino |
| F-409 | 4-benzoylamino |

-continued

| Compound | V |
|---|---|
| F-410 | 4-acetylamino |
| F-411 | 4-hydroxyl |
| F-412 | 4-methoxy |
| F-413 | 4,5-dimethoxy |
| F-414 | 3-hydroxy |
| F-415 | 3-chloro |
| F-416 | 3-methyl |
| F-417 | 3-methoxy |
| F-418 | 3,6-dihydroxy |
| F-419 | 4-dimethylamino |
| F-420 | 4-acetyl |
| F-421 | 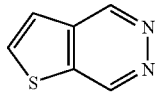 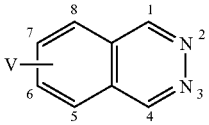 |
| F-431 | H |
| F-432 | 1-phenyl |
| F-433 | 1-(4-isopropylphenyl) |
| F-434 | 5-methyl |
| F-435 | 6-methyl |
| F-436 | 5,7-dimethyl |
| F-437 | 6,7-dimethyl |
| F-438 | 5,6,8-trimethyl |
| F-439 | 6-ethyl |
| F-440 | 6-isopropyl |
| F-441 | 6-isobutyl |
| F-442 | 6-propyl |
| F-443 | 6-t-butyl |
| F-444 | 6-sec-butyl |
| F-445 | 6-cyclohexyl |
| F-446 | 6-phenyl |
| F-447 | 6-benzyl |
| F-448 | 6-thienyl |
| F-449 | 6-chloro |

-continued

| Compound | V |
|---|---|
| F-450 | 6-bromo |
| F-451 | 6,7-dichloro |
| F-452 | 5,6,7,8-tetrachloro |
| F-453 | 1-chloro |
| F-454 | 1-methyl |
| F-455 | 6-acetyl |
| F-456 | 6-benzoyl |
| F-457 | 6-carboxy |
| F-458 | 6-methoxycarbonyl |
| F-459 | 6-sulfo |
| F-460 | 6-hydroxy |
| F-461 | 6,7-dihydroxy |
| F-462 | 6-methoxy |
| F-463 | 6,7-dimethoxy |
| F-464 | 6,7-methylenedioxy |
| F-465 | 6-acetoxy |
| F-466 | 5-nitro |
| F-467 | 6-nitro |
| F-468 | 5-amino |
| F-469 | 6-amino |
| F-470 | 5-dimethylamino |
| F-471 | 6-dimethylamino |
| F-472 | 4-(4-isopropylphenyl)-6-isopropyl |
| F-473 | 4-(4-methylphenyl)-6-methyl |
| F-474 | 1,4-dicarboxy |
| F-475 | 1,4-dichloro |
| F-476 | 1,4-di(methoxycarbonyl) |
| F-477 | 1,4-dimethyl |
| F-478 | 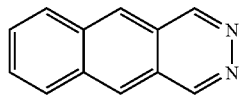 |
| F-479 | 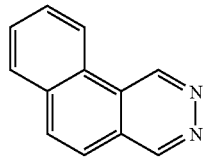 |

| Compound | $R^1$ | $R^2$ | $R^3$ | $R^4$ |
|---|---|---|---|---|
| | | 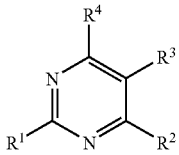 | | |
| F-501 | SH | SH | H | H |
| F-502 | SH | SH | H | OH |
| F-503 | SH | SH | H | SH |
| F-504 | SH | SH | H | $CO_2H$ |
| F-505 | SH | SH | $NH_2$ | $CH_3$ |
| F-505 | SH | SH | H | $CH_2CO_2CH_3$ |
| F-507 | SH | SH | H | $NCH_3(CH_2CO_2H)$ |
| F-508 | $NCH_3(CH_2CO_2H)$ | SH | H | SH |
| F-509 | $NCH_3(CH_2CO_2Na)$ | SH | H | SH |
| F-510 | SH | SH | H | $NCH_3(CH_2CO_2H)$ |
| F-511 | SH | SH | H | $NH(CH_2)_2CO_2H$ |
| F-512 | SH | SH | H | $CONHCH_2CO_2H$ |
| F-513 | SH | SH | H | $CON(CH_3)CH_2CO_2H$ |
| F-514 | SH | SH | H | $N(CH_3)CH_2CO_2C_2H_5$ |
| F-515 | SH | SH | H | $NHC_6H_5$ |

-continued

| Compound | $R^1$ | $R^2$ | $R^3$ | $R^4$ |
|---|---|---|---|---|
| F-516 | SH | SH | H | 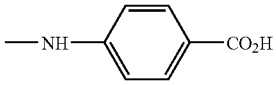 |
| F-517 | SH | SH | H | 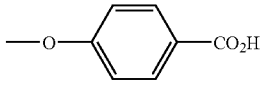 |
| F-518 | SH | SH | H | $—OC_6H_{13}$ |
| F-519 | SH | SH | H | $—N(CH_2CO_2H)_2$ |
| F-520 | SH | SH | H | $—N(CH_2CO_2C_2H_5)_2$ |
| F-521 | SH | SH | H | $CONH(CH_2)_3CH_3$ |
| F-522 | SH | SH | H | $CH_2CO_2C_6H_5$ |
| F-523 | SH | SH | H | 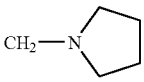 |
| F-524 | SH | SH | H | $N(CH_3)CH_2CH_2SO_3Na$ |

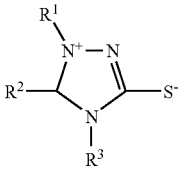

| | | | |
|---|---|---|---|
| F-701 | $CH_3$ | H | $C_2H_5$ |
| F-702 | $CH_3$ | $CH_3$ | $CH_3$ |
| F-703 | $CH_3$ | H | $C_3H_7$ |
| F-704 | $CH_3$ | $CH_3$ | i-$C_3H_7$ |
| F-705 | $CH_3$ | H | $C_4H_9$ |
| F-706 | $CH_3$ | $CH_3$ | $CH_2SO_3H$ |
| F-707 | $CH_3$ | $CH_3$ | $CH_2CO_2H$ |
| F-708 | $CH_3$ | $CH_3$ | $NHCO_2C_2H_5$ |
| F-709 | $CH_3$ | $CH_3$ | $NHCO_2C_6H_{13}$ |
| F-710 | $CH_3$ | $CH_3$ | $C_{12}H_{25}$ |
| F-711 | $CH_3$ | $CH_2CH_2CO_2CH_3$ | $CH_3$ |
| F-712 | $C_6H_5$ | $CH_3$ | $CH_3$ |
| F-713 | $C_6H_5$ | H | $CH_3$ |
| F-714 | t-$C_4H_9$ | $CH_3$ | $CH_3$ |
| F-715 | i-$C_3H_7$ | $CH_3$ | $CH_3$ |
| F-716 | t-$C_4H_9$ | $C_6H_5$ | $CH_3$ |
| F-717 | t-$C_4H_9$ | $CH_3$ | $C_6H_5$ |
| F-718 | $CH_3$ | $CH_3$ | $C_6H_5$ |
| F-719 | $CH_3$ | H | $C_6H_{13}$ |
| F-720 | $CH_3$ | H | $C_6H_{13}$ |

F-801

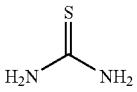

F-802

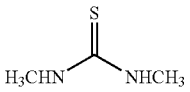

F-803

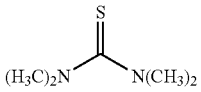

F-804

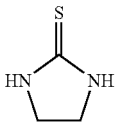

-continued
| Compound | $R^1$ | $R^2$ | $R^3$ | $R^4$ |
|---|---|---|---|---|
| F-805 | 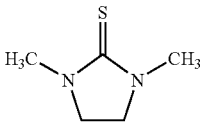 | | | |
| F-806 | 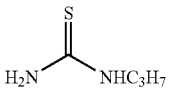 | | | |
| F-807 | 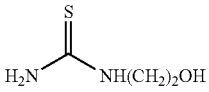 | | | |
| F-808 | 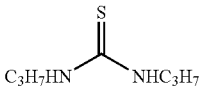 | | | |
| F-809 | 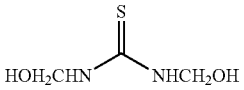 | | | |
| F-810 | 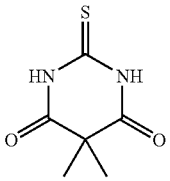 | | | |
| F-811 | 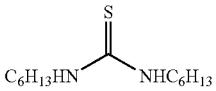 | | | |
| F-812 | 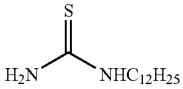 | | | |
| F-813 | 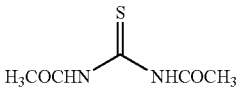 | | | |
| F-814 | 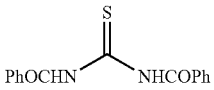 | | | |
| F-815 | 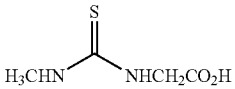 | | | |
| F-816 | 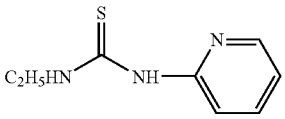 | | | |
| F-817 | 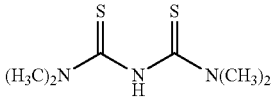 | | | |

-continued
| Compound | $R^1$ | $R^2$ | $R^3$ | $R^4$ |
|---|---|---|---|---|
| F-818 | 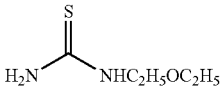 | | | |
| F-901 | $HO(CH_2)_2S(CH_2)_2SH$ | | | |
| F-902 | $HO(CH_2)_2S(CH_2)_2S(CH_2)_2OH$ | | | |
| F-903 | $HO_2CCH_2S(CH_2)_2SCH_2CO_2H$ | | | |
| F-904 | $H_3CO_2CCH_2S(CH_2)_2SCH_2CO_2CH_3$ | | | |
| F-905 | $HS(CH_2)_2S(CH_2)_2S(CH_2)_2SH$ | | | |
| F-906 | $HO(CH_2)_3S(CH_2)_2S(CH_2)_3OH$ | | | |
| F-907 | 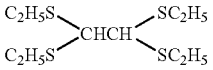 | | | |
| F-908 | $HO(CH_2)_2S(CH_2)_2S(CH_2)_2CO_2H$ | | | |
| F-909 | 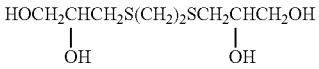 | | | |
| F-910 | 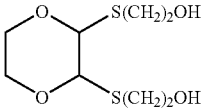 | | | |
| F-911 | 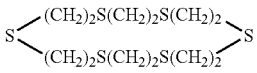 | | | |
| F-912 | 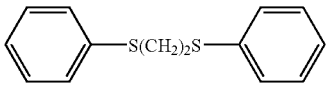 | | | |
| F-913 | 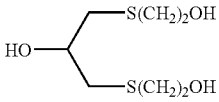 | | | |
| F-914 | 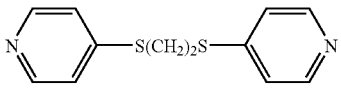 | | | |
| F-915 | 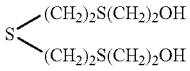 | | | |
| F-916 | 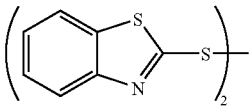 | | | |
| F-917 | 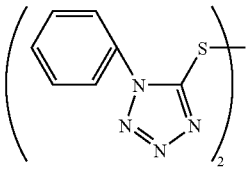 | | | |
| F-918 | 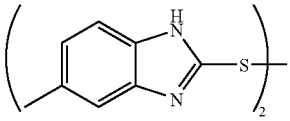 | | | |

-continued

| Compound | $R^1$ | $R^2$ | $R^3$ | $R^4$ |
|---|---|---|---|---|
| F-919 | 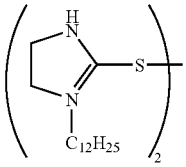 | | | |

When the silver iodide complex forming agent according to the invention performs a function of a color toning agent which has been known, the silver iodide complex forming agent and the color toning agent can be of a common compound. When the silver iodide complex forming agent according to the invention does not perform a function of a color toning agent which has been known, the silver iodide complex forming agent can simultaneously be used with the color toning agent. For example, a compound known as a color toning agent is present in pyridazine derivatives (for example, phthalazine) represented by the formula (4) according to the invention. However, although it has been known that the phthalazine compound is effective as a color toning agent in the photothermographic material, it has not been known at all that the phthalazine compound has a function of the silver iodide complex forming agent according to the invention. Further, since there was no understanding of the compound itself which has the function of the silver iodide complex forming agent, the function thereof has also not been expected. When the phthalazine compound is used as a color toning agent, the phthalazine compound may be used individually or in combination with a different phthalazine derivative.

In order to allow the silver iodide complex forming agent according to the invention to effectively act without giving any detrimental effect on storage stability of an unexposed photothermographic material according to the invention and, also, without hindering an image forming reaction, it is desirable that the silver iodide complex forming agent does not act on the photosensitive silver halide before it is heated to be thermally developed and, also, it starts to act in a step in which no substantial effect to thermal development has not yet been generated after it is heated. For this account, it is preferable that the silver iodide complex forming agent according to the invention is allowed to be present in a film in a separated state from the photosensitive silver halide, for example, in a solid state. It is also preferable that the silver iodide complex forming agent is added to an adjacent layer. It is preferable that the silver iodide complex forming agent according to the invention is used in combination with a compound which is in a solid state below room temperature and has an appropriate range of melting point such that it melts when heated at a thermally developing temperature, or a measure for adjusting a melting point by mixing a melting point adjusting agent.

According to the invention, in order to substantially improve image storability, particularly, that under light irradiation, absorption intensity of the ultraviolet visible absorption spectrum of the photosensitive silver halide after thermal development, based on that before thermal development, is preferably 80% or less, more preferably 40% or less, still more preferably 20% or less, and most preferably 10% or less.

The silver iodide complex forming agent according to the invention may be contained in a coating solution in any form of solution form, emulsify-dispersion form, solid fine grain dispersion form and the like and the resultant coating solution may be contained in the photosensitive material.

As for well known emulsify-dispersion methods, mentioned is a method in which the silver iodide complex forming agent is dissolved by using an auxiliary solvent such as dibutyl phthalate, tricresyl phosphate, glyceryl triacetate, an oil (for example, diethyl phthalate), ethyl acetate, and cyclohexanone and, then, the resultant solution was mechanically treated to prepare an emulsify-dispersion.

Further, as for solid fine grain dispersion methods, mentioned is a method in which the silver iodide complex forming agent according to the invention in powder form is dispersed in an appropriate solvent such as water by using a ball mill, a colloid mill, a vibration ball mill, a sand mill, a jet mill, a roller mill or an ultrasonic wave to prepare a solid dispersion. On this occasion, any one of a protective colloid (for example, polyvinyl alcohol), and a surfactant (for example, an anionic surfactant such as sodium triisopropyl naphthalene sulfonate (mixture of different types of sulfonates in which substitution sites of 3 isopropyl groups are different from one another)) may be used. In the above-described mills, beads of, for example, zirconia are ordinarily used and there is a chance in which Zr or the like is eluted from the beads into the dispersion. Depending on dispersion conditions, such elution is in a range from 1 ppm to 1000 ppm. However, this elution puts forth no practical problem so long as a Zr content in the photosensitive material is, based on 1 g of silver, 0.5 mg or less.

An antiseptic agent (for example, a sodium salt of benzisothiazolinone) is allowed to be contained in an aqueous dispersion.

The silver iodide complex forming agent according to the invention is preferably used in a state of solid dispersion.

The silver iodide complex forming agent according to the invention is used, based on the photosensitive silver halide, preferably in a range from 1 mol % to 5000 mol %, more preferably from 10 mol % to 1000 mol %, and still more preferably from 50 mol % to 300 mol %.

Compound Having Adsorptive Group to Silver Halide and Reducing Group

According to the invention, a compound having an adsorptive group to silver and a reducing group in a molecule (hereinafter referred to also as "adsorptive redox compound"), or a precursor thereof is preferably contained. Such compounds are preferably those represented by the following formula (I):

$$A\text{-}(W)_n\text{—}B \qquad \text{Formula (I)}$$

wherein A represents a group adsorptive to silver halide (hereinafter, referred to also as "adsorptive group");

w represents a divalent linking group;

n represents 0 or 1; and

B represents a reducing group.

In the formula (I), the adsorptive group represented by A is a group which is directly adsorptive to a silver halide, or a group which promote such adsorption to the silver halide; and specific examples of such groups include a mercapto group (and a salt thereof), a thione group (—C(═S)—), a heterocyclic group having at least one atom selected from the group consisting of: a nitrogen atom, a sulfur atom, a selenium atom and a tellurium atom, a sulfide group, a disulfide group, a cationic group, and an ethynyl group.

The mercapto group (or a salt thereof) as the adsorptive group not only means a mercapto group itself but also preferably denotes any one of an heterocyclic group, an aryl group and an alkyl group which are each substituted by at least one mercapto group (or a salt thereof). The term "heterocyclic group" as used herein is intended to denote at least a 5- to 7-membered, monocyclic or condensed-ring-type, aromatic or non-aromatic heterocyclic group; examples of such heterocyclic groups include an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, and a triazine ring group. Further, the heterocyclic group may be a heterocyclic group having a quaternized nitrogen atom; on this occasion, a substituted mercapto group may be dissociated to be a mesoion. When the mercapto group forms a salt, examples of counter ions include a cation ($Li^+$, $Na^+$, $K^+$, $Mg^{2+}$, $Ag^+$, $Zn^{2+}$ or the like) of an alkaline metal, an alkaline earth metal, a heavy metal or the like, an ammonium ion, a heterocyclic group having a quaternized nitrogen atom, and a phosphonium ion.

The mercapto group as an adsorptive group may further be tautomerized to be a thione ion.

Examples of such thione groups as adsorptive groups include a thioamide group, a thioureido group, a thiourethane group, and a dithiocarbamic ester group which are each chain-type or cyclic.

The heterocyclic group having at least one atom selected from the group consisting of: a nitrogen atom, a sulfur atom, a selenium atom and a tellurium atom as an adsorptive group denotes a nitrogen-containing heterocyclic group having an —NH— group which can form an imino silver (>NAg) as a partial structure of the heterocycle, or a heterocyclic group, having an —S— group, an —Se— group, a —Te— group, or an ═N— group as a partial structure of the heterocycle, which can be bonded to a silver ion by a coordinate bond; examples of the former include a benzotriazole group, a triazole group, an indazole group, a pyrazole group, a tetrazole group, a benzimidazole group, an imidazole group, and a purine group; examples of the latter include a thiophene group, a thiazole group, an oxazole group, a benzothiophene group, a benzothiazole group, a benzoxazole group, a thiadiazole group, an oxadiazole group, a triazine group, a selenazole group, a benzoselenazole group, a tellurazole group, and a benzotellurazole group.

The sulfide group or the disulfide group as an adsorptive group denotes all of groups which each have an —S— group or an —S—S— group as a partial structure.

The cationic group as an adsorptive group means a group having a quaternized nitrogen atom and, specifically, an ammonio group or a nitrogen-containing heterocyclic group having a quaternized nitrogen atom. Examples of such nitrogen-containing heterocyclic groups each having a quaternized nitrogen atom include a pyridinio group, a quinolinio group, an isoquinolinio group, and an imidazolio group.

The ethynyl group as an adsorptive group means a —C≡CH group and a hydrogen atom therein may be substituted.

The above-described adsorptive groups may each has a given substituent.

Specific examples of the adsorptive groups further include those as described in JP-A No. 11-95355, pp. 4 to 7.

In the formula (I), the adsorptive group represented by A is preferably a mercapto-substituted heterocyclic group (for example, a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, 1,5-dimethyl-1,2,4-triazolium-3-thiolate group, a 2,4-dimercaptopyrimidine group, a 2,4-dimercaptotriazine group, a 3,5-dimercapto-1,2,4-triazole group, or a 2,5-dimercapto-1,3-thiazole group), or a nitrogen-containing heterocyclic group having an —NH— group which can form an imino silver (>NAg) as a partial structure of such heterocycle (for example, a benzotriazole group, a benzimidazole group, or an indazole group), and more preferably a 2-mercaptobenzimidazole group or a 3,5-dimercapto-1,2,4-triazole group.

In the formula (I), W represents a divalent linking group. The linking group may be any linking group so long as it does not give any detrimental effect to photographic characteristics. For example, any divalent linking group constituted by a carbon atom, a hydrogen atom, an oxygen atom, a nitrogen atom, or a sulfur atom can be utilized. Examples of such linking groups include an alkylene group having from 1 to 20 carbon atoms (for example, a methylene group, an ethylene group, a trimethylene group, a tetramethylene group, or a hexamethylene group), an alkenylene group having from 2 to 20 carbon atoms, an alkynylene group having from 2 to 20 carbon atoms, an arylene group having from 6 to 20 carbon atoms (for example, a phenylene group, or a naphthylene group), a —CO— group, an —$SO_2$— group, an —O— group, an —S— group, an —$NR_1$— group and combinations thereof, in which $R_1$ represents a hydrogen atom, an alkyl group, a heterocyclic group, or an aryl group. The linking group represented by W may have a given substituent.

In the formula (I), the reducing group represented by B denotes a silver ion-reducible group; examples of such reducing groups include a formyl group, an amino group, a group having a triple bond such as an acetylene group or a propargyl group, a mercapto group, a residue generated by removing one hydrogen atom from each of hydroxylamines, hydroxamic acids, hydroxyureas, hydroxyurethanes, hydroxysemicarbazides, reductones (inclusive of derivatives thereof), anilines, phenols (inclusive of chroman-6-ols, 2,3-dihydrobenzofuran-5-ols, aminophenols, sulfonamidophenols, hydroquinones, catechols, resorcinols, benzene triols, and polyphenols such as bisphenols), acylhydrazines, carbamoylhydrazines, and 3-pyrazolidones. It goes without saying that these reducing groups may each individually have a given substituent.

In the formula (I), examples of preferable reducing groups represented by B include residues derived from compounds represented by the following formulas $B_1$ to $B_{13}$:

($B_1$)

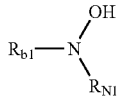

-continued (B2)

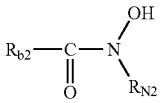

(B3)

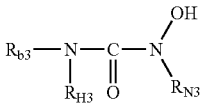

(B4)

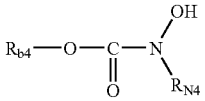

(B5)

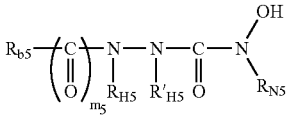

(B6)

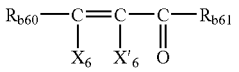

(B7)

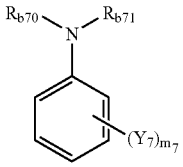

(B8)

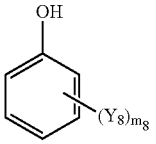

(B9)

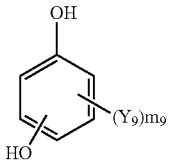

(B10)

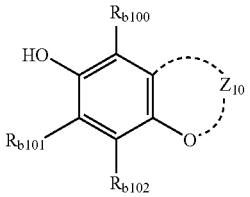

(B11)

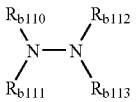

(B12)

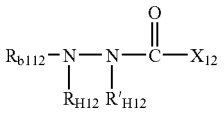

-continued (B13)

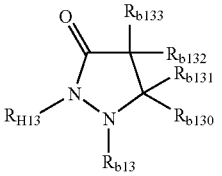

In the formulas ($B_1$) to ($B_{13}$), $R_{b1}$, $R_{b2}$, $R_{b3}$, $R_{b4}$, $R_{b5}$, $R_{b70}$, $R_{b71}$, $R_{b110}$, $R_{b111}$, $R_{B112}$, $R_{b113}$, $R_{b12}$, $R_{b13}$, $R_{N1}$, $R_{N2}$, $R_{N3}$, $R_{N4}$, $R_{N5}$ each independently represent a hydrogen atom, an alkyl group, an aryl group, or a heterocyclic group; $H_{H3}$, $R_{H5}$, $R'_{H5}$, $R_{H12}$, $R'_{H12}$, $R_{H13}$ each individually represent a hydrogen atom, an alkyl group, an aryl group, an acyl group, an alkylsulfonyl group, or arylsulfonyl group, in which $R_{H3}$ may further be a hydroxyl group; $R_{b100}$, $R_{b101}$, $R_{b102}$, $R_{b130}$ to $R_{b133}$ each individually represent a hydrogen atom or a substituent; $Y_7$ and $Y_8$ each individually represent a substituent exclusive of a hydroxyl group; $Y_9$ represents a substituent; $m_5$ represents an integer of 0 or 1; $m_7$ represents an integer of from 0 to 5; $m_8$ represents an integer of from 1 to 5; $m_9$ represents an integer of from 0 to 4; $Y_7$, $Y_8$, and $Y_9$ may each individually further be an aryl group which is condensed to a benzene ring (benzene condensed ring) and such benzene condensed ring may has a substituent; $Z_{10}$ represents a non-metallic atomic group capable of forming a ring; $X_{12}$ represents a hydrogen atom, an alkyl group, an aryl group, a heterocyclic group, an alkoxy group, an amino group (inclusive of an alkylamino group, an arylamino group, a heterocycloamino group, and a cyclic amino group), or a carbamoyl group.

In the formula ($B_6$), $X_6$, and $X'_6$ each individually represent a hydroxyl group, an alkoxy group, a mercapto group, an alkylthio group, an amino group (inclusive of an alkylamino group, an arylamino group, a heterocycloamino group, and a cyclic amino group), an acylamino group, a sulfonamide group, an alkoxycarbonylamino group, a ureido group, an acyloxy group, an acylthio group, an alkylaminocarbonyloxy group, and an arylaminocarbonylox group; $R_{b60}$ and $R_{b61}$ each individually represent an alkyl group, an aryl group, an amino group, an alkoxy group, and aryloxy group, in which $R_{b60}$ and $R_{b61}$ may be combined with each other to form a cyclic structure.

The term "alkyl group" as used in the above description of each group of the formulas ($B_1$) to ($B_{13}$) is intended to include a straight, branched or cyclic, substituted or unsubstituted alkyl group having from 1 to 30 carbon atoms; the term "aryl group" is intended to include a monocyclic or condensed cyclic, substituted or unsubstituted aromatic hydrocarbon cycle such as a phenyl group or a naphthyl group; and the term "heterocyclic group" is intended to include an aromatic or non-aromatic, monocyclic or condensed cyclic, substituted or unsubstituted heterocyclic group having at least one heteroatom.

Further, the term "substituent" as used in the above description of respective groups represented by the formulas ($B_1$) to ($B_{13}$) is intended to include same substituents as those of the above-described adsorptive group. The substituents may each individually be further substituted by any one of these substituents.

In the formulas ($B_1$) to ($B_5$), $R_{N1}$, $R_{N2}$, $R_{N3}$, $R_{N4}$, and $R_{N5}$ represent each individually preferably a hydrogen atom or an alkyl group. The alkyl group is preferably a straight, branched, or cyclic, substituted or unsubstituted alkyl group having from 1 to 12 carbon atoms, and more preferably a straight, branched, substituted or unsubstituted alkyl group having from 1 to 6 carbon atoms such as a methyl group, an ethyl group, a propyl group or a benzyl group.

In the formula ($B_1$), $R_{b1}$ preferably represents an alkyl group or a heterocyclic group. The alkyl group is a straight, branched or cyclic, substituted or unsubstituted alkyl group having preferably from 1 to 30 carbon atoms, and more preferably from 1 to 18 carbon atoms; and the heterocyclic group is a 5- or 6-membered, monocyclic or condensed cyclic, aromatic or non-aromatic heterocyclic group and may have a substituent. The heterocyclic group is preferably an aromatic heterocyclic group; examples of such aromatic heterocyclic groups include a pyridine ring group, a pyrimidine ring group, a triazine ring group, a thiazole ring group, a benzothiazole ring group, an oxazole ring group, a benzoxazole ring group, an imidazole ring group, a benzimidazole ring group, a pyrazole ring group, an indazole ring group, an indole ring group, a purine ring group, a quinoline ring group, an isoquinoline ring group, and a quinazoline ring group, and particularly preferably a triazine ring group, and a benzothiazole ring group. It is also a preferable example of the compound represented by the formula ($B_1$) that the alkyl group or the heterocyclic group represented by $R_{b1}$ further has one or two —N($R_{N1}$)OH groups as substituents.

In the formula ($B_2$), $R_{b2}$ preferably represents an alkyl group, an aryl group or a heterocyclic group, and more preferably represents an alkyl group or an aryl group. Preferable ranges of such alkyl groups are same as those as described in $R_{b1}$. The aryl group is preferably a phenyl group or a naphthyl group, and particularly preferably a phenyl group and may have a substituent. It is also a preferable example of the compound represented by the formula ($B_2$) that the group represented by $R_{b2}$ further has one or two —CON($R_{N2}$)OH groups as substituents.

In the formula ($B_3$), $R_{b3}$ preferably represents an alkyl group or an aryl group. Preferable ranges of these groups are same as those as described in $R_{b1}$ and $R_{b2}$. $R_{H3}$ preferably represents a hydrogen atom, an alkyl group or a hydroxyl group, and more preferably represents a hydrogen atom. It is also a preferable example of the compound represented by the formula ($B_3$) that the group represented by $R_{b3}$ further has one or two —N($R_{H3}$)CON($R_{N3}$)OH groups as substituents. Further, $R_{b3}$ and $R_{N3}$ may be combined with each other to form a ring structure (preferably 5- or 6-membered saturated heterocycle).

In the formula ($B_4$), $R_{b4}$ preferably represents an alkyl group. A preferable range thereof is same as that as described in $R_{b1}$. It is also a preferable example of the compound represented by the formula ($B_4$) that the group represented by $R_{b4}$ further has one or two —OCON($R_{N4}$)OH groups as substituents.

In the formula ($B_5$), $R_{b5}$ preferably represents an alkyl group or an aryl group, and more preferably an aryl group. Preferable ranges of these groups are same as those as described in $R_{b1}$ and $R_{b2}$. $R_{H5}$ and $R'_{H5}$ each preferably represent a hydrogen atom or an alkyl group, and more preferably represent a hydrogen atom.

In the formula ($B_6$), $R_{b60}$ and $R_{b61}$ are preferably combined with each other to form a ring structure. The thus-formed ring structure may be a 5- to 7-membered non-aromatic carbocycle or heterocycle and may be a monocycle or a condensed ring. Specific examples of preferable ring structures include a 2-cyclopenten-1-one ring, a 2,5-dihydrofuran-2-one ring, a 3-pyrrolin-2-one ring, a 4-pyrazolin-3-one ring, a 2-cyclohexen-1-one ring, a 5,6-didydro-2H-pyran-2-one ring, a 5,6-dihydro-2-pyridone ring, a 1,2-dihydronaphthalen-2-one ring, a coumarin ring (benzo-α-pyran-2-one ring), a 2-quinolone ring, a 1,4-dihydronaphthalen-1-one ring, a chromone ring (benzo-γ-pyran-4-one ring), a 4-quinolone ring, an inden-1-one ring, a 3-pyrroline-2,4-dione ring, a uracil ring, a thiouracil ring and a dithiouracil ring, and more preferable are a 2-cyclopenten-1-one ring, a 2,5-dihydrofuran-2-one ring, a 3-pyrrolin-2-one ring, a 4-pyrazolin-3-one ring, a 1,2-dihydronaphthalen-2-one ring, a coumarin ring (benzo-α-pyran-2-one ring), a 2-quinolone ring, a 1,4-dihydronaphthalen-1-one ring, a chromone ring (benzo-γ-pyran-4-one ring), a 4-quinolone ring, an inden-1-one ring, and a dithiouracil ring, and still more preferable are a 2-cyclopenten-1-one ring, a 2,5-dihydrofuran-2-one ring, a 3-pyrrolin-2-one ring, an inden-1-one ring, and a 4-pyrazolin-3-one ring.

When $X_6$ and $X'_6$ each individually represent a cyclic amino group, the term "cyclic amino group" as used in the above description is intended to include a non-aromatic nitrogen-containing heterocyclic group formed by combining with a nitrogen atom; examples of such cyclic amino groups include a pyrrolidino group, a piperidino group, a piperazino group, a morpholino group, a 1,4-thiazin-4-yl group, a 2,3,5,6-tetrahydro-1,4-thiazin-4-yl group, and an indolyl group.

$X_6$, and $X'_6$ each individually represent preferably a hydroxyl group, a mercapto group, an amino group (inclusive of an alkylamino group, an arylamino group or a cyclic amino group), an acylamino group, a sulfonamide group, an acyloxy group, or an acylthio group, more preferably a hydroxyl group, a mercapto group, an amino group, an alkylamino group, a cyclic amino group, a sulfonamide group, an acylamino group, or an acyloxy group, and particularly preferably a hydroxyl group, an amino group, an alkylamino group, or a cyclic amino group. Further, at least one of $X_6$ and $X'_6$ preferably represents a hydroxyl group.

In the formula ($B_7$), $R_{b70}$ and $R_{b71}$ each individually preferably represent a hydrogen atom, an alkyl group or an aryl group, and more preferably an alkyl group. A preferable range of the alkyl group is same as that as described in $R_{b1}$. $R_{b70}$ and $R_{b71}$ may be combined with each other to form a ring structure (for example, a pyrrolidine ring, a piperidine ring, a morpholino ring, or a thiomorpholino ring). Examples of preferable substituents represented by $Y_7$ include an alkyl group (a preferable range thereof is same as that as described in $R_{b1}$), an alkoxy group, an amino group, an acylamino group, a sulfonamide group, a ureido group, an acyl group, an alkoxycarbonyl group, a carbamoyl group, a sulfamoyl group, a chlorine atom, a sulfo group and a salt thereof, a carboxyl group and a salt thereof. $m_7$ preferably represents 0 to 2.

In the formula ($B_8$), m preferably represents 1 to 4 and a plurality of $Y_8$'s may be same with or different from one another. $Y_8$ at the time of $m_8$ representing 1 or at least one of a plurality of $Y_8$'s at the time of $m_8$ representing 2 or more is preferably an amino group (inclusive of an alkylamino group or an arylamino group), a sulfonamide group, or an acylamino group. When $m_8$ represents 2 or more, remaining $Y_8$'s are each individually preferably represent a sulfonamide group, an acylamino group, a ureido group, an alkyl group, an alkylthio group, an acyl group, an alkoxycarbonyl group, a carbamoyl group, a sulfo group and a salt thereof, a carboxyl group and a salt thereof, or a chlorine atom. As for substituents represented by $Y_8$, when an o'-(or p'-)hydroxyphenylmethyl group (permissible to further have a substituent) is substituted at an ortho position or a para position of a hydroxyl group, they denote a group of compounds ordinarily called as bisphenols; this case is also a preferable example of the compound represented by the formula ($B_8$). Further, it is also extremely preferable that $Y_8$ represents a benzene condensed ring and, as a result, the formula ($B_8$) represents naphthols.

In the formula ($B_9$), substitution sites of two hydroxyl groups may each be at an ortho position (catechols), a meta position (resorcinols), or a para position (hydroquinones). $m_9$ preferably represents 1 or 2 and, when $Y_9$ exists in a plural number, they may be same with or different from one another. Preferable examples of substituents represented by Y include a chlorine atom, an acylamino group, a ureido group, a sulfonamide group, an alkyl group, an alkylthio group, an alkoxy group, an acyl group, an alkoxycarbonyl group, a carbamoyl group, a sulfo group and a salt thereof, a carboxyl group and a salt thereof, a hydroxyl group, an alkylsulfonyl group, and an arylsulfonyl group. Further, it is also preferable that $Y_9$ represents a benzene condensed ring and, as a result, the formula ($B_9$) represents 1,4-naphthohydroquinones. When the formula ($B_9$) represents catechols, $Y_9$ particularly preferably represents a sulfo group or a salt thereof, or a hydroxyl group.

In the formula ($B_{10}$), when $R_{b100}$, $R_{b101}$, and $R_{b102}$ represent substituents, preferable examples of the substituents represented by $R_{b100}$, $R_{b101}$, and $R_{b102}$ are same as the preferable examples of the substituents represented by $Y_9$, in which an alkyl group (particularly a methyl group) is preferable. A ring structure formed by $Z_{10}$ is preferably a coumarone ring or a 2,3-dihydrobenzofuran ring. These ring structures may each have a substituent and may each form a spiro ring.

In the formula ($B_{11}$), $R_{b110}$, $R_{b111}$, $R_{112}$, $R_{b113}$ each individually preferably represent an alkyl group, an aryl group or a heterocyclic group. Preferable ranges thereof are same as those as described in $R_{b1}$ and $R_{b2}$ and, among other things, an alkyl group is preferable. Further, two alkyl groups among groups represented by $R_{b110}$ to $R_{b113}$ may be combined with each other to form a ring structure. The term "ring structure" as used in the above description is intended to include a 5- or 6-membered non-aromatic heterocycle; examples of such heterocycles include a pyrrolidine ring, a piperidine ring, a morpholine ring, a thiomorpholine ring, and a hexahydropyridazine ring.

In the formula ($B_{12}$), $R_{b12}$ preferably represents an alkyl group, an aryl group or a heterocyclic group. A preferable range thereof is same as that as described in each of $R_{b1}$ and $R_{b2}$. $X_{12}$ preferably represents an alkyl group, an aryl group (particularly a phenyl group), a heterocyclic group, an alkoxy group, an amino group (inclusive of an alkylamino group, an arylamino group, a heterocycloamino group, and a cyclic amino group), or a carbamoyl group, in which an alkyl group (particularly preferably an alkyl group having from 1 to 8 carbon atoms), an aryl group (particularly preferably a phenyl group), an amino group (particularly preferably an alkylamino group, an arylamino group, or a cyclic amino group) are more preferable. $R_{H12}$ and $R'_{H12}$ each individually preferably represent a hydrogen atom or an alkyl group, and more preferably represent a hydrogen atom.

In the formula ($B_{13}$), $R_{b13}$ preferably represent an alkyl group or an aryl group. A preferable range thereof is same as that as described in each of $R_{b1}$ and $R_{b2}$. $R_{b130}$, $R_{b131}$, $R_{b132}$ and $R_{b133}$, each individually preferably represent a hydrogen atom, an alkyl group (particularly preferably having from 1 to 8 carbon atoms), or an aryl group (particularly a phenyl group). $R_{H13}$ is preferably a hydrogen atom or an acyl group, and more preferably a hydrogen atom.

An oxidation potential of a reducing group represented by B in the formula (I) can be measured by a method described in, for example, Akira Fujishima, "Electrochemical Measurement Method", pp. 150-208, (published by Gihodo Co., Ltd.), or "Experiment Chemistry Lecture", 4th ed., vol. 9, pp. 282-344, (compiled and edited by The Chemical Society of Japan; published by Maruzen Co., Ltd.). For example, a rotating disc voltammetry technique can be utilized. Specifically, a sample is dissolved in a solution having a mixing ratio of 10%:90% by volume of methanol to a Britton-Robinson buffer solution at pH 6.5. After being aerated with a nitrogen gas for 10 minutes, the resultant solution is subjected to measurements with a sweep speed of 20 mV/second at 1000 rotations/minute at 25° C. by using a rotating disc electrode (RDE) made of glassy carbon as a working electrode, a platinum wire as a counter electrode, and a saturated calomel electrode as a reference electrode, thereby constructing a voltamogram. A half-wave potential (E ½) can be obtained from the thus-constructed voltamogram.

When the reducing group represented by B according to the invention is subjected to measurements by the above-described measuring method, the oxidation potential thereof is preferably in a range from approximately −0.3 V to approximately 1.0 V, more preferably from approximately −0.1 V to approximately 0.8 V, and particularly preferably from approximately 0 V to approximately 0.7 V.

In the formula (I), the reducing group represented by B is preferably a residue generated by removing one hydrogen atom from each of hydroxylamines, hydroxamic acids, hydroxyureas, hydroxysemicarbazides, reductones, phenols, hydrazines such as acylhydrazines or carbamoylhydrazines, hydrazides, phenidones, and 3-pyrazolidones. A residue generated by removing one hydrogen atom from each of hydroxyureas, hydroxysemicarbazides, phenols, hydrazides, and phenidones is particularly preferable.

Specific examples of preferable reducing groups represented by B are described below. however, the present invention is by no means limited thereto. The asterisk (*) in each of the following groups means a position to bind to A or W in Formula (I).

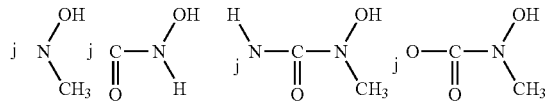

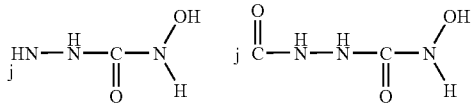

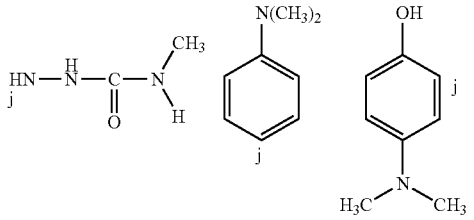

-continued

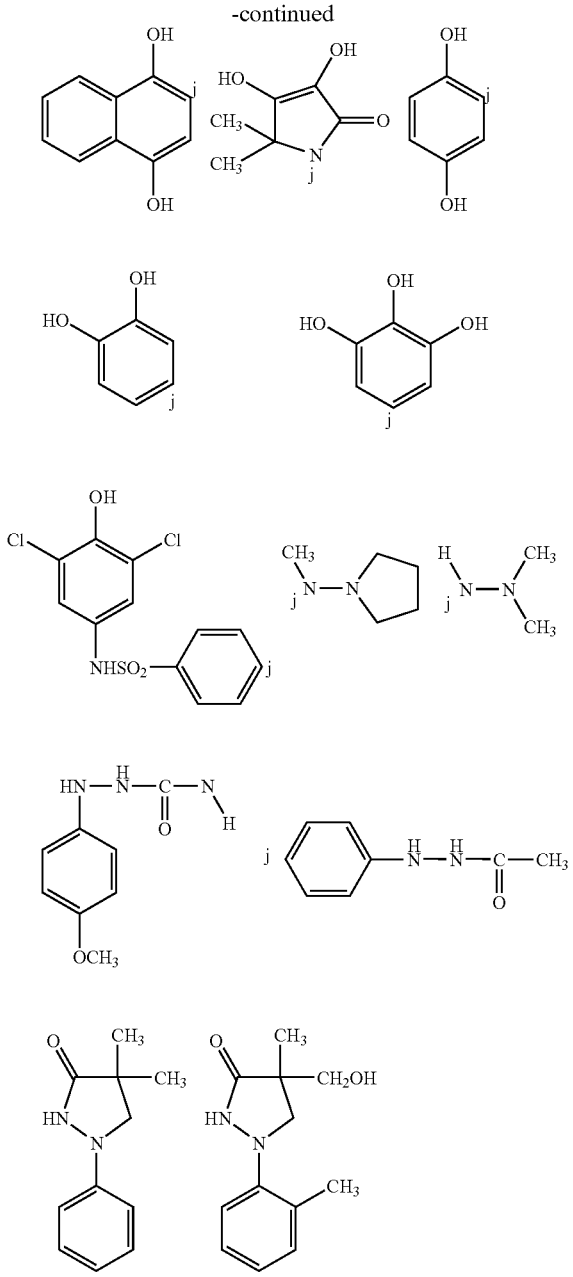

The compound represented by the formula (I) according to the invention may be such that a ballast group or a polymer chain that is commonly used in an immobile additive for photographic use such as a coupler is incorporated thereinto. As for polymers, mentioned are those as described in, for example, JP-A No. 1-100530.

The compound represented by the formula (I) according to the invention may either be a bis-form or a tris-form. A molecular weight of the compound represented by the formula (I) is preferably in a range from 100 to 10000, more preferably from 120 to 1000, and particularly preferably from 150 to 500.

Compounds represented by the formula (I) according to the invention are illustrated below; however, the invention is by no means limited thereto. Further, preferable examples of the compounds also include those as illustratively described in JP-A Nos. 2000-330247, and 2001-42446.

(1)

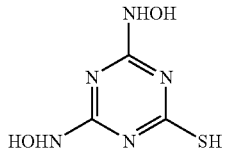

(2)

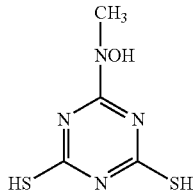

(3)

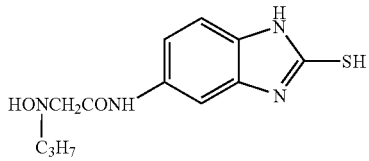

(4)

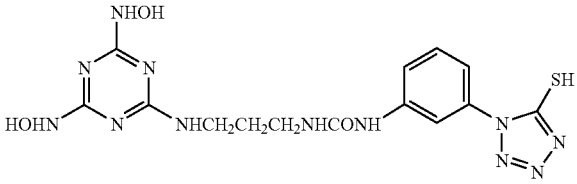

(5)

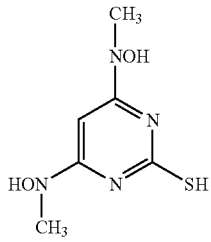

(6)

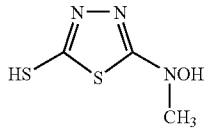

(7)

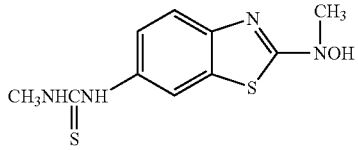

(8)

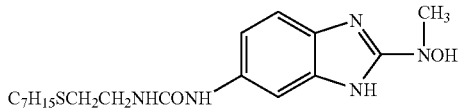

-continued
(9)
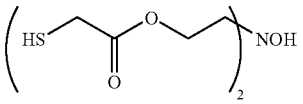
(10)
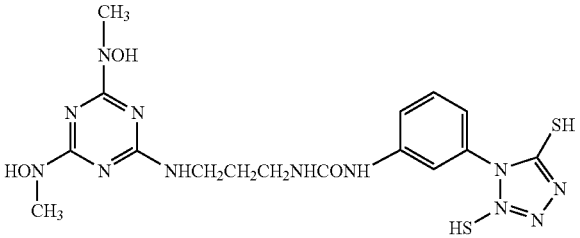
(11)
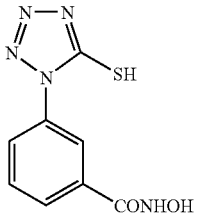
(12)
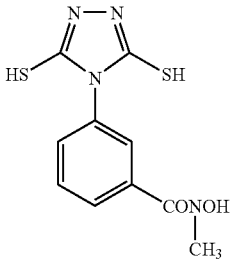
(13)
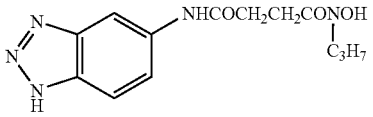
(14)
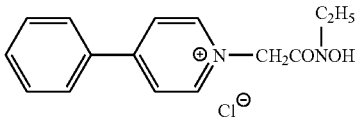
-continued
(15)
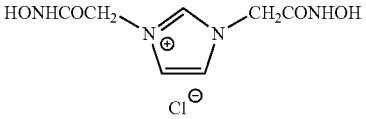
(16)
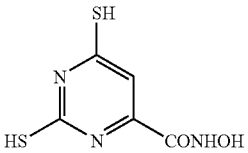
(17)
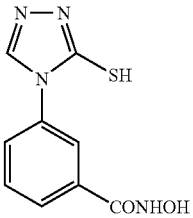
(18)
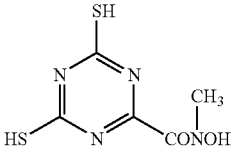
(19)
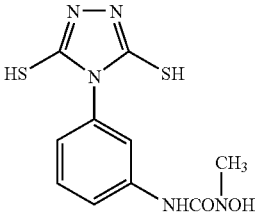
(20)
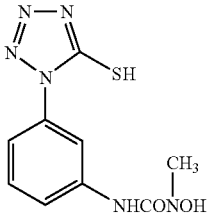
(21)
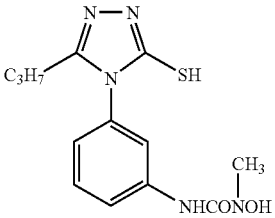
(22)
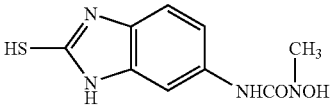
(23)
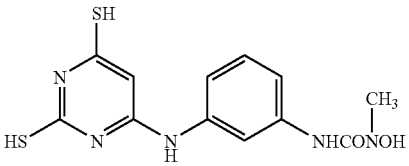

-continued
(24)
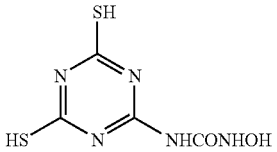
(25)
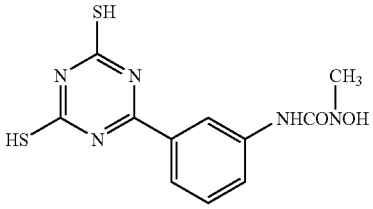
(26)
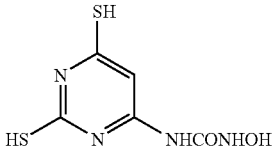
(27)
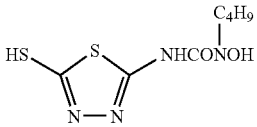
(28)
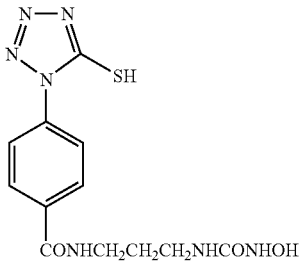
(29)
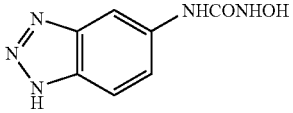
(30)
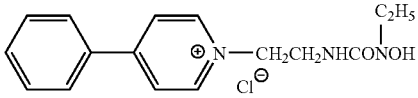
(31)
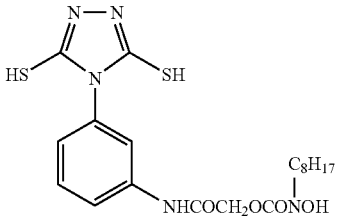
-continued
(32)
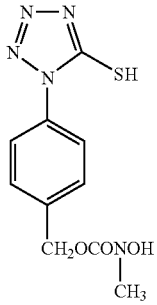
(33)
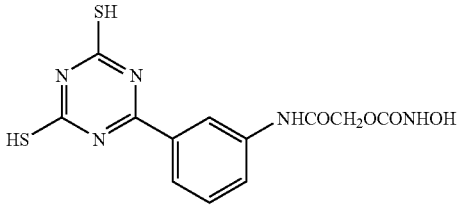
(34)
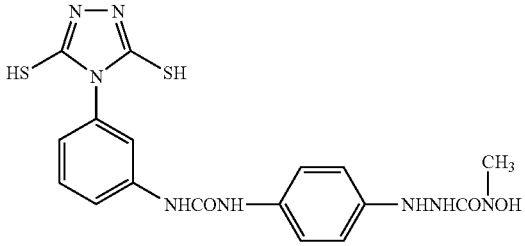
(35)
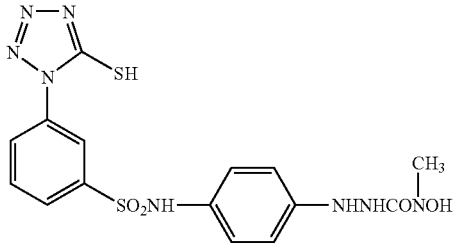
(36)
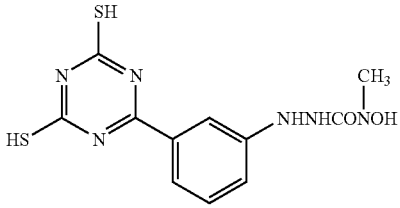
(37)
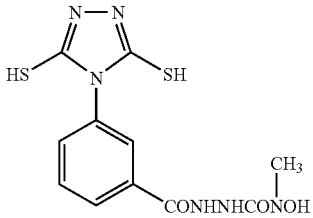

-continued
(38)
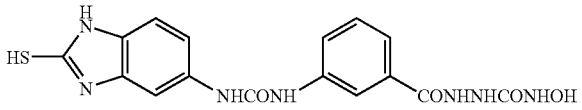
(39)
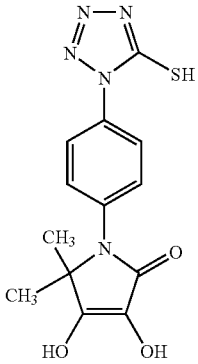
(40)
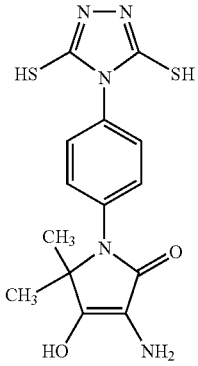
(41)
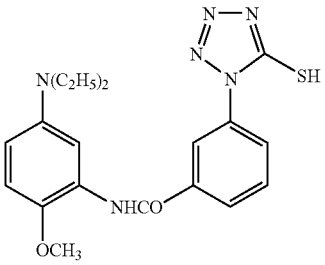
(42)
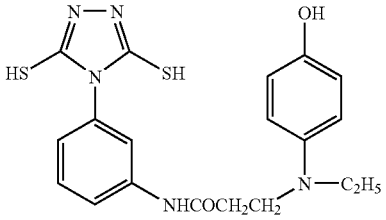
-continued
(43)
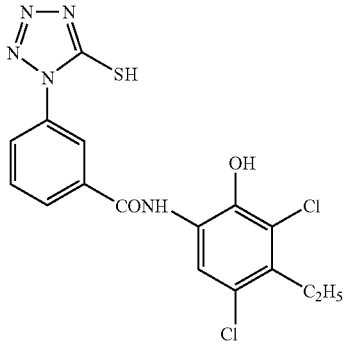
(44)
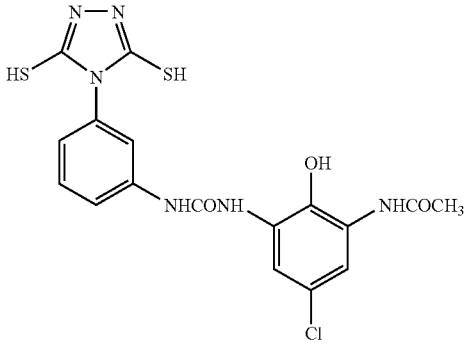
(45)
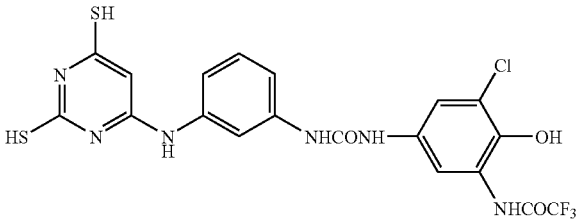
(46)
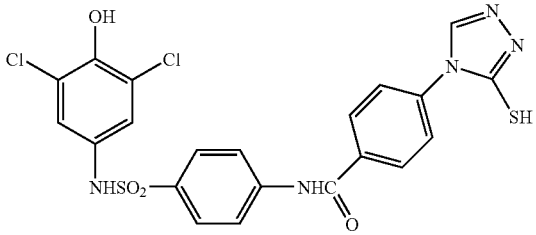

-continued
(47)
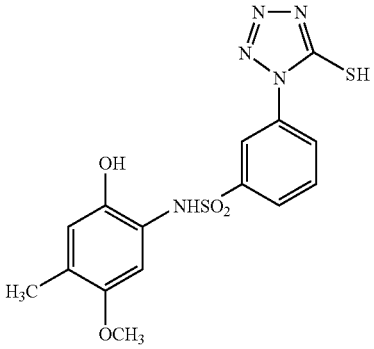
(48)
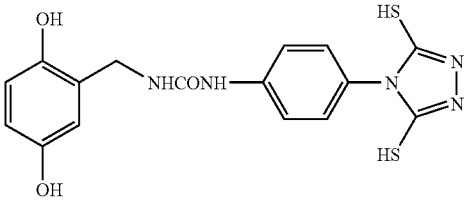
(49)
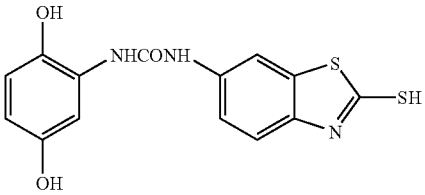
(50)
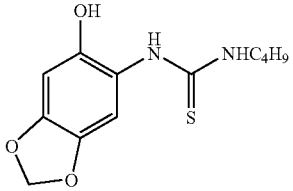
(51)
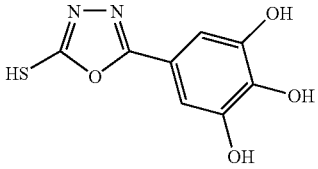
(52)
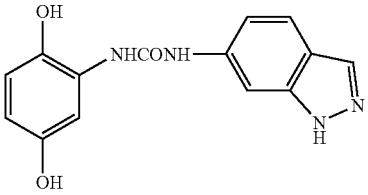
(53)
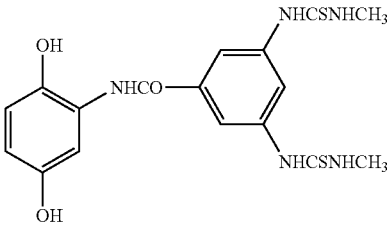
-continued
(54)
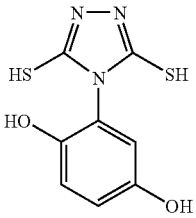
(55)
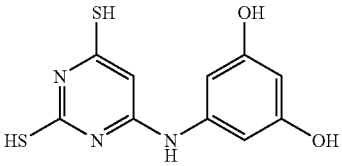
(56)
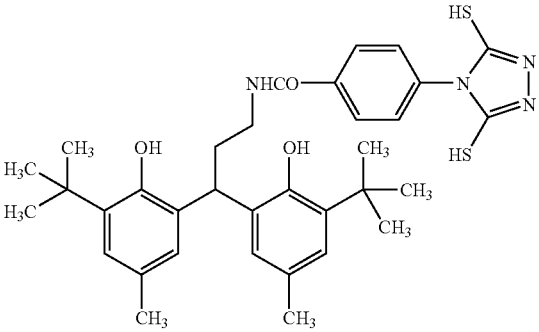
(57)
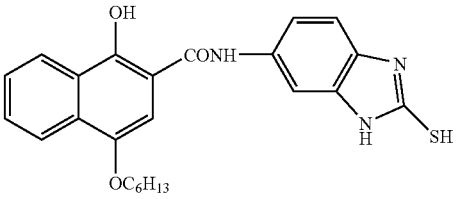
(58)
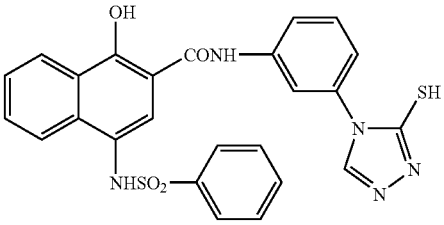
(59)
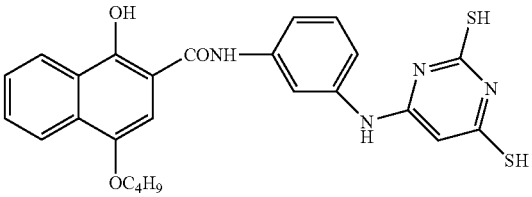
(60)
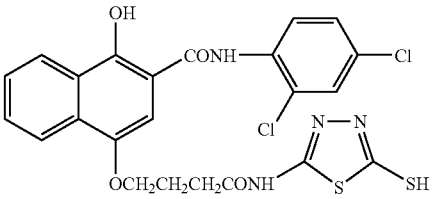

-continued
(61)
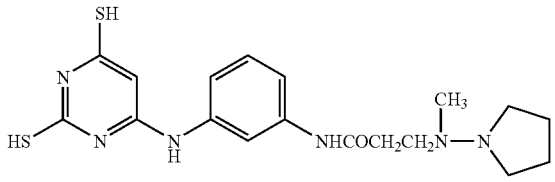
(62)
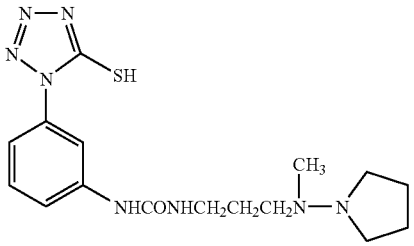
(63)
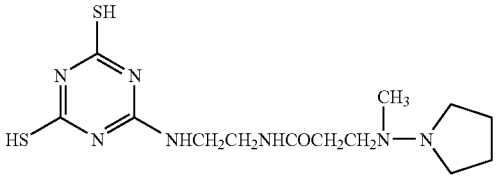
(64)
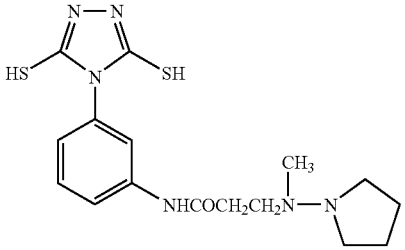
(65)
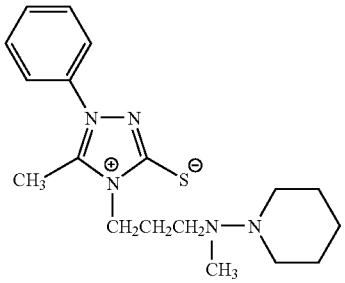
(66)
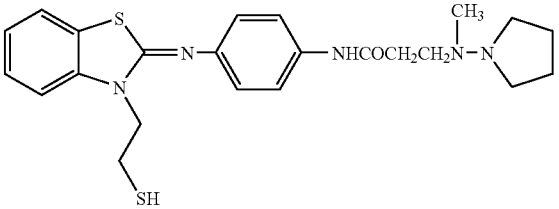
-continued
(67)
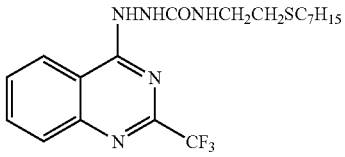
(68)
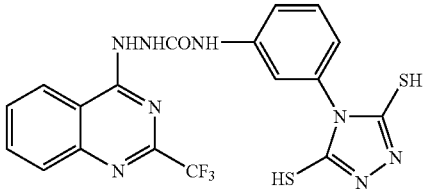
(69)
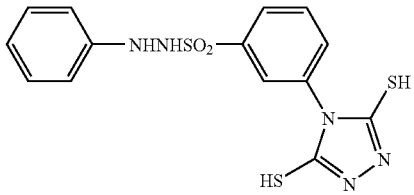
(70)
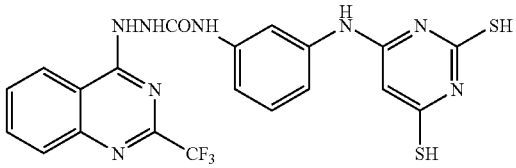
(71)
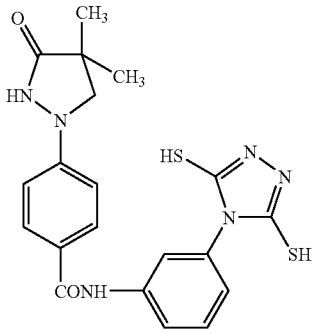
(72)
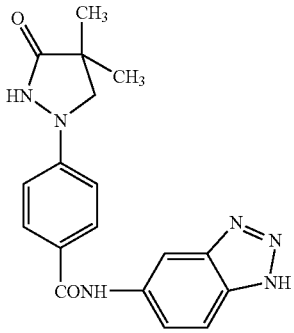

-continued
(73)
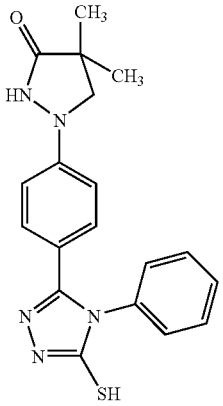
(74)
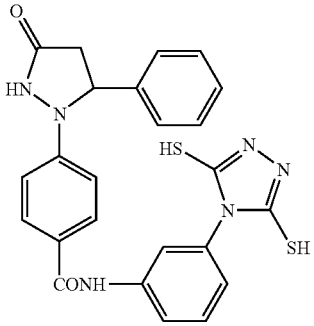
(75)
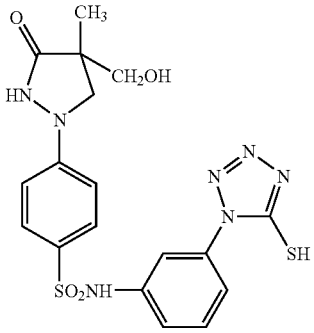
(76)
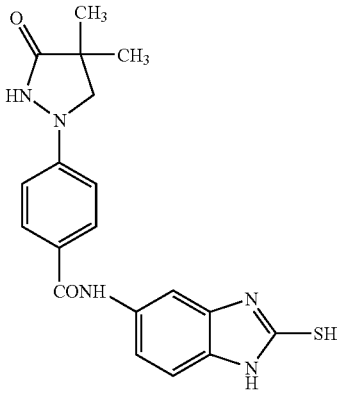
-continued
(77)
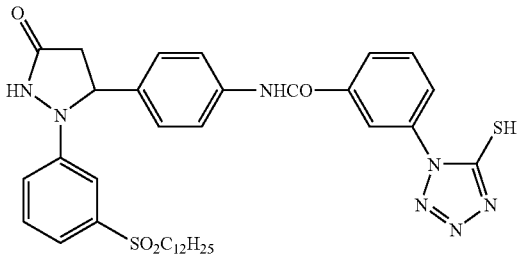
(78)
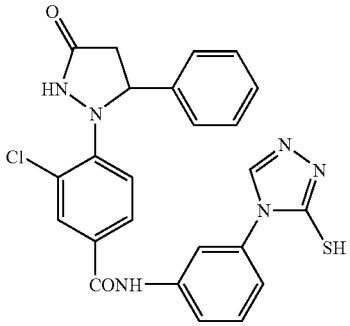
(79)
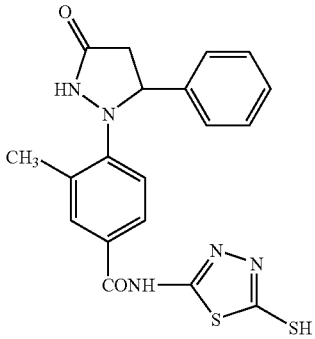
(80)
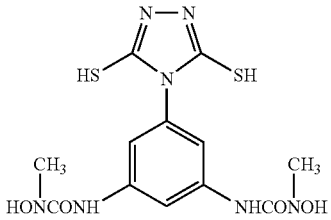
(81)
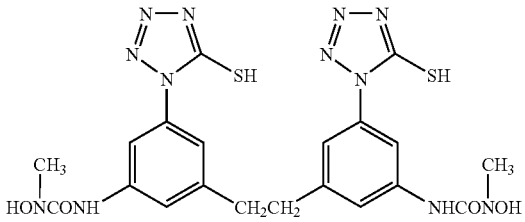

-continued
(82)
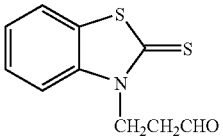
(83)
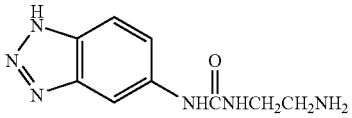
(84)
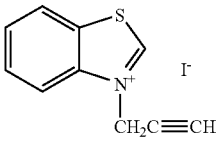
(85)
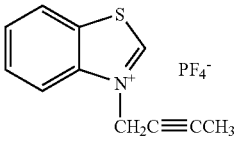
(86)
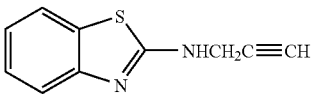
(87)
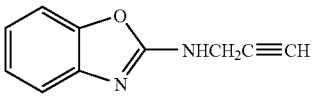
(88)
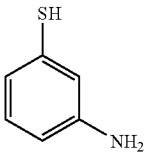
(89)
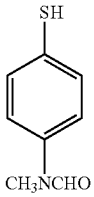
(90)
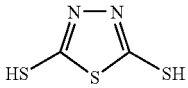
-continued
(91)
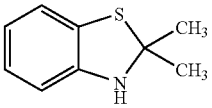
(92)
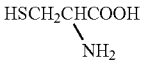
(93)
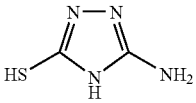
(94)
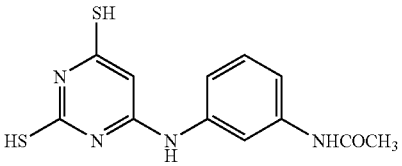
(95)
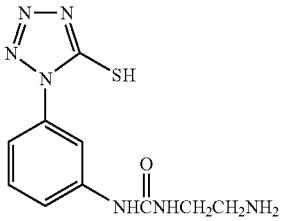
(96)
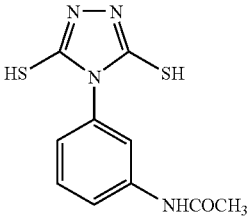
(97)
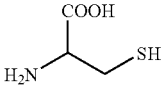
(98)
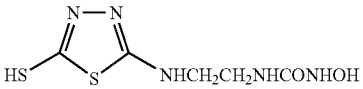
(99)
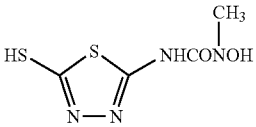
(100)
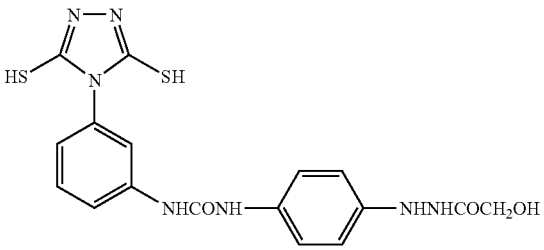

-continued (101)

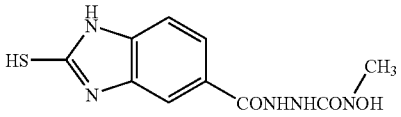

(102)

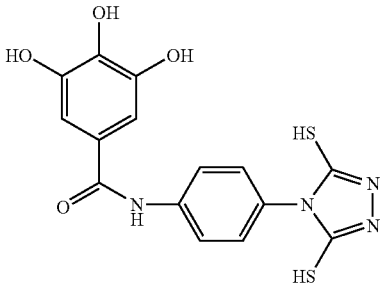

(103)

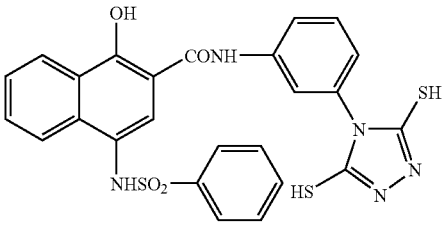

(104)

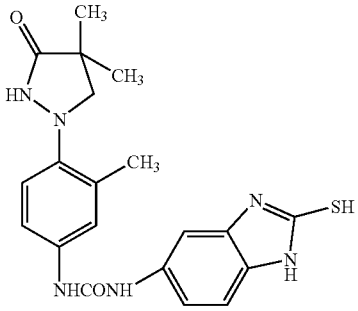

(105)

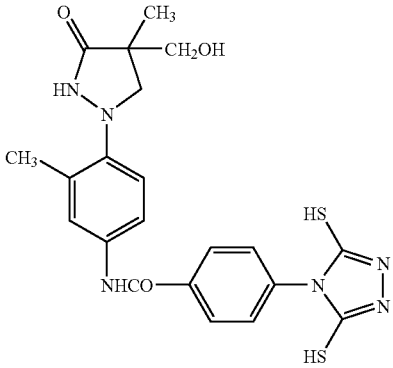

(106)

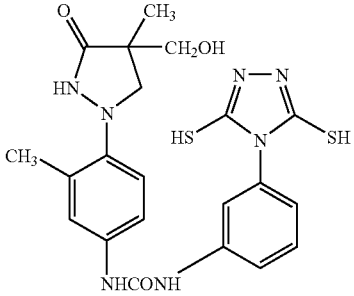

-continued (107)

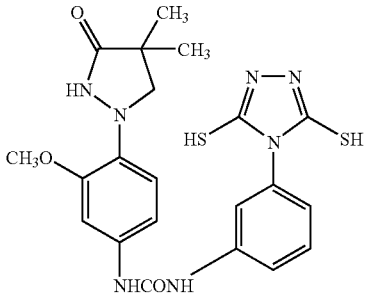

(108)

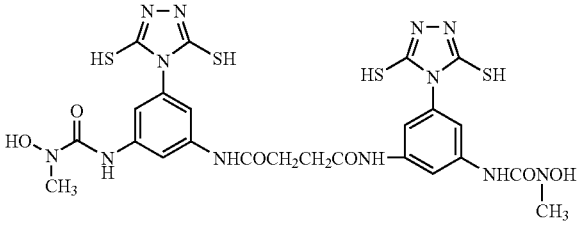

(109)

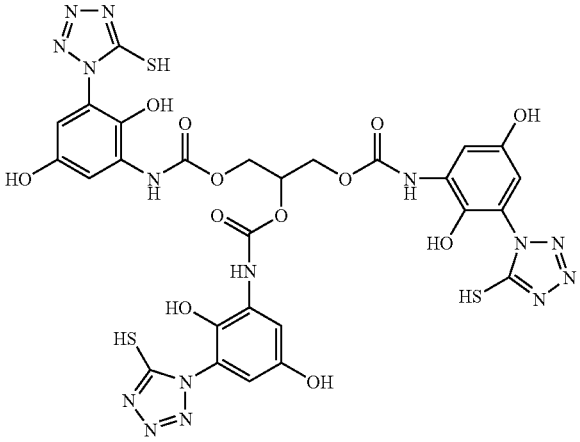

A precursor of a compound having an adsorptive group to the photosensitive silver halide and a reducing group may be added to the photothermographic material. The term "precursor" as used herein is intended to include a compound in which a bond is dissociated at the time of thermal development to generate the above-described adsorptive redox compound. The precursor is not particularly limited so long as it is such a compound as described above. As an example of the precursor to be favorably used, mentioned is a compound in which a site of a reducing group of an adsorptive redox compound is blocked by a dissociatable group which is dissociated at the time of thermal development.

Such compounds can each individually be synthesized in accordance with a known method. The compounds represented by the formula (I) can be used either each individually or in combination of 2 or more types. When 2 or more types of compounds are used, they may be added in a same layer or in different layers. Methods of such addition may be different from one another.

The compound represented by the compound (I) according to the invention is preferably added in a silver halide emulsion layer and more preferably added therein at the time of preparing the emulsion. When the compound is added at the time of preparing the emulsion, the compound can be added in any step of a preparation process; examples of such steps include a grain-forming step of a silver halide, a step before starting a desalting step, the desalting step, a step before starting a chemical ripening step, the chemical ripening step, and a step before preparing a final emulsion. The compound can be added in 2 or more steps in a multiple addition manner. Although the compound is preferably added in the emulsion layer, the compound is first added in not only the emulsion layer but also a protective layer or an intermediate layer adjacent to the emulsion layer and, then, allowed to be diffused at the time of coating.

Although substantially depending on the above-described addition methods or a chemical species to be added, a quantity of the compound to be added is, base on 1 mol of the photosensitive silver halide, in the range of ordinarily from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol.

The compound represented by the formula (I) can be dissolved in water, a water-soluble solvent such as methanol or ethanol, or any mixtures thereof and, then, added. On this occasion, a pH of the resultant solution may be adjusted by an acid or a base, and, further, a surfactant may simultaneously be present in the solution. Still further, the compound can be dissolved in a high-boiling solvent to prepare an emulsify-dispersion and, then, the compound can be added in a form of the thus-prepared emulsify-dispersion. In another case, the compound can be added in a form of a solid dispersion.

Compound In Which A One-Electron-Oxidized Form Generated by Oxidizing One Electron Therein Can Release One or More Electrons It is preferable that the photothermographic material according to the invention comprises a compound in which a one-electron-oxidized form generated by oxidizing one electron therein can release one or more electrons.

The compound in which a one-electron-oxidized form generated by oxidizing one electron therein can release one or more electrons is a compound selected from the following types 1 to 5:

(type 1) a compound in which a one-electron-oxidized form generated by oxidizing one electron therein, following a subsequent bond-cleavage reaction, can further release 2 or more electrons;

(type 2) a compound in which a one-electron-oxidized form generated by oxidizing one electron therein, following a subsequent bond-cleavage reaction, can further release another electron and in which 2 adsorptive groups to silver halide are present in a same molecule;

(type 3) a compound in which a one-electron-oxidized form generated by oxidizing one electron therein, after being subjected to a subsequent bond-forming step, can further release one or more electrons;

(type 4) a compound in which a one-electron-oxidized form generated by oxidizing one electron therein, after being subjected to a subsequent ring-cleavage reaction in a molecule, can further release one or more electrons; and (type 5) a compound represented by X—Y in which X represents a reducing group, Y represents a dissociating group, and the reducing group represented by X in which a one-electron-oxidized form generated by oxidizing one electron therein, following a subsequent cleavage reaction of an X—Y bond, dissociates Y to generate an X radical from which another electron can further be released.

Among compound types 1 and 3 to 5, preferable is "a compound having an adsorptive group to silver halide in a molecule", or "a compound having a partial structure of a spectral sensitizing dye in a molecule", and more preferable is "a compound having an adsorptive group to silver halide in a molecule". Among compound types 1 to 4, more preferable is "a compound having, as an adsorptive group, a nitrogen-containing heterocyclic group which is substituted by 2 or more mercapto groups.

The compound types 1 to 5 will be described in detail below.

In regard to the compound type 1, the term "bond-cleavage reaction" is intended to mean a cleavage of a bond between elements in each of following combinations of elements: carbon-carbon, carbon-silicon, carbon-hydrogen, carbon-boron, carbon-tin, and carbon-germanium and, a cleavage of a bond in carbon-hydrogen may further follow. The compound type 1 is a compound which first becomes a one-electron-oxidized form by oxidizing one electron therein and, then, following the bond-cleavage reaction, can further release 2 or more (preferably 3) electrons.

A preferable compound of compound type 1 is represented by any one of the formulas (A) and (B), the formulas (i) to (iii).

Formula (A)

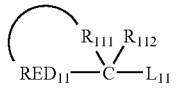

Formula (B)

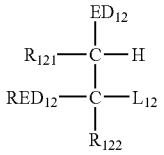

In the formula (A), $RED_{11}$ represents a reducing group in which one electron can be oxidized; $L_{11}$ represents a dissociating group; $R_{112}$ represents a hydrogen atom or a substituent; and $R_{111}$ represents a non-metallic atomic group which can, together with a carbon atom (C) and $RED_{11}$, form a ring structure corresponding to a tetrahydro form, a hexahydro form, or an octahydro form of a 5- or 6-membered aromatic ring (inclusive of aromatic heterocycle).

In the formula (B), $RED_{12}$ represents a reducing group in which one electron can be oxidized; $L_{12}$ represents a dissociating group; $R_{121}$, and $R_{122}$ each individually represent a hydrogen atom or a substituent; and $ED_{12}$ represents an electron-donating group. In the formula (B), $R_{121}$, and $RED_{12}$, $R_{121}$ and $R_{122}$, or $ED_{12}$ and $RED_{12}$ may, within each individual combination, be combined with each other to form a ring structure.

Compounds represented by the formula (A) or (B) are each a compound in which a reducing group represented by $RED_{11}$, or $RED_{12}$ can, after one electron therein is oxidized, spontaneously dissociate $L_{11}$ or $L_{12}$ by a bond-cleavage reaction and can, following such reaction, further release 2 or more, preferably 3 or more electrons.

Formula (i)

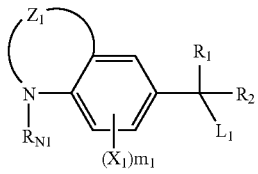

-continued

Formula (ii)

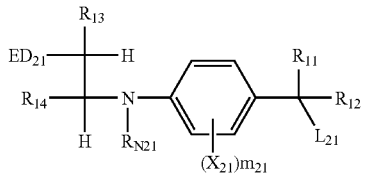

Formula (iii)

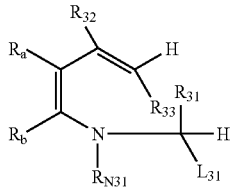

In the formula (i), $Z_1$ represents an atomic group which can form a 6-membered ring, together with a nitrogen atom and 2 carbon atoms of a benzene ring; $R_1$, $R_2$, and $R_{N1}$ each individually represent a hydrogen atom or a substituent; $X_1$ represents a substituent which can be substituted in a benzene ring; $m_1$ represents an integer of 0 to 3; and $L_1$ represents a dissociating group.

In the formula (ii), $ED_{21}$ represents an electron-donating group; $R_{11}$, $R_{12}$, $R_{N21}$, $R_{13}$, and $R_{14}$ each individually represent a hydrogen atom or a substituent; $X_{21}$ represents a substituent which can be substituted in a benzene ring; $m_{21}$ represents an integer of 0 to 3; and $L_{21}$ represents a dissociating group. $R_{N21}$, $R_{13}$, $R_{14}$, $X_{21}$, and $ED_{21}$ may be combined with one another to form a ring structure.

In the formula (iii), $R_{32}$, $R_{33}$, $R_{31}$, $R_{N31}$, $R_a$, and $R_b$ each individually represent a hydrogen atom or a substituent; and $L_{31}$ represents a dissociating group. When $R_{N31}$ represents a group exclusive of an aryl group, $R_a$ and $R_b$ are combined with each other to form an aromatic ring.

Compounds as described above are each a compound in which, after one electron therein is oxidized, can spontaneously dissociate $L_1$, $L_{21}$, or $L_{31}$, by a bond-cleavage reaction and can, following such reaction, further release 2 or more, preferably 3 or more electrons.

First of all, compounds represented by the formula (A) will be described in detail below.

In the formula (A), a reducing group, in which one electron can be oxidized, represented by $RED_{11}$ is a group which can be combined with $R_{111}$, as described below, to form a specified ring. Specifically mentioned is a divalent group which is prepared by removing a hydrogen atom at a site appropriate for forming a ring structure from each of monovalent groups as described below. For example, mentioned are an alkylamino group, an arylamino group (such as an anilino group or a naphthylamino group), a heterocycloamino group (such as a benzthiazolylamino group or a pyrrolylamino group), an alkylthio group, an arylthio group (such as a phenylthio group), a heterocyclothio group, an alkoxy group, an aryloxy group (such as a phenoxy group), a heterocycloxy group, an aryl group (such as a phenyl group, a naphthyl group, or an anthranyl group), and an aromatic or non-aromatic heterocyclic group (a 5- to 7-membered, monocyclic or condensed-ring-type heterocycle having at least one heteroatom of a nitrogen atom, a sulfur atom, an oxygen atom, and a selenium atom; specific examples of such heterocycles include a tetrahydroquinoline ring, a tetrahydroisoquinoline ring, a tetrahydroquinoxaline ring, a tetrahydroquinazoline ring, an indoline ring, an indole ring, an indazole ring, a carbazole ring, a phenoxazine ring, a phenothiazine ring, a benzothiazoline ring, a pyrrole ring, a indazole ring, a thiazoline ring, a piperidine ring, a pyrrolidine ring, a morpholine ring, a benzimidazole ring, a benzimidazoline ring, a benzoxazoline ring, and a methylenedioxyphenyl ring) (hereinafter, compounds represented by $RED_{11}$ are recited in terms of respective monovalent groups thereof for the purpose of convenience). The compounds represented by $RED_{11}$ may each have a substituent.

The substituent according to the invention means, unless otherwise specified, a substituent selected from the following groups: a halogen atom, an alkyl group (inclusive of an aralkyl group, a cycloalkyl group or an active methine group), an alkenyl group, an alkynyl group, an aryl group, a heterocyclic group (a position to be substituted is not limited), a heterocyclic group having a quaternized nitrogen atom (for example, a pyridinio group, an imidazolio group, a quinolinio group, or an isoquinolinio group), an acyl group, an alkoxycarbonyl group, an aryloxycarbonyl group, a carbamoyl group, a carboxyl group or a salt thereof, a sufonylcarbamoyl group, an acylcarbamoyl group, a sulfamoylcarbamoyl group, a carbazoyl group, an oxalyl group, an oxamoyl group, a cyano group, a carbonimidoyl group, a thiocarbamoyl group, a hydroxyl group, an alkoxy group (inclusive of a group having a recurring unit of an ethyleneoxy group or a propyleneoxy group), an aryloxy group, a heterocycloxy group, an acyloxy group, an (alkoxy or aryloxy)carbonyloxy group, a carbamoyloxy group, a sufonyloxy group, an amino group, (an alkyl, aryl, or a heterocyclo)amino group, an acylamino group, a sulfonamide group, a ureido group, a thioureido group, an imido group, an (alkoxy or aryloxy)carbonylamino group, a sufamoylamino group, a semicarbazide group, a thiosemicarbazide group, a hydrazino group, an ammonio group, an oxamoylamino group, an (alkyl or aryl) sufonylureido group, an acylureido group, an acylsulfamoylamino group, a nitro group, a mercapto group, (an alkyl, aryl, or a heterocyclo)thio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, and a group having a phosphoramide or phosphoric acid ester structure. These substituents may each be further substituted by any one of these substituents.

The compound represented by $RED_{11}$ is preferably an alkylamino group, an arylamino group, a heterocycloamino group, an aryl group, or an aromatic or non-aromatic heterocyclic group, and more preferably an arylamino group (particularly an anilino group), or an aryl group (particularly a phenyl group). When these groups each have a substituent, the substituent is preferably a halogen atom, an alkyl group, an alkoxy group, a carbamoyl group, a sulfamoyl group, an acylamino group, or a sulfonamide group.

When $RED_{11}$ represents an aryl group, the aryl group preferably has at least one "electron-donating group". The term "electron-donating group" is intended to include a hydroxyl group, an alkoxy group, a mercapto group, a sulfonamide group, an acylamino group, an alkylamino group, an arylamino group, a heterocycloamino group, and an active methine group, a 5-membered, monocyclic or condensed-ring-type, electron-excessive aromatic heterocyclic group having at least one nitrogen atom in a cycle (for example, an indolyl group, a pyrrolyl group, an imidazolyl group, a benzimidazolyl group, a thiazolyl group, a benzthiazolyl group, or an indazolyl group), a nitrogen-containing heterocyclic group substituted by a nitrogen atom (a group capable of being called as a cycloamino group such as a pyrrolidinyl group, an indolinyl group, a piperidinyl group, a piperazinyl group, or a morpholino group). The active methine group on this occasion means a methine group substituted by two "electron-attracting groups"; examples of such electron-attracting groups include an acyl group, an alkyloxycarbonyl group, an aryloxycarbonyl group, a carbamoyl group, an alkylsulfonyl group, an arylsulfonyl group, a sulfamoyl group, a trifluoromethyl group, a cyano group, a nitro group, or a carbonimidoyl group. On this occasion, two electron-attracting groups may be combined with each other to form a ring structure.

In the formula (A), $L_{11}$ specifically represents a carboxyl group or a salt thereof, a silyl group, a hydrogen atom, a triarylboroanion, a trialkylstannyl group, a trialkylgermyl group, or a —$CR_{C1}R_{C2}R_{C3}$ group. Specific examples of such silyl groups include a trialkylsilyl group, an aryldialkylsilyl group, and a triarylsilyl group. The silyl groups may each have a given substituent.

When $L_{11}$ represents a salt of a carboxyl group, examples of counter ions which each form the salt include an alkaline metal ion, an alkaline earth metal ion, a heavy metal ion, an ammonium ion, and a phosphonium ion, in which an alkaline metal ion or an ammonium ion is preferable, and an alkaline metal ion (particularly, $Li^+$, $Na^+$, or $K^+$ ion) is most preferable.

When $L_{11}$ represents a —$CR_{C1}R_{C2}$ $R_{C3}$ group, $R_{C1}$, $R_{C2}$, and $R_{C3}$ each individually represent a hydrogen atom, an alkyl group, an aryl group, a heterocyclic group, an alkylthio group, an arylthio group, an alkylamino group, an arylamino group, a heterocycloamiono group, an alkoxy group, an aryloxy group, or a hydroxyl group, and these groups may be combined with one another to form a ring structure and, also, may each individually have a given substituent. When any one of $R_{C1}$, $R_{C2}$, and $R_{C3}$ represents a hydrogen atom or an alkyl group, the remaining ones represent neither hydrogen nor alkyl group. $R_{C1}$, $R_{C2}$, and $R_{C3}$ each individually preferably represents an alkyl group, an aryl group (particularly phenyl group), an alkylthio group, an arylthio group, an alkylamino group, an arylamino group, a heterocyclic group, an alkoxy group, or a hydroxyl group. Specific examples thereof include a phenyl group, a p-dimethylaminophenyl group, a p-methoxyphenyl group, a 2,4-dimethoxyphenyl group, a p-hydroxyphenyl group, a methylthio group, a phenylthio group, a phenoxy group, a methoxy group, an ethoxy group, a dimethylamino group, an N-methylanilino group, a diphenylamino group, a morpholino group, a thiomorpholino group, and a hydroxy group. Further, these groups may be combined with each other to form a ring structure; examples of such groups include a 1,3-dithiolan-2-yl group, a 1,3-dithian-2-yl group, an N-methyl-1,3-thiazolidin-2-yl group, and an N-benzyl-benzothiazolidin-2-yl group.

It is also a preferable case in which a —$CR_{C1}R_{C2}R_{C3}$ group represents a same group as a residue generated by removing $L_{11}$ from the formula (A) as a result of selecting $R_{C1}$, $R_{C2}$, and $R_{C3}$ from within respective ranges as described above.

In the formula (A), $L_{11}$ is preferably a carboxyl group or a salt thereof, or a hydrogen atom, and more preferably a carboxylic group or a salt thereof.

When $L_{11}$ represents a hydrogen atom, the compound represented by the formula (A) preferably has a base site inherent in a molecule. After the compound represented by the formula (A) is oxidized by an action of this base site, a hydrogen atom represented by $L_{11}$ is deprotonated and, subsequently, an electron is released from the resultant deprotonated hydrogen atom.

On this occasion, the base specifically denotes a conjugate base of an acid having from approximately 1 pKa to approximately 10 pKa. Examples of such bases include nitrogen-containing heterocycles (such as pyridines, imidazoles, benzimidazoles, and thiazoles), anilines, trialkylamines, an amino group, carbon acids (such as an active methylene anion), a thioacetic acid anion, a carboxylate (—$COO^-$), a sulfate (—$SO_3^-$), and an aminoxide (>$N^+(O^-)$—). Conjugate bases of acids having from approximately 1 pKa to approximately 8 pKa are preferable, in which a carboxlate, a sulfate, and an aminoxide are more preferable, and a carboxylate is particularly preferable. When these bases each have an anion, these bases may each have a counter ion; examples of such counter ions include an alkaline metal ion, an alkaline earth metal ion, a heavy metal ion, an ammonium ion, and a phosphonium ion. These bases are each individually linked to the compound represented by the formula (A) at a given position. The position at which these base sites are each individually connected to is any of $RED_{11}$, $R_{111}$, and $R_{112}$ represented by the formula (A) and, further, respective substituents thereof.

In the formula (A), $R_{112}$ represents a hydrogen atom or a substituent which can be substituted to a carbon atom. However, $R_{112}$ and $L_{11}$ do not simultaneously represent a same group. $R_{112}$ preferably represents a hydrogen atom, an alkyl group, an aryl group (for example, a phenyl group), an alkoxy group (for example, a methoxy group, an ethoxy group or a benzyloxy group) a hydroxyl group, an alkylthio group (for example, a methylthio group or a butylthio group), an amino group, an alkylamino group, an arylamino group, or a heterocycloamino group, and more preferably represents a hydrogen atom, an alkyl group, an alkoxy group, a hydroxyl group, a phenyl group or an alkylamino group.

In the formula (A), the ring structure formed by $R_{111}$ is a ring structure corresponding to a tetrahydro form, a hexahydro form or an octahydro form of a 5- or 6-membered aromatic ring (inclusive of an aromatic heterocycle). The term "hydro form" as used in the above description is intended to mean a ring structure in which a carbon-carbon double bond (or carbon-nitrogen double bond) inherent in an aromatic ring (inclusive of an aromatic heterocycle) is partially hydrogenated, while the terms "tetrahydro form", "hexahydro form", and "octahydro form" are intended to mean structures in which 2, 3, and 4 carbon-carbon double bonds (or corresponding numbers of carbon-nitrogen double bonds) are hydrogenated, respectively. The aromatic ring is converted into a non-aromatic ring structure by being partially hydrogenated.

Examples of such ring structures include a pyrrolidine ring, a imidazolidine ring, a thiazolidine ring, a pyrazolidine ring, an oxazolidine ring, a piperidine ring, a tetrahydropyridine ring, a tetrahydropirimidine ring, a piperazine ring, a tetraline ring, a tetrahydroquinoline ring, a tetrahydroisoquinoline ring, a tetrahydroquinazoline ring, a tetrahydroquinoxaline ring, a tetrahydrocarbazole ring, and and octahydrophenanthridine ring. These ring structures may each individually have a given substituent.

The ring structures formed by $R_{111}$ are more preferably a pyrrolidine ring, a imidazolidine ring, a piperidine ring, a tetrahydropyridine ring, a tetrahydropirimidine ring, a piperazine ring, a tetrahydroquinoline ring, a tetrahydroisoquinoline ring, a tetrahydroquinazoline ring, a tetrahydroquinoxaline ring and a tetrahydrocarbazole ring, and particularly preferably a pyrrolidine ring, a piperidine ring, a piperazine ring, a tetrahydropyridine ring, a tetrahydroquinoline ring, a tetrahydroisoquinoline ring, a tetrahydroquinazoline ring and a tetrahydroquinoxaline ring, and most preferably a pyrrolidine ring, a piperidine ring, a tetrahydropyridine ring, a tetrahydroquinoline ring, and a tetrahydroisoquinoline ring.

In the formula (B), $RED_{12}$ and $L_{12}$ denote groups having same meanings as those as described in $RED_{11}$ and $L_{11}$ in the formula (A). Respective preferable ranges thereof are also same as those as described in $RED_{11}$ and $L_{11}$. However, $RED_{12}$ is monovalent except for a case in which it forms a ring structure as described below and, specifically, denotes same monovalent groups as those as described in $RED_{11}$. $R_{121}$ and $R_{122}$ denote groups having same meanings as those as described in $R_{112}$ in the formula (A). Respective preferable ranges thereof are also same as those as described in $RED_{112}$. $ED_{12}$ represents an electron-donating group. $R_{121}$ and $RED_{12}$, $R_{121}$ and $R_{122}$, and $ED_{12}$ and $RED_{12}$ may, in each combination, be combined with each other to form a ring structure.

In the formula (B), an electron-donating group represented by $ED_{12}$ is same as the electron-donating group as described as the substituent at the time $RED_{11}$ represents an aryl group. $ED_{12}$ preferably represents a hydroxyl group, an alkoxy group, a mercapto group, a sulfonamide group, an alkylamino group, an arylamino group, an active methine group, a 5-membered, monocyclic or condensed-ring-type, electron-excessive aromatic heterocyclic group having a nitrogen atom in a ring, a non-aromatic nitrogen-containing heterocyclic group substituted by a nitrogen atom, or a phenyl group substituted by any one of these electron-donating groups, and more preferably represents a hydroxyl group, a mercapto group, a sulfonamide group, an alkylamino group, an arylamino group, an active methine group, a non-aromatic nitrogen-containing heterocyclic group substituted by a nitrogen atom, or a phenyl group substituted by any one of these electron-donating groups (for example, a p-hydroxyphenyl group, a p-dialkylaminophenyl group, or an o,p-dialkoxyphenyl group).

In the formula (B), $R_{121}$ and $RED_{12}$, $R_{122}$ and $R_{121}$, or $ED_{12}$ and $RED_{12}$ may, in each combination, be combined with each other to form a ring structure. The term "ring structure" formed on this occasion denotes a non-aromatic carbocyclic or heterocyclic, 5- to 7-membered, monocyclic or condensed-ring-type, substituted or non-substituted ring structure. When $R_{121}$ and $RED_{12}$ forms a ring structure, specific examples of such ring structures include not only examples of those formed by $R_{111}$ in the formula (A), but also a pyrroline ring, an imidazoline ring, a thiazoline ring, a pyrazoline ring, an oxazoline ring, an indane ring, a morpholine ring, an indoline ring, a tetrahydro-1,4-oxazine ring, a 2,3-dihydrobenzo-1,4-oxazine ring, a tetrahydro-1,4-thiazine ring, a 2,3-dihydrobenzo-1,4-thiazinering, a 2,3-dihydrobenzofuran ring, and a 2,3-dihydrobenzothiophene ring. When $ED_{12}$ and $RED_{12}$ forms a ring structure therebetween, $ED_{12}$ preferably represents an amino group, an alkylamino group, or arylamino group. Specific examples of such ring structures to be formed include a tetrahydropyrazine ring, a piperazine ring, a tetrahydroquinoxaline ring, and a tetrahydroisoquinoline ring. When $R_{122}$ and $R_{121}$ forms a ring structure with each other, specific examples of such ring structures include a cyclohexane ring and a cyclopentane ring.

Next, the formulas (i) to (iii) will be described.

In the formulas (i) to (iii), meanings of $R_1$, $R_2$, $R_{11}$, $R_{12}$, and $R_{31}$ are each same as that of $R_{112}$ in the formula (A) and respective preferable ranges thereof are each also same as that of $R_{112}$. $L_1$, $L_{21}$, and $L_{31}$ each represent same dissociating group as that illustrated in $L_{11}$ in the formula (A) and the preferable ranges thereof are each also same as that of $L_{11}$. Substituents represented by $X_1$, and $X_{21}$ are each same as that illustrated in $RED_{11}$ in the formula (A) at the time it has a substituent and respective preferable ranges thereof are each also same as that of $RED_{11}$. $m_1$, and $m_{21}$ are each preferably an interger of 0 to 2, and more preferably an integer of 0 or 1.

When $R_{N1}$, $R_{N21}$, and $R_{N31}$ each represent a substituent, such substituents are preferably an alkyl group, an aryl group, and a heterocyclic group, and the substituents may each further have a given substituent. $R_{N1}$, $R_{N21}$, and $R_{N31}$ are each preferably a hydrogen atom, an alkyl group or an aryl group, and more preferably a hydrogen atom or an alkyl group.

When $R_{13}$, $R_{14}$, $R_{33}$, $R_a$, and $R_b$ each represent a substituent, preferable examples of such substituents include an alkyl group, an aryl group, an acyl group, an alkoxycarbonyl group, a carbamoyl group, a cyano group, an alkoxy group, an acylamino group, a sulfonamide group, a ureido group, a thioureido group, an alkylthio group, an arylthio group, an alkylsulfonyl group, an arylsulfonyl group, and a sulfamoyl group.

In the formula (i), a 6-membered ring formed by $Z_1$ is a non-aromatic heterocycle condensed with a benzene ring and, specifically, as ring structures together with a benzene ring to be condensed, mentioned are a tetrahydroquinoline ring, a tetrahydroquinoxaline ring, and tetrahydroquinazoline ring, in which a tetrahydroquinoline ring, and a tetrahydroquinoxaline ring are preferable. These rings may each have a substituent.

In the formula (ii), $ED_{21}$ is a group having a same meaning as that of $ED_{12}$ and a preferable range thereof is also same as that of $ED_{12}$.

In the formula (ii), any two of $R_{N21}$, $R_{13}$, $R_{14}$, $X_{21}$ and $ED_{21}$ may be combined with each other to form a ring structure. When $R_{N21}$ and $X_{21}$, as an example thereamong, are combined to form a ring structure, the ring structure is preferably a 5- to 7-membered non-aromatic carbocycle or heterocycle; specific examples of such ring structures include a tetrahydroquinoline ring, a tetrahydroquinoxaline ring, an indoline ring, and a 2,3-dihydro-5,6-benzo-1,4-thiazine ring. Thereamong, preferable are a tetrahydroquinoline ring, a tetrahydroquinoxaline ring, and an indoline ring.

In the formula (iii), when $R_{N31}$ represents a group except an aryl group, $R_a$ and $R_b$ are combined with each other to form an aromatic ring. The term "aromatic ring" as used in the above description is intended to include an aryl group (for example, a phenyl group, or a naphthyl group) or an aromatic heterocyclic group (for example, a pyridine ring group, a pyrrole ring group, a quinoline ring group, or an indole ring group), in which an aryl group is preferable. The aromatic ring group may have a given substituent.

In the formula (iii), it is a preferable case in which $R_a$ an $R_b$ are combined with each other to form an aromatic ring (particularly a phenyl group).

In the formula (iii), $R_{32}$ preferably represents a hydrogen atom, an alkyl group, an aryl group, a hydroxyl group, an alkoxy group, a mercapto group, or an amino group. When $R_{32}$ represents a hydroxyl group, it is a preferable case in which $R_{33}$ simultaneously represents an "electron-attracting group". The term "electron-attracting group" as used in the above description is same as in the previous description; examples of preferable electron-attracting groups include an acyl group, an alkoxycarbonyl group, a carbamoyl group, and a cyano group.

Next, compound type 2 will be described.

The term "bond-cleavage reaction" as used in the compound type 2 is intended to include a cleavage of a bond between elements in each combination of carbon-carbon, carbon-silicon, carbon-hydrogen, carbon-boron, carbon-tin, and carbon-germanium and, further, a cleavage of a carbon-hydrogen bond may follow any of these cleavages.

The compound type 2 has 2 or more (preferably 2 to 6, and more preferably 2 to 4) adsorptive groups to silver halide in a molecule. The compound type 2 is preferably a compound which has, as an adsorptive group, a nitrogen-containing heterocyclic group substituted with 2 or more mercapto groups. A number of such adsorptive groups is preferably 2 to 6, and more preferably 2 to 4. The adsorptive group will be described in detail below.

Preferable compound of the compound type 2 is represented by the following formula (C):

Formula (C)

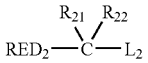

The compound represented by the formula (C) denotes a compound which, after a reducing group represented by $RED_2$ is one-electron-oxidized and the thus-oxidized reducing group spontaneously dissociates $L_2$ by the bond-cleavage reaction, can further release another electron following such dissociation.

$RED_2$ in the formula (C) denotes a group having a same meaning as that of $RED_{12}$ and a preferable range of $RED_2$ is also same as that of $RED_{12}$. $L_2$ denotes a group having a same meaning as that in the above description of $L_{11}$ in the formula (A) and a preferable range of $L_2$ is also same as that of $L_{11}$. When $L_2$ represents a silyl group, the compound, namely, the silyl group, refers to a compound which has, as reducing group, a nitrogen-containing heterocyclic group substituted by 2 or more mercapto groups in a molecule. $R_{21}$ and $R_{22}$ each individually represent a hydrogen atom or a substituent and denote a group having same meaning and preferable range as those of $R_{112}$ in the formula (A), respectively. $RED_2$ and $R_{21}$ may be combined with each other to form a ring structure.

The ring structure to be formed on the above occasion denote a 5- to 7-membered, monocyclic or condensed-ring-type, non-aromatic carbocycle or heterocycle which may have a substituent. However, the ring structure is by no means a ring structure corresponding to a tetrahydro form, a hexahydro form or an octahydro form of an aromatic ring or an aromatic heterocycle. The ring structure is preferably a ring structure corresponding to a dihydro form of an aromatic ring or an aromatic heterocycle. Examples of such ring structures include a 2-pyrroline ring, a 2-imidazoline ring, a 2-thiazoline ring, a 1,2-dihydropyridine ring, a 1,4-dihydropyridine ring, an indoline ring, a benzimadazoline ring, a benzothiazoline ring, a benzoxazoline ring, a 2,3-dihydobenzothiophene ring, a 2,3-dihydrobenzofuran ring, a benzo-α-pyran ring, a 1,2-dihydroquinoline ring, a 1,2-dihydroquinazoline ring, and a 1,2-dihydroquinoxaline ring, in which a 2-imidazoline ring, a 2-thiazoline ring, an indoline ring, a benzimadazoline ring, a benzothiazoline ring, a benzoxazoline ring, a 1,2-dihydropyridine ring, a 1,2-dihydroquinoline ring, a 1,2-dihydroquinazoline ring and a 1,2-dihydroquinoxaline ring are preferable; and an indoline ring, a benzimadazoline ring, a benzothiazoline ring, a 1,2-dihydroquinoline ring are more preferable and an indoline ring is particularly preferable.

Next, compound type 3 will be described.

The term "bond-forming step" as used in the compound type 3 is intended to denote a step of forming a bond between atoms in, for example, combinations of carbon-carbon, carbon-nitrogen, carbon-sulfur, and carbon-oxygen.

The compound type 3 is preferably a compound characterized in that a one-electron-oxidized form generated by oxidizing one electron therein is allowed to subsequently react with a reactive group site (a non-aromatic heterocyclic group site of a carbon-carbon double bond site, a carbon-carbon triple bond site, an aromatic group site, or a benzo-condensed-ring site) which is simultaneously present in a molecule to form a bond and, then, can release further one or more electrons.

In more detail, the compound type 3 has a characteristic that a one-electron-oxidized form generated by oxidizing one electron therein (a cationic radical species, or a neutral radical species generated by dissociating one proton therefrom) is allowed to react with the above-described reactive group which is simultaneously present in a same molecule to form a bond and, then, newly generates a radical species having a ring structure and, thereafter, following a direct or indirect dissociation of the proton from the radical species, a second electron is released therefrom.

Further, there is a case in which the two-electron oxidized form of the compound type 3, after being subjected to a hydrolysis reaction in one case or performing a tautomerization reaction directly accompanied by a transfer of a proton in another case, releases further one or more electrons, ordinarily two or more electrons. There is also another case in which the compound type 3 has capability of directly releasing further one or more electrons, ordinarily two or more electrons, from the two-electron-oxidized form thereof without passing through the tautomerization reaction.

The compound type 3 is preferably represented by the following formula (D):

$$RED_3\text{-}L_3\text{-}Y_3 \qquad \text{Formula (D)}$$

In the formula (D), $RED_3$ represents a reducing group in which one electron can be oxidized; $Y_3$ represents a reactive group site which is reactive after one electron of $RED_3$ is oxidized and specifically represents an organic group having a carbon-carbon double bond site, a carbon-carbon triple bond site, an aromatic group site, or a benzo-condensed-ring, non-aromatic heterocyclic group site; and $L_3$ represents a linking group which links $RED_3$ and $Y_3$.

$RED_3$ in the formula (D) represents a group having a same meaning as that of $RED_{12}$ in the formula (B) and preferably represents an arylamino group, a heterocyclic amino group, an aryloxy group, an arylthio group, an aryl group, or an aromatic or non-aromatic heterocyclic group (particularly preferably a nitrogen-containing heterocyclic group), and more preferably an arylamino group, a heterocyclic amino group, an aryl group, or an aromatic or non-aromatic heterocyclic group; examples of preferable heterocyclic groups include a tetrahydroquinoline ring group, a tetrahydroquinoxaline ring group, a tetrahydroquinazoline ring group, an indoline ring group, an indole ring group, a carbazole ring group, a phenoxazine ring group, phenothiazine ring group, a benzothiazoline ring group, a pyrrole ring group, an indazole ring group, a thiazole ring group, a benzimidazole ring group, a benzimidazoline ring group, a benzothiazoline ring group, and a 3,4-methylenedioxyphenyl-1-yl group.

Particularly preferable examples of $RED_3$ include an arylamino group (particularly an anilino group), an aryl group (particularly a phenyl group), and an aromatic or non-aromatic heterocyclic group.

When $RED_3$ represents an aryl group, the aryl group preferably has at least one "electron-donating group". The "electron-donating group" in the above description has a same meaning as that as previously described.

When $RED_3$ represents an aryl group, the aryl group may have a substituent; examples of such substituents include an alkylamino group, a hydroxyl group, an alkoxy group, a mercapto group, a sulfonamide group, an active methine group, and a non-aromatic nitrogen-containing heterocyclic group substituted by a nitrogen atom, more preferable examples thereof include an alkylamino group, a hydroxyl group, an active methine group, and a non-aromatic nitrogen-containing heterocyclic group substituted by a nitrogen atom, and most preferable examples thereof include an alkylamino group and a non-aromatic nitrogen-containing heterocyclic group substituted by a nitrogen atom.

When an organic group having a carbon-carbon double bond site respected by $Y_3$ (for example, a vinyl group) has a substituent, examples of preferable substituents include an alkyl group, a phenyl group, an acyl group, a cyano group, an alkoxycarbonyl group, a carbamoyl group and an electron-donating group; examples of such electron-donating groups include an alkoxy group, a hydroxyl group (also permissible as a form protected by a silyl group such as a trimethylsilyloxy group, a t-butyldimethylsilyloxy group, a triphenylsilyloxy group, a triethylsilyloxy group, or a phenyldimethylsilyloxy group), an amino group, an alkylamino group, an arylamino group, a sulfonamide group, an active methine group, a mercapto group, an alkylthio group, and a phenyl group having any one of these electron-donating group as a substituent.

When the organic group having the carbon-carbon double bond site has a hydroxyl group as a substituent, $Y_3$ comes to have a partial structure, namely $>C_1{=}C_2(-OH)-$. This partial structure may be tautomerized to be another partial structure, namely $>C_1H-C_2(=O)-$. Further, at this time, a case in which a substituent that is substituted to a $C_1$ carbon is an electron-attracting group is also preferable and, as being the case, $Y_3$ comes to have an "active methylene group" or a partial structure of the "active methine group". The electron-attracting group which can give the active methylene group or the partial structure of the methine group is same as that in the previous description of the active methine group.

When an organic group (for example, an ethynyl group) having a carbon-carbon triple bond site represented by $Y_3$ has a substituent, preferable examples of such substituents include an alkyl group, a phenyl group, an alkoxycarbonyl group, a carbamoyl group and an electron-donating group.

When $Y_3$ represents an organic group having an aromatic group site, an aromatic group is preferably an aryl group (particularly a phenyl group) having an electron-donating group as a substituent or an indole ring group; examples of preferable electron-donating groups include a hydroxyl group (permissible as a form protected by a silyl group), an alkoxy group, an amino group, an alkylamino group, an active methine group, a sulfonamide group, and a mercaptan group.

When $Y_3$ represents an organic group having a benzo-condensed-ring-type non-aromatic heterocyclic group site, a benzo-condensed-ring-type non-aromatic heterocyclic group is preferably that having an aniline structure therein as a partial structure; examples of such benzo-condensed-ring-type non-aromatic heterocyclic groups include an indoline ring group, a 1,2,3,4-tetrahydroquinoline ring group, a 1,2,3,4-tetrahydroquinoxaline ring group, and a 4-quinolone ring group.

The reactive group represented by $Y_3$ is more preferably an organic group having a carbon-carbon double bond site, an aromatic group site, or a benzo-condensed-ring-type non-aromatic heterocyclic group, and still more preferably a phenyl group having a carbon-carbon double bond site, or an electron-donating group as a substituent, an indole group, or a benzo-condensed-ring-type, non-aromatic heterocyclic group inherently having an aniline structure as a partial structure. It is further still more preferable that the carbon-carbon double bond site has at least one electron-donating group as a substituent.

A case in which the reactive group represented by $Y_3$, as a result of being selected from within a range so far described, has a same partial structure as that of the reducing group respected by $RED_3$ is also a preferable example of the compound represented by the formula (D).

$L_3$ represents a linking group which links $RED_3$ and $Y_3$ with each other, and specifically represents a single bond, an alkylene group, an arylene group, an heterocyclic group, an —O— group, an —S— group, an $-NR_N-$ group, a —C(=O)— group, an $-SO_2-$ group, an —SO— group, a —P(=O) group, or any combinations thereof, in which $R_N$ represents a hydrogen atom, an alkyl group, an aryl group, or a heterocyclic group. The linking group represented by $L_3$ may have a given substituent. Further, the linking group represented by $L_3$ can be linked by substituting one given hydrogen of each of $RED_3$ and $Y_3$ at given positions of the groups represented by $RED_3$ and $Y_3$, respectively.

As examples of preferable $L_3$, mentioned are divalent linking groups including a single bond, an alkylene group (particularly a methylene group, an ethylene group, a propylene group), an arylene group (particularly a phenylene group), a —C(=O)— group, an —O— group, an —NH— group, an —N(alkyl)— group, and any combinations thereof.

In regard to a group represented by $L_3$, when a cationic radical species ($X^{+}$.) or a radical species (X.) which is generated by dissociating a proton therefrom, and a reactive group represented by $Y_3$ are allowed to react with each other to form a bond, it is preferable that a group of atoms related with such reaction and bond-formation forms a 3- to 7-membered ring structure together with $L_3$. For this end, it is preferable that the radical species ($X^{+}$. or X.), the reactive group represented by Y, and $L_3$ are all linked with one another to form a group of 3 to 7 atoms.

Next, compound type 4 will be described.

The compound type 4 denotes a compound having a ring structure substituted by a reducing group, and particularly denotes a compound which, after the reducing group is one-electron-oxidized, following a cleavage reaction of a ring structure, can further release one or more electrons. The term "cleavage reaction of the ring structure" as used in the above description is represented by the following reaction scheme:

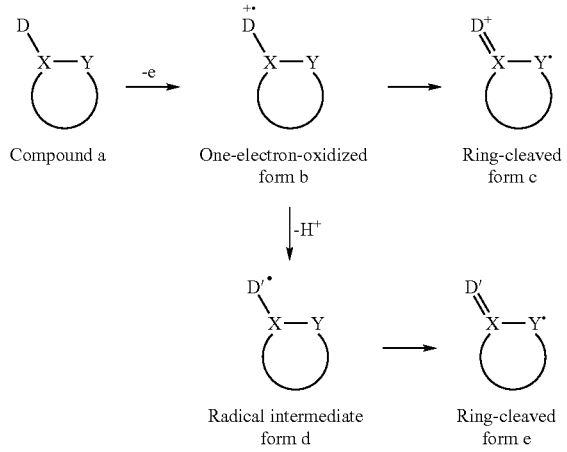

In the reaction scheme, the compound a denotes a compound type 4. In the compound a, D represents a reducing group; and X, and Y represent respective atoms which form a bond which is cleaved after one electron is oxidized. First, the compound a is one-electron-oxidized to form a one-electron-oxidized form b and, then, a single bond of D-X in the thus-formed one-electron-oxidized form b is converted to a double bond and, at the same time, a bond of X—Y is cleaved to form a ring-cleaved form c. In another case in which the reaction passes through a path in which a radical intermediate d is generated by dissociating a proton from the thus-generated one-electron-oxidized form b and, then, a ring-cleaved form e is generated from the thus-generated radical intermediate d in a same manner as in the ring-cleaved form c. These compounds have characteristics in that one or more electrons are subsequently further released therefrom.

The ring structure which the compound type 4 has denotes a 3- to 7-membered ring of a carbocycle or heterocycle and, particularly, denotes a monocyclic or condensed-ring-type, saturated or unsaturated non-aromatic ring. It is preferably a saturated ring structure, and more preferably a 3- or 4-membered ring structure. Examples of preferable ring structures include a cyclopropane ring, a cyclobutane ring, an oxirane ring, an oxetane ring, an aziridine ring, an azetidine ring, an episulfide ring, and a thietane ring, in which a cyclopropane ring, a cyclobutane ring, an oxirane ring, an oxetane ring, and an azetidine ring are more preferable and a cyclopropane ring, a cyclobutane ring, and an azetidine ring are particularly preferable. These ring structures may each individually have a given substituent.

The compound type 4 is preferably represented by the following formula (E) or (F):

Formula (E)

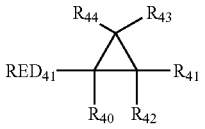

Formula (F)

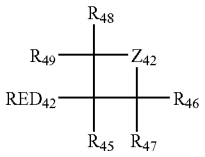

In the formulas (E) and (F), $RED_{41}$ and $RED_{42}$ each have a same meaning as that of $RED_{12}$ in the formula (B) and a preferable range of each of $RED_{41}$ and $RED_{42}$ is same as that of $RED_{12}$. $R_{40}$ to $R_{44}$, and $R_{45}$ to $R_{49}$ each represent a hydrogen atom or a substituent. In the formula (F), $Z_{42}$ represents a —$CR_{420}R_{421}$— group, an —$NR_{423}$— group, or an —O— group, in which $R_{420}$ and $R_{421}$ each represent a hydrogen atom or a substituent; and $R_{423}$ represents a hydrogen atom, an alkyl group, an aryl group or a heterocyclic group.

In the formulas (E) and (F), $R_{40}$ and $R_{45}$ each represent preferably a hydrogen atom, an alkyl group, an aryl group or a heterocyclic group, and more preferably a hydrogen atom, an alkyl group or an aryl group. $R_{41}$ to $R_{44}$, and $R_{46}$ to $R_{49}$ each represent preferably a hydrogen atom, an alkyl group, an alkenyl group, an aryl group, a heterocyclic group, an arylthio group, an alkylthio group, an acylamino group or a sulfonamide group, and more preferably a hydrogen atom, an alkyl group, an aryl group or a heterocyclic group.

Preferable is a case in which at least one of $R_{41}$ to $R_{44}$ is a donor-type group, or both of $R_{43}$ and $R_{44}$ are electron-attractive groups. More preferable is a case in which at least one of $R_{41}$ to $R_{44}$ is a donor-type group. Still more preferable is a case in which not only at least one of $R_{41}$ to $R_{44}$ is a donor-type group, but also any one group which is not a donor type among $R_{41}$ to $R_{44}$ is a hydrogen atom or an alkyl group.

The term "donor-type group" as used in the above description refers to an "electron-donating group, or an aryl group substituted by at least one "electron-donating group". As such donor-type groups, preferably used are an alkylamino group, an arylamino group, a heteroamino group, a 5-membered moncyclic or condensed-ring-type, electron-excessive aromatic heterocyclic group having at least one nitrogen atom in a cycle, a non-aromatic nitrogen-containing heterocyclic group substituted by a nitrogen atom, and a phenyl group substituted by at least one electron-donating group. More preferably used are an alkylamino group, an arylamino group, a 5-membered monocyclic or condensed-ring-type, electron-excessive aromatic heterocyclic group having a nitrogen atom in a cycle (for example, an indole ring, a pyrrole ring, or a carbazole ring), a phenyl group substituted by an electron-donating group (for example, a phenyl group substituted by 3 or more alkoxy groups, a phenyl group substituted by a hydroxyl group, an alkylamino group, or an arylamino group). Particularly preferably used are an arylamino group, a 5-membered monocyclic or condensed-ring-type, electron-excessive, aromatic heterocyclic group having at least one of an arylamino group and a nitrogen atom in a ring (particularly a 3-indoline group), a phenyl group substituted by an electron-donating group (particularly a trialkoxyphenyl group, or a phenyl group substituted by an alkylamino group or an arylamino group).

$Z_{42}$ represents preferably a —$CR_{420}R_{421}$ group, or an —$NR_{423}$— group, and more preferably an —$NR_{423}$— group. $R_{420}$, and $R_{421}$ each preferably represent a hydrogen group, an alkyl group, an aryl group, a heterocyclic group, an acylamino group and a sulfonamino group, and more preferably a hydrogen atom, an alkyl group, an aryl group and a heterocyclic group. $R_{423}$ represents preferably a hydrogen atom, an alkyl group, an aryl group and an aromatic heterocyclic group, and more preferably a hydrogen atom, an alkyl group and an aryl group.

When $R_{40}$ to $R_{49}$, $R_{420}$, $R_{421}$, and $R_{423}$ each represent a substituent, the substituent is preferably a substituent having 40 or less carbon atoms in total, and more preferably a substituent having 30 or less carbon atoms in total, and particularly preferably a substituent having 15 or less carbon atoms in total. Further, these substituents may be combined with one another, or with another site ($RED_{41}$, $RED_{42}$ or $Z_{42}$) in a molecule to form a ring.

The term "adsorptive group to silver halide" as used in the description of compound types 1 to 4 according to the invention refers to a group which is directly adsorbed to a silver halide or accelerates such adsorption to a silver halide and, specifically, refers to a mercapto group (or a salt thereof), a thione group (—C(=S)—), a heterocyclic group having at least one atom selected from the group consisting of: a nitrogen atom, a sulfur atom, a selenium atom and a tellurium atom, a sulfide group, a cationic group, or an ethynyl group. However, a sulfide group is not contained as an adsorptive group in the compound type 2 according to the invention.

The mercapto group (or a salt thereof) as the adsorptive group not only means the mercapto group itself, but also preferably refers to any one of a heterocyclic group, an aryl group and an alkyl group which have been substituted by at least one mercapto group (or a salt thereof). The above-described heterocyclic group refers to a 5- to 7-membered, monocyclic or condensed-ring-type aromatic or non-aromatic heterocyclic group. Examples of such heterocyclic groups include an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, and a triazine ring group. Further, the heterocyclic group may be a heterocyclic group having a quaternized nitrogen atom; on this occasion, a substituted mercapto group may be dissociated to be a mesoion. Examples of such heterocyclic groups include an imidazolium ring group, a pyrazolium ring group, a thiazolium ring group, a tirazolium ring group, a tetrazolium ring group, a thiadiazolium ring group, a pyridinium ring group, a pyrimidinium ring group, and a triazinium ring group. Thereamong, preferable is a triazolium ring group (for example, a 1,2,4-triazolium-3-thiolate ring group). As the aryl group, mentioned is a phenyl group or a naphthyl group. As the alkyl group, mentioned is a straight, branched, or cyclic alkyl group having from 1 to 30 carbon atoms. When the mercapto group forms a salt, examples of counter ions include a cation ($Li^+$, $Na^+$, $K^+$, $Mg^{2+}$, $Ag^+$, $Zn^{2+}$ or the like) of an alkaline metal, an alkaline earth metal, a heavy metal or the like, an ammonium ion, a heterocyclic group having a quaternized nitrogen atom, and a phosphonium ion.

The mercapto group as an adsorptive group may further be tautomerized to be a thione group. Specifically mentioned are a thioamide group (a —C(═S)—NH— group on this occasion), and a group which has a partial structure of the thioamido group, namely, a chained or cyclic thiamide group, a thioamido group, a thiourethane group, or a dithiocarbamic ester group. Examples of such cyclic groups include a thiazolidine-2-thione group, anoxazolidine-2-thione group, a 2-thiohydantoin group, a rhodanine group, an isorhodanine group, a thiobarbituric acid group, and a 2-thioxo-oxazolidin-4-one group.

The thione groups as the adsorptive group include not only a thione group generated by tautomerizing the above-described mercapto group, but also a chained or cyclic thioamide group, thioureido group, thiourethane group or dithiocarbamic acid ester group which can not be tautomerized to the mercapto group (having no hydrogen atom at an α-position of the thione group).

The heterocyclic group having at least one atom selected from the group consisting of: a nitrogen atom, a sulfur atom, a selenium atom and a tellurium atom as an adsorptive group denotes a nitrogen-containing heterocyclic group having an —NH— group which can form an imino silver (>NAg) as a partial structure of the heterocycle, or a heterocyclic group, having an —S— group, an —Se— group, a —Te— group, or an ═N— group as a partial structure of a heterocycle, which can be bonded to a silver ion by a coordinate bond; examples of the former include a benzotriazole group, a triazole group, an indazole group, a pyrazole group, a tetrazole group, a benzimidazole group, an imidazole group, and a purine group; examples of the latter include a thiophene group, a thiazole group, an oxazole group, a benzothiazole group, a benzoxazole group, a thiadiazole group, an oxadiazole group, a triazine group, a selenazole group, a benzoselenazole group, a tellurazole group, and a benzotellurazole group. The former is preferable.

The sulfide group as an adsorptive group denotes all of groups which each have an —S— group as a partial structure and preferably a groups having a partial structure of alkyl (or alkylene)-S-alkyl (or alkylene), aryl (or arylene)-S-alkyl (or alkylene), or aryl (or arylene)-S-aryl (or arylene). Further, the sulfide group may form a ring structure, or be in a form of an —S—S— group. When the cyclic structure is formed, specifically mentioned is a group containing, for example, a thiolane ring, a 1,3-dithiolane ring or a 1,2-dithiolane ring, a thiane ring, a dithiane ring, or a tetrahydro-1,4-thiazine ring (thiomorpholine ring). The sulfide group is particularly preferably a group having a partial structure of alkyl-(or alkylene)-S-alkyl (or alkylene).

The cationic group as an adsorptive group means a group having a quaternized nitrogen atom and, specifically, refers to a group containing an ammonio group or a nitrogen-containing heterocyclic group having a quaternized nitrogen atom. However, the cationic group does not become a part of an atomic group forming a dye structure (for example, a cyanine chromophore). The ammonio group refers to a trialkylammonio group, a dialkylarylammonio group, an alkyldiarylammonio group or the like; examples of such ammonio groups include a benzyldimethylammonio group, a trihexylammonio group, and a phenyldiethylammonio group. As for the nitrogen-containing heterocyclic group having a quaternized nitrogen atom, mentioned are, for example, a pyridinio group, a quinolinio group, an isoquinolinio group, and an imidazolio group, in which a pyridinio group and an imidazolio group are preferable and a pyridinio group is particularly preferable. Any one of these nitrogen-containing heterocyclic groups each having a quaternized nitrogen atom may have a given substituent. However, when it refers to a pyridinio group or an imidazolio group, the substituent is preferably an alkyl group, an aryl group, an acylamino group, a chlorine atom, an alkoxycarbonyl group, or a carbamoyl group. When it refers to a pyridinio group, the substituent is particularly preferably a phenyl group.

The ethynyl group as an adsorptive group means a —C≡CH group in which a hydrogen atom may be substituted.

The above-described adsorptive groups may each has a given substituent.

Specific examples of the adsorptive groups further include those as described in JP-A No. 11-95355, pp. 4 to 7.

The adsorptive group according to the invention is preferably a mercapto-substituted nitrogen-containing heterocyclic group (for example, a 2-mercaptothiadiazole group, a 3-mercapto-1,2,4-triazole group, a 5-mercaptotetrazolegroup, a2-mercapto-1,3,4-oxadiazolegroup, a 2-mercaptobenzoxazole group, a 2-mercaptobenzthiazole group, 1,5-dimethyl-1,2,4-triazolium-3-thiolate group), or a nitrogen-containing heterocyclic group having an —NH— group which can form an imino silver (>NAg) as a partial structure of a heterocycle (for example, a benzotriazole group, a benzimidazole group, or an indazole group), particularly preferably a 5-mercaptotetrazole group, a 3-mercapto-1,2,4-triazole group, or a benzotriazole group, and most preferably a 3-mercapto-1,2,4-triazole group, or a 5-mercaptotetrazole group.

Among these compounds, a compound having two or more mercapto groups in a molecule as a partial structure is also preferable. The mercapto group (—SH) in the above-description may be tautomerized, if possible, to be a thione group. As for examples of such compounds, permissible is a compound which has two or more adsorptive groups (for example, ring-forming thioamide group, an alkylmercapto group, an arylmercapto group, and a heterocyclic mercapto group) having the above-described mercapto group or a thione group as a partial structure in a molecule, or a compound which has one or more adsorptive groups (for example, a dimercapto-substituted nitrogen-containing heterocyclic group) having two or more mercapto groups or thione groups as a partial structure in a molecule.

Examples of the adsorptive groups (for example, dimercapto-substituted nitrogen-containing heterocyclic group) each having two or more mercapto groups as a partial structure include a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, a 2,7-dimercapto-5-methyl-s-triazolo(1,5-A)-pyrimidine, 2,6,8-trimercaptopurine, a 6,8-dimercaptopurine, a 3,5,7-trimercapto-s-triazolotriazine, 4,6-dimercaptopyrazolopyrimidine, 2,5-dimercaptoimidazolein which a 2,4-dimercaptopyrimidine group, a 2,4-dimercaptotriazine group, and a 3,5-dimercapto-1,2,4-triazole group are particularly preferable.

The adsorptive group may be substituted at any site of the formulas (A) to (F), and (1) to (3). However, the adsorptive group is preferably substituted at $RED_{11}$, $RED_{12}$, $RED_2$, and $RED_3$ in the formulas (A) to (D), $RED_{41}$, $R_{41}$, $RED_{42}$, and $R_{46}$ to $R_{48}$ in the formulas (E) and (F), and any given site except $R_1$, $R_2$, $R_{11}$, $R_{12}$, $R_{31}$, $L_1$, $L_{21}$, and $L_{31}$ in the formulas (1) to (3), and more preferably at $RED_{11}$ to $RED_{42}$ in all of the formulas (A) to (F).

The partial structure of the spectral sensitizing dye is a group having a chromophore of the spectral sensitizing dye and, also, is a residue generated by removing a given hydrogen or substituent from a spectral sensitizing dye compound. The partial structure of the spectral sensitizing dye may be substituted at any site in the formulas (A) to (F) and (1) to (3). However, the partial structure is preferably substituted at $RED_{11}$, $RED_{12}$, $RED_2$, and $RED_3$ in the formulas (A) to (D), $RED_{41}$, $R_{41}$, $RED_{42}$, and $R_{46}$ to $R_{48}$ in the formulas (E) and (F), and any given site except $R_1$, $R_2$, $R_{11}$, $R_{12}$, $R_{31}$, $L_1$, $L_{21}$, and $L_{31}$ in the formulas (1) to (3), and more preferably at $RED_{11}$, to $RED_{42}$ in all of the formulas (A) to (F). Preferable spectral sensitizing dye is a spectral sensitizing dye to be typically used in a color sensitizing technique; examples of such spectral sensitizing dyes include cyanine dyes, complex cyanine dyes, merocyanine dyes, complex merocyanine dyes, homopolar cyanine dyes, styryl dyes, and hemicyanine dyes. Representative spectral sensitizing dyes are described in Research Disclosure, Item 36544, September, 1994. These dyes can be synthesized by those skilled in the art in accordance with procedures described in the Research Disclosure, or F. M. Hamer, The Cyanine dyes and Related Compounds (Interscience Publishers, New York, 1964). Further, dyes described in JP-A No. 11-95355, pp. 7 to 14, (U.S. Pat. No. 6,054,260) are all applicable to the spectral sensitizing dyes according to the invention.

The compound types 1 to 4 according to the invention each have total carbon atoms in the range of preferably from 10 to 60, more preferably from 15 to 50, still more preferably from 18 to 40, and particularly preferably from 18 to 30.

Each of the compound types 1 to 4 according to the invention is one-electron-oxidized by being triggered at exposing the silver halide photographic photosensitive material using any one of these compounds and, then, after a subsequent reaction, release one more electron, or two or more electrons depending on the types to be oxidized. An oxidation potential of a first electron is preferably approximately 1.4 V or less, and more preferably 1.0 V or less. The oxidation potential is preferably more than 0 V, more preferably more than 0.3 V. Therefore, the oxidation potential is preferably in a range from approximately 0 V to approximately 1.4 V, and more preferably from approximately 0.3 V to approximately 1.0 V.

The oxidation potential can be measured by a cyclic voltammetry technique. Specifically, a sample is dissolved in a solution having a mixing ratio of 80%:20% (by volume) of acetonitrile to water (containing 0.1 M lithium perchlorate). After a nitrogen gas is allowed to pass through the solution for 10 minutes, the resultant solution is subjected to measurements at 25° C. with a potential scanning speed of 0.1 V/second by using a glassy carbon disc as a working electrode, a platinum wire as a counter electrode, and a calomel electrode (SCE) as a reference electrode. The oxidation potential vs. SCE is taken as a peak potential of a cyclic voltammetric wave.

Each of the compound types 1 to 4 according to the invention is one-electron-oxidized and, then, after a subsequent reaction, release one more electron. An oxidation potential at this stage is preferably in a range from −0.5 V to −2 V, more preferably from −0.7 V to −2 V, and still more preferably from −0.9 V to −1.6 V.

Each of the compound types 1 to 4 according to the invention is one-electron-oxidized and, then, after a subsequent reaction, release two or more electrons to be oxidized. An oxidation potential at this subsequent stage is not particularly limited. This is due to the fact that, since the oxidation potential of the second electron and those of a third electron and thereafter are not conspicuously distinguished, there are many cases in which it is difficult to accurately measure these potentials in a separate manner.

Next, compound type 5 will be described.

The compound type 5 is represented by X—Y, in which X represents a reducing group; and Y represents a dissociating group each. The reducing group represented by X is a compound capable of being one-electron-oxidized to generate a one-electron-oxidized form and, then, following a subsequent cleavage reaction of an X—Y bond, the thus-formed one-electron-oxidized form dissociates Y therefrom to generate an X radical and, thereafter, the thus-generated X radical can release one more electron therefrom. Reactions at the time such compound type 5 as described above is oxidized can be represented by the following reaction formula:

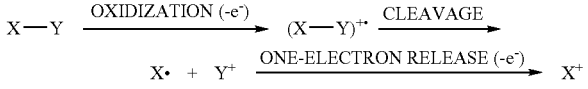

An oxidation potential of the compound type 5 is preferably in a range from 0 V to 1.4 V, and more preferably from 0.3 V to 1.0 V. An oxidation potential of a radical X-generated by the above reaction formula is preferably in a range from −0.7 V to −2.0 V, and more preferably from −0.9 V to −1.6 V.

The compound type 5 is preferably represented by the following formula (G):

Formula (G)

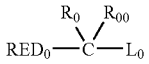

In the formula (G), $RED_0$ represents a reducing group; $L_0$ represents a dissociating group; $R_0$ and $R_{00}$ each represent a hydrogen atom or a substituent. $RED_0$ and $R_0$, and $R_0$ and $R_{00}$ may, within each combination, be combined with each other to form a ring structure. $RED_0$ has a same meaning as that of $RED_2$ in the formula (C) and a preferable range thereof is also same as that of $RED_2$. $R_0$ and $R_{00}$ have same meanings as those of $R_{21}$ and $R_{22}$ in the formula (C), respectively and preferable ranges thereof are also same as those of $R_{21}$ and $R_{22}$ in the formula (C). However, $R_0$ and $R_{00}$ do not represent a group having a same meaning as that of $L_0$ except a hydrogen atom. $RED_0$ and $R_0$ may be combined with each other to form a ring structure; examples of such ring structures include those in a case in which $RED_2$ and $R_{21}$ in the formula (C) are combined with each other to form a ring structure and preferable ranges thereof are also same as those of $RED_2$ and $R_{21}$ in the formula (C) Examples of ring structures formed by combining $R_0$ and $R_{00}$ with each other include a cyclopentane ring and a tetrahydrofuran ring. $L_0$ in the formula (G) has a same meaning as that of $L_2$ in the formula (C) and same is said with a preferable range thereof.

The compounds represented by the formula (G) each preferably have an adsorptive group to silver halide or a partial structure of a spectral sensitizing dye in a molecule. When $L_0$ represents a group except a silyl group, two or more adsorptive groups do not simultaneously exist in a molecule. However, two or more sulfide groups, without depending on $L_0$, may simultaneous be present in a molecule.

Examples of such adsorptive groups to silver halide which the compounds represented by the formula (G) may have are same as those of the reducing groups which the compound types 1 to 4 may have and, further, such examples include all of groups as described as the "adsorptive group to silver halide" in JP-A No. 11-95355, pp. 4 to 7, and same is said with the preferable range thereof.

The partial structures of the spectral sensitizing dyes which the compounds represented by the formula (G) may have are same as those of the spectral sensitizing dyes which the compound types 1 to 4 may have and, at the same time, examples of such partial structures include all of the groups described as the "light-absorptive groups" in JP-A No. 11-95355, pp. 7 to 14, and same is said with the preferable range thereof.

Specific examples of the compound types 1 to 5 according to the invention are described below; however, the invention is by no means limited thereto.

1

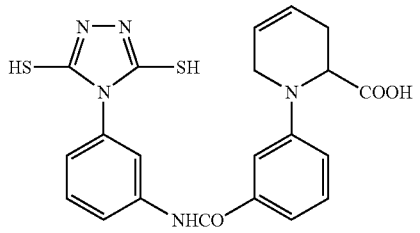

2

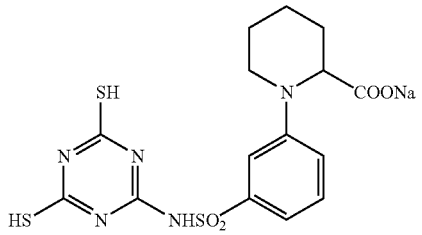

3

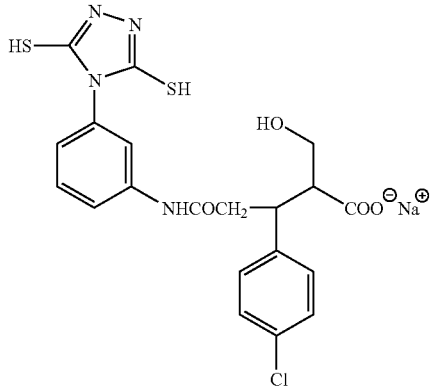

4

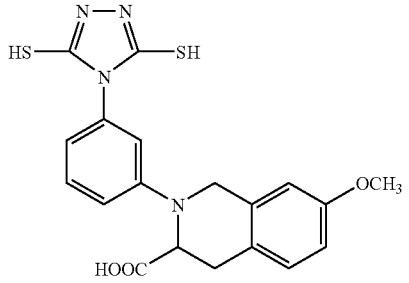

5

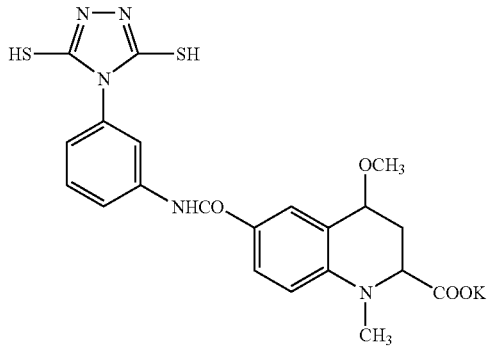

6

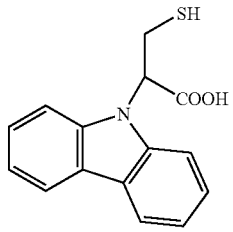

-continued
7
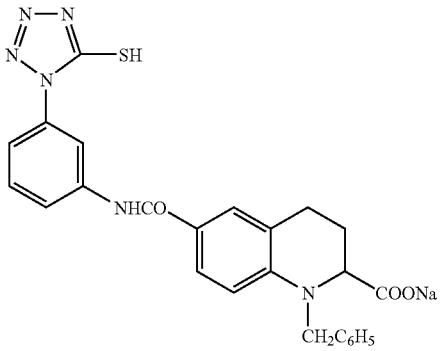
8
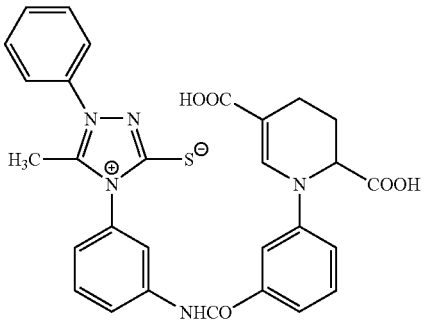
9
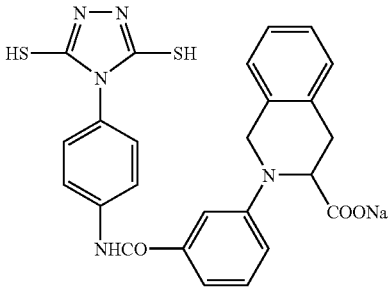
10
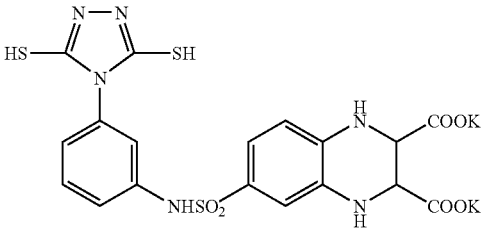
11
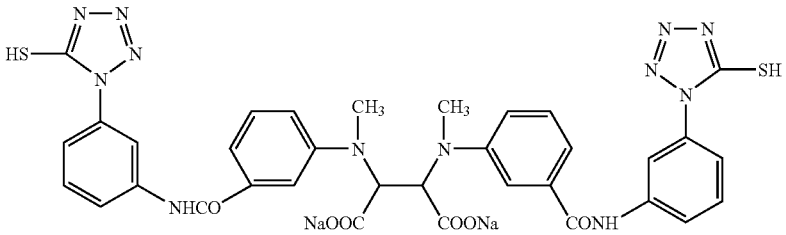
12
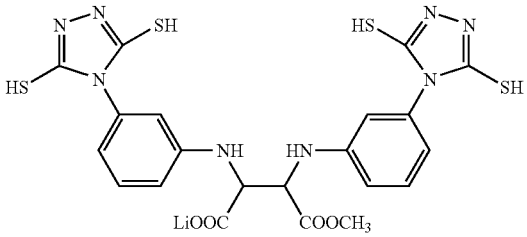
13
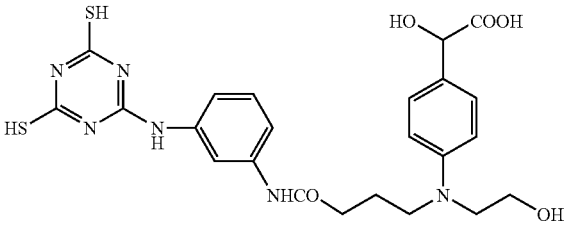
14
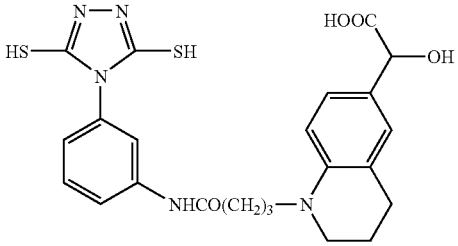
15
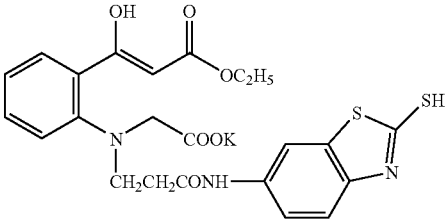

-continued
16
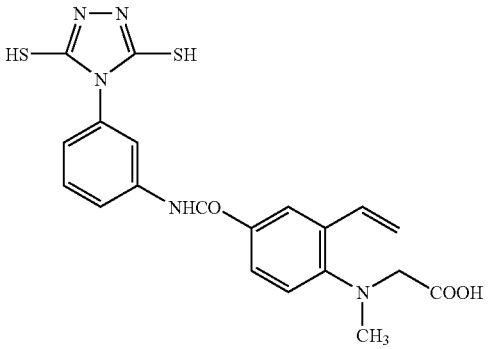
17
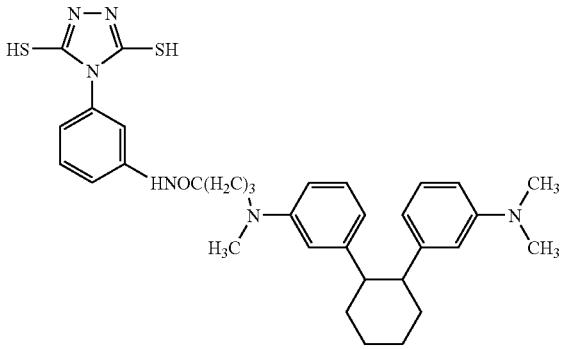
18
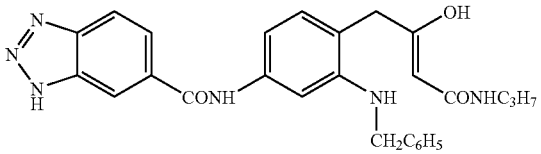
19
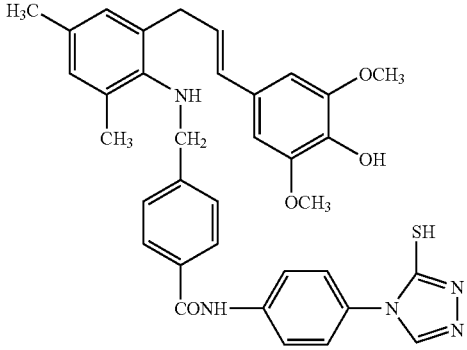
20
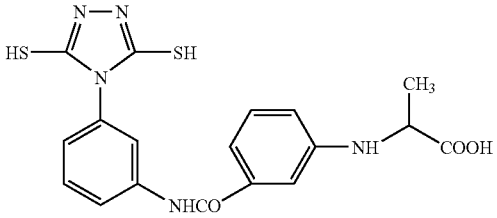
21
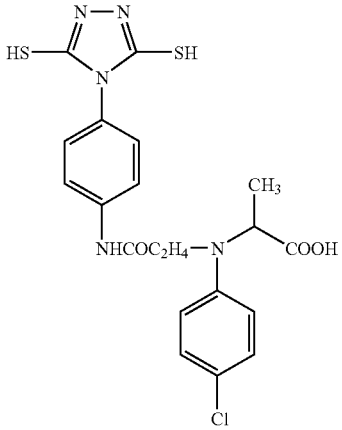
22
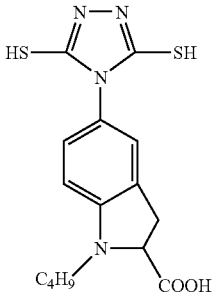
23
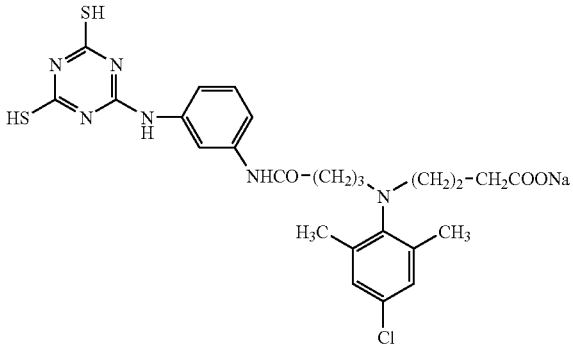

-continued
24
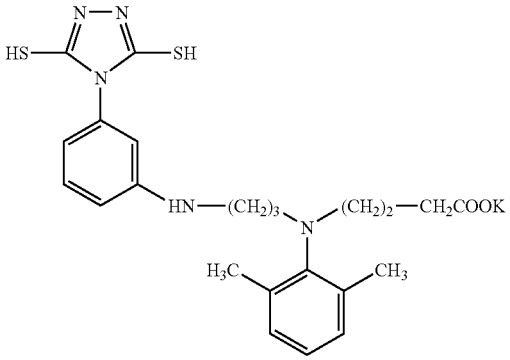
25
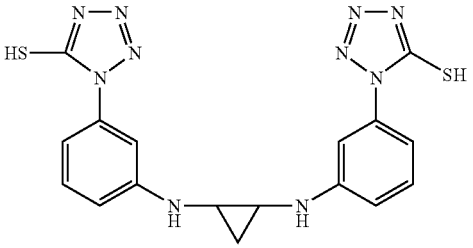
26
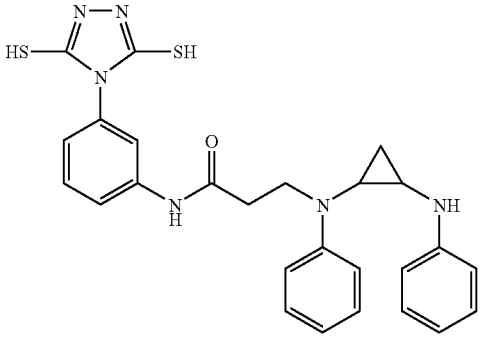
27
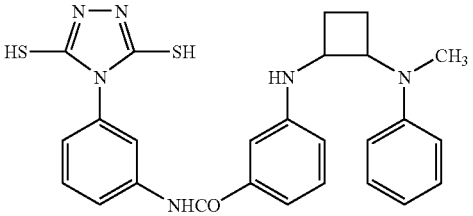
28
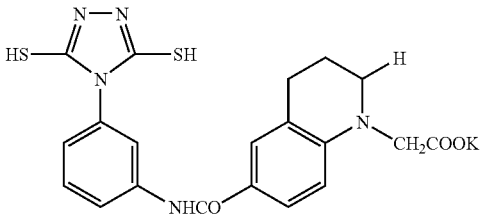
29
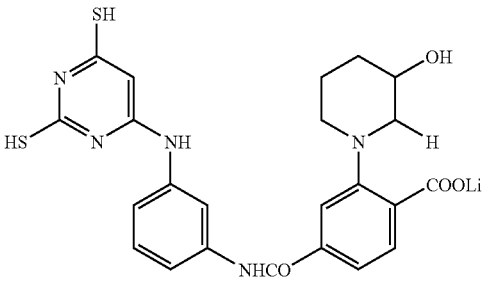
30
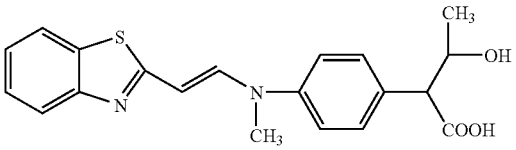
31
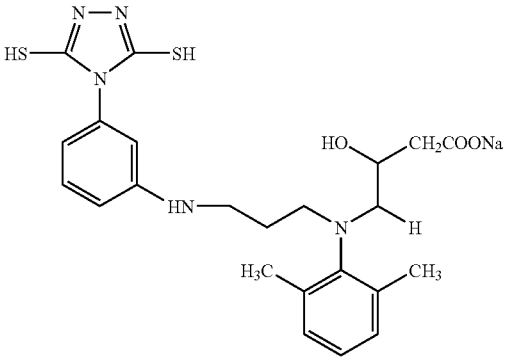

-continued
32
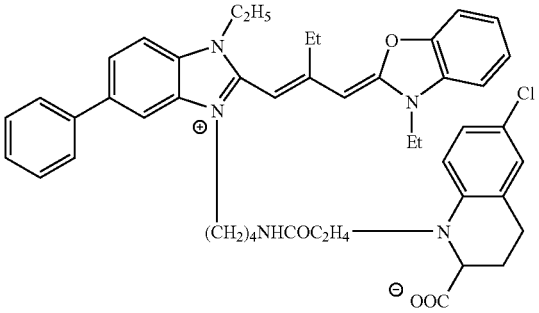
33
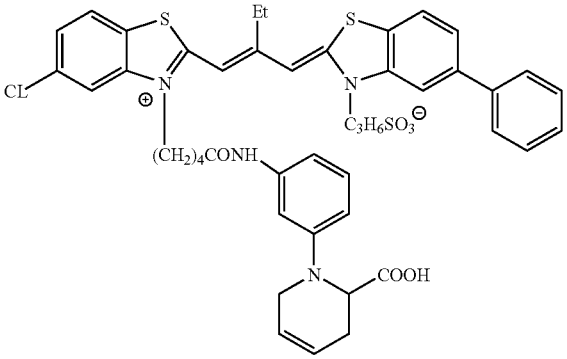
34
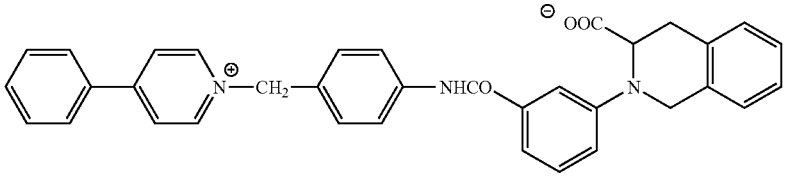
35
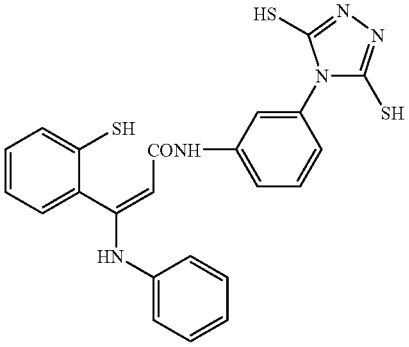
G-1
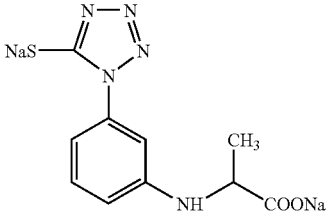
G-2
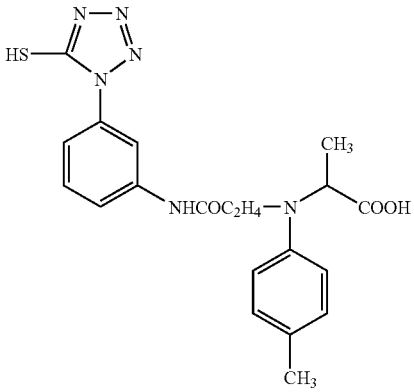
G-3
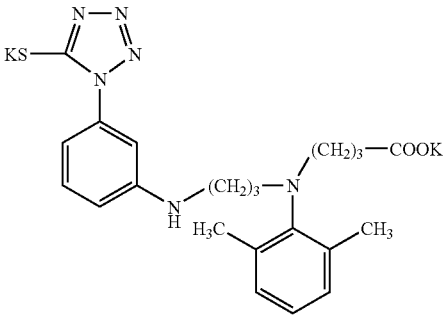

-continued

G-4

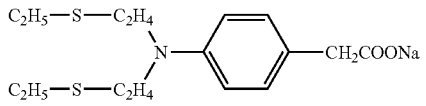

G-5

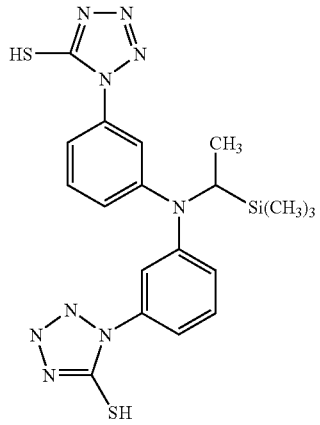

The compound types 1 to 4 according to the invention are same as those as described in detail in Japanese Patent Application Nos. 2002-192373, 2002-188537, 2002-188536, 2001-272137, and 2002-192374. Specific examples of compounds as described in these patent applications are also applicable to examples of the compound types 1 to 4 according to the invention. Further, examples of syntheses of the compound types 1 to 4 according to the invention are same as those as described in these patent applications.

As for specific examples of the compound type 5 according to the invention, examples of compounds denoted as "sensitizers capable of donating two electrons by one photon" or "deprotonating electron donating sensitizers" in, for example, JP-A No. 9-211769, pp. 28 to 32, Figs. E and F (compounds PMT-1 to S-37), JP-A No. 9-211774, JP-A No. 11-95355 (compounds INV1 to 36), JP-W No. 2001-500996 (compounds 1 to 74, 80 to 87, and 92 to 122), U.S. Pat. Nos. 5,747,235, 5,747,236, EP-A No. 786692 (compounds INV1 to 35), EP-A No. 893732 and U.S. Pat. Nos. 6,054,260, and 5,994,051 are further mentioned as they are.

The compound types 1 to 5 according to the invention may be used at any step of the preparation process of the photosensitive silver halide or the production process of photothermographic material, for example, at a silver halide grain-forming step, at a desalting step, at the time of chemical sensitization, or before coating. The compounds can be added in 2 or more steps in a multiple addition manner. Addition time of the compounds is preferably from after completion of photosensitive silver halide grain formation to before the desalting step, at the time of chemical sensitization (from immediately before the start of chemical sensitization to immediately after the completion thereof), or before the coating, and more preferably from the time of chemical sensitization to before being mixed with a non-photosensitive organic silver salt.

It is preferable that the compound types 1 to 5 according to the invention are each first dissolved in water, a water-soluble solvent, for example, methanol or ethanol, or mixtures thereof and, then, added. When the compound types 1 to 5 are dissolved in water, the compounds having a high solubility at a high or low pH may be dissolved while adjusting the pH thereof to be high or low and, then, added.

The compound types 1 to 5 according to the invention are preferably used in an image-forming layer containing a photosensitive silver halide and a non-photosensitive organic silver salt; however, they may first be added not only to the image-forming layer containing the photosensitive silver halide and the non-photosensitive organic silver salt, but also to a protective layer and an intermediate layer and, then, be diffused at the time of coating. Addition timing of these compounds is not particularly limited; whether it is before or after the chemical sensitization is not questioned. The compounds are contained in a silver halide emulsion layer, based on 1 mol of silver halide, in a range from $1\times10^{-9}$ mol to $5\times10^{-1}$ mol, and preferably $1\times10^{-8}$ to $5\times10^{-2}$ mol.

Development Accelerator

In the photothermographic material according to the invention, sulfonamide phenolic compounds represented by the formula (A) as described in JP-A Nos. 2000-267222 and 2000-330234, hindered phenolic compounds represented by the formula (II) as described in JP-A No. 2001-92075, hydrazine-type compounds as described in JP-A No. 10-62895, and represented by the formula (I) as described in JP-A No. 11-15116, the formula (D) as described in JP-A No. 2002-156727, or the formula (1) as described in JP-A No. 2002-278017, and phenolic or naphthol-type compounds represented by the formula (2) as described in JP-A No. 2001-264929 are favorably used. These development accelerators are used, against the reduction agent, in a range from 0.1 mol % to 20 mol %, preferably from 0.5 mol % to 10 mol %, and more preferably from 1 mol % to 5 mol %. A method of introducing the development accelerator to the photosensitive material may be performed in a same manner as in the reduction agent and, particularly, it is preferably incorporated after being changed into a solid dispersion or an emulsify-dispersion.

When the development accelerator is added as an emulsify-dispersion, it is preferable to add the development accelerator in a form of the emulsify-dispersion which has been prepared by emulsifying the development accelerator by simultaneously using a high-boiling solvent that is solid at room temperature and a low-boiling auxiliary solvent or in a form of a so-called oil-less emulsify-dispersion in which a high-boiling solvent is not used.

Among the above-mentioned development accelerators, hydrazine compounds represented by the formula (D) in JP-A No. 2002-156727 and phenol or naphthol compounds represented by the formula (2) in JP-A No. 2001-264929 are more preferred in the invention.

Particularly preferable development accelerators according to the invention are compounds represented by the formulas (A-1) and (A-2) described below.

$Q_1$-NHNH-$Q_2$ Formula (A-1)

wherein $Q_1$ represents an aromatic group, or a heterocyclic group which combines with —NHNH-$Q_2$ by way of a carbon atom; and $Q_2$ represents a carbamoyl group, an acyl group, an alkoxycarbonyl group, an aryloxycarbonyl group, a sulfonyl group, or a sufamoyl group.

In the formula (A-1), the aromatic group or the heterocyclic group represented by $Q_1$ is preferably a 5- to 7-membered unsaturated ring. Preferable examples of such rings include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, and a thiophene ring. A condensed ring in which these rings are condensed with each other is also preferable.

These rings may each have a substituent. When these rings each have two or more substituents, these substituents may be same with or different from each other. Examples of the substituents include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsufonyl group, an arylsulfonyl group, an alkoxycarbonyl group, an aryloxycarbonyl group, and an acyl group. When these substituents are groups capable of being substituted, these substituents may each further have a substituent; examples of such latter substituents include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsufonyl group, an arylsulfonyl group, and an acyloxy group.

The carbamoyl group represented by $Q_2$ is a carbamoyl group having preferably from 1 to 50 carbon atoms and more preferably from 6 to 40 carbon atoms; examples of such carbamoyl groups include a unsubstituted carbamoyl group, a methyl carbamoyl group, an N-ethyl carbamoyl group, an N-propyl carbamoyl group, an N-sec-butyl carbamoyl group, an N-octyl carbamoyl group, an N-cyclohexyl carbamoyl group, an N-tert-butyl carbamoyl group, an N-dodecyl carbamoyl group, an N-(3-dodecyloxypropyl)carbamoyl group, an N-octadecyl carbamoyl group, an N-{3-(2,4-tert-pentylphenoxy)propyl} carbamoyl group, an N-(2-hexyldecyl) carbamoyl group, an N-phenyl carbamoyl group, an N-(4-dodecyloxy phenyl)carbamoyl group, an N-(2-chloro-5-dodecyloxycarbonylphenyl)carbamoyl group, an N-naphthyl carbamoyl group, an N-3-pyridyl carbamoyl group, and an N-benzyl carbamoyl group.

The acyl group represented by $Q_2$ is an acyl group having preferably from 1 to 50 carbon atoms and more preferably from 6 to 40 carbon atoms; examples of such acyl groups include a formyl group, an acetyl group, a 2-methylpropanoyl group, a cyclohexyl carbonyl group, an octanoyl group, a 2-hexyldecanoyl group, a dodecanoyl group, a chloroacetyl group, a trifluoroacetyl group, a benzoyl group, a 4-dodecyloxybenzoyl group, and a 2-hydroxymethyl benzoyl group. The alkoxycarbonyl group represented by $Q_2$ is an alkoxycarbonyl group having preferably from 2 to 50 carbon atoms and more preferably from 6 to 40 carbon atoms; examples of such alkoxycarbonyl groups include a methoxycarbonyl group, an ethoxycarbonyl group, an isobutyloxycarbonyl group, a cyclohexyloxycarbonyl group, a dodecyloxycarbonyl group, and a benzyloxycarbonyl group.

The aryloxycarbonyl group represented by $Q_2$ is an aryloxycarbonyl group having preferably from 7 to 50 carbon atoms and more preferably from 7 to 40 carbon atoms; examples of such aryloxycarbonyl groups include a phenoxycarbonyl group, a 4-octyloxyphenoxycarbonyl group, a 2-hydroxymethyl phenoxycarbonyl group, and a 4-dodecyloxyphenoxycarbonyl group. The sulfonyl group represented by $Q_2$ is a sulfonyl group having preferably from 1 to 50 carbon atoms and more preferably from 6 to 40 carbon atoms; examples of such sulfonyl groups include a methyl sulfonyl group, a butyl sulfonyl group, an octyl sulfonyl group, a 2-hexadecyl sulfonyl group, a 3-dodecyloxypropyl sulfonyl group, a 2-octyloxy-5-tert-octylphenyl sulfonyl group, and a 4-dodecyloxyphenyl sulfonyl group.

The sulfamoyl group represented by $Q_2$ is a sulfamoyl group having preferably from 0 to 50 carbon atoms and more preferably from 6 to 40 carbon atoms; examples of such sulfamoyl groups include an unsubstituted sulfamoyl group, an N-ethyl sulfamoyl group, an N-(2-ethylhexyl)sulfamoyl group, an N-decyl sulfamoyl group, an N-hexadecyl sulfamoyl group, an N-{3-(2-ethylhexyloxy)propyl} sulfamoyl group, an N-(2-chloro-5-dodecyloxycarbonylphenyl)sulfamoyl group, and an N-(2-tetradecyloxyphenyl)sulfamoyl group. The group represented by $Q_2$ may further have a group selected from those as described as the examples of the substituents of the 5- to 7-membered unsaturated ring represented by $Q_1$ at a position at which the substitution can be conducted and, when the group has two or more substituents, these substituents may be same with or different from one another.

Next, a preferable range of the compound represented by the formula (A-1) will be described. As $Q_1$, a 5- or 6-membered unsaturated ring is preferable, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isooxazole ring and a condensed ring in which these rings are each condensed with a benzene ring or an unsaturated heterocycle is more preferable. Further, as $Q_2$, a carbamoyl group is preferable and a carbamoyl group having a hydrogen group on a nitrogen atom is particularly preferable.

Formula (A-2)

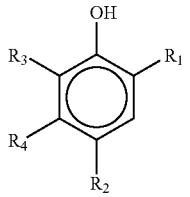

wherein $R_1$ represents an alkyl group, an acyl group, an acylamino group, a sulfonamide group, an alkoxycarbonyl group, or a carbamoyl group;

$R_2$ represents a hydrogen atom, a halogen atom, an alkyl group, an alkoxy group, an aryloxy group, an alkylthio group, an arylthio group, an acyloxy group or a carbonic acid ester; and $R_3$, and $R_4$ each independently represent a group capable of being substituted to a benzene ring as described as examples of the substituents in the formula (A-1), wherein $R_3$, and $R_4$ may be linked with each other to form a condensed ring.

As $R_1$, preferable are an alkyl group having from 1 to 20 carbon atoms (for example, a methyl group, an ethyl group, an isopropyl group, a butyl group, a tert-octyl group, or a cyclohexyl group), an acylamino group (for example, an acetylamino group, a benzoylamino group, a methylureido group, or a 4-cyanophenylureido group), and a carbamoyl group (for example, an n-butyl carbamoyl group, an N,N-diethyl carbamoyl group, a phenyl carbamoyl group, a 2-chlorophenyl carbamoyl group, or a 2,4-dichlorophenyl carbamoyl group), in which an acylamino group (inclusive of a ureido group and a urethane group) is more preferable.

As $R_2$, preferable are a halogen atom (more preferably a chlorine atom, or a bromine atom), an alkoxy group (for example, a methoxy group, a butoxy group, an n-hexyloxy group, an n-decyloxy group, a cyclohexyloxy group, or a benzyloxy group), and an aryloxy group (for example, a phenoxy group or a naphthoxy group).

As $R_3$, preferable are a hydrogen atom, a halogen atom and an alkyl group having from 1 to 20 carbon atoms, and a halogen atom is most preferable. As $R_4$, preferable are a hydrogen atom, an alkyl group, and an acylamino group, in which an alkyl group and an acylamino group are more preferable. Preferable substituents of these groups are same as in $R_1$. It is also preferable that, when $R_4$ represents an acylamino group, $R_3$ and $R_4$ may be linked to each other to form a carbostyryl ring.

In the formula (A-2), when $R_3$ and $R_4$ are linked to each other to form a condensed ring, the condensed ring is particularly preferably a naphthalene ring. A same substituent as that described in the formula (A-1) may be combined to the naphthalene ring. It is preferable that, when the formula (A-2) represents a naphthol-type compound, $R_1$ preferably represents a carbamoyl group. Among such carbamoyl groups, a benzoyl group is particularly preferable. As $R_2$, an alkoxy group and an aryloxy group are preferable, in which an alkoxy group is particularly preferable.

Specific examples of development accelerators according to the invention are described below; however, the invention is by no means limited thereto.

(A-1)

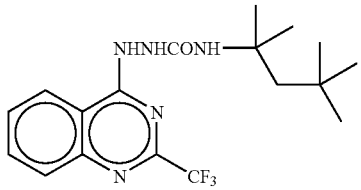

(A-2)

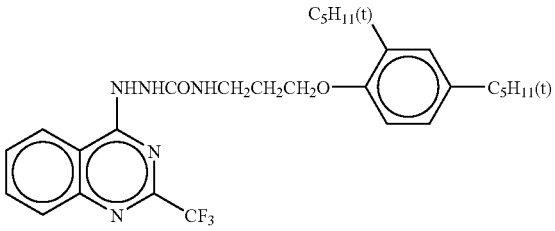

(A-3)

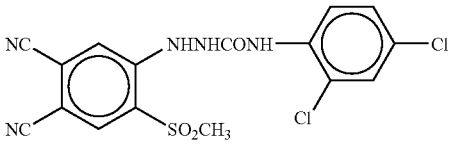

-continued (A-4)

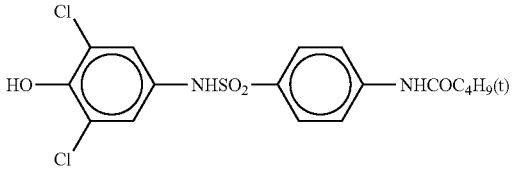

(A-5)

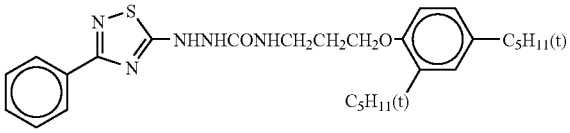

(A-6)

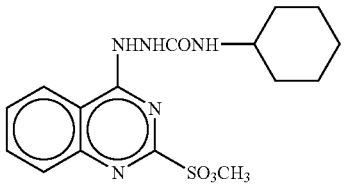

(A-7)

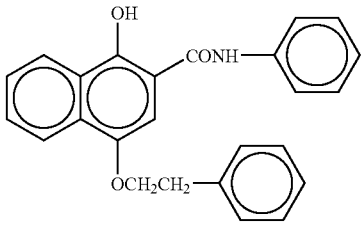

(A-8)

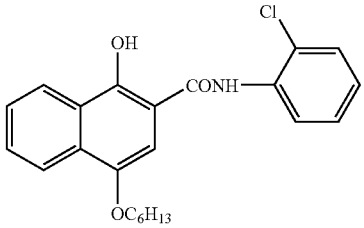

(A-9)

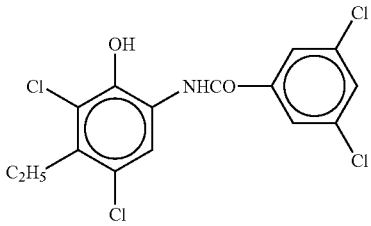

(A-10)

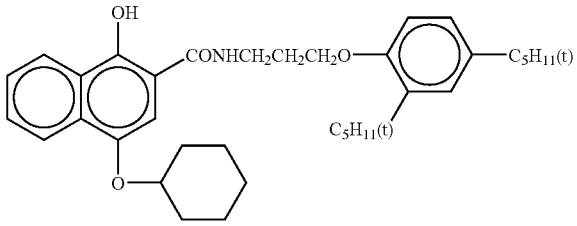

Phthalic Acid and Derivative Thereof

According to the invention, not only a silver iodide complex forming agent, but also a compound selected from phthalic acid and the derivatives thereof are preferably contained. As for phthalic acid and the derivatives thereof according to the invention, preferable are compounds represented by the following formula (PH):

Formula (PH)

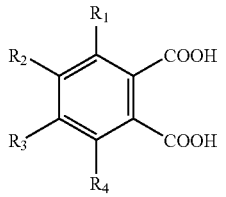

In the formula (PH), $R_1$ to $R_4$ each independently represent a hydrogen atom, a halogen atom (a fluorine atom, a bromine atom, or an iodine atom), an alkyl group, an aryl group, an alkoxy group, or a nitro group.

The compounds represented by the formula (PH) may be used in acid form as they are, or in appropriate salt form from the standpoint of easiness of addition to a coating solution, and adjustment of pH. As for salts thereof, an alkaline metal salt, an ammonium salt, an alkaline earth metal salt, an amine salt and the like can be used; an alkaline metal salt (Li, Na, K or the like), and an ammonium salt are preferable thereamong.

Specific examples of phthalic acid, and the derivatives thereof according to the invention are described below; however, the invention is by no means limited thereto.

(1)

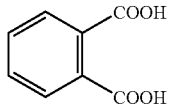

(2)

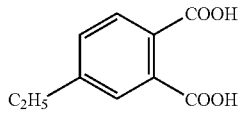

(3)

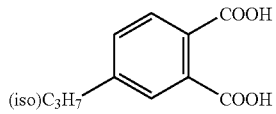

(4)

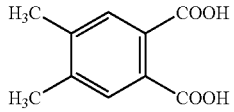

(5)

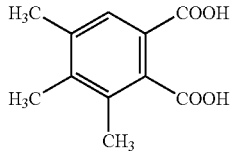

(6)

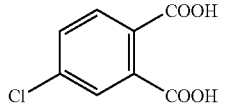

-continued (7)

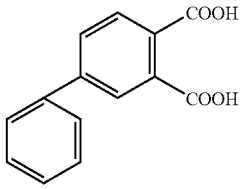

(8)

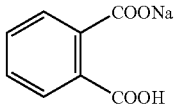

(9)

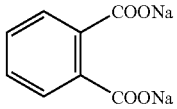

(10)

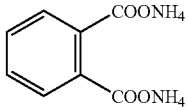

(11)

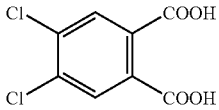

(12)

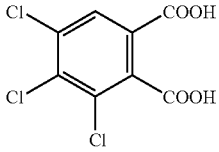

(13)

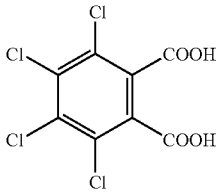

Phthalic acid and the derivatives thereof according to the invention are used, based on 1 mol of silver to be coated, in a range from $1.0\times10^{-4}$ mol to 1 mol, preferably from $1.0\times10^{-3}$ to 0.5 mol, and more preferably from $2.0\times10^{-3}$ mol to 0.2 mol.

Description of Organic Silver Salt

The non-photosensitive organic silver salt which can be used in the invention is relatively stable to light, and is a silver salt which forms a silver image, when heated at 80° C. or more in the presence of an exposed photosensitive silver halide and a reduction agent. The organic silver salt may be any type of an organic substance containing a source which can reduce a silver ion. Such non-photosensitive organic silver salts are described in, for example, paragraphs [0048] and [0049] of JP-A No. 10-62899, pp. 18 (line 24) to 19 (line 37) of EP-A No. 0803764, EP-A No. 0962812, JP-A Nos. 11-349591, 2000-7683, and 2000-72711. Silver salts of organic acids, particularly, long chain aliphatic carboxylic acids (each having from 10 to 30 carbon atoms, preferably from 15 to 28 carbon atoms) are preferable. Preferable examples of such organic silver salts include silver behenate, silver arachidate, silver stearate, silver oleate, silver laurate, silver caproate, silver myristate, silver palmitate, and mixtures thereof. According to the invention, it is preferable to use an organic acid silver salt in which a silver behenate content is from 50 mol % to 100 mol % among these organic silver salts. It is particularly preferable that the silver behenate content is from 75 mol % to 98 mol %.

A shape of the organic silver salt that can be used for the invention is not particularly limited, and any form of acicular, rod-like, tabular, and scaly forms is permissible. However, according to the invention, the organic silver salt in the scaly form is preferable. The term "scaly organic silver salts" as used herein are defined as described below. An organic silver salt is observed under an electron microscope, and a shape of an organic silver salt grain is approximated to a rectangular parallelepiped. Three different edges of the rectangular parallelepiped are represented as a, b and c in which a is the shortest, c is the longest (c and b may be same with each other). From the shorter edges a and b, x is obtained according to the following equation:

$$x=b/a$$

Values of x are obtained for about 200 grains in a same manner as described above, and an average thereof x (average) is obtained. Samples that satisfy the relationship of x (average)≧1.5 are defined as being scaly. Scaly grains preferably satisfy 30≧x (average)≧1.5, more preferably 15≧x (average)≧1.5. In this connection, acicular grains satisfy 1≦x (average)<1.5.

In scaly grains, it is understood that a corresponds to thickness of tabular grains in which main planes are defined by the sides of b and c. An average of a is preferably from 0.01 μm to 0.3 μm, and more preferably from 0.1 μm to 0.23 μm. An average of c/b is preferably from 1 to 6, more preferably from 1 to 4, still more preferably from 1 to 3, and particularly preferably from 1 to 2.

A grain size distribution of the organic silver salts is preferably monodispersed. The term "monodispersed" as used herein is intended to mean that the percentage of a value obtained by dividing the standard deviation of the length of the short axis or long axis by the length of the short axis or long axis, respectively, is preferably 100% or less, more preferably 80% or less, and still more preferably 50% or less. As for a method for measuring the shape of the organic silver salt, the shape of the organic silver salt can be determined by a method utilizing a transmission electron microscope image of an organic silver salt dispersion. Another method for determining the monodispesibility is a method involving obtaining the standard deviation of a volume weight average diameter of the organic silver salt. The percentage (coefficient of variation) of the value obtained by dividing the standard deviation by the volume weight average diameter is preferably 100% or less, more preferably 80% or less, and still more preferably 50% or less. As for a measurement method, for example, laser light is irradiated on the organic silver salt dispersed in the solution to allow the light to be scattered and, then, an autocorrelation function of fluctuation of the resultant scattered light against time is obtained to measure a grain size (volume weight average diameter) and, thereafter, the monodispesibility can be obtained from the thus-measured grain size.

A preparation method and a dispersion method of the organic acid silver according to the invention can adopt any one of known methods and the like. Methods described in, for example, JP-A No. 10-62899, EP-A Nos. 0803763, and 0962812, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870 and 2002-107868 can be of reference.

According to the invention, it is possible to prepare a photosensitive material by mixing an aqueous dispersion of the organic silver salt and an aqueous dispersion of the photosensitive silver salt. When such mixing is performed, it is a favorable method for the purpose of appropriately adjusting photographic properties to mix two or more types of aqueous dispersions of organic silver salts and two or more types of aqueous dispersion of the photosensitive silver salt.

Although the organic silver salt according to the invention can be used in a desired quantity, a silver quantity is preferably in a range from 0.1 g/m$^2$ to 5 g/m$^2$, more preferably from 1 g/m$^2$ to 3 g/m$^2$ and particularly preferably from 1.2 g/m$^2$ to 2.5 g/m$^2$.

According to the invention, it is preferable to add a blocking compound which will inhibit adsorption of the spectral sensitizing dye to a non-photosensitive organic silver salt. As for such blocking compounds, mercapto compounds as described in, for example, the formula (1) of JP-A No. 9-297367, and JP-A No. 10-186572 are preferable. By a blocking effect thereof, a quantity $S_3$ of the spectral sensitizing dye adsorbed to the non-photosensitive organic silver salt against the total content $S_0$ of the spectral sensitizing dye is preferably in the relation of $S_3<S_0<0.6$ and more preferably $S_3/S_0<0.4$.

A value of $S_3/S_0$ can be obtained by a method described below. (1) a solution (referred to as "solution (1)") in which a solid dispersion of the non-photosensitive organic silver salt which may contain or may not contain a blocking compound has been adjusted to have an appropriate concentration, and (2) a solution (referred to as "solution (2)") of a sensitizing dye desirous to be evaluated which has been dissolved in an appropriate solvent are prepared and, then, the solutions (1) and (2) are mixed with each other and sufficiently stirred. Thereafter, the resultant mixture is centrifuged until non-photosensitive organic silver salt grains are sufficiently precipitated. After such centrifugation, spectral absorption of a supernatant thereof is measured and a value obtained at that time is set as $S_4$. Next, water having a same volume as that of a solid dispersion of the non-photosensitive organic silver salt in place of the solid dispersion of the non-photosensitive organic silver salt and the sensitizing dye solution are mixed with each other and centrifuged under a same condition. Thereafter, spectral absorption of a supernatant thereof is measured and a value obtained at that time is set as $S_0$, thereby constructing an equation of $S_3/S_0=(S_0-S_4)/S_0$.

Description of Reduction Agent

The photothermographic material according to the invention comprises a reduction agent for an organic silver salt. The reduction agent may be any substance (preferably organic substance) which can reduce a silver ion to metallic silver. Examples of such reduction agents include those as described in paragraphs [0043] to [0045] of JP-A No. 11-65021, and in pp. 7 (line 34) to 18 (line 12) of EP-A No. 0803764.

A preferable reduction agent according to the invention is a so-called hindered phenolic reduction agent or bisphenolic reduction agent having a substituent in an ortho position of a phenolic hydroxyl group. Particularly, favorable are compounds represented by the following formula (R):

Formula (R)

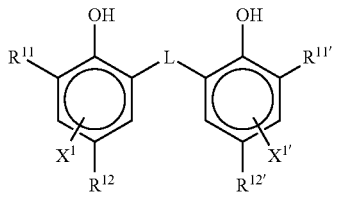

wherein $R^{11}$ and $R^{11'}$ each independently represent an alkyl group having from 1 to 20 carbon atoms;

$R^{12}$ and $R^{12'}$ each independently represent a hydrogen atom or a substituent which can be substituted in a benzene ring;

L represents a group of —S— or —$CHR^{13}$—, wherein $R^{13}$ represents a hydrogen atom or an alkyl group having from 1 to 20 carbon atoms; and $X^1$ and $X^{1'}$ each independently represent a hydrogen atom or a group which can be substituted in a benzene ring.

Now, each substituent will be described in detail.

1) $R^{11}$ and $R^{11'}$ $R^{11}$ and $R^{11'}$ each independently represent an alkyl group, which is substituted or non-substituted, having from 1 to 20 carbon atoms. A substituent of the alkyl group is not particularly limited and preferable examples of such substituents include an aryl group, a hydroxyl group, an alkoxy group, an aryloxy group, an alkylthio group, an arylthio group, an acylamino group, a sulfonamide group, a sulfonyl group, a phosphoryl group, an acyl group, a carbamoyl group, an ester group, and a halogen atom.

2) $R^{12}$ and $R^{12'}$, and $X^1$ and $X^{1'}$ $R^{12}$ and $R^{12'}$ each independently represent a hydrogen atom or a group which can be substituted in a benzene ring.

$X^1$ and $X^{1'}$ each independently represent a hydrogen atom or a group which can be substituted in a benzene ring.

Preferable examples of such groups which can each be substituted in a benzene ring include an alkyl group, an aryl group, a halogen atom, an alkoxy group and an acylamino group.

3) L

L represents a group of —S— or —$CHR^{13}$—, wherein $R^{13}$ represents a hydrogen atom or an alkyl group having from 1 to 20 carbon atoms, in which the alkyl group may have a substituent.

Specific examples of such alkyl groups which are non-substituted $R^{13}$ include a methyl group, an ethyl group, a propyl group, a butyl group, a heptyl group, an undecyl group, an isopropyl group, a 1-ethylpentyl group, and a 2,4,4-trimethylpentyl group.

Examples of substituents of the alkyl groups, being same as those of $R^{11}$, include a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group, and a sulfamoyl group.

4) Preferred Substituent $R^{11}$ and $R^{11'}$ are preferably a secondary or tertiary alkyl group having from 3 to 15 carbon atoms; examples of such alkyl groups include an isopropyl group, an isobutyl group, a t-butyl group, a t-amyl group, a t-octyl group, a cyclohexyl group, a cyclopentyl group, a 1-methylcyclohexyl group, and a 1-methylcyclopropyl group. $R^{11}$ and $R^{11'}$ are more preferably a tertiary alkyl group having from 4 to 12 carbon atoms, still more preferably a t-butyl group, a t-amyl group, and a 1-methylcyclohexyl group, and most preferably a t-butyl group.

$R^{12}$ and $R^{12'}$ are each independently preferably an alkyl group having from 1 to 20 carbon atoms; and specific examples of such alkyl groups include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, and a methoxyethyl group, and more preferably a methyl group, an ethyl group, a propyl group, an isopropyl group and a t-butyl group.

$X^1$ and $X^{1'}$ are each preferably a hydrogen atom, a halogen atom, and an alkyl group, and more preferably a hydrogen atom.

L is preferably a —$CHR^{13}$— group.

$R^{13}$ is preferably a hydrogen atom or an alkyl group having from 1 to 15 carbon atoms, and preferable examples of such alkyl groups include a methyl group, an ethyl group, a propyl group, an isopropyl group, and a 2,4,4-trimethypentyl group. Particularly preferable examples of $R^{13}$ include a hydrogen atom, a methyl group, a propyl group, and an isopropyl group.

When $R^{13}$ is a hydrogen atom, $R^{12}$ and $R^{12'}$ are each preferably an alkyl group having from 2 to 5 carbon atoms in which an ethyl group and a propyl group are more preferable and an ethyl group is most preferable.

When $R^{13}$ is a primary or secondary alkyl group having form 1 to 8 carbon atoms, $R^{12}$ and $R^{12'}$ are each preferably a methyl group. As for the primary or secondary alkyl group each having from 1 to 8 carbon atoms of $R^{13}$, a methyl group, an ethyl group, a propyl group, an isopropyl group are more preferable, and a methyl group, an ethyl group and a propyl group are still more preferable.

When $R^{11}$, $R^{11'}$, $R^{12}$, and $R^{12'}$ are each a methyl group, $R^{13}$ is preferably a secondary alkyl group. On this occasion, as for such secondary alkyl groups of $R^{13}$, an isopropyl group, an isobutyl group, and a 1-ethylpentyl group are preferable, and an isopropyl group is more preferable.

Various types of thermal developing properties of these reduction agents can be changed by combining $R^{11}$, $R^{11'}$, $R^{12}$, $R^{12'}$and $R^{13}$. Since the thermal developing properties of reduction agents can be adjusted by simultaneously using at least two types of reduction agents at various types of combining ratios, it is preferable, though depending on applications, to use at least two types of reduction agents in combination.

Specific examples of compounds represented by the formula (R) according to the invention are described below; however, the invention is by no means limited thereto.

(R-1)

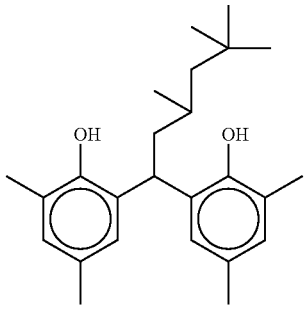

(R-2)

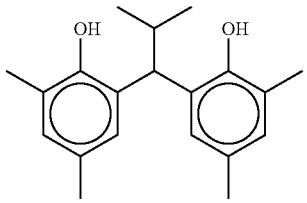

-continued
(R-3)
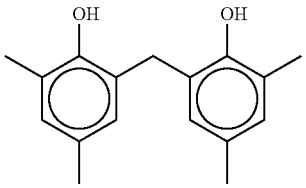
(R-4)
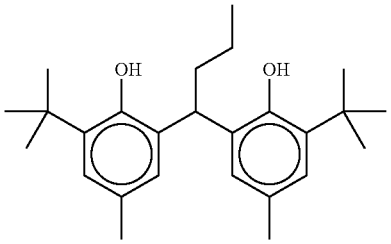
(R-5)
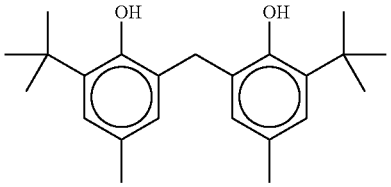
(R-6)
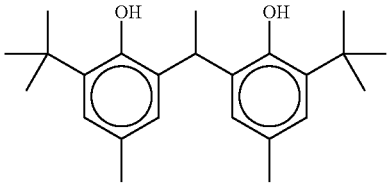
(R-7)
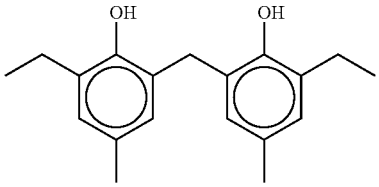
(R-8)
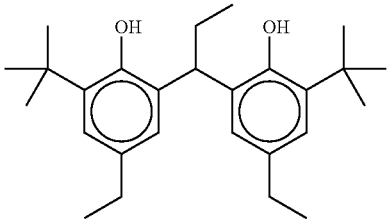
(R-9)
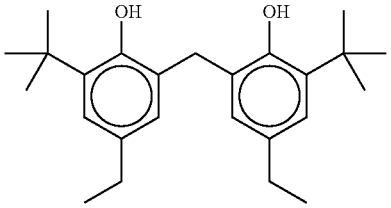
-continued
(R-10)
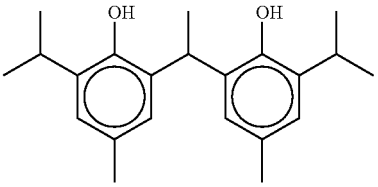
(R-11)
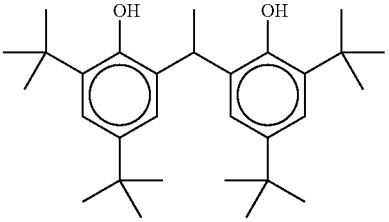
(R-12)
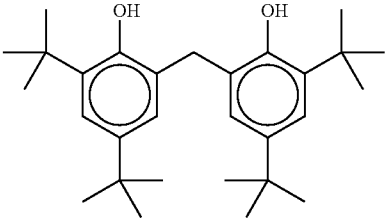
(R-13)
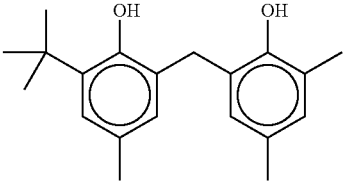
(R-14)
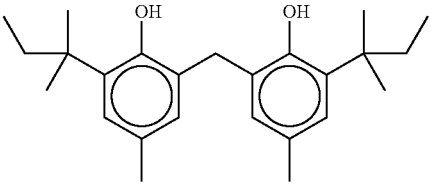
(R-15)
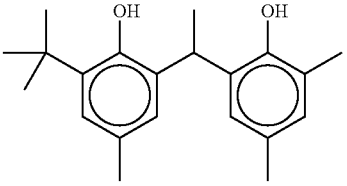
(R-16)
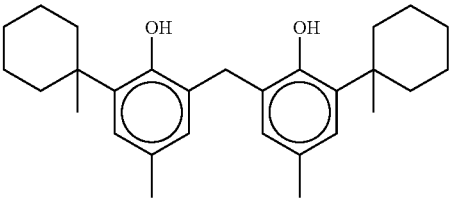

-continued
(R-17)
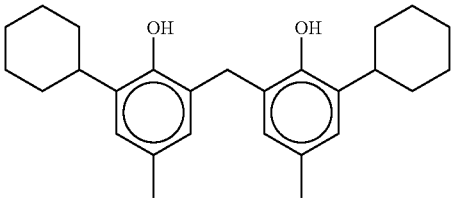
(R-18)
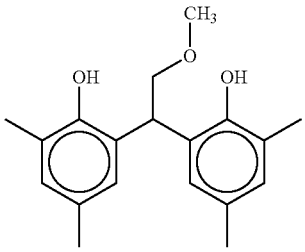
(R-19)
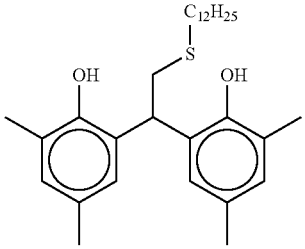
(R-20)
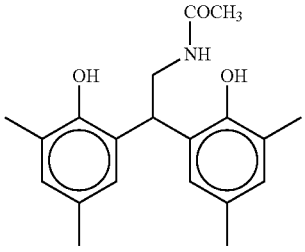
(R-21)
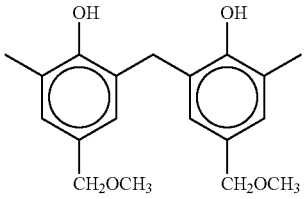
(R-22)
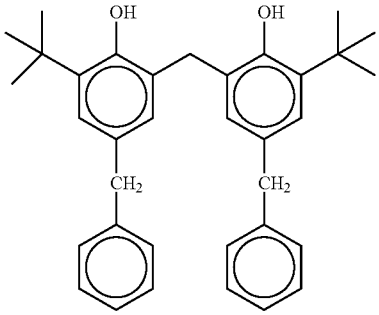
-continued
(R-23)
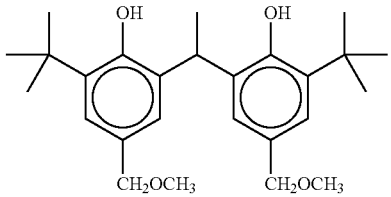
(R-24)
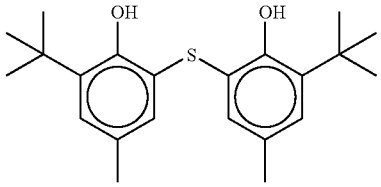
(R-25)
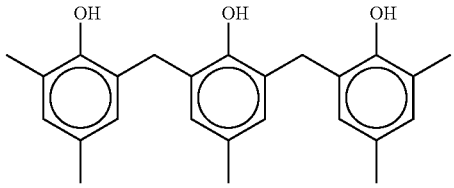
(R-26)
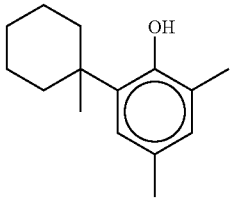
(R-27)
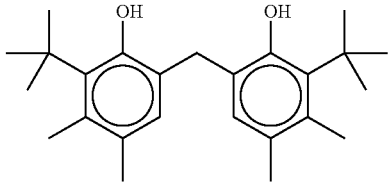
(R-28)
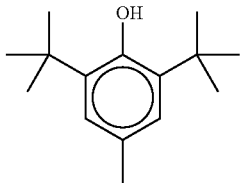
(R-29)
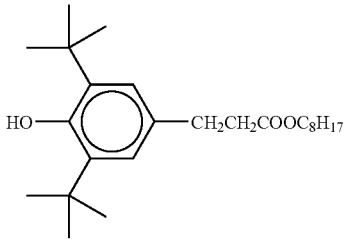

-continued (R-30)

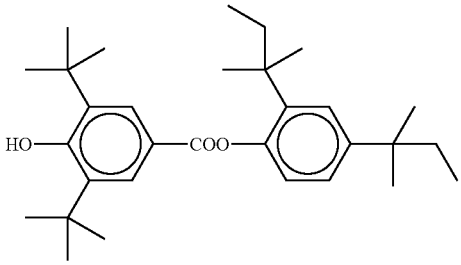

(R-31)

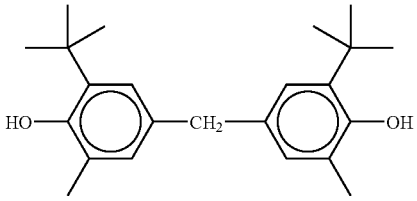

(R-32)

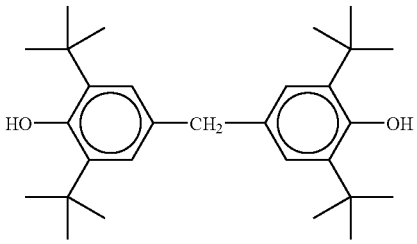

(R-33)

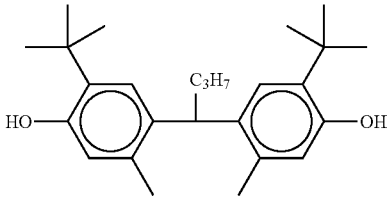

(R-34)

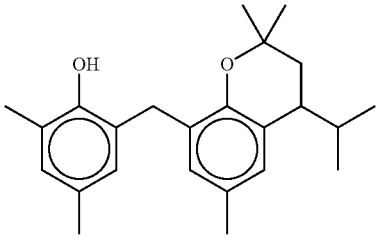

Particularly, compounds of from (R-1) to (R-20) are preferable.

A quantity of the reduction agent to be added according to the invention is preferably in a range from 0.01 g/m$^2$ to 5.0 g/m$^2$, more preferably from 0.1 g/m$^2$ to 3.0 g/m$^2$ and, based on 1 mol of silver on a surface having an image-forming layer, preferably in a range from 5 mol % to 50 mol % and more preferably from 10 mol % to 40 mol %.

Although the reduction agent according to the invention can be added in the image-forming layer comprising the organic silver salt and the photosensitive silver halide, and a layer adjacent thereto, it is more preferable to allow the reduction agent to be contained in the image-forming layer.

The reduction agent according to the invention may be contained in the coating solution in any form of solution form, emulsify-dispersion form, solid fine grain dispersion form and the like and the resultant coating solution may be contained in the photosensitive material.

As for well known emulsify-emulsion methods, mentioned is a method in which the reduction agent is dissolved by using an auxiliary solvent such as dibutyl phthalate, tricresyl phosphate, glyceryl triacetate, an oil such as diethyl phthalate, ethyl acetate, and cyclohexanone and, then, the resultant solution was mechanically treated to prepare an emulsion.

Further, as for solid fine grain dispersion methods, mentioned is a method in which the reduction agent is dispersed in an appropriate solvent such as water by using a ball mill, a colloid mill, a vibration ball mill, a sand mill, a jet mill, a roller mill or an ultrasonic wave to prepare a solid dispersion. Preferably, the dispersion method is that of using the sand mill. On this occasion, any one of a protective colloid (for example, polyvinyl alcohol), and a surfactant (for example, an anionic surfactant such as sodium triisopropyl naphthalene sulfonate that is a mixture of different types of such sulfonates in which substitution positions of three isopropyl groups are different from one another) may be used. An antiseptic agent (for example, a sodium salt of benzisothiazolinone) is allowed to be contained in an aqueous dispersion.

A particularly favorable method is the solid fine grain dispersion method. The reduction agent is added as fine grains having an average grain size in a range from 0.01 μm to 10 μm, preferably from 0.05 μm to 5 μm, and more preferably from 0.1 μm to 1 μm. According to the invention, it is preferable that any one of other solid dispersions is dispersed in the above-described ranges of grain sizes and, then, used.

Description of Hydrogen Bonding-Type Compound

When a reduction agent according to the invention has an aromatic hydroxyl group (—OH), or an amino group, it is possible that a non-reducible compound having a group capable of forming a hydrogen bond with an amino group can simultaneously be used.

Examples of groups each capable of forming a hydrogen bond include a phosphoryl group, a sulfoxide group, a sulfonyl group, a carbonyl group, an amide group, an ester group, a urethane group, a ureido group, a t-amino group, and a nitrogen-containing aromatic group. Among these groups, compounds each having a phosphoryl group, a sulfoxide group, an amide group (however, having no >N—H group; being blocked in form of >N—Ra, in which Ra represents a substituent exclusive of H), a urethane group (however, having no >N—H group; being blocked in form of >N—Ra, in which Ra represents a substituent exclusive of H), a ureido group (however, having no >N—H group; being blocked in form of >N—Ra, in which Ra represents a substituent exclusive of H) are preferable.

Particularly favorable hydrogen bonding-type compounds according to the invention are compounds represented by the following formula (J):

Formula (J)

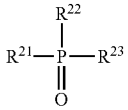

In the formula (J), $R^{21}$, $R^{22}$, and $R^{23}$ each independently represent an alkyl group, an aryl group, an alkoxy group, an aryloxy group, an amino group, or a heterocyclic group. These groups may be non-substituted or have a substituent.

When any one of $R^{21}$, $R^{22}$, and $R^{23}$ has a substituent, examples of such substituents include a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group and a phosphoryl group; on this occasion, the substituent is preferably an alkyl group or an aryl group; examples of such alkyl groups and aryl groups include a methyl group, an ethyl group, an isopropyl group, a t-butyl group, a t-octyl group, a phenyl group, a 4-alkoxyphenyl group, and a 4-acyloxyphenyl group.

Specific examples of such alkyl groups represented each independently by $R^{21}$, $R^{22}$, and $R^{23}$ include a methyl group, an ethyl group, a butyl group, an octyl group, a dodecyl group, an isopropyl group, a t-butyl group, a t-amyl group, a t-octyl group, a cyclohexyl group, a 1-methyl cyclohexyl group, a benzyl group, a phenethyl group, and a 2-phenoxypropyl group.

Specific examples of such aryl groups include a phenyl group, a cresyl group, a xylyl group, a naphthyl group, a 4-t-butylphenyl group, a 4-t-octylphenyl group, a 4-anisidyl group, and a 3,5-dichlorophenyl group.

Specific examples of such alkoxy groups include a methoxy group, an ethoxy group, a butoxy group, an octyloxy group, a 2-ethylhexyloxy group, a 3,5,5-trimethyl hexyloxy group, a dodecyloxy group, a cyclohexyloxy group, a 4-methyl cyclohexyloxy group, and a benzyloxy group.

Specific examples of such aryloxy groups include a phenoxy group, a cresyloxy group, an isopropylphenoxy group, a 4-t-butylphenoxy group, a naphthoxy group, and a biphenyloxy group.

Specific examples of such amino groups include a dimethylamino group, a diethylamino group, a dibutylamino group, a dioctylamino group, an N-methyl-N-hexylamino group, a dicyclohexylamino group, a diphenylamino group, and an N-methyl-N-phenylamino group.

As for $R^{21}$, $R^{22}$, and $R^{23}$, an alkyl group, an aryl group, an alkoxy group, and aryloxy group are preferable. From the standpoint of an effect according to the invention, it is preferable that at least one of $R^{21}$, $R^{22}$ and $R^{23}$ is an alkyl group or an aryl group, and it is more preferable that at least two of $R^{21}$, $R^{22}$ and $R^{23}$ are an alkyl group or an aryl group. Further, taking availability at a low price into consideration, it is preferable that $R^{21}$, $R^{22}$, and $R^{23}$ are a same group with one another.

Specific examples of hydrogen bonding-type compounds (D-1) to (D-21) are described below, starting with compounds represented by the formula (J) according to the invention; however, the invention is by no means limited thereto.

(D-1)

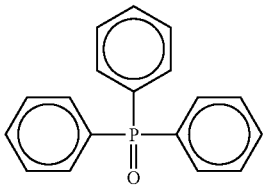

(D-2)

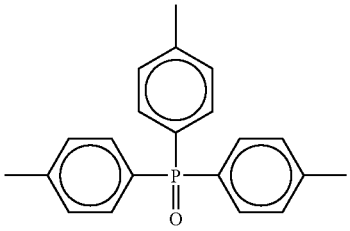

-continued (D-3)

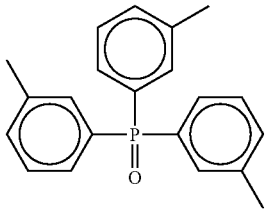

(D-4)

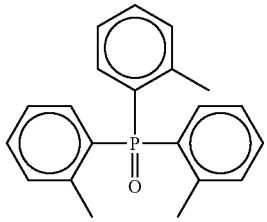

(D-5)

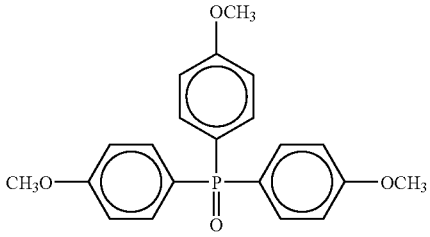

(D-6)

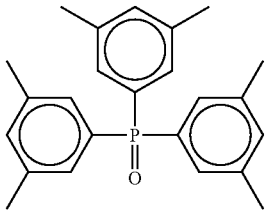

(D-7)

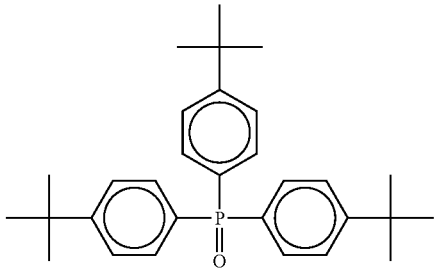

(D-8)

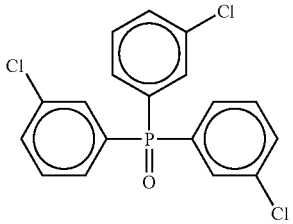

-continued (D-9)

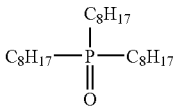

(D-10)

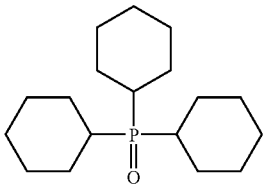

(D-11)

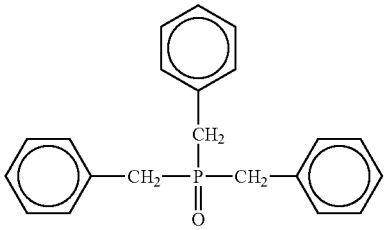

(D-12)

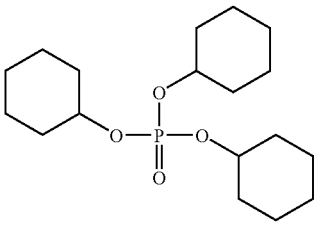

(D-13)

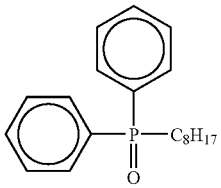

(D-14)

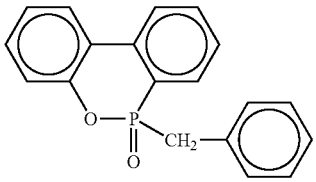

(D-15)

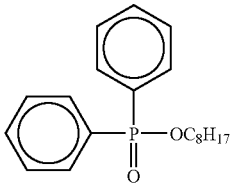

(D-16)

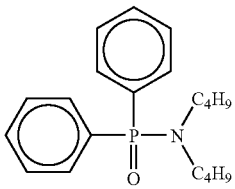

-continued (D-17)

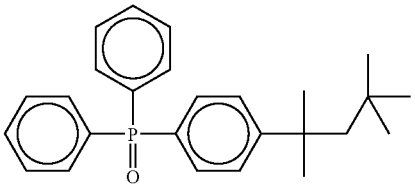

(D-18)

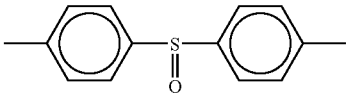

(D-19)

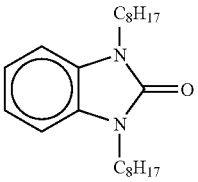

(D-20)

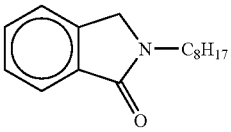

(D-21)

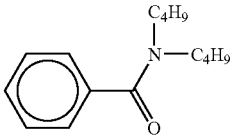

Specific examples of the hydrogen bonding-type compounds further include those as described in EP-A No. 1096310, JP-A Nos. 2002-156727 and 2002-318431.

The hydrogen bonding-type compound according to the invention can be contained in the coating solution, in a same manner as in the reduction agent, in a form of the solution form, the emulsify-dispersion form, or the solid fine grain dispersion form and, then, the resultant coating solution can be contained in the photosensitive material. The hydrogen bonding-type compound according to the invention forms a complex in a solution state by forming a hydrogen bond with a compound having a phenolic hydroxyl group. The complex, though depending on combinations of the reduction agents and the compounds represented by the formula (A) according to the invention, can be isolated in a crystal state.

It is particularly favorable from the standpoint of obtaining a consistent performance that the thus-isolated crystal powders are used as the solid fine grain dispersion. Further, favorably used is a method in which the reduction agent and the hydrogen bonding-type compound according to the invention are mixed in respective powder states with each other and, then, dispersed by using an appropriate dispersing agent by utilizing a sand-grinder mill or the like to form a complex at the time of such dispersion.

The hydrogen bonding-type compound according to the invention is used, against the reduction agent, preferably in a range from 1 mol % to 200 mol %, more preferably from 10 mol % to 150 mol % and still more preferably from 30 mol % to 100 mol %.

Description of Binder

A binder in an organic silver salt-containing layer according to the invention may be any type of polymers. Such binders are preferably transparent or semi-transparent and ordinarily colorless; examples of the binders include natural resins or polymers and copolymers, synthetic resins or polymers and copolymers, and other media which form a film; and specific examples thereof include gelatins, rubbers, poly(vinyl alcohol)s, hydoxyethyl celluloses, cellulose acetates, cellulose acetate butyrates, poly(vinylpyrrolidone)s, casein, starch, poly(acrylic acid)s, poly(methylmethacrylic acid)s, poly(vinyl chloride)s, poly(methacrylic acid)s, styrene/maleic acid anhydride copolymers, styrene/acrylonitrile copolymers, styrene/butadiene copolymers, poly(vinyl acetal)s (for example, poly(vinyl formal) and poly(vinyl butylal)), poly (ester)s, poly(urethane)s, phenoxy resins, poly(vinylidene chloride)s, poly(epoxide)s, poly(carbonate)s, poly(vinyl acetate)s, poly(olefin)s, cellulose esters and poly(amide)s. The binders may be provided in water or an organic solvent or as an emulsion for film forming.

According to the invention, a glass transition temperature (hereinafter referred to also as "Tg") of the binder in the organic silver salt-containing layer is preferably in a range from 10° C. to 80° C., more preferably from 20° C. to 70° C., and still more preferably from 23° C. to 65° C.

Further, according to the invention, the Tg is calculated with the following equation:

$$1/Tg=\Sigma(Xi/Tgi)$$

In this case, it is assumed that the polymer is formed by copolymerization of n monomer components from i=1 to i=n. Xi is a weight ratio ($\Sigma Xi=1$) of the i-th monomer and Tgi is a glass transition temperature (at an absolute temperature) of a homopolymer of the i-th monomer, provided that $\Sigma$ is a sum of from i=1 to i=n.

Further, for the value (Tgi) of glass transition temperature of the homopolymer made from each monomer, values described in J. Brandrup and E. H. Immergut, *Polymer Handbook,* 3rd Edition, Willey-Interscience (1989) have been adopted.

These polymers which become binders may be used as a single type or in combination of two or more types according to necessity. A combination of a polymer having Tg of 20° C. or more and a polymer having Tg of less than 20° C. may also be used. When two or more types of polymers having different Tg values from one another are used in blending, it is preferable that a weight average Tg resides in the ranges described above.

According to the invention, properties of the photothermographic material are improved when the organic silver salt-containing layer has been formed by first applying a coating solution comprising 30% by mass or more of water of the total solvent and, then, drying and, further, when the binder in the organic solver salt-containing layer is soluble or dispersible in an aqueous solvent (a water solvent), and, particularly, when the binder comprises a latex of polymer in which an equilibrium moisture content at 25° C. 60% RH is 2% by mass or less.

The most preferred form is such a form as is prepared such that an ionic conductivity becomes 2.5 mS/cm or less. As for such preparation method, mentioned is a purification method using a functional membrane for separation after a polymer is synthesized.

The aqueous solvent mentioned here in which the polymer is soluble or dispersible means water or a mixture of water and a water-miscible organic solvent in a quantity of 70% by mass or less.

Examples of such water-miscible organic solvents include alcohol solvents such as methyl alcohol, ethyl alcohol and propyl alcohol; cellosolve solvents such as methyl cellosolve, ethyl cellosolve and butyl cellosolve; ethyl acetate; and dimethyl formamide.

Further, the term "equilibrium moisture content at 25° C. 60% RH" as used herein can be expressed by using a weight W1 of a polymer in an equilibrium with moisture conditioning under the atmosphere at 25° C. 60% RH and a weight W0 of the polymer in the absolutely dry state, as shown in the following equation:

The equilibrium moisture content at 25° C. 60% RH={(W1-W0)/W0}×100 (% by mass)

Regarding a definition and a measurement method of the moisture content, for example, *Testing Methods of Polymer Materials, Polymer Engineering Course* 14, compiled by the Society of Polymer Science of Japan, Chijin Shokan Co., Ltd. can be referred.

An equilibrium moisture content of the binder polymer according to the invention at 25° C. 60% RH is preferably 2% by mass or less, more preferably in a range from 0.01% by mass to 1.5% by mass, and still more preferably from 0.02% by mass to 1% by mass.

As for the binders according to the invention, a polymer dispersible in an aqueous solvent is particularly preferred. Examples of dispersed states include a latex in which fine grains of a water-insoluble and hydrophobic polymer are dispersed and a dispersion in which polymer molecules are dispersed in a molecular state or a micelle-forming state. Both of them are favorable. An average grain diameter of dispersed grains is preferably in a range from 1 nm to 50,000 nm, and more preferably from approximately 5 nm to approximately 1,000 nm. A grain diameter distribution of the dispersed grains is not particularly limited and either of dispersed grains having a broad grain diameter distribution or having a monodispersed grain diameter distribution may be used.

According to the invention, examples of preferably usable embodiments of polymers dispersible in aqueous solvents include hydrophobic polymers such as acrylic polymers, poly (ester)s, rubbers (for example, SBR resins), poly(urethane)s, poly(vinylchloride)s, poly(vinyl acetate)s, poly(vinylidene chloride)s and poly(olefin)s. These polymers may be a straight-chain polymer, a branched-chain polymer, a cross-linked polymer, a so-called homopolymer in which monomers of a single type have been polymerized, or a copolymer in which monomers of two or more types have been polymerized. In case of the copolymer, it may be either of a random copolymer or a block copolymer.

A molecular weight of these polymers is, in terms of the number average molecular weight, in a range from 5,000 to 1,000,000 and preferably from 10,000 to 200,000. When a polymer having an unduly small molecular weight is used, dynamic strength of the emulsion layer becomes insufficient. When a polymer having an unduly large molecular weight is used, film-forming properties are deteriorated. None of these cases is preferable.

Specific examples of preferable polymer latices include materials described below. These materials are each expressed in terms of a starting monomer; a value in each parenthesis is indicated in terms of "% by mass"; and a molecular weight means a number average molecular weight. In a case in which a multi-functional monomer is used, the concept of molecular weight can not be applied, since a cross-linked structure is formed. Accordingly, such a case is marked as "cross-linking" to omit description of molecular weight. Tg denotes a glass transition temperature.

P-1; a latex (MW: 37,000; Tg: 61° C.) of MMA(70)/EA(27)/MAA(3)

P-2; a latex (MW: 40,000; Tg: 59° C.) of MMA(70)/2EHA(20)/St(5)/AA(5)

P-3; a latex (cross-linking; Tg: −17° C.) of St(50)/Bu(47)/MAA(3)

P-4; a latex (cross-linking; Tg: 17° C.) of St(68)/Bu(29)/AA(3)

P-5; a latex (cross-linking; Tg: 24° C.) of St(71)/Bu(26)/AA(3)

P-6; a latex (cross-linking) of St(70)/Bu(27)/IA(3)

P-7; a latex (cross-linking; Tg: 29° C.) of St(75)/Bu(24)/AA(1)

P-8; a latex (cross-linking) of St(60)/Bu(35)/DVB(3)/MAA(2)

P-9; a latex (cross-linking) of St(70)/Bu(25)/DVB(2)/AA(3)

P-10; a latex (MW: 80,000) of VC(50)/MMA(20)/EA(20)/AN(5)/AA(5)

P-11; a latex (MW: 67,000) of VDC(85)/MMA(5)/EA(5)/MAA(5)

P-12; a latex (MW: 12,000) of Et(90)/MAA(10)

P-13; a latex (MW: 130,000; Tg: 43° C.) of St(70)/2EHA(27)/AA(3)

P-14; a latex (MW 33,000; Tg: 47° C.) of MMA(63)/EA(35)/AA(2)

P-15; a latex (cross-linking; Tg: 23° C.) of St(70.5)/Bu(26.5)/AA(3)

P-16; a latex (cross-linking; Tg: 20.5° C.) of St(69.5)/Bu(27.5)/AA(3)

Abbreviations in the above structures denote respective monomers as follows:

MMA: methyl metacrylate; EA: ethy acrylate; MAA methacylic acid; 2EHA: 2-ethylhexyl acrylate; St: Styrene; Bu: Butadiene; AA: acrylic acid; DVB: divinyl benzene; VC: vinyl chloride; AN: acrylonitrile; VDC: vinylidene chloride; Et: ethylene; and IA: itaconic acid.

Polymer latices described above are commercially available and such products as described below can be utilized. Examples of acrylic polymers include Cevian A-4635, 4718 and 4601 (trade names, manufactured by Daicel Chemical Industries, Ltd.) and Nipol Lx811, 814, 821, 820 and 857 (trade names, manufactured by Zeon Corp.) Examples of poly(ester)s include FINETEX ES650, 611, 675 and 850 (trade names, manufactured by Dainippon Ink & Chemicals Inc.) and WD-size and WMS (trade names, manufactured by Eastman Chemical Company). Examples of poly (urethane)s include HYDRAN AP10, 20, 30 and 40 (trade names; manufactured by Dainippon Ink & Chemicals Inc.). Examples of rubbers include LACSTAR 7310K, 3307B, 4700H and 7132C (trade names, manufactured by Dainippon Ink & Chemicals Inc.) and Nipol Lx416, 410, 438C and 2507 (trade names, manufactured by Zeon Corp.). Examples of poly(vinyl chloride)s include G351 and G576 (trade names, manufactured by Zeon Corp.). Examples of poly(vinylidene chloride)s include L502 and L513 (trade names; manufactured by Asahi Chemical Industry Co., Ltd.). Examples of poly(olefin)s include Chemipearl S120 and SA100 (trade names, manufactured by Mitsui Petrochemical Industries, Ltd.).

These polymer latices may be used as a single type or as a blend of two or more types according to necessity.

As for the polymer latices according to the invention, a latex of a styrene/butadiene copolymer, particularly, is preferred. It is preferable that a weight ratio of styrene monomer units to butadiene monomer units is in a range from 40:60 to 95:5. Further, it is preferable that a ratio of styrene monomer units together with butadiene monomer units in the copolymer is in a range from 60% by mass to 99% by mass. The range of preferable molecular weight is same as that described above.

As for preferable latices of styrene/butadiene copolymers according to the invention, mentioned are P-3 to P-8, P-15 and P-16 as described above, LACSTAR-3307B, and 7132C, and Nipol Lx416 (all trade names) which are commercially available.

To the organic silver salt-containing layer of the photosensitive material according to the invention, hydrophilic polymers such as gelatin, polyvinyl alcohol, methyl cellulose, hydroxypropyl cellulose and carboxymethyl cellulose may be added according to necessity.

A quantity of each of these hydrophilic polymers to be added is, based on an entire binder quantity in the organic silver salt-containing layer, preferably 30% by mass or less, and more preferably 20% by mass or less.

It is preferable that the organic silver salt-containing layer (namely, image-forming layer) according to the invention is formed by using a polymer latex as a binder. A quantity of the binder in the organic silver salt-containing layer is, in terms of a weight ratio of the entire binder/organic silver salt, preferably in a range from 1/10 to 10/1, and more preferably from 1/5 to 4/1.

Further, the organic silver salt-containing layer like this ordinarily acts as a photosensitive layer (image-forming layer or emulsion layer) in which a photosensitive silver halide is contained as a photosensitive silver salt. A weight ratio of an entire binder/silver halide in such a case as described above is preferably in a range from 400 to 5, and more preferably from 200 to 10.

The entire binder quantity in the image-forming layer according to the invention is preferably in a range from 0.2 $g/m^2$ to 30 $g/m^2$, and more preferably from 1 $g/m^2$ to 15 $g/m^2$. To the image-forming layer according to the invention, a cross-linking agent for executing cross-linking, a surfactant for improving coating properties and the like may be added.

According to the invention, a solvent (for the purpose of simplicity, a solvent and a dispersing medium are unanimously expressed as solvents) of a coating solution for an organic silver salt-containing layer of the photosensitive material is preferably an aqueous solvent containing 30% by mass or more of water. As for components other than water, any types of water-miscible organic solvents such as methyl alcohol, ethyl alcohol, isopropyl alcohol, Methyl Cellosolve, Ethyl Cellosolve, dimethyl formamide, and ethyl acetate may be used. A water content of such solvent is more preferably 50% by mass or more, and still more preferably 70% by mass or more.

Examples of preferable solvent compositions include, not only water=100, but also water/methyl alcohol=90/10, water/methyl alcohol=70/30, water/methyl alcohol/dimethyl formamide=80/15/5, and water/methyl alcohol/ethyl cellosolve=85/10/5 and water/methyl alcohol/isopropyl alcohol=85/10/5 (numerical values being indicated in terms of "% by mass").

Description of Antifoggant

According to the invention, it is preferable to contain as an antifoggant any one of compounds which are represented by the following formula (H):

$$Q\text{-}(Y)n\text{-}C(Z_1)\text{-}(Z_2)X \qquad \text{Formula (H)}$$

wherein, Q represents an alkyl group, an aryl group or a heterocyclic group;

Y represents a divalent linking group;

n represents 0 or 1;

$Z_1$ and $Z_2$ each independently represent a halogen atom; and

X represents a hydrogen atom or an electron-attracting group.

Q preferably represents a phenyl group substituted by an electron-attracting group in which the Hammet's substituent constant up has a positive value. Regarding the Hammet's substituent constant, *Journal of Medicinal Chemistry*, Vol. 16, No. 11, pp. 1207-1216 (1973) can be referred.

Examples of such electron-attracting groups include a halogen atom (for example, a fluorine atom ($\sigma_p$ value: 0.06)), a chlorine atom ($\sigma_p$ value: 0.23), a bromine atom ($\sigma_p$ value: 0.23) or an iodine atom ($\sigma_p$ value: 0.18)), a trihalomethyl group (for example, a tribromomethyl group ($\sigma_p$ value: 0.29), a trichloromethyl group ($\sigma_p$ value: 0.33) or a trifluoromethyl group ($\sigma_p$ value: 0.54)), a cyano group ($\sigma_p$ value: 0.66), a nitro group ($\sigma_p$ value: 0.78), an aliphatic, aryl or a heterocyclic sulfonyl group (for example, a methane sulfonyl group ($\sigma_p$ value: 0.72)), an aliphatic, aryl or a heterocyclic acyl group (for example, an acetyl group ($\sigma_p$ value: 0.50) or a benzoyl group ($\sigma_p$ value: 0.43)), an alkynyl group (for example, a group of C≡CH ($\sigma_p$ value: 0.23)), an aliphatic, aryl or a heterocyclic oxycarbonyl group (for example, a methoxycarbonyl group ($\sigma_p$ value: 0.45) and a phenoxycarbonyl group ($\sigma_p$ value: 0.44)), a carbamoyl group ($\sigma_p$ value: 0.36), a sulfamoyl group ($\sigma_p$ value: 0.57), a sulfoxide group, a heterocyclic group and a phosphoryl group.

A $\sigma_p$ value is preferably in a range from 0.2 to 2.0, and more preferably from 0.4 to 1.0.

Preferable electron-attracting groups are a carbamoyl group, an alkoxycarbonyl group, an alkylsulfonyl group, an alkylphosphoryl group, a carboxyl group, an alkyl- or arylcarbonyl group, and an arylsulfonyl group; particularly preferable groups are a carbamoyl group, an alkoxycarbonyl group, an alkylsulfonyl group, and an alkylphosphoryl group; and most preferable group is a carbamoyl group.

X represents preferably an electron-attracting group, and more preferably a halogen atom, an aliphatic, aryl or a heterocyclic sulfonyl group, an aliphatic, aryl or a heterocyclic acyl group, an aliphatic, aryl or a heterocyclic oxycarbonyl group, a carbamoyl group or a sulfamoyl group, and particularly preferably a halogen atom.

Among such halogen atoms, a chlorine atom, a bromine atom and an iodine atom are preferable; a chlorine atom and a bromine atom are more preferable; and a bromine atom is particularly preferable.

Y represents preferably —C(=O)—, —SO—, or —$SO_2$—, more preferably —C(=O)— or —$SO_2$—, and particularly preferably —$SO_2$—.

n represents 0 or 1, and preferably 1.

Specific examples of compounds represented by the formula (H) according to the invention are described below; however, the invention is by no means limited thereto.

(H-1)

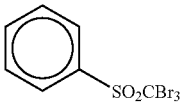

(H-2)

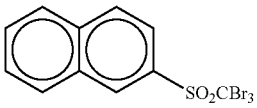

-continued (H-3)

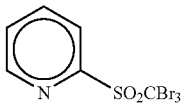

(H-4)

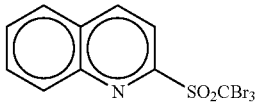

(H-5)

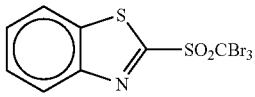

(H-6)

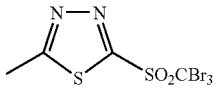

(H-7)

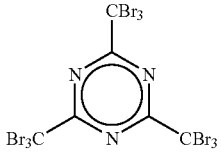

(H-8)

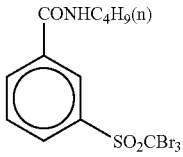

(H-9)

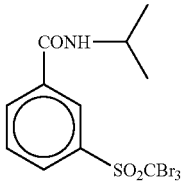

(H-10)

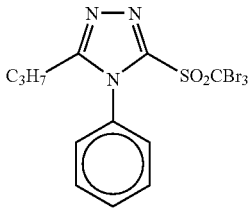

(H-11)

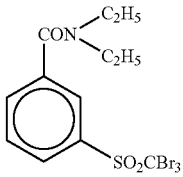

(H-12)

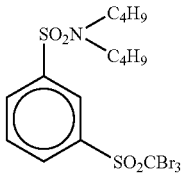

-continued (H-13)

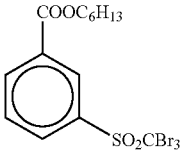

(H-14)

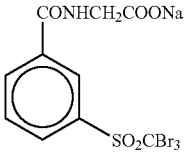

(H-15)

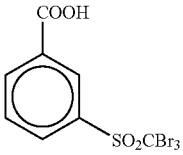

(H-16)

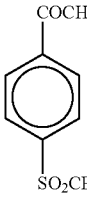

(H-17)

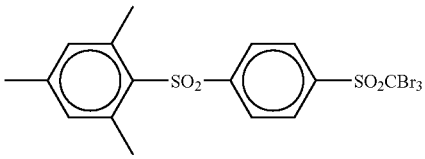

(H-18)

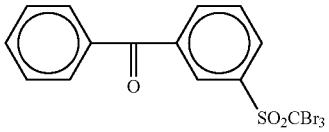

(H-19)

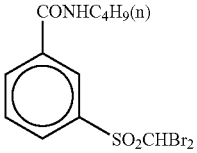

(H-20)

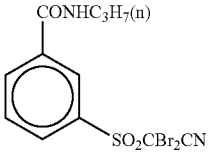

(H-21)

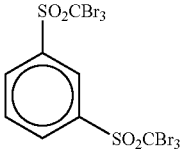

-continued (H-22)

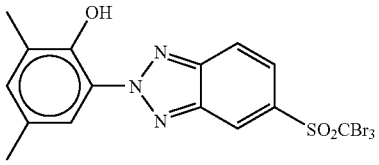

(H-23)

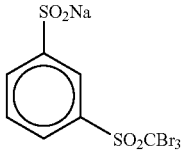

(H-24)

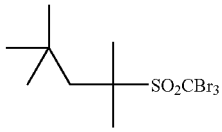

The compound represented by the formula (H) according to the invention is used, based on 1 mol of non-photosensitive silver salt in the image-forming layer, preferably in a range from $1\times10^{-4}$ mol to 0.8 mol, more preferably from $1\times10^{-3}$ mol to 0.1 mol, and still more preferably from $5\times10^{-3}$ mol to 0.05 mol.

Particularly, when the silver halide having a composition in which a silver iodide content is high according to the invention is used, a quantity of the compound represented by the formula (H) to be added is an important factor so as to obtain a sufficient fogging effect and the compound is most preferably used in a range from $5\times10^{-3}$ mol to 0.03 mol.

As for methods for allowing the compound represented by the formula (H) according to the invention to be contained in the photosensitive material, same methods as those described in the reduction agent are applicable.

A melting point of the compound represented by the formula (H) is preferably 200° C. or less and more preferably 170° C. or less.

As for other organic polyhalogenated materials according to the invention, compounds disclosed in patents described in paragraphs [0111] to [0112] of JP-A No. 11-65021 are cited. Particularly, organic halogen compounds represented by the formula (P) in Japanese Patent Application No. 11-87297, organic polyhalogen compounds represented by the formula (II) in JP-A No. 10-339934 and organic polyhalogen compounds described in Japanese Patent Application No. 11-205330 are preferable.

Description of Antifoggant

As for other antifoggants, a mercury (II) salt as described in paragraph [0113] of JP-A No. 11-65021, benzoic acids as described in paragraph [0114] of P-A No. 11-65021, a salicylic acid derivative as described in JP-A No. 2000-206642, a formalin scavenger compound represented by the formula (S) in JP-A No. 2000-221634, a triazine compound related to claim 9 of JP-A No. 11-352624, compounds represented by the formula (III) of JP-A No. 11-11791, 4-hydoxy-6-methyl-1,3,3a,7-tetrazaindene and the like are mentioned.

As for antifoggants, stabilizers and stabilizer precursors according to the invention, those disclosed as patents as described in paragraph [0070] of JP-A No. 10-62899, pp. 20 (line 57) to 21 (line 7) of EP-A No. 0803764, and compounds described in JP-A Nos. 9-281637 and 9-329864 are also mentioned.

The photothermographic material according to the invention may contain an azolium salt for the purpose of inhibiting fogging. As for such azolium salts, compounds represented by the formula (XI) as described in JP-A No. 59-193447, compounds as described in JP-B No. 55-12581, and compounds represented by the formula (II) as described in JP-A No. 60-153039 can be cited. The azolium salt may be added in any part of the photosensitive material; however, as for a layer to be added with the azolium salt, the layer on a surface having the image-forming layer is preferable, and the layer containing the organic silver salt is more preferable.

Timing of adding the azolium salt may be in any step for preparing a coating solution. When the azolium salt is added to the layer containing the organic silver salt, the azolium salt may be added in any step of from preparation of the organic silver salt to preparation of a coating solution; however, the azolium salt is preferably added during a period of after the preparation of the organic silver salt to immediately before the coating. As for methods for adding the azolium salt, any addition method, such as that in a powder state, a solution state or a fine grain dispersion state thereof, may be adopted. The azolium salt may also be added in a state of solution mixed with other additives such as a sensitizing dye, a reduction agent and a color toning agent.

According to the invention, a quantity of the azolium salt to be added may be optional; however, it is, based on 1 mol of silver, preferably in a range from $1\times10^{-6}$ mol to 2 mol, and more preferably from $1\times10^{-3}$ mol to 0.5 mol.

Description of Other Additives

1) Mercapto, Disulfide, and Thiones

According to the invention, for the purpose of controlling development by inhibiting or accelerating the development, improving spectral sensitization efficiency, improving storability before and after the development and the like, a mercapto compound, a disulfide compound, or a thione compound can be incorporated. Compounds as described in paragraphs [0067] to [0069] of JP-A No. 10-62899, compounds represented by the formula (I) and their specific examples as described in paragraphs [0033] to [0052] of JP-A No. 10-186572, compounds described in page 20, lines 36 to 56 of EP-A No. 0803764. Among other things, mercapto-substituted heteroaromatic compounds as described in, for example, JP-A Nos. 9-297367, 9-304875, 2001-100358, 2002-303951, and 2002-303954 are preferable.

2) Color Toning Agent

In the photothermographic material according to the invention, a color toning agent is preferably added. Such color toning agents are described in paragraphs [0054] to [0055] of JP-A No. 10-62899, page 21, lines 23 to 48 of EP-A No. 0803764, JP-A Nos. 2000-356317 and Japanese Patent Application No. 2000-187298. Particularly, phthalazinones (phthalazinone, phthalazinone derivatives or their metal salts, for example, 4-(1-naphthyl)phthalazinone, 6-chlorophthalazinone, 5,7-dimethoxy phthalazinone and 2,3-dihydro-1,4-phthalazinedione); combinations of phthalazinones and phthalic acids (for example, phthalic acid, 4-methylphthalic acid, 4-nitrophthalic acid, diammonium phthalate, sodium phthalate, potassium phthalate and tetrachlorophthalic acid anhydride); phthalazines (phthalazine, phthalazine derivatives or their metal salts, for example, 4-(1-naphthyl)phthalazine, 6-isopropylphthalazine, 6-t-butylphthalazine, 6-chlorophthalazine, 5,7-dimethoxyphthalazine and 2,3-dihydrophthalazine) are preferable and, in combinations with a silver halide having a composition in which a silver iodide content is high, combinations of phthalazines and phthalic acids are particularly preferred.

A quantity of any of the phthalazines to be added is, based on 1 mol of the organic silver salt, preferably in a range from 0.01 mol to 0.3 mol, more preferably from 0.02 mol to 0.2 mol, and particularly preferably from 0.02 mol to 0.1 mol. Such addition quantities are important factors for development acceleration which is a problem of a silver halide emulsion, according to the invention, having a composition in which a silver iodide content is high.

3) Plasticizer and Lubricant

Plasticizers and lubricants employable in the image-forming layer according to the invention are described in paragraph (01171 of JP-A No. 11-65021. Slipping agents are described in paragraphs [0061] to [0064] of JP-A No. 11-84573, and paragraphs [0049] to [0062] of Japanese Patent Application No. 11-106881.

4) Dye and Pigment

From the standpoint of improving color tones, preventing an interference fringe pattern to be generated by laser light exposure, and preventing irradiation, various types of dyes and pigments (for example, C. I. Pigment Blue 60, C. I. Pigment Blue 64, and C. I. Pigment Blue 15:6) can be used in the image-forming layer according to the invention. These dyes and pigments are described in detail, for example, in WO98/36322, JP-A No. 10-268465, and 11-338098.

5) Ultra-hard Gradation Enhancing Agent

For the purpose of forming an ultra-hard gradation image appropriate for an application of a printing plate fabrication, an ultra-hard gradation enhancing agent is preferably added to an image-forming layer. As for such ultra-hard gradation enhancing agents, addition methods thereof, and respective quantities thereof to be added, mentioned are compounds described in paragraph [0118] of JP-A No. 11-65021, and paragraphs [0136] to [0193] of JP-A No. 11-223898, compounds represented by the formula (H), the formulas (1) to (3) and the formulas (A) and (B) in Japanese Patent Application No. 11-87297, and compounds represented by the formulas (III) to (V) in Japanese Patent Application No. 11-91652 (specifically, compounds denoted by Chemicals 21 to 24). Further, hard gradation accelerators are also described in paragraph [0102] of JP-A No. 11-65021, and paragraph [0194] to [0195] of JP-A No. 11-223898.

In a case in which a substance which generates formic acid or a salt thereof when decomposed is used as a strong fogging substance, the fogging substance is contained on a side having the image-forming layer containing the photosensitive silver halide, based on 1 mol of silver, in a quantity of preferably 5 millimol or less, and more preferably 1 millimol or less.

When the ultra-hard gradation enhancing agent is used in the photothermographic material according to the invention, it is preferable to use in combination an acid formed by hydration of phosphorus pentoxide or a salt thereof. As for such acids formed by hydration of phosphorus pentoxide or the salts thereof, mentioned are meta-phosphoric acid (and salts thereof), pyro-phosphoric acid (and salts thereof), ortho-phosphoric acid (and salts thereof), triphosphoric acid (and salts thereof), tetraphosphoric acid (and salts thereof), and hexameta-phosphoric acid (and salts thereof). Acids formed by hydration of phosphorus pentoxide or the salts thereof which are particularly preferably used are ortho-phosphoric acid (and salts thereof) and hexameta-phosphoric acid (and salts thereof). Specific examples of the salts include sodium ortho-phosphate, sodium dihydrogen ortho-phosphate, sodium hexameta-phosphate and ammonium hexameta-phosphate.

A quantity of the acid formed by hydration of phosphorus pentoxide or the salt thereof to be used (in terms of a coated quantity based on 1 $m^2$ of the photosensitive material) may be a desired quantity, depending on properties of sensitivity, fog, and the like; however, it is preferably in a range from 0.1 $mg/m^2$ to 500 $mg/m^2$, and more preferably from 0.5 $mg/m^2$ to 100 $mg/m^2$.

Preparation and Application of Coating Solution

A temperature at which the coating solution for the image-forming layer according to the invention is prepared is preferably in a range from 30° C. to 65° C., more preferably from 35° C. to less than 60° C., and still more preferably from 35° C. to 55° C. It is also preferable that the temperature of the coating solution for the image-forming layer immediately after the polymer latex is added thereto is maintained in a range from 30° C. to 65° C.

2. Layer Composition and Other Composition Components

The photothermographic material according to the invention may be a "one-side type" which has an image-forming layer only on one side of a support, or a "double-side type" which has the image-forming layer on both sides thereof. (Double-side-type photothermographic material)

A double-side-type photothermographic material according to the invention can be used in an image-forming method in which an X-ray image is recorded by using an X-ray intensifying screen.

The image-forming method which uses this double-side type preferably comprises at least the following steps of:

(a) obtaining an image-forming combined system by providing the photothermographic material between a pair of X-ray intensifying screens;

(b) placing a subject between the combined system and an X-ray source;

(c) irradiating an X-ray having an energy level of from 25 kVp to 125 kVp on the subject;

(d) retreaving the photothermographic material from the combined system; and (e) heating the thus-retreaved photothermographic material at a temperature of from 90° C. to 180° C.

The photothermographic material to be used in the combined system according to the invention is preferably prepared such that an image to be obtained by exposing the photosensitive material by an X-ray in a stepwise manner and, then, thermally developing it has a characteristic curve, being constructed on a crossed coordinates having same unit lengths of coordinate axes denoting optical density (D) and exposure quantity (logE) respectively, in which an average gamma (y) obtained by a point of a minimum density (Dmin) plus density 0.1 and a point of a minimum density (Dmin) plus density 1.2 is in a range from 0.5 to 0.9, and an average gamma (y) obtained by a point of a minimum density (Dmin) plus density 1.2 and a point of a minimum density (Dmin) plus density 1.6 is in a range from 3.2 to 4.0. When the photothermographic material having the characteristic curve is used in an X-ray photographing system, an X-ray image having excellent photographic characteristics in which a foot part of the characteristic curve is extremely extended and also a gamma value in an intermediate density part is high can be obtained. By these photographic characteristics, there is a merit in that depiction of a low density area, for example, a mediastinum area, or cardioshadowgraph which is low in X-ray transmission quantity becomes enhanced and, further, an image of a lung field which is subjected to a large X-ray exposure quantity comes to have a density which allows the lung field to be easily recognized and, also, comes to have a favorable contrast.

A soft tissue is photographed by using an X-ray having a tube potential of preferably 40 kV or less, and more preferably 35 kV or less. When the tube potential as described above is used, the soft tissue can be photographed as an easily-recognizable image.

The photothermographic material having such favorable characteristic curve as described above can easily be produced by, for example, a method in which an image-forming layer on each side is constituted by two or more layers which are different in sensitivity from each other. Prticularly, it is preferable to form the image-forming layer by using a high-speed emulsion having as an upper layer and an emulsion having photographic characteristics of low speed and hard tone as a lower layer. When the image-forming layer comprising such two layers as described above is used, a difference in speeds between silver halide emulsions of the two layers is in a range from 1.5 time to 20 times, and preferably from 2 times to 15 times. Further, a ratio of quantities of emulsions to be used in forming respective layers differs depending on differences in speeds and covering powers of the emulsions to be used. Ordinarily, as the difference in speeds of the emulsions to be used becomes larger, the ratio of quantities thereof becomes lower. For example, when the difference in speeds is two times, a preferable ratio of emulsions to be used, namely, a high-speed emulsion to a low-speed emulsion, is adjusted to be in a range from 1:20 to 1:50 in terms of silver quantity on condition that covering powers of respective emulsions are same with each other.

Emulsion sensitizing methods, various types of additives, constituting materials and the like to be used in preparation of the photothermographic material according to the invention are not particularly limited. For example, various types of techniques as described in, for example, JP-A Nos. 2-68539, 2-103037, and 2-115837 can be utilized.

As for techniques of cross-over cut (for double-side-type photosensitive material) and antihalation (for single-side-type material), dyes, dyes and mordants as described in JP-A No. 2-68539, from page 13, left lower column, line 1 to page 14, left lower column, line 9 can be used.

Next, sensitivity of the double-side-type photothermographic material will be described.

Exposure is conducted by using an X-ray intensifying screen and a monochromatic light which has a same wavelength as that of a main luminescent peak of the X-ray intensifying screen and a half bandwidth of 15±5 nm as a light source. As for methods for obtaining such light, a method which uses a filter system combined with an interference filter can be used. By this method, although depending on combinations of interference filters, ordinarily, light having a necessary exposure quantity and a half bandwidth of 15±5 nm can easily be obtained.

The photosensitive material placed 1 m apart from the light source is exposed for one second through a step-wedge of a neutral filter by using the above-described light as the light source in which luminance is accurately measured by a luminometer which has previously been appropriately calibrated.

After thermal development is performed, an image-forming layer provided on a side opposite to an exposed face from the support is removed to obtain an image. When the density of the thus-obtained image is measured, an exposure quantity which can obtain fog plus density 0.5 is measured to determine sensitivity of the photosensitive material. The sensitivity can be denoted in terms of lux·second. The image-forming layer can be removed by an organic solvent such as acetone, DMF, or MEK.

The sensitivity of the double-side-type photothermographic material according to the invention is preferably in a range from 0.005 lux·second to 0.07 lux·second, and more preferably from 0.007 lux·second to 0.05 lux·second.

Next, a fluorescent intensifying screen (radiation intensifying screen) will be described. The radiation intensifying screen comprises, as a basic structure, a support, and a phosphor layer formed on one side of the support. The phosphor layer is a layer in which a phosphor is dispersed in a binder. Further, a transparent protective layer is ordinarily provided on a surface of the phosphor layer opposite to the support (a surface thereof on a side not facing the support) to protect the phosphor layer from a chemical change in quality or a physical impact.

Examples of preferable phosphors according to the invention include a tungstate-type phosphor (for example, $CaWO_4$, $MgWO_4$, or $CaWO_4$:Pb), a terbium-activated rare earth metal oxysulfide-type phosphor (for example, $Y_2O_2S$:Tb, $Gd_2O_2S$:Tb, $La_2O_2S$:Tb, $(Y,Gd)_2O_2S$:Tb, (Y,Gd)$O_2S$:Tb,Tm), a terbium-activated rare earth metal phosphate-type phosphor (for example, $YPO_4$:Tb, $GdPO_4$:Tb, or $LaPO_4$:Tb), a terbium-activated rare earth element oxyhalogenide type phosphor (for example, LaOBr:Tb, LaOBr:Tb,Tm, LaOCl:Tb, LaOCi:Tb,Tm, GdOBr:Tb, or GdOCl:Tb] and a thulium-activated rare earth element oxyhalogenide type phosphor (for example, LaOBr:Tm, or LaOCl:Tm). a barium sulfate-type phosphor (for example, $BaSO_4$Pb, $BaSO_4$:$Eu^{2+}$, or (Ba, Sr)$SO_4$:$Eu^{2+}$), a divalent europium-activated alkaline earth metal phosphate-type phosphor (for example, $(Ba_2PO_4)_2$:$Eu^{2+}$, or $(Ba_2PO_4)_2$:$Eu^{2+}$), a divalent europium-activated alkaline earth metal fluorohalogenide-type phosphor (for example, BaFCl:$Eu^{2+}$, BaFBr:$Eu^{2+}$, BaFCl:$Eu^{2+}$,Tb, BaFBr:$Eu^{2+}$,Tb, $BaF_2$.BaCl.KCl:$Eu^{2+}$, or (Ba,Mg)$F_2$.BaCl.KCl:$Eu^{2+}$), an iodide-type phosphor (for example, CsI:Na, CsI:TI, or NaI,KI:TI), sulfide-type phosphor (for example, ZnS:Ag (Zn,Cd)S:Ag, (Zn,Cd)S:Cu, or (Zn,Cd)S:Cu,Al) and a hafnium phosphate-type phosphor (for example, $HfP_2O_7$:Cu). However, the invention is by no means limited thereto and any types of phosphors can be used, so long as they can emit visible light or light in a near-ultraviolet region.

The fluorescent intensifying screen according to the invention is preferably filled with the phosphor in a gradient diameter structure. Particularly, it is preferable that a phosphor grain having a large diameter is applied to a surface protective layer side and a phosphor grain having a small diameter to a support side. It is preferable that the small diameter is in a range from 0.5 μm to 2.0 μm while the large diameter is in a range from 10 μm to 30 μm.

Single-side-type Photothermographic Material

The single-side-type photothermographic material according to the invention is preferably used in particularly as a photosensitive material for mammography.

It is important that the single-side-type photothermographic material according to the invention is designed such that contrast of the image to be obtained falls in an appropriate range.

Next, a method for obtaining the characteristic curve of the photothermographic material according to the invention will be described. In the mammography, exposure is ordinarily performed by using an Mo target tube which emits a low potential X-ray. However, for practical use, a characteristic curve obtained by a method in which X-ray exposure quantity is changed by using an X-ray emitted from a tungsten-target tube as a radiation source by means of a distance method is not substantially different from that obtained by the above-described method, so long as the intensifying screen comprising a phosphor comprising $Gd_2O_2S$:Tb is used.

Specifically, when measurements were performed this time, a method in which the X-ray emitted from the tungsten target tube which was operated at 50 kVp generated by a three-phase power supply was allowed to transmit an aluminum plate having a thickness of 3 mm was used. A commercially available UM-Fine screen and a photosensitive material to be measured were allowed to be in contact with each other and, then, inserted in an ECMA cassette (trade name; manufacture by Fuji Photo Film Co., Ltd.). An X-ray tube, a cassette upper lid, a film, and a screen were aligned in the stated order and were subjected to an X-ray exposure. Exposure was conducted in a stepwise manner at a width of log E=0.15 by changing the X-ray exposure quantities by means of the distance method.

An exposed film is thermally developed under a predetermined condition and, then, density of the thus-developed film is measured. Thereafter, a characteristic curve is obtained by plotting a logarithm of an exposure quantity of an irradiation ray in abscissa against an optical density in ordinate. A contrast can be obtained from an inclination of a straight line (tangent θ when an angle of the straight line to abscissa is represented by θ) connected by two density points of fog plus 0.25 and fog plus 2.0.

Next, a measuring method of sensitivity of the photosensitive material will be described. A monochromatic light having a same wavelength as that of a main luminescent peak of the X-ray intensifying screen to be used is used in a same manner as in a case of the double-side-type photothermographic material. An exposure method is also same as in a case of the double-side-type photothermographic material. After thermal development is performed, density of the thus-obtained image is measured. Sensitivity of the photosensitive material can be obtained by measuring an exposure quantity which obtains fog plus density 0.5.

The sensitivity of the single-side-type photothermographic material according to the invention is preferably in a range from 0.01 lux·second to 0.07 lux·second, and more preferably from 0.01 lux·second to 0.05 lux·second. The contrast thereof is preferably in a range from 3.0 to 5.0 which is particularly advantageous for use in the mammography.

Next, an intensigying screen for mammography according to the invention will be described in detail.

The X-ray intensifying screen of a photographing combined system for mammography required high resolution compared with that for chest-area diagnosis or the like. Therefore, a commercially available ordinary X-ray intensifying screen for mammography is prepared by coloring a phosphor layer thereof to enhance the resolution. However, such coloring prevent light emitted by the X-ray absorbed by the phosphor present far from a surface to which the X-ray is incident from being effectively drawn out. For the X-ray intensifying screen according to the invention, it is required to provide a screen in which the phosphor capable of sufficiently absorbing the X-ray without substantially coloring the phosphor layer is applied to obtain a necessary high sharpness.

In order to achieve a targe of such a screen as described above, a grain size of the phosphor is preferably a given size or less. As for the measuring methods of the size of the phosphor, mentioned are, for example, a coulter-counter method, and an electron microscopy. An average sphere-equivalent diameter of such phosphor sizes is preferably in the range of rom 1 μm to 5 μm, and more preferably from 1 μm to 4 μm. Although these ranges are not important for a conventional screen for mammography which colors the phosphor layer, they are important for the screen according to the invention.

Further, in order to enhance sharpness with the screen, it is preferable that a rate of a binder in a weight ratio of the binder to the phosphor is small. The weight ratio of the binder to the phosphor is preferably in a range from 1/50 to 1/20, and more preferably from 1/50 to 1/25.

As for binders, known binders as described in JP-A No. 6-75097, from page 4, right column, line 45 to page 5, left column, line 10 can be used, thermoplastic elastomers having a softening temperature or melting point of from 30° C. to 150° C. are preferably used each individually or in combinations with other binder polymers. In such a screen having a small quantity of the binder for enhancing the sharpness as in the invention, durability thereof is liable to be deteriorated and, accordingly, it is necessary to select a binder which can withstand such deterioration. To solve such problem, it is preferable to select a binder having a sufficient flexibility. Further, it is preferable to incorporate, for example, a plasticizer, in the phosphor layer. Examples of thermoplastic elastomers include polystyrene, polyolefin, polyurethane, polyester, polyamide, polybutadiene, ethylene-vinyl acetate, natural rubber, fluororubber, polyisoprene, chlorinated polyethylene, styrene-butadiene rubber, and silicone rubber, in which polyurethane is particularly preferred. It is also important to select an appropriate binder of undercoat of the phosphor layer; an acrylic binder is preferably used.

Further, it is preferable that a surface protective layer of the screen is as thin as possible within a range in which scratch resistance and stain resistance are secured; thickness of the surface protective layer thereof is preferably in a range from 2 μm to 7 μm.

A material for the surface protective layer can be prepared by laminating PET (particularly stretched type), PEN, nylon and the like one on top of another. Further, it is also preferable from the standpoint of stain resistance that the surface protective layer is formed by applying a solution in which a fluorocarbon resin is dissolved in a solvent. A preferred embodiment of the fluocarbon resin is described in detail in JP-A No. 6-75097, page 6, from left column, 4 line to right column, 43 line. As for other resins which can form the surface protective layer in such a solvent-applycation manner as described above, mentioned are a polyurethane resin, a polyacrylic resin, a cellulose derivative, polymethyl methacrylate, a polyester resin, an epoxy resin and the like other than a fluorocarbon resin.

It is also important that a filling rate of the phosphor is sufficiently high for obtaining the screen having a high sensitivity and high sharpness. Specifically, a volume filling rate of the phosphor is preferably in a range from 60% to 80%, and more preferably from 65% to 80%. In order to maintain the volume filling rate by the phosphor of such fine grain according to the invention to be high, a process for compressing the phosphor layer as described in JP-A No. 6-75097, from page 4, right column, line 29 to page 6, left column, line 1 is favorably used.

It is preferable that the phosphor according to the invention is substantially $Gd_2O_2S$:Tb. The term "substantially" as used in the above description is intended to mean that a main component of the phosphor is $Gd_2O_2S$:Tb and, also, 1 to 9% of an additive for enhancing performance, silica for modifying the surface, or the like can favorably be used. Further, Y, La, or Lu can simultaneously be used replacing 1.0 to 90% of Gd.

Ordinarily, density of the phosphor is preferably high to effectively absorb the X-ray. As for phosphors which exhibit a preferable absorption of the X-ray emitted from a radiation source for use in the mammography, not only $Gd_2O_2S$:Tb, but also $YTaO_4$ and a derivative thereof prepared by adding any one of various types of activating agents thereto as a luminescence center, CaWO4, and BaFBr:Eu are mentioned.

Combination with Ultraviolet Fluorescent Screen

As or image-forming methods using photothermographic material according to the invention, a method in which images are formed in combination with a phosphor having a main peak at preferably 400 nm or less, and more preferably 380 nm or less can be used. The double-side-type photosensitive material and the single-side-type photosensitive material can each individually be used as a combined system. As for such screens each having a main peak at 400 nm or less, screens as described in, for example, JP-A No. 6-11804, and WO93/01521 can be used; however, the present invention is by no means limited thereto. As for techniques of crossover-cut of the ultraviolet ray (for double-side-type photosensitive material) and antihalation (for single-side-type photosensitive material), those as described in JP-A No. 8-76307 can be used.

The photothermographic material according to the invention preferably contains an ultraviolet ray-absorbing agent. As for such ultraviolet ray-absorbing agents, a dye as described in JP-A No. 2002-328090 is particularly preferred.

The photothermographic material according to the invention may contain a non-image-forming layer in addition to the image-forming layer. The non-image-forming layer can be classified according to its position as follows; (a) a surface protective layer formed on the image-forming layer (on a farther side from a support), (b) an intermediate layer formed between any two of a plurality of image-forming layers or between the image-forming layer and the protective layer, (c) an undercoat layer formed between the image-forming layer and the support, and (d) a back layer formed on a side opposite to the image-forming layer.

Further, a layer acting as an optical filter can be formed in the photosensitive material as a layer classified in the above-described (a) or (b). An antihalation layer is formed in the photosensitive material as a layer classified in the above-described (c) or (d).

1) Surface Protective Layer

The photothermographic material according to the invention may have a surface protective layer for the purpose of preventing adhesion of the image-forming layer and the like. The surface protective layer may be of a single layer or of a plurality of layers. Such surface protective layers are described in paragraphs [0119] to [0120] of JP-A No. 11-65021, and JP-A No. 2001-348546.

As for binders for the surface protective layer according to the invention, gelatin is preferably used, and polyvinyl alcohol (PVA) is also preferably used solely or in combination with gelatin. As for gelatin, inert gelatin (for example, Nitta Gelatin 750), phthalated gelatin (for example, Nitta Gelatin 801) and the like can be used.

As for PVA, those described in paragraphs [0009] to [0020] of JP-A No. 2000-171936 can be cited. PVA-105 as a completely saponified PVA, PVA-205 and PVA-335 as partly saponified PVA, and MP-203 as a modified polyvinyl alcohol (these are manufactured by Kuraray Co., Ltd.) are preferably mentioned.

A quantity (based on 1 $m^2$ of the support) of polyvinyl alcohol to be coated of the protective layer (per one layer) is preferably in a range from 0.3 $g/m^2$ to 4.0 $g/m^2$, and more preferably from 0.3 $g/m^2$ to 2.0 $g/m^2$.

A quantity (based on 1 $m^2$ of the support) of the entire binder (inclusive of water-soluble polymer and latex polymer) to be coated of the surface protective layer (per one layer) is preferably in a range from 0.3 $g/m^2$ to 5.0 $g/m^2$, and more preferably from 0.3 $g/m^2$ to 2.0 $g/m^2$.

2) Antihalation Layer

In the photothermographic material according to the invention, an antihalation layer can be formed at the farther side from an exposure light source relative to the image-forming layer. Such antihalation layers are described, for example, in paragraphs [0123] to [0124] of JP-A No. 11-65021, JP-A Nos. 11-223898, 9-230531, 10-36695, 10-104779, 11-231457, 11-352625, and 11-352626.

The antihalation layer contains an antihalation dye having an absorption in an exposure wavelength. When such exposure wavelength is in an infrared region, a dye absorbing an infrared ray may be used; on this occasion, the dye having no absorption in a visible wavelength region is preferred.

When antihalation is performed by using a dye having absorption in the visible wavelength region, it is preferred that color of the dye does not remain substantially after an image is formed, a device to decolorize the dye by heat in thermal development is used and a thermally decolorizable dye and a base precursor are added to the non-image-forming layer to allow the resultant non-image-forming layer to function as an antihalation layer. Such techniques are described in JP-A No. 11-231457 and the like.

A quantity of the decolorizable dye to be added is determined depending on applications of the dye. Ordinarily, the decolorizable dye is used in such a quantity as an optical density (absorbance) measured at the objective wavelength exceeds 0.1. The optical density is preferably in a range from 0.2 to 2. A quantity of the decolorizable dye for obtaining the above-described optical density is ordinarily in a range from about 0.001 $g/m^2$ to about 1 $g/m^2$.

When the dye is decolorized in such a way, the optical density after thermal development is performed can be lowered to 0.1 or less. Two or more types of decolorizable dyes may be used in combination in a thermally decolorizable-type recording material or in the photothermographic material. In a similar way, two or more types of base precursors may be used in combination.

In the thermal decolorization using such a decolorizable dye and base precursor as described above, it is preferable from the viewpoint of thermal decolorization properties and the like that a substance (for example, diphenylsulfone, or 4-chlorophenyl (phenyl)sulfone) which decreases a melting point by 3° C. or more when mixed with the base precursor as described in JP-A No. 11-352626 is simultaneously used.

3) Back Layer

Back layers applicable to the invention are described in paragraphs [0128] to [0130] of JP-A No. 11-65021. According to the invention, a coloring agent having an absorption maximum in the wavelength region of from 300 nm to 450 nm can be added for the purpose of improving silver color tone and improving change of image over time. Such coloring agents are described in, for example, JP-A Nos. 62-210458, 63-104046, 63-103235, 63-208846, 63-306436, 63-314535, 1-61745, and 2001-100363.

The coloring agents are each added ordinarily in a range from 0.1 $mg/m^2$ to 1 $g/m^2$. As a layer for such addition, a back layer provided on a side opposite to the image-forming layer is preferred.

4) Matting Agent

According to the invention, it is preferred to add a matting agent to the surface protective layer and the back layer for improving transportation properties. Such matting agents are described in paragraphs [0126] to [0127] of JP-A No. 11-65021.

A quantity of the matting agent to be added is, based on 1 $m^2$ of the photosensitive material, preferably in a range from 1 $mg/M^2$ to 400 $mg/m^2$, and more preferably from 5 $mg/m^2$ to 300 $mg/m^2$.

Further, as a matting degree of an emulsion surface, any degree is permissible so far as a so-called star dust-like defect in which a small blank area is generated in an image portion to cause a light leakage does not occur; however, a Beck's degree of smoothness is in the range preferably of from 30 seconds to 2000 seconds, and particularly preferably from 40 seconds to 1500 seconds. The Beck's degree of smoothness can easily be obtained in accordance with "Testing Method for Smoothness of Paper and Paperboard by Beck's Tester" that is known in the art.

According to the invention, the Beck's degree of smoothness as a matting degree for the back layer is preferably in a range from 10 seconds to 1200 seconds, more preferably from 20 seconds to 800 seconds, and still more preferably from 40 seconds to 500 seconds.

According to the invention, the matting agent is preferably contained in an outermost surface layer, a layer functioning as the outermost surface layer, or a layer in a neighborhood of the outer surface layer which functions as the so-called protective layer.

5) Polymer Latex

A polymer latex can be added in the surface protective layer or the back layer according to the invention. Such polymer latices are described in, for example, "Synthetic Resin Emulsion", compiled by Taira Okuda and Hiroshi Inagaki, Kobunshi Kankokai (Polymer Publishing) (1978), "*Application of Synthesized Latex*", compiled by Takaaki Sugimura, Yasuo Kataoka, Soichi Suzuki and Keiji Kasahara, Kobunshi Kankokai (Polymer Publishing) (1993), and Soichi Muroi, "*Chemistry of Synthesized Latex*", Kobunshi Kankokai (Polymer Publishing) (1970). Specific examples of the polymer latices include a latex of a methyl methacrylate (33.5% by mass)/ethyl acrylate (50% by mass)/methacrylic acid (16.5% by mass) copolymer, a latex of a methyl methacrylate (47.5% by mass)/butadiene (47.5% by mass)/itaconic acid (5% by mass) copolymer, a latex of an ethyl acrylate/methacrylic acid copolymer, a latex of a methyl methacrylate (58.9% by mass)/2-ethylhexyl acrylate (25.4% by mass)/styrene (8.6% by mass)/2-hydroxyethyl metacrylate (5.1% by mass)/acrylic acid (2.0% by mass) copolymer, and a latex of a methyl methacrylate (64.0% by mass)/styrene (9.0% by mass)/butyl acrylate (20.0% by mass)/2-hydroxyethyl metacrylate (5.0% by mass)/acrylic acid (2.0% by mass) copolymer.

A quantity of the polymer latex to be added in the surface protective layer or the back layer is, based on an entire binder (inclusive of water-soluble polymer and latex polymer), preferably in a range from 10% by mass to 90% by mass, and particularly preferably from 20% by mass to 80% by mass.

6) Film Surface pH

In the photothermographic material according to the invention, a film surface pH before the thermal development is preferably 7.0 or less, and more preferably 6.6 or less. A lower limit is not particularly restricted but is approximately 3. A most preferable pH is in a range from 4 to 6.2.

For adjusting the film surface pH, it is preferred from the viewpoint of lowering the film surface pH that an organic acid such as a phthalic acid derivative, a non-volatile acid such as sulfuric acid or a volatile base such as ammonia is used. Particularly, ammonia is preferable for achieving a low film surface pH, because ammonia is particularly apt to be vaporized and can be removed during a coating step or before being subjected to the thermal development.

Further, it is also preferred that a non-volatile base such as sodium hydroxide, potassium hydroxide or lithium hydroxide is used with ammonia in combination. Furthermore, measurement methods of the film surface pH are described in paragraph [0123] of JP-A No. 2000-2843997.

7) Film Hardening Agent

A film hardening agent may be used in each of the image-forming layer, the protective layer, the back layer and the like according to the invention. Examples of such film hardening agents are found in various methods described in T. H. James, *The Theory of the Photographic Process,* 4th edition, Macmillan Publishing Co., Inc., pp. 77 to 87 (1977). In addition to compounds such as chrome alum, sodium salt of 2,4-dichloro-6-hydroxy-s-triazine, N,N-ethylene bis(vinylsulfone acetamide) and N,N-propylene bis(vinylsulfone acetamide), polyvalent metal ions described in the above-cited reference, page 78 and the like, polyisocyanates as described in U.S. Pat. No. 4,281,060, JP-A No. 6-208193 and the like, epoxy compounds as described in U.S. Pat. No. 4,791,042, and vinyl sulfone-type compounds as described in JP-A No. 62-89048 are preferably used.

The film hardening agent is added as a solution. Timing of adding such film hardening agent solution into the coating solution for the protective layer is in a period of from 180 minutes before coating to immediately before coating, and preferably in a period of from 60 minutes before coating to 10 seconds before coating; however, mixing methods and mixing conditions for the film hardening agent solution are not particularly limited so far as the effects according to the invention are sufficiently realized.

Specific examples of mixing methods include a mixing method using a tank in which an average staying time calculated from an addition flow rate and a feeding flow rate to a coater is adjusted to be a desired time, and a mixing method using a static mixer described in N. Harnby, M. F. Edwards and A. W. Nienow, *Techniques of Mixing Liquids*, translated by Koji Takahashi, Nikkan Kogyo Newspaper (1989), Chapter 8 an the like.

8) Surfactant

Surfactants according to the invention are described in paragraph [0132] of JP-A No. 11-65021.

According to the invention, fluorine-type surfactants may preferably be used. Specific preferred examples of fluorine-type surfactants include compounds as described in, for example, JP-A Nos. 10-197985, 2000-19680, and 2000-214554. Also, polymeric fluorine-type surfactants as described in JP-A 9-281636 are preferably used. According to the invention, the fluorine-type surfactants as described in Japanese Patent Application No. 2000-206560 are particularly preferably used.

9) Antistatic Agent

Further, according to the invention, an antistatic layer containing various types of known metal oxides or electrically conductive polymers may be provided. The antistatic layer may concurrently functions as the above-described undercoat layer, back layer, surface protective layer or the like, or may separately be provided from these layers. The antistatic layer may adopt techniques as described in paragraphs [0135] of JP-A No. 11-65021, JP-A Nos. 56-143430, 56-143431, 58-62646, and 56-120519, paragraphs [0040] to [0051] of JP-A No. 11-84573, U.S. Pat. No. 5,575,957, and paragraphs [0078] to [0084] of JP-A No. 11-223898.

10) Support

As for transparent supports, polyester, particularly, polyethylene terephthalate, which has been subjected to a thermal treatment in the temperature range of from 130° C. to 185° C. in order to relax residual internal stress in the film generated when being biaxially stretched and to eliminate the strain of thermal contraction generated when subjected to the thermal treatment, is preferably used.

As for supports of the photothermographic material to be used in combination with an ultraviolet luminescent screen, PEN is favorably used. However, the invention is by no means limited thereto. In regard PEN, a polyethylene-2,6-naphthalate is preferred. As for the polyethylene-2,6-naphthalate used herein, any substance is permissible, so long as a recurring structural unit thereof is substantially constituted by an ethylene-2,6-naphthalene-dicarboxylate unit; examples of such polyethylene-2,6-naphthalates include not only an uncopolymerized polyethylene-2,6-naphthalene-dicarboxylate, but also a copolymer thereof in which 10% or less, and more preferably 5% or less of the recurring structural units therein is modified with other components, and a mixture or composition containing other polymers.

The polyethylene-2,6-naphthalate is synthesized by bonding naphthalene-2,6-dicarboxylic acid or a functional derivative, and ethylene glycol or a functional derivative in the presence of a catalyst under an appropriate reaction condition; however, examples of the polyethylene-2,6-naphthalates according to the invention also include a copolymerized or mixed polyester which is prepared by adding thereto one or more types of appropriate third components (modifying agent) before polymerization of the polyethylene-2,6-naphthalate is completed. Examples of the appropriate third components include a compound having a divalent ester-forming functional group, for example, a dicarboxylic acid such as oxalic acid, adipic acid, phthalic acid, isophthalic acid, telephthalic acid, naphthalene-2,7-dicarboxylic acid, succinic acid or diphenylether-dicarboxylic acid, a lower alkylester thereof, an oxycarbonic acid such as p-oxybenzoic acid or p-oxyethoxybenzoic acid, a layer alkylester thereof, and a dihydric alcohol such as propylene glycol or trimethylene glycol. As for such polyethylene-2,6-naphthalates or modified polymers thereof, for example, those prepared by blocking at least one of a terminal hydroxyl group and carboxylic group thereof by monofunctional compound such as benzoic acid, benzoylbenzoic acid, benzyloxybenzoic acid or methoxypolyalkylene glycol, and those modified by a very small amount of a three- or four-functional ester-forming compound such as glycerin or pentaerythritol within a range in which a linear copolymer is substantially obtained are permissible.

In case of the photothermographic materials for medical diagnosis use, the transparent support may be colored with a blue dye (for example, Dye-1 as described in JP-A No. 8-240877) or may not be colored.

Specific examples of the supports are described in paragraphs [0134] of JP-A No. 11-65021.

In the supports, undercoat techniques of a water-soluble polyester as described in JP-A No. 11-84574, a styrene-butadiene copolymer as described in JP-A No. 10-186565, vinylidene chloride copolymers as described in JP-A No.

2000-39684, paragraphs [0063] to [0080] of Japanese Patent Application No. 11-106881 and the like are preferably applied.

11) Other Additives

To the photothermographic material, an anti-oxidant, a stabilizing agent, a plasticizer, an ultraviolet ray-absorbing agent or a covering aid may further be added. A solvent as described in paragraph [0133] of JP-A No. 11-65021 may be added. Various types of these additives are added either to the image-forming layer or to the non-image-forming layer. In regard to those additives, WO98/36322, EP-A No. 803764, JP-A Nos. 10-186567 and 10-18568 and the like can be referred.

12) Coating Method

The photothermographic material according to the invention may be applied by any method. Various types of coating operations may be used; and specific examples thereof include extrusion coating, slide coating, curtain coating, dip coating, knife coating, flow coating, and extrusion coating using such a kind of hopper as described in U.S. Pat. No. 2,681,294. Extrusion coating or slide coating as described in Stephen F. Kistler and Peter M. Schweizer, Liquid Film Coating, Chapman & Hall, pp. 399 to 536 (1997) is preferably used. Particularly, slide coating is preferably used therebetween.

Examples of shapes of slide coaters to be used for slide coating are described in the above-cited book, pp. 427, FIG. 11b-I1. Further, as desired, two or more layers can simultaneously be coated by methods described in the above-cited book, pp. 399 to 536, U.S. Pat. No. 2,761,791 and BP-A No. 837,095.

It is preferable that a coating solution for the organic silver salt-containing layer according to the invention is a so-called thixotropic fluid. Techniques related to this fluid can be referred to JP-A No. 11-52509.

In regard to the coating solution for the organic silver salt-containing layer according to the invention, a viscosity thereof at the shearing velocity of 0.1 $S^{-1}$ is preferably in a range from 400 mPa·s to 100,000 mPa·s, and more preferably from 500 mPa·s to 20,000 mPa·s.

Further, a viscosity at the shearing velocity of 1000 $S^{-1}$ is preferably in a range from 1 mPa·s to 200 mPa·s, and more preferably from 5 mPa·s to 80 mPa·s.

13) Wrapping Material

It is preferable that the photothermographic material according to the invention is hermetically packed by a wrapping material having at least one of a low oxygen transmittance and a low moisture transmittance in order to prevent photographic properties from being deteriorated at the time of storage before being used, or prevent a product using the photothermographic material from being curled or curly deformed when the product is in roll form. The oxygen transmittance at 25° C. is preferably 50 ml/atm/$m^2$·day or less, more preferably 10 ml/atm/$m^2$·day or less, and still more preferably 1.0 ml/atm/$m^2$·day or less. The moisture transmittance is preferably 10 g/atm/$m^2$·day or less, more preferably 5 g/atm/$m^2$·day or less, and still more preferably 1 g/atm/$m^2$·day or less. Specific examples of employable wrapping materials in which at least one of the oxygen transmittance and the moisture transmittance is low include those as described in JP-A Nos. 8-254793 and 2000-206653.

A photothermographic material for use in an image-forming method employing an X-ray intensifying screen is preferably used in sheet form. A cutting step of cutting the photothermographic material in sheet form into sheets each having a predetermined size and a packaging step of containing the thus-cut photothermographic material in sheet form in a packaging material are preferably conducted in an environment having cleanliness of class 10,000 or less as defined by US Federal Standard 209d. Further, it is more effective to make the packaging material clean before the packaging step.

In the cutting step, the cleanliness defined by a measuring method in accordance with US Federal Standard 209d is more preferably class 7,000 or less, still more preferably class 4,000 or less, further still more preferably class 1,000 or less and particularly preferably class 500 or less.

In the packaging step, the cleanliness defined by a measuring method in accordance with US Federal Standard 209d is more preferably class 7,000 or less, still more preferably class 4,000 or less, further still more preferably class 1,000 or less and particularly preferably class 500 or less.

According to the invention, by performing at least one step of the cutting step and the packaging step in an environment having the cleanliness of class 10,000 or less defined by US Federal Standard 209d, a risk of generating an image defect at the time of recording an image on the photothermographic material in sheet form can be suppressed to a great extent. Specifically, when the image is recorded on the photothermographic material in sheet form, generation of a blanking phenomenon or a scratch can be minimized According to the invention, a packaging material to be used for packaging the photothermographic material in sheet form is preferably selected from among materials which least generate dust. Particularly, when an environment having the cleanliness of class 10,000 or less defined by US Federal Standard 209d can not be maintained by the dust derived from the packaging material, it is preferable that such a material as described above is not chosen.

14) Other Employable Techniques

As for techniques employable in the phototermographic materials according to the invention, techniques described in the following references are further cited: EP-A Nos. 803764, and 883022, WO98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, from 10-186569 to 10-186572, 10-197974, 10-197982, 10-197983, from 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832,11-84574, 11-65021, 11-109547, 11-125880, 11-129629, from 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, and 11-343420, Japanese Patent Application Nos. 2000-187298, 2000-10229, 2000-47345, 2000-206642, 2000-98530, 2000-98531, 2000-112059, 2000-112060, 2000-112104, 2000-112064, and 2000-171936.

15) Color Image Formation

Constitution of a multi-color photothermographic material may comprise a combination of at least two layers of different colors or may comprise one layer containing all colors therein as described in U.S. Pat. No. 4,708,928.

In a case of the multi-color photothermographic material, respective image-forming layers are, as described in U.S. Pat. No. 4,460,681, ordinarily maintained in a separate manner from one another by being provided with a functional or non-functional barrier layer between any two of the respective image-forming layers.

3. Image Forming Method

1) Exposure

The photosensitive material according to the invention may be exposed by any method; however, it is preferable to use laser light as an exposure source. The silver halide emulsion having a high silver iodide content according to the invention has so far had a problem in that sensitivity thereof is low. However, it was found that the problem of such low sensitivity is solved by performing writing-in by means of such an intense irradiation as laser light and image recording can be performed by a smaller energy than conventional. Thus, aimed sensitivity can be attained by performing writing-in by strong light in a short period of time.

Particularly when a quantity of exposure which realizes a maximum density (Dmax) is provided, a quantity of light on a surface of the photosensitive material is preferably in a range from 0.1 $W/mm^2$ tp 100 $W/mm^2$, more preferably from 0.5 $W/mm^2$ to 50 $W/mm^2$, and most preferably from 1 $W/mm^2$ to 50 $W/mm^2$.

As for laser light according to the invention, a gas laser ($Ar^+$, He—Ne, or He—Cd), a YAG laser, a dye laser, a semiconductor laser and the like are preferable. Further, a combination of the semiconductor laser with a second harmonic generating element or the like can also be used. Preferable laser is, although being determined in correspondence to a light-absorbing peak wavelength of a spectral sensitizing dye or the like of the photothermographic material, He—Ne laser or red semiconductor laser which radiates red to infrared light, or $Ar^+$, He—Ne, or He—Cd laser, or blue semiconductor laser which radiates blue to green light. In recent years, particularly, a module fabricated by unifying SHG (Second Harmonic Generator) element with the semiconductor laser, or the blue semiconductor laser has been developed, thereby rapidly attracting people's attention to a laser output device in a short wavelength region. Since the blue semiconductor laser is capable of performing ultra-fine image recording, increasing a recording density and obtaining a long-life and consistent output, it is expected that demand for the blue semiconductor laser will be increased. The peak wavelength of the laser light is, in terms of blue color, in a range from 300 nm to 500 nm and preferably from 400 nm to 500 nm, whereas, in terms of red to infrared, in a range from 600 nm to 900 nm and preferably from 620 nm to 850 nm.

The laser light is favorably used in a manner in which it is oscillated in a vertical multi-mode by a method such as a high frequency superimposition method.

2) Thermal Development

The photothermographic material according to the invention may be developed by any method. Ordinarily, a temperature of the photothermographic material which has imagewise been exposed is elevated to allow the photothermographic material to be developed. A development temperature is preferably in a range from 80° C. to 250° C., and more preferably from 100° C. to 140° C.

A development time is preferably in a range from 1 second to 60 seconds, more preferably from 5 seconds to 30 seconds, and particularly preferably from 5 seconds to 20 seconds.

A plate heater system is preferably used as a thermal development process. As for the thermal development process utilizing the plate heater system, processes as described in JP-A No. 11-133572 are preferable. These processes use a thermal development apparatus for obtaining a visible image by allowing the photothermographic material, in which a latent image has been formed, to contact a heating unit in a thermal development part. The heating unit comprises a plate heater and a plurality of pressing rollers arranged along one surface of the plate heater such that they face the surface. The photothermographic material is allowed to pass through between the pressing rollers and the plate heater to be thermally developed. It is preferable that the plate heater is divided into 2 to 6 steps, and that the top step has a temperature lowered by approximately 1° C. to 10° C.

Such methods are also described in JP-A No. 54-30032. According to these methods, moisture and organic solvents contained in the photothermographic material can be removed out of a system, and deformation of the support of the photothermographic material caused by rapid heating can also be suppressed.

3) System

As for laser imagers each having an exposure part and a thermal development part for the medical diagnosis use, Fuji Medical Dry Imager FM-DP L and Fuji Medical Dry Imager DRYPIX 7000 (both being trade name; being manufactured by Fuji Photo Film Co., Ltd.) can be mentioned. Such systems are described in Fuji Medical Review No. 8, pp. 39 to 55 and techniques described therein can be utilized. Further, the photothermographic material according to the invention can also be applied as a photothermographic material for the laser imager in "AD network" proposed by Fuji Film Medical Systems as a network system adapted to DICOM Standards.

4. Application of the Invention

The photothermographic material using a high silver iodide photographic emulsion according to the invention forms a black-and-white image based on a silver image; hence, it is preferred that the photothermographic material is used as a photothermographic material for medical diagnosis, as a photothermographic material for industrial photography, as a photothermographic material for printing use, and as a photothermographic material for COM use.

Next, particularly preferable embodiments according to the invention will be described.

(1-1) A photothermographic material comprising: a support and an image-forming layer comprising a non-photosensitive silver salt, a photosensitive silver halide, a binder, and a reduction agent on the support, wherein a silver iodide content in the photosensitive silver halide is in a range from 40 mol % to 100 mol %; and an average sphere-equivalent diameter of the photosensitive silver halide is in a range from 0.3 μm to 5.0 μm.

(1-2) The photothermographic material as described in (1-1), further comprising a compound which after thermal development substantially reduces visible light absorption caused by the photosensitive silver halide.

(1-3) The photothermographic material as described in (1-2), wherein the compound which after thermal development substantially reduces visible light absorption caused by the photosensitive silver halide is a silver iodide complex forming agent.

(1-4) The photothermographic material as described in any one of (1-1) to (1-3), wherein the photosensitive silver halide resides as tabular grains having an aspect ratio of 2 or more.

(1-5) The photothermographic material as described in any one of (1-1) to (1-4), wherein at least 50%, in terms of a projected area, of the photosensitive silver halide is occupied by tabular grains having an aspect ratio of from 2 to 100.

(1-6) The photothermographic material as described in any one of (1-1) to (1-5), wherein at least 50%, in terms of a projected area, of the photosensitive silver halide is occupied by tabular grains having an aspect ratio of from 2 to 50.

(1-7) The photothermographic material as described in any one of from (1-1) to (1-6), wherein the average sphere-equivalent diameter of the photosensitive silver halide is in a range from 0.4 μm to 3.0 μm.

(1-8) The photothermographic material as described in any one of from (1-1) to (1-7), wherein the photosensitive silver halide contains silver iodide in an amount from 70 mol % to 100 mol %.

(1-9) The photothermographic material as described in any one of from (1-1) to (1-8), wherein the photosensitive silver halide contains silver iodide in an amount from 80 mol % to 100 mol %.

(1-10) The photothermographic material as described in any one of from (1-1) to (1-9), wherein the photosensitive silver halide contains silver iodide in an amount from 90 mol % to 100 mol %.

(1-11) The photothermographic material as described in any one of from (1-1) to (1-10), wherein the photosensitive silver halide contains a metal belonging to groups 3 to 14 in the periodic table or a complex thereof.

(1-12) The photothermographic material as described in any one of from (1-1) to (1-11), wherein the photosensitive silver halide contains a metal belonging to groups 3 to 11 in the periodic table or a complex thereof.

(1-13) The photothermographic material as described in any one of from (1-1) to (1-12), wherein the silver iodide complex forming agent is a compound represented by the formula (1) or (2).

(1-14) The photothermographic material as described in (1-13), wherein the compound represented by the formula (1) is a pyridine derivative represented by the formula (3).

(1-15) The photothermographic material as described in (1-13), wherein the compound represented by the formula (1) is a pyridazine derivative represented by the formula (4).

(1-16) The photothermographic material as described in (1-13), wherein the compound represented by the formula (1) is a 5- to 7-membered heterocycle, containing at least one mercapto group as a substituent and at least one of a nitrogen atom and a sulfur atom.

(1-17) The photothermographic material as described in (1-13), wherein the compound represented by the formula (1) is a compound represented by any one of the formulas (5) to (7).

(1-18) The photothermographic material as described in (1-13), wherein the compound represented by the formula (2) is a compound represented by the formula (8) or (9).

(1-19) The photothermographic material as described in any one of (1-13) to (1-17), wherein the compound represented by the formula (1) is a nitrogen-containing heterocyclic compound, and an acid dissociation constant (pKa) of a conjugate acid thereof in a tetrahydrofuran-water mixed solution (tetrahydrofuran: water=3:2) at 25° C. is in a range from 3 to 8.

(1-20) The photothermographic material as described in any one of (1-13), (1-14), and (1-19), wherein the compound represented by the formula (1) is a pyridine derivative represented by the formula (3), and that an acid dissociation constant (pKa) of a conjugate acid thereof in a tetrahydrofuran-water mixed solution (tetrahydrofuran: water=3:2) at 25° C. is in a range from 3 to 8.

(1-21) The photothermographic material as described in any one of (1-1) to (1-21), further comprising at least one of phthalic acid and a derivative thereof.

(1-22) The photothermographic material as described in any one of (1-1) to (1-21), further comprising a compound in which a one-electron-oxidized form generated by oxidizing one electron therein can release one or more electrons.

(1-23) The photothermographic material as described in (1-22), wherein the compound in which the one-electron-oxidized form generated by oxidizing one electron therein can release one or more electrons is at least one compound selected from the compound types 1 to 5.

(1-24) The photothermographic material as described in any one of (1-1) to (1-23), further comprising a development accelerator.

(1-25) The photothermographic material as described in any one of (1-1) to (1-24), further comprising a compound having an adsorptive group to a silver halide and a reducing group.

(1-26) The photothermographic material as described in (1-25), further comprising a compound represented by the formula (I) as the compound having an adsorptive group to a silver halide and a reducing group.

(1-27) The photothermographic material as described in any one of (1-1) to (1-26), wherein the image-forming layer is provided on each side of the support.

(1-28) The photothermographic material as described in (1-27) which is imagewise exposed by using an X-ray intensifying screen, being characterized in that, when exposure is conducted with an exposure quantity in a range from 0.005 lux·second to 0.07 lux·second by using a monochromatic light which has a same wavelength as that of a main luminescent peak of the X-ray intensifying screen and a half bandwidth of 15±5 nm, an image density obtained by removing an image-forming layer provided on a side opposite to an exposed face from the support becomes minimum density plus 0.5.

(1-29) An image-forming method which uses the photothermographic material as described in (1-27) or (1-28), comprising the steps of:

(a) obtaining an image-forming combined system by providing the photothermographic material between a pair of X-ray intensifying screens;

(b) placing a subject between the combined system and a monochromatic light source;

(c) irradiating a monochromatic light having an energy level of from 25 kVp to 125 kVp on the subject;

(d) retreaving the photothermographic material from the combined system; and (e) heating the thus-retreaved photothermographic material at a temperature of from 90° C. to 180° C.

(1-30) The photothermographic material as described in any one of (1-1) to (1-26), comprising the image-forming layer provided only on one surface of the support, being characterized in that, when exposure is conducted by using an X-ray intensifying screen and a monochromatic light which has a same wavelength as that of a main luminescent peak of the X-ray intensifying screen and a half bandwidth of 15±5 nm, an image density after thermal development becomes minimum density plus 0.5 at the time of an exposure quantity of from 0.01 lux·second to 0.07 lux·second, and an image contrast after thermal development is in a range from 3.0 to 5.0.

(1-31) An image-forming method, being characterized by photographing a soft tissue by using the photothermographic material as described in (1-30) and a monochromatic light having a tube potential of 40 kV or less.

(1-32) The photothermographic material as described in any one of (1-1) to (1-27) and (1-30), further comprising an ultraviolet ray-absorbing agent.

(1-33) The photothermographic material as described in (1-32), being characterized by being used in combination with an X-ray intensifying screen having a luminescent peak in an ultraviolet region.

(2-1) A photothermographic material comprising: a support and an image-forming layer comprising a non-photosensitive silver salt, a photosensitive silver halide, a binder, and a reduction agent on the support, wherein a silver iodide content in the photosensitive silver halide is in a range from 40 mol % to 100 mol %;

an average sphere-equivalent diameter of the photosensitive silver halide is in a range from 0.3 μm to 5.0 at least 50%, in terms of a projected area, of the photosensitive silver halide is occupied by tabular silver halide grains having an aspect ratio of from 2 to 50 and being deposited with a silver salt in an epitaxial growth manner;

and wherein the image-forming layer further contains a silver iodide complex forming agent.

(2-2) A photothermographic material comprising: a support and an image-forming layer comprising a non-photosensitive silver salt, a photosensitive silver halide, a binder, and a reduction agent on the support, wherein a silver iodide content in the photosensitive silver halide is in a range from 40 mol % to 100 mol %;

an average sphere-equivalent diameter of the photosensitive silver halide is in a range from 0.3 μm to 5.0 μm;

at least 50%, in terms of a projected area, of the photosensitive silver halide is occupied by tabular silver halide grains having an aspect ratio of from 2 to 50 and having one or more dislocation lines respectively;

and wherein the image-forming layer further contains a silver iodide complex forming agent.

(2-3) The photothermographic material as described in (2-1), wherein the silver salt is silver chloride.

(2-4) The photothermographic material as described in (2-1), wherein the silver salt is silver bromide.

(2-5) The photothermographic material as described in any one of (2-1) to (2-4), wherein silver iodide content in the photosensitive silver halide is in a range from 80 mol % to 100 mol % of.

(2-6) The photothermographic material as described in any one of (2-1) to (2-4), wherein silver iodide content in the photosensitive silver halide is in a range from 90 mol % to 100 mol % of silver iodide.

(2-7) The photothermographic material as described in any one of (2-1) to (2-6), further comprising at least one type of a compound having an adsorptive group to the photosensitive silver halide, a reducing group, and a precursor thereof.

(2-8) The photothermographic material as described in any one of (2-1) to (2-7), further comprising a compound in which a one-electron-oxidized form generated by oxidizing one electron therein can release one or more electrons.

(2-9) The photothermographic material as described in any one of (2-1) to (2-8), further comprising a development accelerator.

(2-10) The photothermographic material as described in any one of (2-1) to (2-9), further comprising at least one type of phthalic acid and a derivative thereof.

(2-11 The photothermographic material as described in any one of (2-1) to (2-10), wherein the image-forming layer is provided on each side of the support.

(2-12) The photothermographic material as described in (2-11), which is imagewise exposed by using an X-ray intensifying screen, being characterized in that, when exposure is conducted with an exposure quantity in a range from 0.005 lux·second to 0.07 lux·second by using a monochromatic light which has a same wavelength as that of a main luminescent peak of the X-ray intensifying screen and a half bandwidth of 15±5 nm, an image density to be obtained by removing an image-forming layer provided on a side opposite to an exposed face from the support becomes minimum density plus 0.5.

(2-13) The photothermographic material as described in any one of (2-1) to (2-10) in which the image-forming layer is provided only on one surface of the support, being characterized in that, when exposure is conducted with an exposure quantity of from 0.01 lux·second to 0.07 lux·second by using an X-ray intensifying screen and a monochromatic light which has a same wavelength as that of a main luminescent peak of the X-ray intensifying screen and a half bandwidth of 15±5 nm, an image density becomes minimum density plus 0.5 and an image contrast after thermal development is in a range from 3.0 to 5.0.

(2-14) An image-forming method which uses the photothermographic material as described in (2-11) or (2-12), being characterized by comprising the steps of:

(a) obtaining an image-forming combined system by providing the photothermographic material between a pair of X-ray intensifying screens;

(b) placing a subject between the combined system and a monochromatic light source;

(c) irradiating a monochromatic light having an energy level of from 25 kVp to 125 kVp on the subject;

(d) retreaving the photothermographic material from the combined system; and (e) heating the thus-retreaved photothermographic material at a temperature of from 90° C. to 180° C.

(2-15) The image-forming method as described in (2-14), being characterized by photographing a soft tissure by using the monochromatic light having a tube potential of 40 kV or less.

(2-16) The photothermographic material as described in any one of (2-1) to (2-13), further comprising an ultraviolet ray-absorbing agent.

(2-17) The photothermographic material as described in any one of (2-1) to (2-11), being characterized by being exposed by means of an X-ray intensifying screen having a luminescent peak in an ultraviolet region.

EXAMPLES

Hereinafter, specific examples are given below to illustrate the invention and should not be interpreted as limiting it in any way.

Example 1-1

1. Preparation of PET Support and Undercoating 1-1. Film Forming

PET having an intrinsic viscosity IV=0.66 (measured at 25° C. in phenol/tetrachlorethane=6/4 (ratio by weight)) was obtained in accordance with an ordinary preparation method by using terephthalic acid and ethylene glycol. After the thus-obtained PET is pelletized, the resultant pellets were dried at 130° C. for 4 hours. Then, the thus-dried pellets was extruded from a T-type die, and rapidly quenched, thereby preparing an unstretched film having a film thickness of 175 μm after thermal fixation.

The thus-prepared film was stretched up to 3.3 times in the machine direction with rollers having different peripheral velocities, then up to 4.5 times in the transverse direction by means of a tenter. The temperatures at the time of such stretching were 110° C. and 130° C. in the above sequence. Subsequently, the thus-stretched film was subjected to thermal fixation at 240° C. for 20 seconds and, then, to relaxation by 4% in the transverse direction at the same temperature as at the thermal fixation. Thereafter, chucking parts of the tenter were slit off, and both edges of the film were subjected to knurl processing. The film was rolled at 4 kg/cm$^2$ to obtain a roll of film having a thickness of 175 μm.

1-2. Corona Discharge Surface Treatment

Both surfaces of the support were treated at room temperature at the web handling velocity of 20 m/min by using a solid-state corona discharge processor Model 6KVA manufactured by Pillar Co. From values of electric current and voltage read at that time, it was found that a treatment of 0.375 kV·A·min/m$^2$ was applied to the support. A treatment frequency was 9.6 kHz and a gap clearance between an electrode and a dielectric roll was 1.6 mm.

1-3. Undercoat

1) Preparation of Coating Solution for Undercoat Layer

| Prescription-1 (For Undercoat Layer on Photosensitive Layer Side) | |
|---|---|
| Pesresin A-520 (30% by mass solution) manufactured by Takamatsu Oil & Fat, Inc. | 59 g |
| Polyethylene glycol monononylphenyl ether (average number of ethylene oxide = 8.5; 10% by mass solution) | 5.4 g |
| MP-1000 (polymeric fine grains; average grain diameter: 0.4 μm) manufactured by Soken Kagaku Co., Ltd. | 0.91 g |
| Distilled water | 935 ml |
| **Prescription-2 (For First Layer on Back Surface)** | |
| Styrene/butadiene copolymer latex (solid content: 40% by mass; weight ratio of styrene/butadiene = 68/32) | 158 g |
| Sodium salt of 2,4-dichloro-6-hydroxy-S-triazine (8% by mass aqueous solution) | 20 g |
| Sodium laurylbenzene sulfonate (1% by mass aqueous solution) | 10 ml |
| Distilled water | 854 ml |
| **Prescription-3 (For Second Layer on Back Surface)** | |
| $SnO_2$/SbO (9/1 mass ratio; average grain diameter: 0.038 μm; 17% by mass dispersion) | 84 g |
| Gelatin (10% by mass aqueous solution) | 89.2 g |
| Metolose TC-5 (2% by mass aqueous solution) manufactured by Shin-Etsu Chemical Co., Ltd. | 8.6 g |
| MP-1000 manufactured by Soken Kagaku Co., Ltd. | 0.01 g |
| Sodium dodecylbenzene sulfonate (1% by mass aqueous solution) | 10 ml |
| NaOH (1% by mass) | 6 ml |
| Proxel manufactured by ICI Co., Ltd. | 1 ml |
| Distilled water | 805 ml |

2) Undercoating

After the corona discharge treatment was performed on both surfaces of a biaxially stretched polyethylene terephthalate support having a thickness of 175 μm, the undercoating solution of Prescription-1 was applied on one surface (photosensitive layer surface) thereof by means of a wire-bar in a wet coated quantity of 6.6 ml/m$^2$ (per one surface) and dried at 180° C. for 5 minutes. Then, the undercoating solution of Prescription-2 was applied on the opposite surface (back surface) by means of a wire-bar in a wet coated quantity of 5.7 ml/m$^2$ and dried at 180° C. for 5 minutes. Further, the undercoating solution of Prescription-3 was applied on the opposite surface (back surface) by means of a wire-bar in a wet coated quantity of 7.7 ml/m$^2$ and dried at 180° C. for 6 minutes to prepare an undercoated support.

2. Preparation of Coating Material

1) Silver Halide Emulsion

Preparation of Silver Halide Emulsion 1A

To 1,421 ml of distilled water, 3.1 ml of a 1% by mass potassium bromide solution was added and, further, 3.5 ml of sulfuric acid having a concentration of 0.5 mol/L and 31.7 g of phthalated gelatin were added. While being kept stirring at 30° C. in a reaction vessel made of stainless steel, the resultant mixture was added with an entire quantity of both of a solution A which has been prepared by adding distilled water to 22.22 g of silver nitrate to make an entire volume up to 95.4 ml and a solution B which has been prepared by adding distilled water to 15.3 g of potassium bromide and 0.8 g of potassium iodide to make an entire volume up to 97.4 ml at a constant flow-rate consuming 45 seconds and, then, added with 10 ml of a 3.5% by mass aqueous solution of hydrogen peroxide and, thereafter, added with 10.8 ml of a 10% by mass aqueous solution of benzimidazole and, further, added with both of a solution C which has been prepared by adding distilled water to 51.86 g of silver nitrate to make an entire volume up to 317.5 ml and a solution D which has been prepared by adding distilled water to 44.2 g of potassium bromide and 2.2 g of potassium iodide to make an entire volume up to 400 ml such that an entire quantity of the solution C was added at a constant flow rate consuming 20 minutes and the solution D was added by a controlled-double-jet method while keeping a pAg value at 8.1 and, 10 minutes after such additions of the solution C and the solution D were started, added with an entire quantity of potassium hexachloroiridate (III) so as to be $1\times10^{-4}$ mol, based on 1 mol of silver and, five seconds after the addition of the solution C was completed, added with an entire quantity of $3\times10^{-4}$ mol, based on 1 mol of silver, of an aqueous solution of potassium hexacyanoiron (II). A pH of the resultant mixture was adjusted to 3.8 by using sulfuric acid having a concentration of 0.5 mol/L and, then, a stirring operation was stopped to perform precipitation/desalination/washing steps. Subsequently, a pH of the mixture thus subjected to these steps was adjusted to 5.9 by using sodium hydroxide having a concentration of 1 mol/L, thereby preparing a silver halide dispersion having a pAg value of 8.0.

While being kept stirring at 38° C., the thus-prepared silver halide dispersion was added with 5 ml of a 0.34% by mass methanol solution of 1,2-benzisothiazolin-3-one and, after 40 minutes elapsed, heated to 47° C. and, 20 minutes after such heating, added with $7.6\times10^{-5}$ mol, based on 1 mol of silver, of a methanol solution of sodium benzene thiosulfonate and, after 5 minutes elapsed, added with $2.9\times10^{-4}$ mol, based on 1 mol of silver, of a methanol solution of a tellurium sensitizing agent C and, then, ripened for 91 minutes and, thereafter, added with $1.2\times10^{-3}$ mol, as a total of a spectral sensitizing dye A and a sensitizing dye B based on 1 mol of silver, of a methanol solution of a 3:1 mixture in a molar ratio of the spectral sensitizing dye A and the sensitizing dye B and, after one minute elapsed, added with 1.3 ml of a 0.8% by mass methanol solution of N,N'-dihydroxy-N"-diethylmelamine and, after 4 minutes elapsed, added with $4.8\times10^{-3}$ mol, based on 1 mol of silver, of a methanol solution of 5-methyl-2-mercaptobenzimidazole, $5.4\times10^{-3}$ mol, based on 1 mol of silver, of a methanol solution of 1-phenyl-2-heptyl-5-mercapto-1,3,4-triazole, and $8.5\times10^{-3}$ mol, based on 1 mol of silver, of an aqueous solution of a 1-(3-methylureidophenyl)-5-mercaptotetrazole, thereby preparing a silver halide emulsion 1A.

Grains in the thus-prepared silver halide emulsion were silver iodobromide grains in cubic form having (100) face ratio of 80%, an average sphere-equivalent diameter of 0.042 μm, a variation coefficient of a sphere-equivalent diameter of 20%, and uniformly containing 3.5 mol % of iodine. A grain size or the like was determined based on an average of 1,000 grains obtained by using an electron microscope.

A silver halide emulsion 1A' was prepared by adjusting in a same manner as in the silver halide emulsion 1A except for removing the sensitizing dyes A and B therefrom. (1) 100 g of an emulsion solution in which an Ag concentration of the silver halide emulsion 1A' has been adjusted to be 0.07 mM and (2) 100 cc of a solution in which the sensitizing dye A has been dissolved in methanol such that it had concentrations as shown in Table 1 were prepared and, then, the solutions (1) and (2) were mixed with each other and sufficiently stirred. Thereafter, the resultant mixture was centrifuged at a rotation speed of 18000 rpm for 2 hours until silver halide emulsion grains were sufficiently precipitated. After such centrifugation, spectral absorption of a supernatant thereof was measured and a value obtained at that time was set as $S_2$. Next, a gelatin solution having a same concentration as that of the silver halide emulsion in place of the silver halide emulsion, and the sensitizing dye solution were mixed with each other and centrifuged under a same condition. Thereafter, spectral absorption of a supernatant thereof was measured and a value obtained at that time was set as $S_0$. When the equation of $S_1/S_0=(S_0-S_2)/S_0$ was constructed, the result of the adsorption ratio of the dye, namely, $S_1/S_0$ are shown in Table 1.

TABLE 1

| Test No. | Dye concentration (mM) | $S_1/S_0$ |
|---|---|---|
| 1 | 0.7 | 0.25 |
| 2 | 0.07 | 0.53 |
| 3 | 0.007 | 0.71 |
| 4 | 0.0007 | 0.90 |
| 5 | 0.00007 | 0.95 |

Preparation of Silver Halide Emulsion 1B

A silver halide emulsion 1B was prepared in a same manner as in the preparation of the silver halide emulsion A except for removing potassium iodide. Grains in the thus-prepared silver halide emulsion were silver bromide grains in cubic form having (100) face ratio of 85%, an average sphere-equivalent diameter of 0.07 μm, and a variation coefficient of a sphere-equivalent diameter of 15%.

Preparation of Silver Halide Emulsion 1C

To 1,420 ml of distilled water, 4.3 ml of a 1% by mass potassium iodide solution was added and, further, 3.5 ml of sulfuric acid having a concentration of 0.5 mol/L and 36.7 g of phthalated gelatin were added. While being kept stirring at 35° C. in a reaction vessel made of stainless steel, the resultant mixture was added with an entire quantity of both of a solution A which has been prepared by adding distilled water to 22.22 g of silver nitrate to make an entire volume up to 195.6 ml and a solution B which has been prepared by adding distilled water to 21.8 g of potassium iodide to make an entire volume up to 219 ml at a constant flow-rate consuming 9 minutes and, then, added with 10 ml of a 3.5% by mass aqueous solution of hydrogen peroxide and, thereafter, added with 10.8 ml of a 10% by mass aqueous solution of benzimidazole and, further, added with both of a solution C which has been prepared by adding distilled water to 51.86 g of silver nitrate to make an entire volume up to 317.5 ml and a solution D which has been prepared by adding distilled water to 60 g of potassium iodide to make an entire volume up to 600 ml such that an entire quantity of the solution C was added at a constant flow rate consuming 120 minutes and the solution D was added by a controlled-double-jet method while keeping a pAg value at 8.1.

10 minutes after such additions of the solution C and the solution D were started, added with an entire quantity of potassium hexachloroiridate (III) so as to be $1\times10^{-4}$ mol, based on 1 mol of silver and, five seconds after the addition of the solution C was completed, added with an entire quantity of $3\times10^{-4}$ mol, based on 1 mol of silver, of an aqueous solution of potassium hexacyanoiron (II). A pH of the resultant mixture was adjusted to 3.8 by using sulfuric acid having a concentration of 0.5 mol/L and, then, a stirring operation was stopped to perform precipitation/desalination/washing steps. Subsequently, a pH of the mixture thus subjected to these steps was adjusted to 5.9 by using sodium hydroxide having a concentration of 1 mol/L, thereby preparing a silver halide dispersion having a pAg value of 8.0.

While being kept stirring at 38° C., the thus-prepared silver halide dispersion was added with 5 ml of a 0.34% by mass methanol solution of 1,2-benzisothiazolin-3-one and, then, heated to 47° C. and, 20 minutes after such heating, added with $7.6\times10^{-5}$ mol, based on 1 mol of silver, of a methanol solution of sodium benzene thiosulfonate and, after 5 minutes elapsed, added with $2.9\times10^{-4}$ mol, based on 1 mol of silver, of a methanol solution of a tellurium sensitizing agent C and, then, ripened for 91 minutes and, thereafter, added with 1.3 ml of a 0.8% by mass methanol solution of N,N'-dihydroxy-N"-diethylmelamine and, after 4 minutes elapsed, added with $4.8\times10^{-3}$ mol, based on 1 mol of silver, of a methanol solution of 5-methyl-2-mercaptobenzimidazole, and $5.4\times10^{-3}$ mol, based on 1 mol of silver, of a methanol solution of 1-phenyl-2-heptyl-5-mercapto-1,3,4-triazole, thereby preparing a silver halide emulsion 1C.

The grain in the thus-prepared silver halide emulsion was in tetradecahedral form having (100), {100}, and {101} faces and a ratio of γ phase thereof was 30%. Further, the grain was a pure silver iodide grain having an average sphere-equivalent diameter of 0.30 μm and a variation coefficient of a sphere-equivalent diameter of 15%. A size or the like of the grain was determined based on an average of 1000 grains obtained by using an electron microscope.

Preparation of Silver Halide Emulsion 1D

To 1,421 ml of distilled water, 4.3 ml of a 1% by mass potassium iodide solution was added and, further, 3.5 ml of sulfuric acid having a concentration of 0.5 mol/L, 36.5 g of phthalated gelatin, and 160 ml of a 5% by mass methanol solution of 2,2'-(ethylenedithio)diethanol were added. While being kept stirring at 75° C. in a reaction vessel made of stainless steel, the resultant mixture was added with both of a solution A which has been prepared by adding distilled water to 22.22 g of silver nitrate to make an entire volume up to 218 ml and a solution B which has been prepared by adding distilled water to 36.6 g of potassium iodide to make an entire volume up to 366 ml such that an entire quantity of the solution A was added at a constant flow-rate consuming 38 minutes and the solution B was added by a controlled-double-jet method while keeping a pAg value at 10.2 and, then, added with 10 ml of a 3.5% by mass aqueous solution of hydrogen peroxide and, thereafter, added with 10.8 ml of a 10% by mass aqueous solution of benzimidazole and, further, added with both of a solution C which has been prepared by adding distilled water to 51.86 g of silver nitrate to make an entire volume up to 508.2 ml and a solution D which has been prepared by adding distilled water to 63.9 g of potassium iodide to make an entire volume up to 639 ml such that an entire quantity of the solution C was added at a constant flow rate consuming 63 minutes and the solution D was added by a controlled-double-jet method while keeping a pAg value at 10.2. Then, 10 minutes after such additions of the solution C and the solution D were started, the resultant mixture was added with an entire quantity of potassium hexachloroiridate (III) so as to be $1\times10^{-4}$ mol, based on 1 mol of silver and, five seconds after the addition of the solution C was completed, added with an entire quantity of $3\times10^{-4}$ mol, based on 1 mol of silver, of an aqueous solution of potassium hexacyanoiron (II). A pH of the resultant mixture was adjusted to 3.8 by using sulfuric acid having a concentration of 0.5 mol/L and, then, a stirring operation was stopped to perform precipitation/desalination/washing steps. Subsequently, a pH of the mixture thus subjected to these steps was adjusted to 5.9 by using sodium hydroxide having a concentration of 1 mol/L, thereby preparing a silver halide dispersion having a pAg value of 11.0.

While being kept stirring at 38° C., the thus-prepared silver halide dispersion was added with 5 ml of a 0.34% by mass methanol solution of 1,2-benzisothiazolin-3-one and, after 40 minutes elapsed, heated to 47° C. and, 20 minutes after such heating, added with $7.6\times10^{-5}$ mol, based on 1 mol of silver, of a methanol solution of sodium benzene thiosulfonate and, after 5 minutes elapsed, added with $2.9\times10^{-4}$ mol, based on 1 mol of silver, of a methanol solution of a tellurium sensitizing agent C and, then, ripened for 91 minutes and, thereafter, added with $1.2\times10^{-3}$ mol, as a total of sensitizing dyes A and B based on 1 mol of silver, of a methanol solution of a 3:1 mixture in a molar ratio of the sensitizing dyes A and B and, after one minute elapsed, added with 1.3 ml of a 0.8% by mass methanol solution of N,N'-dihydroxy-N"-diethylmelamine and, after 4 minutes elapsed, added with $4.8\times10^{-3}$ mol, based on 1 mol of silver, of a methanol solution of 5-methyl-2-mercaptobenzimidazole, $5.4\times10^{-3}$ mol, based on 1 mol of silver, of a methanol solution of 1-phenyl-2-heptyl-5-mercapto-1,3,4-triazole, and $8.5\times10^{-3}$ mol, based on 1 mol of silver, of an aqueous solution of a 1-(3-methylureidophenyl)-5-mercaptotetrazole, thereby preparing a silver halide emulsion 1D.

The thus-prepared silver halide emulsion 1D was a pure silver iodide emulsion in which tabular grains having an average projected area diameter of 1.369 μm, a variation coefficient of the average projected area diameter of 19.7%, an average thickness of 0.130 μm, and an average aspect ratio of 11:1 occupy 80% or more of an entire projected area. A sphere-equivalent diameter of the grain was 0.707 μm. As a result of an X-ray powder diffraction analysis, it was found that 90% or more of silver iodide was present in a form of γ phase.

An electron micrograph of the grains of the silver halide emulsion 1D is shown in FIG. 1. The electron micrograph was taken at a shadowing angle of 15 degrees. Spherical grains in FIG. 1 show grains of latex used as reference. Such grain of latex has a size of 0.5 μm.

A silver halide emulsion 1D' was prepared by adjusting in a same manner as in the silver halide emulsion D except for removing the spectral sensitizing dyes A and B therefrom. (1) 100 g of an emulsion solution in which an Ag concentration of the silver halide emulsion D' has been adjusted to be 0.07 mM and (2) 100 cc of a solution in which the spectral sensitizing dye A has been dissolved in methanol such that it had concentrations as shown in Table 2 were prepared. Thereafter, absorption ratio of the dye was obtained in a same manner as is silver halide emulsion A'. The results of the absorption ratios, namely, $S_1/S_0$ are shown in Table 2.

TABLE 2

| Test No. | Dye concentration (mM) | $S_1/S_0$ |
|---|---|---|
| 6 | 0.7 | 0.17 |
| 7 | 0.07 | 0.38 |
| 8 | 0.007 | 0.52 |
| 9 | 0.0007 | 0.83 |
| 10 | 0.00007 | 0.92 |

Preparation of Silver Halide Emulsions 1E and 1F

A silver halide emulsions 1E and 1F, as shown in FIG. 1, were prepared in a same manner as in the preparation of the silver halide emulsion 1D except for appropriately changing a quantity of a 5% by mass methanol solution of 2,2'-(ethylenedithio)diethanol to be added, a temperature at the time of grain-forming, and an additing time of the solution A.

TABLE 3

| | Average projected area diameter (μm) | Variation coefficient of Average projected area (%) | Average grain thickness (μm) | Average aspect ratio | Average sphere equivalent diameter (μm) |
|---|---|---|---|---|---|
| Emulsion 1D | 1.369 | 19.7 | 0.130 | 11.1 | 0.707 |
| Emulsion 1E | 1.140 | 19.7 | 0.112 | 10.6 | 0.592 |
| Emulsion 1F | 0.907 | 20.3 | 0.107 | 9.0 | 0.417 |

2) Preparation of Fatty Acid Silver Salt Dispersion A

Preparation of Recrystallized Behenic Acid 100 kg of behenic acid (product name: Edenor C22-85R; manufactured by Henkel Co.) was added to 1200 kg of isopropyl alcohol, dissolved therein at 50° C., filtered by a filter of 10 μm, and cooled to 30° C. to be recrystallized. A cooling speed at the time of such recrystallization was controlled to be 3° C./hour. Such crystal obtained in a manner as described above was subjected to centrifugal filtration, rinsed with 100 kg of isopropyl alcohol by sprinkling, and dried. The thus-dried crystal was esterified and subjected to a GC-FID measurement to find that the crystal contained 96 mol % of behenic acid, 2 mol % of lignoceric acid, 2 mol % of arachidic acid, and 0.001 mol % of erucic acid.

Preparation of Fatty Acid Silver Salt Dispersion 88 kg of recrystallized behenic acid, 422 L of distilled water, 49.2 L of an aqueous solution of NaOH having a concentration of 5 mol/L and 120 L of t-butyl alcohol were mixed and, then, while being kept stirring at 75° C. for 1 hour, allowed to react with one another to obtain a sodium behenate solution B. Apart from the sodium behenate solution B, 206.2 L of an aqueous solution (pH: 4.0) containing 40.4 kg of silver nitrate was prepared and maintained at 10° C. A reaction vessel charged with 635 L of distilled water and 30 L of t-butyl alcohol was maintained at 30° C. and, then, while being kept sufficiently stirring, charged with an entire quantity of the foregoing sodium behenate solution B and an entire quantity of the foregoing silver nitrate aqueous solution at a constant flow rate consuming 93 minutes 15 seconds and 90 minutes, respectively. At that time, the silver nitrate aqueous solution was solely added for 11 minutes after the addition of the silver nitrate aqueous solution was started. After that, the addition of the sodium behenate solution was started. For 14 minutes 15 seconds after the addition of the silver nitrate aqueous solution was completed, the sodium behenate solution was solely added. At that time, a temperature inside the reaction vessel was maintained at 30° C. and a solution temperature was maintained constant by means of an external temperature control. Further, piping of an addition system for the sodium behenate solution was warmed by circulating warm water in an outer part of a double-walled tube so that the solution temperature at an outlet of an addition nozzle tip was adjusted to be 75° C. Piping of an addition system of the aqueous silver nitrate solution was also heat-controlled by circulating cold water in an outer part of a double-walled tube. Positions where the sodium behenate solution and the aqueous silver nitrate solution were added were arranged symmetrically in relation to a stirring shaft in the center, and respective heights of the positions were adjusted such that they do not touch a reaction solution.

After the addition of the sodium behenate solution was completed, the resultant reaction solution was held at a temperature thereof as it was for 20 minutes with stirring and, then, the temperature was elevated up to 35° C. consuming 30 minutes. After that, the reaction solution was ripened for 210 minutes. Immediately after such ripening, the solid content was separated by centrifugal filtration and, then, the thus-separated solid content was rinsed with water until electrical conductivity of the filtrate reached 30 μS/cm. Thus, a fatty acid silver salt was obtained. A solid substance obtained in such a manner as described above was stored as a wet cake without drying.

Shapes of silver behenate grains thus obtained were evaluated by electron microscopic photography. The obtained silver behenate grains were crystals having average values of a=0.21 μm, b=0.4 μm and c=0.4 μm, an average aspect ratio of 2.1, and a variation coefficient of a sphere-equivalent diameter of 11% (a, b and c were defined according to respective definitions previously described herein).

19.3 kg of polyvinyl alcohol (trade name: PVA-217; manufactured by Kuraray Co., Ltd.) and water were added to the thus-stored wet cake corresponding to 260 kg of dried solid content to make an entire quantity of the resultant mixture up to 1,000 kg and, then, the resultant mixture was changed into a slurry by means of dissolver-blades. Further, the slurry was preliminarily dispersed with a pipeline-mixer (Model PM-10; manufactured by Mizuho Industrial Co., Ltd.)

Then, the thus-preliminarily-dispersed starting solution was processed three times with a dispersing machine (trade name: Microfluidizer M-610 equipped with a Z-type interaction chamber; manufactured by Microfluidex International Corporation) under a pressure adjusted to 1,150 kg/cm$^2$ to obtain a silver behenate dispersion. A dispersion temperature was set at 18° C. by adjusting a temperature of coolant such that a cooling operation was performed by using coil type heat exchangers installed in front and rear of the interaction chamber, respectively.

3) Preparation of Reduction Agent Dispersion

Preparation of Reduction Agent-1 Dispersion 10 kg of water was added to 10 kg of a reduction agent-1 (2,2'-methylene-bis(4-ethyl-6-tert-butyl phenol) and 16 kg of a 10% by mass aqueous solution of modified polyvinylalcohol (trade name: POVAL MP203; manufactured by Kuraray Co. Ltd.). The resultant mixture was thoroughly mixed to form a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed therein for 3 hours. Then, 0.2 g of a sodium salt of benzisothiazolinone and water were added to the resultant dispersion so as to allow a concentration of the reduction agent to be 25% by mass. The resultant dispersion was heated at 60° C. for 5 hours, thereby obtaining a reduction agent-1 dispersion. Reduction agent grains contained in the thus-obtained reduction agent dispersion had a median diameter of 0.40 μm and a maximum grain diameter of 1.4 μm or less. The reduction agent dispersion was filtrated with a filter made of polypropylene having a pore diameter of 3.0 μm to remove foreign matters such as dust and, then, stored. Preparation of Reduction agent-2 Dispersion 10 kg of water was added to 10 kg of a reduction agent-2 (6,6'-di-t-butyl-4,4'-dimethyl-2,2'-butylidene diphenol), and 16 kg of a 10% by mass aqueous solution of modified polyvinylalcohol (trade name: POVAL MP203; manufactured by Kuraray Co. Ltd.). The resultant mixture was thoroughly mixed to form a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed for 3 hours 30 minutes. Then, 0.2 g of a sodium salt of benzisothiazolinone and water were added to the resultant dispersion so as to allow a concentration of the reduction agent to be 25% by mass. The resultant dispersion was heated at 40° C. for one hour and, subsequently, at 80° C. for one hour to obtain a reduction agent-2 dispersion. Reduction agent grains contained in the thus-obtained reduction agent dispersion had a median diameter of 0.50 μm and a maximum grain diameter of 1.6 μm or less. The reduction agent dispersion was filtrated with a filter made of polypropylene having a pore diameter of 3.0 μm to remove foreign matters such as dust and, then, stored.

4) Preparation of Hydrogen Bonding-Type Compound-1 Dispersion 10 kg of water was added to 10 kg of a hydrogen bonding-type compound-1 (tri(4-t-butylphenyl)phosphine oxide), and 16 kg of a 10% by mass aqueous solution of modified polyvinylalcohol (trade name: POVAL MP203; manufactured by Kuraray Co., Ltd.). The resultant mixture was thoroughly mixed to form a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed for 4 hours. Then, 0.2 g of a sodium salt of benzisothiazolinone and water were added to the resultant dispersion so as to allow a concentration of the hydrogen bonding-type compound to be 25% by mass. The resultant dispersion was heated at 40° C. for one hour and, subsequently, at 80° C. for one hour, thereby obtaining a hydrogen bonding-type compound-1 dispersion. Hydrogen bonding-type compound grains contained in the thus-obtained hydrogen bonding-type compound dispersion had a median diameter of 0.45 μm and a maximum grain diameter of 1.3 μm or less. The hydrogen bonding-type compound dispersion was filtrated with a filter made of polypropylene having a pore diameter of 3.0 μm to remove foreign matters such as dust and, then, stored.

5) Preparation of Development Accelerator-1 Dispersion 10 kg of water was added to 10 kg of a development accelerator-1, and 20 kg of a 10% by mass aqueous solution of modified polyvinylalcohol (trade name: POVAL MP203; manufactured by Kuraray Co., Ltd.). The resultant mixture was thoroughly mixed to form a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed for 3 hours 30 minutes. Then, 0.2 g of a sodium salt of benzisothiazolinone and water were added to the resultant dispersion so as to allow a concentration of the development accelerator to be 20% by mass, thereby obtaining a development accelerator-1 dispersion. Development accelerator grains contained in the thus-obtained development accelerator dispersion had a median diameter of 0.48 μm and a maximum grain diameter of 1.4 μm or less. The development accelerator dispersion was filtrated with a filter made of polypropylene having a pore diameter of 3.0 μm to remove foreign matters such as dust and, then, stored.

Solid dispersions of a development accelerator-2 and a color tone adjusting agent-1 were dispersed in a same manner as in the development accelerator-1, thereby obtaining 20% by mass and 15% by mass dispersions, respectively.

6) Preparation of Organic Polyhalogen Compound Dispersion

Preparation of Organic Polyhalogen Compound Dispersion a 14 kg of water was added to 10 kg of an organic polyhalogen compound-1, 10 kg of a 20% by mass aqueous solution of modified polyvinylalcohol (trade name: POVAL MP203), and 0.4 kg of a 20% by mass aqueous solution of sodium triisopropylnaphthalene sulfonate. The resultant mixture was thoroughly mixed to form a slurry. The slurry was fed by means of a diaphragm pump into a horizontal-type sand mill (trade name: UVM-2) filled with zirconia beads having an average diameter of 0.5 mm, and dispersed for 5 hours. Then, 0.2 g of a sodium salt of benzisothiazolinone and water were added to the resultant dispersion so as to allow a concentration of the organic polyhalogen compound to be 26% by mass, thereby obtaining an organic polyhalogen compound dispersion a. Organic polyhalogen compound grains contained in the thus-obtained organic polyhalogen compound dispersion had a median diameter of 0.41 μm and a maximum grain diameter of 2.0 μm or less. The organic polyhalogen compound dispersion was filtrated with a filter made of polypropylene having a pore diameter of 10.0 μm to remove foreign matters such as dust and, then, stored.

Preparation of Organic Polyhalogen Compound Dispersion b 8 kg of water was added to 10 kg of an organic polyhalogen compound-2, 20 kg of a 10% by mass aqueous solution of modified polyvinylalcohol (trade name: POVAL MP203), and 0.4 kg of a 20% by mass aqueous solution of sodium triisopropylnaphthalene sulfonate. The resultant mixture was thoroughly mixed to form a slurry. The slurry was fed by means of a diaphragm pump into a horizontal-type sand mill (trade name: UVM-2) filled with zirconia beads having an average diameter of 0.5 mm, and dispersed for 5 hours. Then, 0.2 g of a sodium salt of benzisothiazolinone and water were added to the resultant dispersion so as to allow a concentration of the organic polyhalogen compound to be 25% by mass. The resultant dispersion was heated at 40° C. for 5 hours, thereby obtaining an organic polyhalogen compound dispersion b. Organic polyhalogen compound grains contained in the thus-obtained organic polyhalogen compound dispersion had a median diameter of 0.36 μm and a maximum grain diameter of 1.5 μm or less. The organic polyhalogen compound dispersion was filtrated with a filter made of polypropylene having a pore diameter of 3.0 μm to remove foreign matters such as dust and, then, stored.

7) Preparation of Silver Iodide Complex Forming Agent (Compound No. F-440)

8 kg of modified polyvinyl alcohol (trade name: MP203) was dissolved in 174.57 kg of water. Then, 3.15 kg of a 20% by mass aqueous solution of sodium triisopropylnaphthalene sulfonate and 14.28 kg of a 70% by mass aqueous solution of the compound No. F-440 to the resultant mixture, thereby preparing a 5% by mass solution of the compound No. F-440.

(Preparation of Other Silver Iodide Complex Forming Agent Dispersions)

250 g of water was added to 64 g of a silver iodide complex forming agent shown in Table 3 and 6.4 g of DEMOL N (trade name; manufactured by Kao Corporation). The resultant mixture was thoroughly mixed to form a slurry. The slurry, together with 800 g of zirconia beads having an average diameter of 0.5 mm which have previously been prepared, was fed into a vessel and, then, dispersed for 8 hours by a dispersing device (¼ G Sand-Grinder Mill: manufactured by Imex Co., Ltd.). The resultant dispersion was taken out of the vessel and, then, diluted with water, thereby obtaining a dispersion having a compound concentration of 5% by mass. Compound grains in the thus-obtained dispersion had an average grain diameter of 0.40 μm.

8) Preparation of SBR Latex Liquid

An SBR latex at Tg=23° C. was prepared in a manner as described below.

70.5 parts by mass of styrene, 26.5 parts by mass of butadiene, and 3 parts by mass of acrylic acid were allowed to be emulsify-polymerized thereamong by using ammonium persulfate as a polymerization initiator and an anionic surfactant as an emulsifying agent. The resultant reaction product was subjected to aging at 80° C. for 8 hours and, then, cooled to be 40° C. and, then, a pH thereof was adjusted to be 7.0 by using an aqueous ammonia solution. Further, the resultant mixture was added with SANDET BL (trade name; manufactured by Sanyo Chemical Industries, Ltd.) to allow a concentration thereof to be 0.22%. Next, a pH of the resultant mixture was adjusted to be 8.3 by using an aqueous 5% NaOH solution and, further, adjusted to be 8.4 by using an aqueous ammonia solution; on this occasion, a molar ratio of $Na^+$ ion to $NH_4^+$ ion which was employed was 1:2.3. Still further, 0.15 ml, based on 1 kg of the thus-pH-adjusted mixture, of an aqueous 7% solution of a sodium salt of benzisothiazolinone was added thereto, thereby preparing an SBR latex solution. (SBR latex: latex of -St(70.5)-Bu(26.5)-AA(3))

Properties of the latex were as follows: an average grain diameter at Tg=23° C.: 0.1 μm; concentration: 43% by mass; equilibrium moisture content at 25° C. 60% RH: 0.6% by mass; ionic conductance: 4.2 mS/cm (as for ionic conductance, latex starting solution (43% by mass) was measured at 25° C. by using a diagometer (trade name: CM-30S; manufactured by DKK-TOA Corporation); and pH: 8.4.

9) Preparation of Mercapto Compound (Preparation of Aqueous Solution of Mercapto Compound-1)

7 g of a mercapto compound-1 (sodium salt of 1-(3-sulfophenyl)-5-mercaptotetrazole) was dissolved in 993 g of water to prepare a 0.7% by mass aqueous solution.

(Preparation of Aqueous Solution of Mercapto Compound-2)

20 g of a mercapto compound-2 (1-(3-methylureidophenyl)-5-mercaptotetrazole) was dissolved in 980 g of water to prepare a 2.0% by mass aqueous solution.

In regard to the mercapto compounds 1 and 2, a blocking effect of the spectral sensitizing dye adsorption to a fatty acid silver dispersion was obtained as described below. (1) 100 cc of a solution prepared by adding an aqueous solution of a mercapto compound 1 and an aqueous solution of a mercapto compound 2 to the fatty acid silver dispersion A as shown in Table 4 and, then, performing an final adjustment such that silver concentration came to be 0.15 M, and (2) 100 cc of a 0.0007 mM methanol solution of the spectral sensitizing dye A were prepared. The solutions (1) and (2) were mixed with each other and, then, sufficiently stirred. Thereafter, the resultant mixture was centrifuged at the rotation speed of 18000 rpm for 2 hours until the non-photosensitive organic silver salt grains were sufficiently precipitated. After such centrifugation, spectral absorption of a supernatant thereof was measured and a value obtained at that time is set as $S_4$. Next, water having a same quantity as that of the non-photosensitive organic silver salt grains in place of the non-photosensitive organic silver salt grains, and the sensitizing dye solution were mixed and centrifuged under a same condition. Thereafter, spectral absorption of a supernatant thereof was measured and a value obtained at that time was set as $S_0$. When the equation of $S_3/S_0=(S_0-S_4)/S_0$ was constructed, the adsorption ratio of the dye was measured. The results are shown in Table 4.

TABLE 4

| Test No. | Addition quantity of mercapto 1 (mol/mol Ag) | Addition quantity of mercapto 2 (mol/mol Ag) | $S_3/S_0$ |
|---|---|---|---|
| 11 | — | — | 0.97 |
| 12 | $4\times10^{-4}$ | — | 0.74 |
| 13 | $4\times10^{-4}$ | $1\times10^{-3}$ | 0.58 |
| 14 | $4\times10^{-4}$ | $4\times10^{-3}$ | 0.32 |
| 15 | $4\times10^{-3}$ | $4\times10^{-3}$ | 0.23 |

3. Preparation of Coating Solution

1) Preparation of Image Forming Layer 1,000 g of the fatty acid silver salt dispersion A obtained in a manner as described above, 220 ml of water, 6.3 g of the organic polyhalogen compound dispersion (a), 20.7 g of the organic polyhalogen compound dispersion (b), 1,082 g of an SBR latex (Tg: 23° C.) solution, 75 g of the reduction agent-1 dispersion, 75 g of the reduction agent-2 dispersion, 106 g of the hydrogen bonding-type compound-1 dispersion, 4.8 g of the development accelerator-1 dispersion, 9 ml of the mercapto compound-1 aqueous solution, and 27 ml of the mercapto compound-2 aqueous solution were mixed in the stated order to prepare a mixture. The thus-prepared mixture was, further, added with the silver iodide complex forming agent (shown in Table 5) and, immediately before coating, added with 0.25 mol in a silver quantity, based on 1 mol of the fatty acid silver salt, of the silver halide emulsion (shown in Table 5) and, then, thoroughly mixed. Thereafter, the resultant mixture was fed to a coating die as it was to be applied.

2) Preparation of Coating Solution for Intermediate Layer 2 ml of a 5% by mass aqueous solution of Aerosol OT (trade name; manufactured by American Cyanamid Company) and 10.5 ml of a 20% by mass aqueous solution of diammonium phthalate were added to 772 g of a 10% by mass aqueous solution of polyvinyl alcohol (trade name: PVA-205; manufactured by Kuraray Co., Ltd.), 5.3 g of a pigment-1 dispersion, and 226 ml of a 27.5% by mass solution of a latex of a methyl methacrylate/styrene/butyl acrylate/hydroxyethyl methacrylate/acrylic acid copolymer (copolymerization ratio by mass: 64/9/20/5/2) to prepare a mixture. Then, the thus-prepared mixture was added with water so as to make an entire quantity of the mixture up to 880 g. A pH value of the thus-made mixture was adjusted to be 7.5 by using NaOH, thereby obtaining a coating solution for an intermediate layer. The coating solution was fed to a coating die such that a coating quantity became 10 ml/m$^2$.

Viscosity of the coating solution measured by a B-type viscometer (No. 1 rotor at 60 rpm) was 65 [mPa·s] at 40° C.

3) Preparation of Coating Solution for First Layer of Protective Layer of Emulsion Layer 64 g of inert gelatin was dissolved in water. To the resultant gelatin solution, added were 80 g of a 27.5% by mass solution of a latex of a methyl methacrylate/styrene/butyl acrylate/hydroxyethyl methacrylate/acrylic acid copolymer (copolymerization ratio by mass: 64/9/20/5/2), 23 ml of a 10% by mass methanol solution of phthalic acid, 23 ml of a 10% by mass aqueous solution of 4-methyl phthalic acid, 28 ml of sulfuric acid having a concentration of 0.5 mol/L, 5 ml of a 5% by mass aqueous solution of Aerosol OT, 0.5 g of phenoxyethanol and 0.1 g of benzisothiazolinone to prepare a mixture. Then, the thus-prepared mixture was added with water to make an entire quantity of the mixture up to be 750 g, thereby obtaining a coating solution. Immediately before coating, the coating solution was mixed with 26 ml of a 4% by mass chrome alum solution by using a static mixer and, then, fed to a coating die such that a coating quantity became 18.6 ml/m$^2$.

Viscosity of the coating solution measured by a B-type viscometer (No. 1 rotor at 60 rpm) was 20 [mPa·s] at 40° C.

4) Preparation of Coating Solution for Second Layer of Protective Layer of Emulsion Layer 80 g of inert gelatin was dissolved in water. To the resultant gelatin solution, added were 102 g of a 27.5% by mass solution of a latex of a methyl methacrylate/styrene/butyl acrylate/hydroxyethyl methacrylate/acrylic acid copolymer (copolymerization ratio by mass: 64/9/20/5/2), 3.2 ml of a 5% by mass solution of a fluorine-type surfactant (F-1), 32 ml of a 2% by mass solution of a fluorine-type surfactant (F-2), 23 ml of a 5% by mass solution of Aerosol OT, 4 g of polymethyl methacrylate fine grains (average grain diameter: 0.7 μm), 21 g of polymethyl methacrylate fine grains (average grain diameter: 4.5 μm), 1.6 g of 4-methyl phthalic acid, 4.8 g of phthalic acid, 44 ml of sulfuric acid having a concentration of 0.5 mol/L, and 10 mg of benzisothiazolinone to prepare a mixture. Then, the thus-prepared mixture was added with water to make an entire quantity of the mixture up to 650 g. Immediately before coating, the thus-made mixture was mixed with 445 ml of an aqueous solution containing 4% by mass of chrome alum and 0.67% by mass of phthalic acid by using a static mixer, thereby obtaining a coating solution for a second layer for a protection layer of an emulsion layer. The thus-obtained coating solution was, then, fed to a coating die such that a coating quantity became 8.3 ml/m$^2$.

Viscosity of the coating solution measured by a B-type viscometer (No. 1 rotor at 60 rpm) was 19 [mPa·s] at 40° C.

4. Coating

The image-forming layer, the intermediate layer, the first layer for the protection layer of the emulsion layer, and the second layer for the protection layer of the emulsion layer were applied in the stated order in a simultaneous multi-layer manner. A coated silver quantity in the image-forming layer was 1.65 g/m$^2$ as a sum of the fatty acid silver salt and the silver halide.

5. Evaluation of Performance

1) Preparation

Each of the thus-obtained samples was cut into pieces of a half-size, wrapped with a wrapping material as mentioned below in an environment of 25° C. 50% RH and, then, stored for 2 weeks at room temperature.

Wrapping Material

The wrapping material used was 50 μm thick polyethylene film comprising PET: 10 μm/PE: 12 μm/aluminum foil: 9 μm/Ny: 15 μm/PE: 50 μm containing 3% by mass of carbon.

Oxygen transmittance was 0.02 ml/atm·$m^2$·25° C.·day; and moisture transmittance was 0.10 g/atm·$m^2$·25° C.·day.

2) Evaluation Condition (Measurement of Transmission Density of Film)

Ultraviolet visible region transmission densities before and after thermal development of unexposed samples were measured by making use of spectral absorption spectra.

Thermal development condition: samples were thermally developed by using a thermal development part of Fuji Medical Dry Laser Imager FM-DPL for 24 seconds in which temperatures of 4 panels of a 4-panel-type panel heater were set at 112° C., 119° C., 121° C. and 121° C., respectively.

Measuring Device: a spectrophotometer (trade name: U-4100; manufactured by Hitachi, Ltd.)

Photographing condition: each sample was shaved by a diamond cutter to prepare a thin section having a thickness of about 0.1 μm which was, then, put on the observation.

In regard to each of sample Nos. 1 to 10, a photograph (A) showing that before the thermal development and a photograph (B) showing that after the thermal development are shown in FIG. 3.

3) Evaluation of Sample

Obtained results are shown in Table 5.

Figure 2:
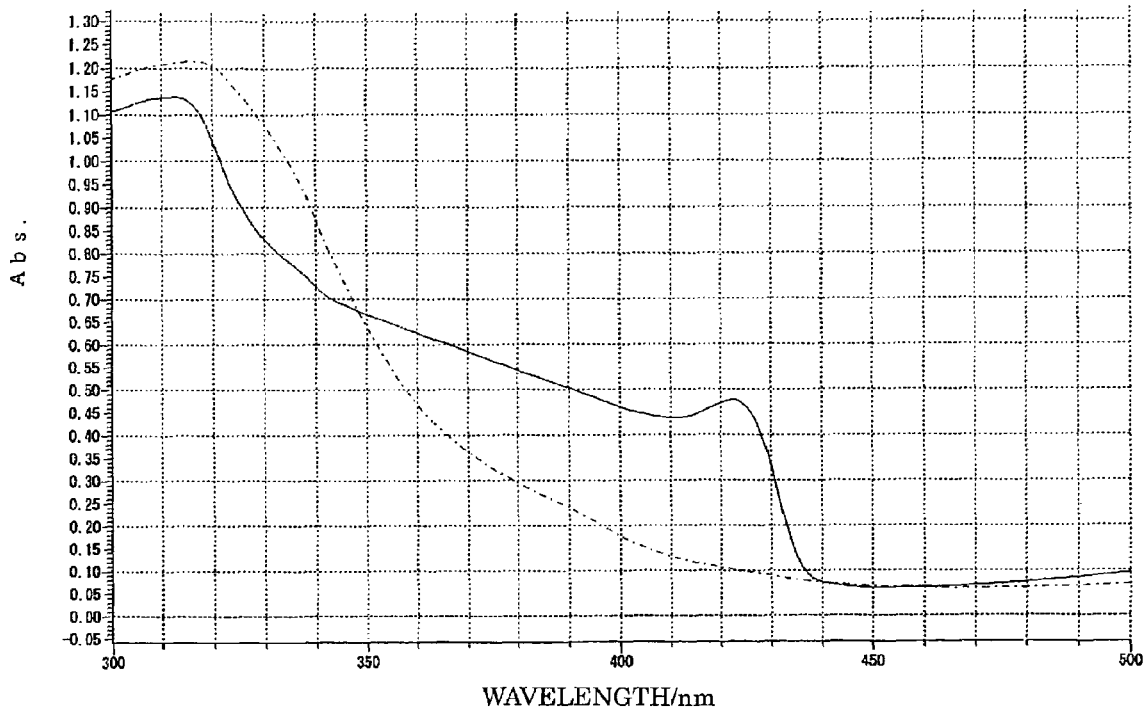
FIG. 2 shows spectral absorption spectra of photothermographic materials according to the invention before and after thermal development in which a solid line indicates absorption spectra before the thermal development while a broken line indicates absorption spectra after the thermal development.

From FIG. 2, in regard to samples before the thermal development, a characteristic maximum absorption was noticed in the vicinity of 423 nm. The characteristic maximum absorption was effected by a transition absorption caused by a high silver iodide phase. Meanwhile, in regard to samples after the thermal development, the transition absorption was reduced to be ½ or less of the former one or disappeared. Haze of the film was also disappeared, thereby forming a transparent film.

From FIG. 3, in regard to the sample A before the thermal development, a tabular cross-section was observed as in a rod-like shape derived from the fact that the tabular silver halide grains are aligned on a plane while in regard to the sample B after the thermal development, it is found that such grains were disappeared.

TABLE 5

| Sample Nos. 1-1 to 1-12 | | | | | | | |
|---|---|---|---|---|---|---|---|
| | Silver halide emulsion | | Silver iodide complex forming agent | | | Electron microscopy of | |
| Sample No. | Emulsion No. | Shape, size | Compound No. | Addition quantity | Absorption spectral* | Ultrathin section** | Remarks |
| 1-1 | 1A (AgBr3.5) | Cubic | — | — | No change | Remained | Comparative Example |
| 1-2 | 1A (AgBr3.5) | " | F-440 | 8 mol % | No change | Remained | Comparative Example |
| 1-3 | 1B (AgBr) | " | — | — | No change | Remained | Comparative Example |
| 1-4 | 1C | " | F-440 | 8 mol % | No change | Remained | Comparative Example |
| 1-5 | " | Tetradecahedron | — | — | No change | Remained | Comparative Example |
| 1-6 | " | " | F-440 | 8 mol % | Disappeared | Disappeared | Prsesnt invention |
| 1-7 | " | " | F-431 | " | Disappeared | Disappeared | Prsesnt invention |
| 1-8 | " | " | F-443 | " | Disappeared | Disappeared | Prsesnt invention |
| 1-9 | " | " | F-444 | " | Disappeared | Disappeared | Prsesnt invention |
| 1-10 | 1D | Tabular | F-440 | " | Disappeared | Disappeared | Prsesnt invention |
| 1-11 | 1E | " | " | " | Disappeared | Disappeared | Prsesnt invention |
| 1-12 | 1F | " | " | " | Disappeared | Disappeared | Prsesnt invention |

(Absorption spectral*: Change of transition absorption)
(Electron microscopy of Ultrathin section**: Observation of silver halide grain)

Results of such measurement are shown in FIG. 2. In FIG. 2, a solid line indicates absorption spectra before the thermal development while a broken line indicates absorption spectra after the thermal development.

(Observation of Silver Halide Grain in Film by Electron Microscope)

An ultrathin section of a film of each of samples before and after the thermal development was photographed by a transmission electron microscope.

The quantity of the silver iodide complex forming agent to be coated is based on 1 mol of silver behenate.

The transmission density of the film was reduced when it was thermally developed, by adding the silver iodide complex forming agent to the silver halide emulsion having a high iodine content according to the invention. As a result of the observation by a transmission electron microscope, in regard to samples according to the invention, the silver halide grains were disappeared after the thermal development.

In a case in which silver bromide or the silver halide grain having a low iodine content of about 3.5 mol % was used, even when the silver iodide complex forming agent was incorporated, the grain remained without being disappeared and, accordingly, the transmission density was least reduced. It is apparent that an effect of the invention can be realized only when the high silver iodide grain and the silver iodide complex forming agent are used in combination.

Example 1-2

1. Back Layer

1) Preparation of Coating Solution for Back Layer (Preparation of Solid Fine Grain Dispersion (a) of Base Precursor)

64 g of abase precursor compound-1, 10 g of DEMOL N (trade name; manufactured by Kao Corporation), 28 g of diphenylsulfone, and 220 ml of distilled water were mixed. The resultant mixture was dispersed by using beads media by means of ¼ G Sand-Grinder Mill (trade name; manufactured by Imex Co., Ltd.) to obtain a solid fine grain dispersion (a) of the base precursor compound having an average grain diameter of 0.2 μm.

Preparation of Dye Solid Fine Grain Dispersion (a)

9.6 g of a cyanine dye compound-1, 5.8 g of sodium p-dodecyl sulfonate, and 305 ml of distilled water were mixed. The resultant mixture was dispersed by using beads media by means of a ¼ G Sand-Grinder Mill (trade name; manufactured by Imex Co., Ltd.) to obtain a dye fine grain dispersion (a) having an average grain diameter of 0.2 μm.

Preparation of Coating Solution for Antihalation Layer 17 g of gelatin, 9.6 g of polyacrylamide, 70 g of the above-prepared solid fine grain dispersion (a) of base precursor, 56 g of the above-prepared dye solid fine grain dispersion (a), 1.5 g of monodispersed fine grains of polymethyl methacrylate (average grain size: 8 μm; standard deviation of grain diameter: 0.4), 0.03 g of benzisothiazolinone, 2.2 g of sodium polyethylene sulfonate, 0.2 g of a blue dye compound-1, 4.2 g of an ultraviolet light-absorbing agent, and 844 ml of water were mixed to prepare a coating solution for an antihalation layer.

Preparation of Coating Solution for Back Surface Protective Layer

In a vessel maintained at 40° C., 50 g of gelatin, 0.2 g of sodium polystyrene sulfonate, 2.4 g of N,N-ethylene bis(vinyl sulfonacetamide), 1 g of sodium t-octylphenoxyethoxyethane sulfonate, 30 mg of benzisothiazolinone, 37 mg of fluorine-type surfactant (F-1), 0.15 g of fluorine-type surfactant (F-2), 64 mg of fluorine-type surfactant (F-3), 32 mg of fluorine-type surfactant (F-4), 8.8 g of an acrylic acid/ethylacrylate copolymer (weight ratio of copolymerization: 5/95), 0.6 g of Aerosol OT (trade name; manufactured by American Cyanamid Company), 1.8 g of a liquid paraffin emulsion in terms of liquid paraffin, and 950 ml of water were mixed to prepare a coating solution for back surface protective layer.

2) Coating of Back Layer

On a back surface side of the thus-undercoated support, the coating solution for the antihalation layer was applied such that a coated quantity of the solid fine grain dye was allowed to be 0.04 g/m$^2$, and the coating solution for the back surface protective layer was applied in a simultaneous multi-layer manner such that a coated quantity of the gelatin was allowed to be 1.7 g/m$^2$ and, then, dried to prepare a back layer.

2. Image-forming Layer, Intermediate Layer, and Protective Layer of Emulsion Layer 2-1. Preparation of Material 1) Preparation of Photosensitive Silver Halide Emulsions 1G to 1K Tabular emulsion grains 1G to 1K having different average grain sizes form one another as shown in Table 6 were prepared in a same manner as in the preparation of the emulsion 1D of Example 1-1 except for appropriately changing a quantity of a 5% by mass methanol solution of 2,2'-(ethylenedithio)diethanol to be added, a temperature at the time of grain-forming, and an additing time of the solution A. Emulsion grains G and H are Comparative Examples.

2) Preparation of Photosensitive Silver Halide Emulsions 1L to 1N

Further, for the comparison purpose, tabular silver bromide emulsions 1L to 1N were prepared as shown below. Preparation of Tabular Silver Bromide Emulsion 1L Grain formation 1178 ml of an aqueous solution containing 0.8 g of KBr, and 3.2 g of gelatin, subjected to an oxidation treatment, having an average molecular weight of 20000 were stirred while keeping it at 35° C. Respective solutions of 1.6 g of silver nitrate, 1.16 g of KBr, and 1.1 g of gelatin subjected to the oxidation treatment were added to the thus-stirred solution by a triple-jet method consuming 45 seconds. A concentration of silver nitrate in the resultant mixture was 0.3 mol/L. The mixture was heated up to 76° C. consuming 20 minutes and, then, added with 26 g of succinated gelatin having an average molecular weight of 100000 and, thereafter, added with an aqueous solution containing 209 g of silver nitrate and an aqueous KBr solution while keeping a pAg value at 8.0 and accelerating a flow rate by a controlled-double-jet method consuming 75 minutes. After being added with gelatin having an average molecular weight of 100000, the resultant mixture was desalted in accordance with an ordinary method and, then, added with gelatin having an average molecular weight of 100000 while allowing it to be dispersed and, thereafter, adjusted so as to have a pH value of 5.8 and a pAg value of 8.0 at 40° C., thereby obtaining an emulsion. It is found that the thus-obtained emulsion contained one mol of silver and 40 g of gelatin based on 1 kg of the emulsion and that silver halide grains therein were tabular grains having an average projected area diameter of 0.97 μm, a variation coefficient of projected area diameter of 19.1%, an average thickness of 0.12 μm, and an average aspect ratio of 8.1.

Chemical Sensitization

Each emulsion thus prepared was subjected to chemical sensitization while kept stirring at 56° C. Firstly, the emulsion was added with $1\times10^{-4}$ mol, based on 1 mol of silver halide, of a thiosulfonic acid compound-1 to be described below and, then, added with 0.15 mol %, based on an entire silver quantity, of AgI grains having a size of 0.03 μm. 3 minutes after such addition, the resultant mixture was added with $1\times10^{-6}$ mol/Ag mol of thiourea dioxide and kept to stand for 22 minutes as it was to allow a reduction sensitization to be performed. Next, the thus-reduction-sensitized mixture was added with $3\times10^{-4}$ mol equivalent, based on 1 mol of silver halide, of 4-hydroxy-6-6-methyl-1,3,3a,7-tetrazaindene, $1\times10^{-3}$ mol equivalent, based on 1 mol of silver halide and in terms of a quantity of a sensitizing dye IV-I, of a sensitizing dye IV-I dispersion, $1\times10^{-4}$ mol equivalent, based on 1 mol of silver halide, of each of sensitizing dyes-1 and -2 to be described below and calcium chloride.

Subsequently, the resultant mixture was added with $6\times10^{-6}$ mol equivalent, based on 1 mol of silver halide, of sodium thiosulfate and $4\times10^{-6}$ mol equivalent, based on 1 mol of silver halide, of a selenium compound-1 and, then, added with $2\times10^{-3}$ mol equivalent, based on 1 mol of silver halide, of chloroauric acid and, thereafter, added with 67 mg equivalent, based on 1 mol of silver halide, of nucleic acid (trade name: RNA-F; manufactured by Sanyo-Kokusaku Pulp Co., Ltd.). 40 minutes after such addition, the resultant mixture was added with $1\times10^{-4}$ mol equivalent, based on 1 mol of silver halide, of a water-soluble mercapto compound-1 and, then, cooled to terminate the chemical sensitization of the emulsion 1L. Preparation of Tablular Silver Bromide Emulsions 1M and 1N Emulsions 1M and 1N were prepared in a same manner as in the emulsion 1L except for adjusting the pAg value at the time of being performed by the controlled-double-jet method, and temperatures at the time of nucleus formation and grain growth. A quantity of the chemical sensitizer was adjusted so as to be optimal for each grain.

TABLE 6

| Emulsion | Halogen composition | Average projected area diameter (μm) | Variation coefficient of Average projected area | Average grain thickness (μm) | Average aspect ratio | Average sphere equivalent diameter (μm) | Remark |
|---|---|---|---|---|---|---|---|
| 1G | AgI | 0.037 | 8.2 | 0.031 | 1.2 | 0.04 | Comparative Example |
| 1H | AgI | 0.330 | 13.5 | 0.094 | 3.5 | 0.25 | Comparative Example |
| 1I | AgI | 0.960 | 19.5 | 0.120 | 8.0 | 0.55 | Present Invention |
| 1J | AgI | 1.650 | 19.8 | 0.103 | 16.0 | 0.75 | Present Invention |
| 1K | AgI | 2.580 | 23.1 | 0.086 | 30.0 | 0.95 | Present Invention |
| 1L | AgBr | 0.970 | 19.1 | 0.120 | 8.1 | 0.55 | Comparative Example |
| 1M | AgBr | 1.670 | 19.5 | 0.104 | 16.0 | 0.76 | Comparative Example |
| 1N | AgBr | 2.620 | 22.1 | 0.087 | 30.0 | 0.96 | Comparative Example |

Thiosulfonic acid compound-1

$C_2H_5SO_2SNa$

Selenium compound-1

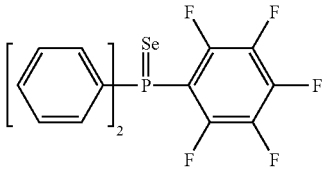

Water-soluble mercapto compound-1

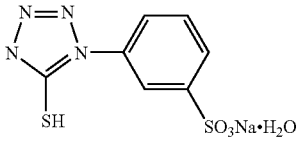

-continued

Sensitizing dye-1

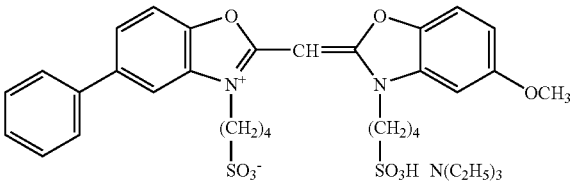

-continued

Sensitizing dye-2

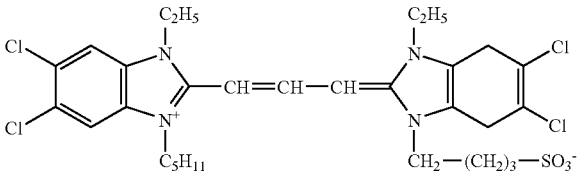

Sensitizing dye-3

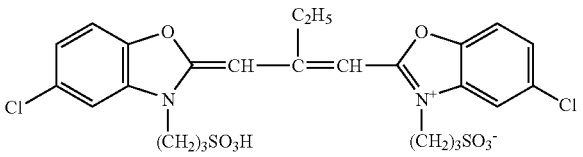

Preparation of Silver Halide Emulsion for Preparation of Coating Solution

The above-described silver halide dispersion was dissolved at 40° C. and, then, added with $7\times10^{-3}$ mol, based on 1 mol of silver, of a 1% by mass aqueous solution of benzothiazolium iodide and, thereafter, added with water such that a silver halide content thereof, based on 1 kg of a mixed emulsion for a coating solution, is allowed to be 38.2 g in terms of silver and, then, added with a 1-(3-methylureidophenyl)-5-mercaptotetrazole such that the content thereof is allowed to be 0.34 g based on 1 kg of the mixed emulsion for the coating solution and, further, added with each of compounds 2, 20 and 26, as "a compound in which a one-electron-oxidized form generated by oxidizing one electron therein can release one or more electrons", such that each of the compounds is allowed to be $2\times10^{-3}$ mol based on 1 mol of silver of silver halide and, still further, added with each of compounds (19), (49) and (71), as a compound having an adsorptive group and a reducing group, such that each of the compounds is allowed to be $8\times10^{-3}$ mol based on 1 mol of silver halide.

2) Preparation of Pigment-1 Dispersion 250 g of water was added to 64 g of C.I. Pigment Blue 60 and 6.4 g of DEMOL N (trade name; manufactured by Kao Corporation). Then, the resultant mixture was thoroughly mixed to form a slurry. 800 g of zirconia beads having an average diameter of 0.5 mm was prepared and charged in a vessel together with the slurry. The slurry was dispersed for 25 hours with a dispersing machine (trade name: ¼ G Sand-Grinder Mill; manufactured by Imex Co., Ltd.) and, then, taken out of the vessel and, thereafter, added with water to allow a concentration of such pigment to be a 5% by mass, thereby obtaining a pigment-1 dispersion. Pigment grains contained in the thus-obtained pigment dispersion had an average grain diameter of 0.21 μm.

3) Preparation of Coating Solution

Preparation of Coating Solution for Image-Forming Layer 1,000 g of the above-described fatty acid silver salt dispersion A, 104 ml of water, 35 g of a pigment-1 dispersion, 6.3 g of an organic polyhalogen compound dispersion a, 20.7 g of an organic polyhalogen compound dispersion b, 1,060 g of and SBR Latex (Tg: 17° C.) solution, 75 g of a reduction agent-I dispersion, 75 g of a reduction agent-2 dispersion, 106 g of a hydrogen-bonding compound-1 dispersion, 4.8 g of a development accelerator-1 dispersion, 9 ml of a mercapto compound-1 aqueous solution, and 27 ml of a mercapto compound-2 aqueous solution were mixed by adding them in the stated order. The resultant mixture was further added with 9 g of a mercapto compound-1 solution and silver iodide complex forming agent (shown in Table 7) and, immediately before coating, added with a silver halide coating solution (shown in Table 7) such that a quantity thereof was allowed to be 0.25 mol in terms of silver, based on 1 mol of fatty acid silver salt (0.125 mol in regard to the sample 2-9; 0.5 mol in regard to the sample 2-11) and, thereafter, thoroughly mixed. The resulting coating solution for the image-forming layer was fed to a coating die as it was such that a coated quantity of silver was allowed to be 1.65 g/m$^2$ as a sum of the fatty acid silver salt and the silver halide.

An intermediate layer, a first layer of a protective layer of an emulsion layer, and a second layer of the protective layer of the emulsion layer used same layers as in the Example 1-1, respectively.

2-2. Preparation of Photothermographic Materials 1-13 to 1-38

On a surface opposite to a back surface, an image-forming layer, an intermediate layer, a first layer of a protective layer of an emulsion layer, and a second layer of the protective layer of the emulsion layer were coated in the stated order in a simultaneous multi-layer manner by using a slide bead coating method to prepare samples of photothermographic materials. Temperatures, at that time, of coating solutions were adjusted such that the coating solution for the image-forming layer and that for the intermediate layer were maintained at 35° C., that for the first layer of the protective layer of the emulsion layer was maintained at 36° C. and that for the second layer of the protective layer of the emulsion layer was maintained at 37° C.

Coating and drying conditions are described below.

Coating was performed at a coating speed of 160 m/min. A distance between the tip of the coating die and the support was set in a range from 0.10 mm to 0.30 mm. Pressure inside a reduced pressure chamber was set lower than the atmospheric pressure by from 196 Pa to 882 Pa. The support was electrically discharged with ionized air before coating.

After the coated solution was chilled in a subsequent chilling zone with air having a dry bulb temperature of from 10° C. to 20° C., the coated support was transported to a helical non-contact-type drying apparatus in a non-contact manner and, then, dried therein with drying air having a dry bulb temperature of from 23° C. to 45° C. and a wet bulb temperature of from 15° C. to 21° C. to obtain coated samples 21 to 27.

After such drying, the thus-obtained samples were conditioned in moisture contents at 25° C. from 40% to 60% RH and, then, heated such that a temperature of each of surfaces thereof came to be from 70° C. to 90° C. and, subsequently, cooled such that the temperature of a surface of a film came to be 25° C.

3. Evaluation of Photographic Performance

Each of the thus-obtained samples was cut into pieces of a half-size, wrapped with the above-described wrapping material in an atmosphere of 25° C. 50% RH and, then, stored for 2 weeks at room temperature.

The above-described photothermographic material was assessed as mentioned below.

Exposure of Photothermographic Material

The photothermographic material was subjected to an exposure treatment in a manner as described below.

The Fuji Medical Dry Laser Image FM-DPL was modified and, then, performed exposure and development process.

The exposure was conducted by irradiating such photosensitive material by a semiconductor laser (trade name: NLHV 3000E; manufactured by Nichia Corporation; oscillation wavelength: 405 nm) by restricting a beam diamer to 100 μm. The exposure was conducted by changing irradiation quantities of a laser in steps. The development was conducted by means of a thermal development part of the FM-DPL, while using 4 plates of panel heaters therein which have been set at 112° C., 119° C., 121° C., and 121° C., respectively. An entire developing time was 24 seconds.

Evaluation of Sample

Density of the resultant image was measured by using a Macbeth densitometer to construct a characteristic curve of the density to a logarithm of exposed quantity. Sensitivity: Sensitivity was exhibited in terms of a reciprocal number of an exposed quantity necessary for providing a blackening density of fog plus 1.0 and was shown as a relative value assuming the sensitivity of Sample No. 2-13 to be 100; it shows that, as the value becomes larger, the sensitivity becomes higher.

Dmin: Density of a non-image part was measured by using a Macbeth densitometer. The density thereof before thermal development was also measured.

Evaluation of Degree of Haze

A degree of haze denotes a degree of diffusion of light which is incident in a photosensitive material and is shown as a percentage of a diffused transmitted light quantity against an entire transmitted light quantity. The degree of haze was measure by using a haze meter "Model 1001DP" manufactured by Nippon Denshoku Industries Co., Ltd.

Evaluation of Image Storability (Printout)

An image sample obtained by thermally developing each of samples 1-13 to 1-38 was exposed to fluorescent light having an intensity of 8500 lux in an atmosphere of 40° C. 50% RH for 3 days. An optical density of an unexposed part of the thus-exposed image sample was measured. The thus-measured optical density was defined as $Dmin_2$ and that before such exposure to the fluorescent light was defined as $Dmin_1$. A difference (ΔDmin) was obtained by the following equation:

$$\Delta D\,\mathrm{min} = D\,\mathrm{min}_2 - D\,\mathrm{min}_1.$$

The obtained results are shown in Table 7. From the results shown in Table 7, following facts are found:

1) an image in which sensitivity is high, Dmin is low, and clearness of a film is favorable can be obtrained by simultaneously using the silver halide emulsion, being the silver iodide emulsion, having a size as large as 0.3 μm or more and the silver iodide complex forming agent according to the invention;

2) Only a small increase of sensitivity can be expected even when a quantity of the fine grain silver iodide emulsion having a size of 0.25 μm or less is increased. To contrast, a high sensitivity can only be obtained by using the emulsion having a size as large as 0.3 μm or more according to the invention;

3) In regard to the emulsion having a size as large as 0.3 μm or more, the haze of the film before the thermal development

TABLE 7

Present Inv.: Present invention, CE: Comparative example

| Sample No. | Emulsion No. | Addition quantity | Silver iodide complex forming agent: Compound No. | Silver iodide complex forming agent: Addition quantity | Haze degree of film: Before development | Haze degree of film: After development | Photographic property: Dmin (before development) | Photographic property: Sensitivity | Image storability: Printout | Remark |
|---|---|---|---|---|---|---|---|---|---|---|
| 1-13 | G | 0.25 | — | — | 28.6 | 22.5 | 0.18 | No image | 0.05 | CE |
| 1-14 | H | 0.25 | — | — | 42.5 | 36.6 | 0.22 | No image | 0.07 | CE |
| 1-15 | I | 0.25 | — | — | 50.5 | 45.6 | 0.24 | No image | 0.08 | CE |
| 1-16 | J | 0.25 | — | — | 52.4 | 46.1 | 0.26 | No image | 0.10 | CE |
| 1-17 | K | 0.25 | — | — | 58.5 | 52.6 | 0.27 | No image | 0.11 | CE |
| 1-18 | L | 0.25 | — | — | 50.2 | 44.3 | 0.25 | No image | 0.52 | CE |
| 1-19 | M | 0.25 | — | — | 53.5 | 47.5 | 0.28 | No image | 0.63 | CE |
| 1-20 | N | 0.25 | — | — | 57.2 | 51.2 | 0.28 | No image | 0.88 | CE |
| 1-21 | G | 0.125 | F-444 | 8 mol % | 28.6 | 22.5 | 0.18 | 0.03 | 0.00 | CE |
| 1-22 | " | 0.25 | " | 8 mol % | 28.8 | 22.6 | 0.18 | 0.03 | 0.00 | CE |
| 1-23 | " | 0.5 | " | 8 mol % | 29.2 | 23.0 | 0.18 | 0.04 | 0.00 | CE |
| 1-24 | H | 0.25 | " | 8 mol % | 42.5 | 23.2 | 0.17 | 9 | 0.01 | CE |
| 1-25 | I | 0.25 | " | 8 mol % | 50.5 | 24.1 | 0.18 | 100 | 0.02 | Present inv. |
| 1-26 | J | 0.25 | " | 8 mol % | 52.4 | 24.2 | 0.18 | 253 | 0.02 | Present inv. |
| 1-27 | K | 0.25 | " | 8 mol % | 58.5 | 23.8 | 0.28 | 515 | 0.02 | Present inv. |
| 1-28 | L | 0.25 | " | 8 mol % | 50.2 | 44.3 | 0.31 | 120 | 1.08 | CE |
| 1-29 | M | 0.25 | " | 8 mol % | 53.5 | 47.5 | 0.31 | 317 | 1.22 | CE |
| 1-30 | N | 0.25 | " | 8 mol % | 57.2 | 51.2 | 0.20 | 638 | 1.52 | CE |
| 1-31 | G | 0.25 | F-431 | 9.5 mol % | 28.6 | 23.2 | 0.17 | 0.03 | 0.00 | CE |
| 1-32 | H | 0.25 | " | 9.5 mol % | 42.5 | 24.1 | 0.18 | 7.7 | 0.01 | CE |
| 1-33 | I | 0.25 | " | 9.5 mol % | 50.5 | 24.4 | 0.18 | 85 | 0.02 | Present inv. |
| 1-34 | J | 0.25 | " | 9.5 mol % | 52.4 | 24.2 | 0.19 | 215 | 0.02 | Present inv. |
| 1-35 | K | 0.25 | " | 9.5 mol % | 58.5 | 23.2 | 0.17 | 438 | 0.02 | Present inv. |
| 1-36 | L | 0.25 | " | 9.5 mol % | 50.2 | 44.3 | 0.30 | 102 | 1.21 | CE |
| 1-37 | M | 0.25 | " | 9.5 mol % | 53.5 | 47.5 | 0.33 | 269 | 1.42 | CE |
| 1-38 | N | 0.25 | " | 9.5 mol % | 57.2 | 51.2 | 0.33 | 542 | 1.68 | CE |

is extremely high. However, the haze thereof after the thermal development is decreased by virtue of the silver iodide complex forming agent according to the invention and, accordingly, the film comes to be clear and is also excellent in the image storability (printout property); and 4) A silver bromide grain having a size of 0.3 μm or more has a sufficient sensitivity as a photosensitive material for photo-taking. However, since a dissolution phenomenon of the silver halide grain will not occur by the silver iodide complex forming agent according to the invention, a high haze remains after the thermal development and the image storability is also inferior.

Chemical structures of compounds employed in Examples according to the invention are described below.

Tellurium sensitizer C

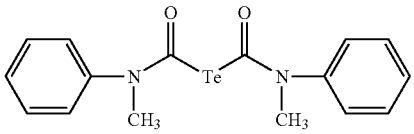

Base precursor compound-1

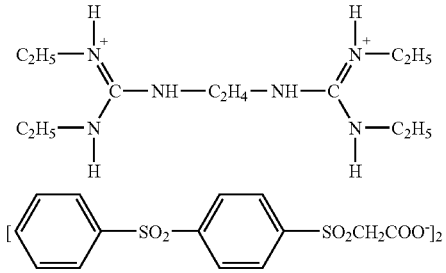

Spectral sensitizing dye A

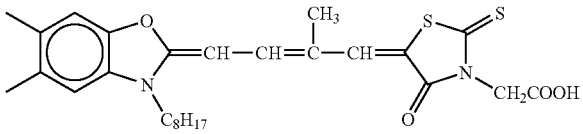

Spectral sensitizing dye B

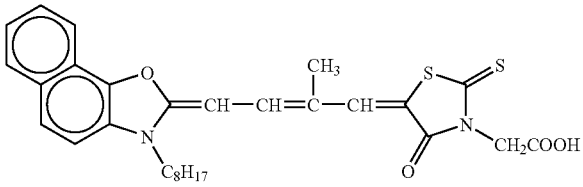

-continued

Cyanine dye Compound-1

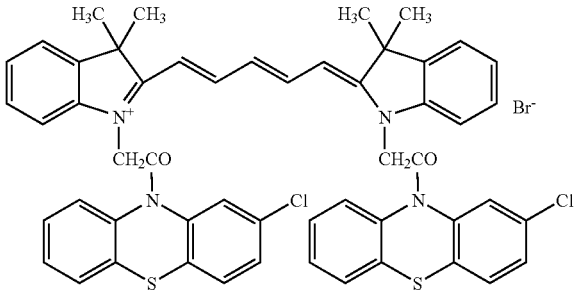

Blue dye compound-1

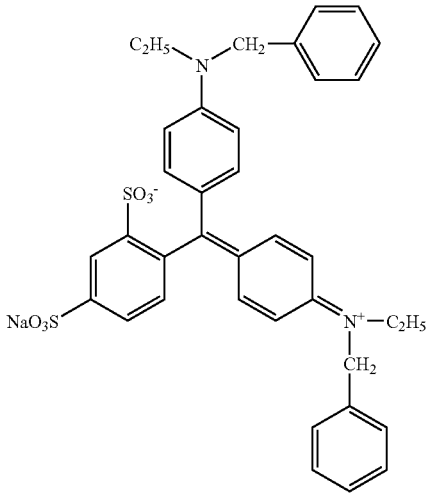

Blue dye compound-2

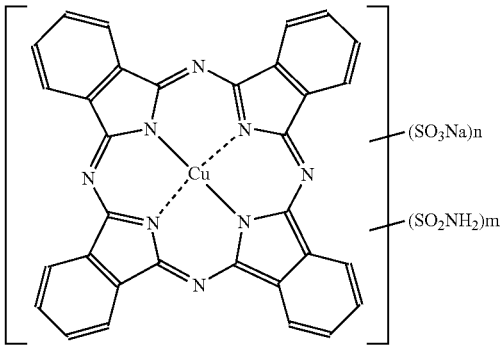

n = 0.5~2.0
m = 0.5~2.5

-continued

Ultraviolet light-absorbing agent-1

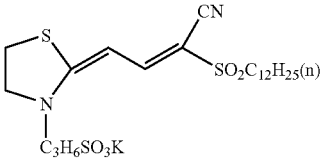

Reduction agent-1

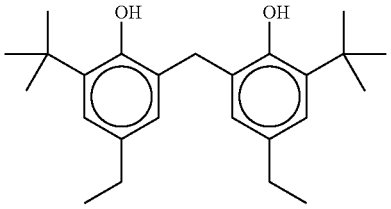

Reduction agent-2

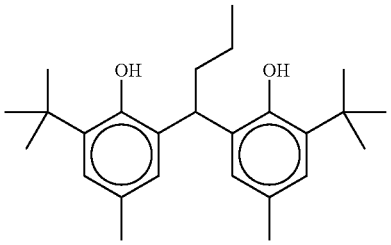

Hydrogen bond-forming compound-1

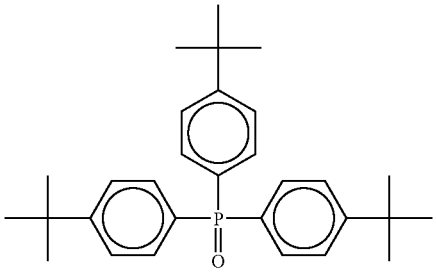

Organic polyhalogen compound-1

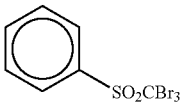

Organic polyhalogen compound-2

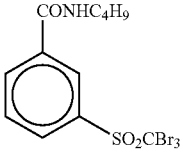

-continued

Mercapto compound-1

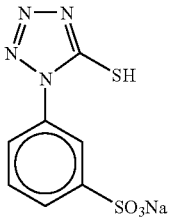

Mercapto compound-2

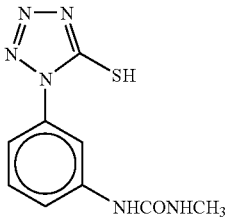

Development accelerator-1

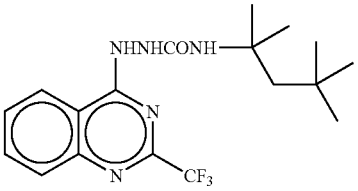

Development accelerator-2

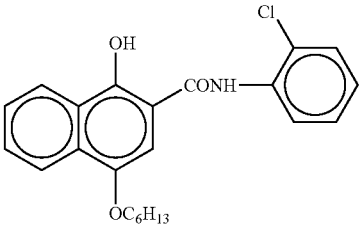

Color tone adjusting agent-1

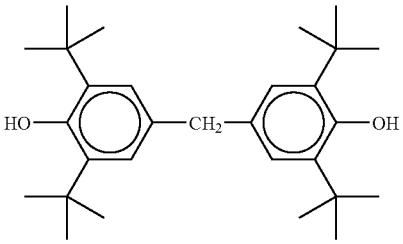

F-1: Mixture of $CF_3(CF_2)CH_2CH_2SCH_2CH_2COOLi$ (n=5 to 11)

F-2: Mixture of $CF_3(CF_2)CH_2CH_2O(CH_2CH_2O)_mH$ (n=5 to 11, m=5 to 15)

F-3

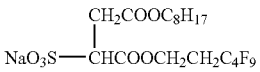

F-4

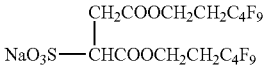

Example 1-3

1) Support

Undercoat having the prescription of Example 1-1 was applied on each surface of a PET support, having a thickness of 175 μm, colored in blue with a blue dye (1,4-bis(2,6-diethylanilinoanthraquinone)

2) Preparation of Coated Sample

An image-forming layer, an intermediate layer, a first layer for a protection layer of an emulsion layer, and a second layer for the protection layer of the emulsion layer having the same composition as that of the sample 1-26 of Example 1-2 were applied on each side of a support in a simultaneous manner and, then, dried. In other words, a photothermographic material, having a total coated quantity of silver of 1.72 g/m$^2$, in which an image-forming layer having a coated quantity of silver of 0.86 g/m$^2$ as a sum of a fatty acid silver and a silver halide was applied on each side of the support was prepared.

3) Evaluation of Performance

The thus-prepared photosensitive material in which both sides were coated was evaluated as described below.

A sample thereof was sandwiched between two sheets of X-ray regular screen HI-SCREEN B3 (trade name; manufactured by Fuji Photo Film Co., Ltd.) ($CaWO_4$ having a luminescent peak wavelength of 425 nm being used as a phosphor) to construct a combined system for image-forming. The combined system was subjected to an X-ray exposure for 0.05 second to perform an X-ray sensitometry. An X-ray apparatus DRX-3724HD (trade name; manufactured by Toshiba Corporation), as well as a tungsten target, was used. An X-ray which was emitted by applying an electric potential of 80 kVp to the apparatus by means of a three-phase pulse generator and, then, allowed to pass through a filter of water in 7 cm thick which has absorption approximately equivalent to that of a human body was employed as a light source. An exposure was conducted in a stepwise manner at a width of log E=0.15 by changing exposure quantities of the X-ray by means of a distance method. After the exposure, a thermal treatment was performed on the thus-exposed sample under thermal development conditions as described below to obtain an image. The thus-obtained image was evaluated by using a densitometer.

A thermal development part of the Fuji medical dry laser imager FM-DP L (trade name; manufactured by Fuji Photo Film Co., Ltd.) was modified such that heating can be performed from both sides to fabricate a thermal developing machine. Further, another medication was conducted such that a transportation roller of the thermal development part was replaced by a heat drum so as to allow a film sheet to be transported. Temperatures of 4 panel of a panel heater were set at 112° C., 118° C., 120° C. and 120° C., respectively while a temperature of the heat drum was set at 120° C. Further, a transportation speed was increased and set at 14 seconds in total.

On the other hand, a regular photosensitive material RX-U (trade name; manufactured by Fuji Photo Film Co., Ltd.) of a wet-type developing system was exposed under same conditions as described above and, then, treated with a developing solution CE-DI (trade name; manufactured by Fuji Photo Film Co., Ltd.) by using an automatic developing machine CEPROS-M2 (trade name; manufactured by Fuji Photo Film Co., Ltd.) for 45 seconds.

The photographic characteristics of the image obtained by the photothermographic material according to the invention and those of the image obtained by the wet-type developing system were compared with each other. As a result, both of them are equally favorable.

Example 1-4

1) Preparation of Sample

A double-side-type photographic material was prepared in a same manner as in Example 1-3 except for two points. The two points of alterations from Example 1-3 are as follows:

(1) An emulsion K was used as a silver halide emulsion and an ortho spectral sensitization was optimally conducted by sensitizing dyes 1 and 2; and (2) A cross-over cut layer was provided between an image-forming layer and a support.

Preparation of Coating Solution for Cross-Over Cut Layer 17 g of polyvinyl alcohol PVA-205 (trade name; manufactured by Kuraray Co., Ltd.), 9.6 g of polyacrylamide, 70 g of a solid fine grain dispersion (a) of a base precursor as described in Example 2, 56 g of an ortho dye solid fine grain dispersion (dye solid content: 3%; being prepared in a same manner as in the dye solid fine grain dispersion as in Example 2) containing an ortho thermally decolorizable dye-1 (λmax=566 nm) as described in JP-A No. 11-231457, 0.03 g of benzisothiazolinone, 2.2 g of sodium polyethylene sulfonate and 844 ml of water were mixed to prepare a coating solution for a cross-over cut layer.

Preparation of Coated Sample

A cross-over cut layer, an image-forming layer, an intermediate layer, a first layer for a protective layer of an emulsion layer, and a second layer for the protective layer of the emulsion layer were applied on each side of a support in a simultaneous manner and, then, dried. A flow rate of the cross-over cut layer was adjusted such that a coated quantity of the solid content of the ortho thermally decolorizing dye was allowed to be 0.04 g/m$^2$. Coating quantities of other layers were allowed to be same as those in Example 1-3.

Ortho Thermally Decolorizing Dye-1

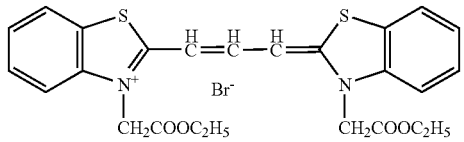

2) Evaluation of Performance

An X-ray exposure and thermal development were conducted in a same manner as in Example 1-3, except for using an X-ray ortho screen HG-M (trade name; manufactured by Fuji Photo Film Co., Ltd.) as a fluorescent screen (a terbium-activated gadolinium oxysulfide phosphor being used as a phosphor; a luminescent peak wavelength: 545 nm).

On the other hand, a photosensitive material SHR-S30 (trade name; manufactured by Fuji Photo Film Co., Ltd.) for an ortho system was exposed under same conditions as described above and, then, treated with a processing solution CE-DI-M2 (trade name; manufactured by Fuji Photo Film Co., Ltd.) by using an automatic developing machine CEPROS-M2 (trade name; manufactured by Fuji Photo Film Co., Ltd.) for 45 seconds to form an image.

The photographic characteristics of the thus-formed image obtained by using the photosensitive material and those of the image obtained by using the former photosensitive material according to the invention were compared with each other. As a result, both of them are equally favorable.

A measurement of sensitivity was performed in a same manner as in Example 1 of Japanese Patent No. 3083647 except for performing development by thermal development processing. As a result, the sensitivity was 0.0076 lux·second.

A measurement of cross-over was performed in a same manner as in Example 1 of JP-A No. 11-142723 except for performing development by thermal development processing. As a result, the cross-over was 7%.

Example 1-5

1) Preparation of Sample

A single-side-type photosensitive material was prepared in a same manner as in Example 1-2.

However, the image-forming layer was applied in two layers, namely, an upper layer and a lower layer and coated silver quantity as an entire silver quantity of fatty acid silver halide of each of these layers was allowed to be 0.8 g/m$^2$. The silver halides which were used for the upper layer and the lower layer were an emulsion I and an emulsion J, respectively. Ortho spectral sensitization of the upper layer and the lower layer was optimally performed by using the sensitizing dyes 1 and 2.

Further, the dye solid fine grain dispersion to be used in a coating solution for the antihalation layer which is a back layer was replaced by the dye solid dispersion of the ortho thermally decolorizing dye in Example 4.

2) Evaluation of Performance

The thus-obtained ortho sensitizing single-side-type photosensitive material was evaluated as described below.

A fluorescent screen for mammography UM MAMMO FINE (trade name; manufactured by Fuji Photo Film Co., Ltd.) (a terbium-activated gadolinium oxysulfide phosphor being used as a phosphor; a luminescent peak wavelength: 545 nm) was used as a fluorescent screen. Surfaces of the image-forming layer of the sample and the protective layer of the screen were allowed to be in contact with each other and a resultant combined body was inserted in a cassette ECMA (trade name; manufactured by Fuji Photo Film Co., Ltd.). The X-ray tube, an upper lid of the cassette, the film, and the screen were aligned in the stated order and were subjected to the X-ray irradiation.

A commercially available machine for mammography DRX-B1356EC (trade name; manufactured by Toshiba Corporation) was used as an X-ray supply. The X-ray which was emitted from an Mo target tube operated by 26 kVp generated by means of three-phase electric supply and allowed to pass through 1 mm-thick Be, 0.03 mm-thick Mo and a 2 cm-thick filter made of acrylate was used. An exposure was conducted for one second in a stepwise manner at a width of log E=0.15 by varying the exposure quantity of the X-ray by means of a distance method. After such exposure, thermal development processing was performed in a same manner as in Example 2.

On the other hand, a photosensitive material for mammography UM-MA$_{HC}$ (trade name; manufactured by Fuji Photo Film Co., Ltd.) was exposed under same conditions as described above and, then, treated with a processing solution CE-DI (trade name; manufactured by Fuji Photo Film Co., Ltd.) by using an automatic developing machine CEPROS-M2 (trade name; manufactured by Fuji Photo Film Co., Ltd.) for 90 seconds to form an image.

The photographic characteristics of the thus-formed image obtained by using the photosensitive material for mammography and those of the image obtained by using the former single-side-type photosensitive material according to the invention were compared with each other. As a result, both of them are equally favorable.

Sensitivity of the resultant photothermographic material was measured in a same manner as in Example as described in JP-A No. 10-62881 except for performing development by thermal development processing. As a result, the sensitivity was 0.021 lux·second. Further, gradation between density points of fog plus 0.25 and fog plus 2.0 was also measured. As a result, the gradation was 4.1.

Example 1-6

A double-side-type photosensitive material was prepared in a same manner as in Example 1-3.

However, the support was changed into PEN (polyethylene naphthalate.

Commercially available polyethylene-2,6-naphthalate was melted at 300° C. and, then, extruded from a T-type die and, thereafter, stretched up to 3.3 times in the machine direction and up to 3.3 times in the transverse direction at 140° C. and, subsequently, subjected to thermal fixation at 250° C. for 6 seconds to obtain a roll of film having a thickness of 175 μm. The support was treated with corona discharge by a solid-state corona discharge processor Model 6KVA (trade name; manufactured by Pillar Co.), in which the support having a width of 30 cm was treated at a running rate of 20 m/minute. From values of electric current and voltage read at that time, it was found that a treatment of 0.375 KV·A·min/m$^2$ was applied to the support. A discharge frequency at the time of the treatment was 9.6 KHz and a gap clearance between an electrode and a dielectric roll was 1.6 mm. Undercoat was performed in a same manner as in that of the support in Example 1-1.

The resultant double-side-type photothermographic material was evaluated as described below.

Each side of a sample of the double-side-type photosensitive material and a sheet of Ultravision First Detail (trade name; manufactured by Du Pont) were allowed to be in contact with each other and, then, exposured to the X-ray for 0.05 second to perform X-ray sensitometry. An exposure quantity of the X-ray was adjusted by varying a distance between the X-ray tube and the cassette.

After such exposure, a thermal development process was performed on the sample in a same manner as in Example 1-3.

As a result, a same excellent image as that in Example 1-3 was obtained.

Example 1-7

1. Preparation of Packaging Material

1) Preparation of Protective Cardboard-1 for Photothermographic Material

Figure 4:
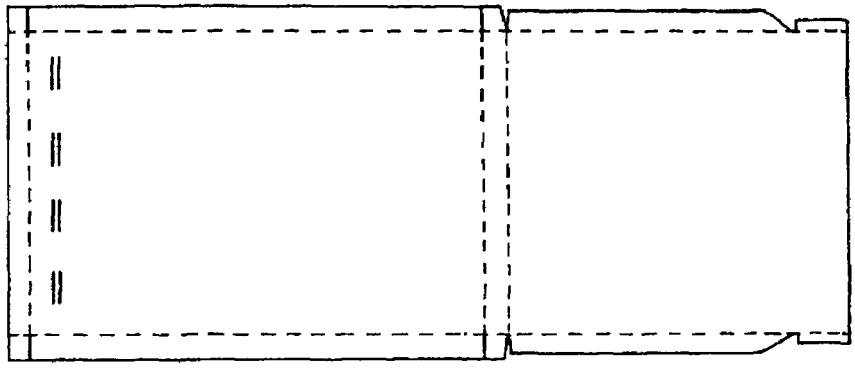
FIG. 4 is developed view of a protective cardboard.

Acid-free paper having a basis weight of 310 g/m$^2$ (LBKP/NBKP=70/30) (trade name: Prime 311; available from Stra Enso) was subjected to stamping to prepare a sheet having a form as shown in a developed view in FIG. 4

The thus-prepared sheet was allowed to pass through cleaning rolls (available from Teknek Japan Ltd.) at a traveling speed of 1 m/second and, then, folded along a ruled line to prepare a protective cardboard-1.

2) Preparation of Sheet for Hermetically Packaging

A mixture having a composition as shown in Table 8 was melt-kneaded and, then, stretched to obtain a film A having a thickness of 40 μm.

TABLE 8

| Components | Mass % |
|---|---|
| Furnace carbon black (light-shielding material) (manufactured by firing ethylene bottom oil derived from naphtha as a raw material in a furnace at 1600° C.; pH: 8.0; average grain diameter: 20 nm; volatile matter content: 0.6%; sulfurous component content: 0.05%; free sulfur content: 20 ppm or less) | 5.0 |
| Erucamide (slipping agent) | 0.05 |
| Calcium stearate (slipping agent) | 0.5 |
| Hindered phenol-type antioxidant (melting point: 110° C. or more) | 0.05 |
| Ethylene/4-methylpentene-1 copolymer resin (MFR: 2.0 g/10 minutes; density: 0.920 g/cm$^3$) | 79.4 |
| Ethylene homopolymer resin (MFR: 2.4 g/10 minutes; density: 0.921 g/cm$^3$) | 15 |

A sheet for hermitically packaging was obtained by laminating the thus-obtained film A and other articles in the stated order as shown in Table 9.

TABLE 9

| Layer | Thickness (μm) |
|---|---|
| Film A | 40 |
| Biaxially stretched polyester resin film (sliding angle: 19°) | 9 |
| Extrusion laminate adhesive layer of homopolyethylene resin (MFR: 4.5 g/10 minutes; density: 0.918 g/cm$^3$) | 13 |
| Dry laminate adhesive layer | 2 |
| Soft aluminum foil | 6.5 |
| Biaxially stretched nylon 6 resin film | 12 |

2. Preparation of Packaged Body

Figure 5:
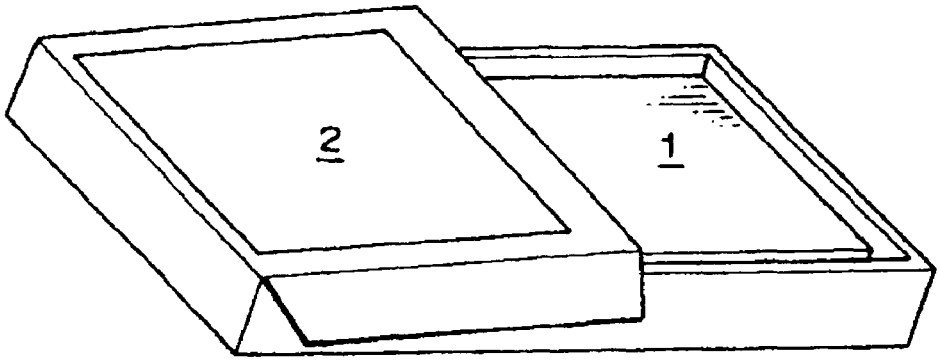
FIG. 5 is a perspective view of a stacked body—1 of a photothermographic material in sheet form, in which sheets of the photothermographic material are stacked and, then, contained in a protective cardboard—2.
Figure 6:
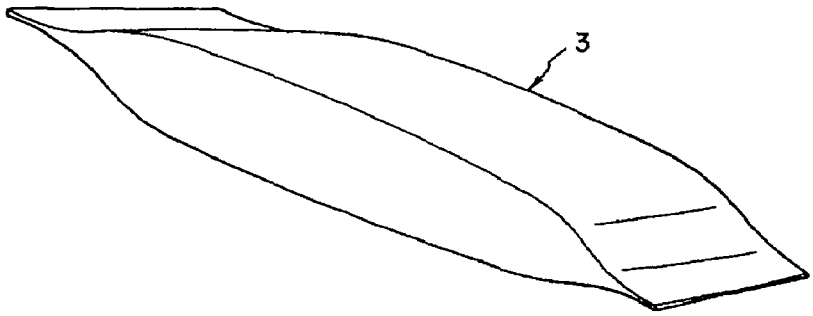
FIG. 6 is a perspective view of a state of hermetically packaging performed by a hermitically packaging sheet 3.
Figure 7:
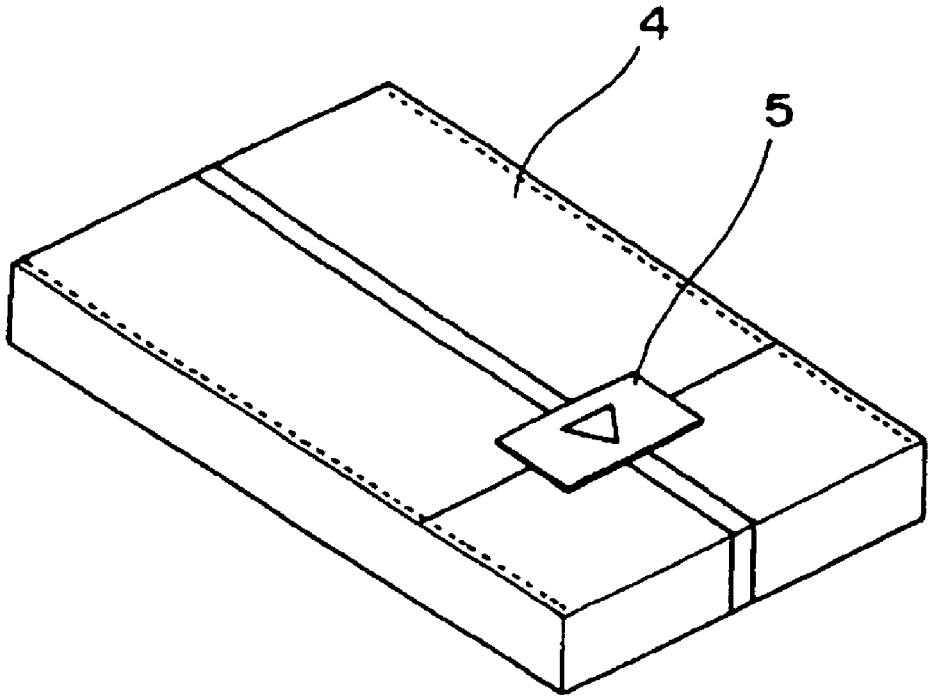
FIG. 7 is a perspective view of a state in which an emblem 5 is attached on a hermetically packaging bag provided with a moisture-proof light-shielding bag 4.

Each of the photothermographic materials 1-25 to 1-27 and 1-32 to 1-35 prepared in Example 1-2 was cut to sheets each having a size of 257 mm×364 mm in a room having cleanliness of class 3000 defined by a measuring method in accordance with US Federal Standard 209d. 150 sheets thereof were stacked with one another and, then, contained in a protective cardboard-1 (see FIG. 5). The resultant article was put in a packaging bag made of the sheet for hermetically packaging. Thereafter, it was de-aerated to decrease pressure and, then, both ends of the bag were heat-sealed (see FIG. 6), folded and fixed by labels as shown in FIG. 7.

In order to realize the cleanliness in the room, dust-protective coating was applied on all of a floor, a ceiling, and piping, an interior air-conditioner of turbulent pressurization type was installed, and a three-stage filter comprising a roll filter (dust collection rate: 50 to 80% of particulates having a size of 10 μm or more), a medium-performance filter (dust collection rate: 90% or more of particulates having a size of 0.3 μm or more) and a hepafilter (dust collection rate: 99.97% of particulates having a size of 0.3 μm or more) was used. For the dust-protective coating, used was HISTAR EF841 (trade name; manufactured by Hitachi Chemical Industrial Materials Co., Ltd.). Drive parts of cutting and stacking machines were separately framed and dust collection was locally performed at a wind flow rate of 8.0 m$^3$/minute.

Particularly, a cut portion was enclosed in a clean booth in which a downward flow of air was realized by supplying air from a ceiling and sucking it from under a floor which was lifted by a mesh wire. The air to be supplied was filtered by a hepafilter (dust collection rate: 99.97% of particulates having a size of 0.3 μm or more).

Figure 8:
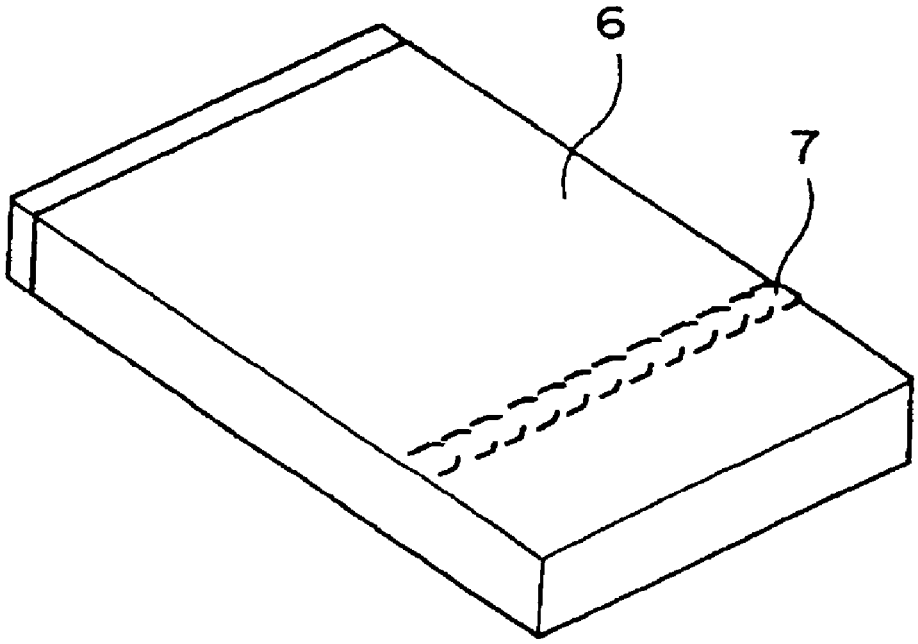
FIG. 8 is a perspective view of a state in which hermetically packaging bags are packed in a fancy box provided with a zip fastener.
Figure 9:
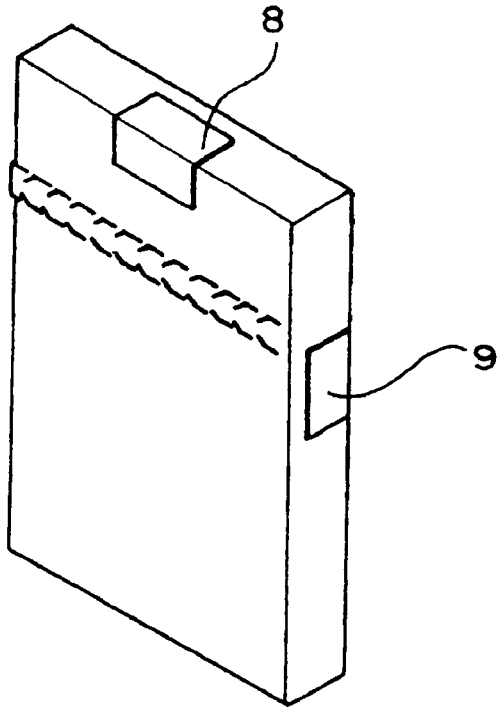
FIG. 9 is a perspective view of a state in which a tape for opening a fancy box provided with a zip fastener or a label is attached to the fancy box provided with the zip fastener.

Thereafter, in a room having cleanliness of class 10,000 defined by US Federal Standard 209d, as shown in FIG. 8, the resultant bag was packed in a fancy box 6 provided with a zip fastener 7 and, then, as shown in FIG. 9, a tape (or label) 8 for securing original sealability and for facilitating opening, and a quality label 9. Further, as for the material of the fancy box provided with a zip fastener, used was an E corrugated cardboard (front and rear liners: cardboard made of unbleached kraft pulp having a basis weight of 210 g/m$^2$; E-flute of corrugating medium: cardboard made of semi-kraft pulp having a basis weight of 180 g/m$^2$).

Figure 10:
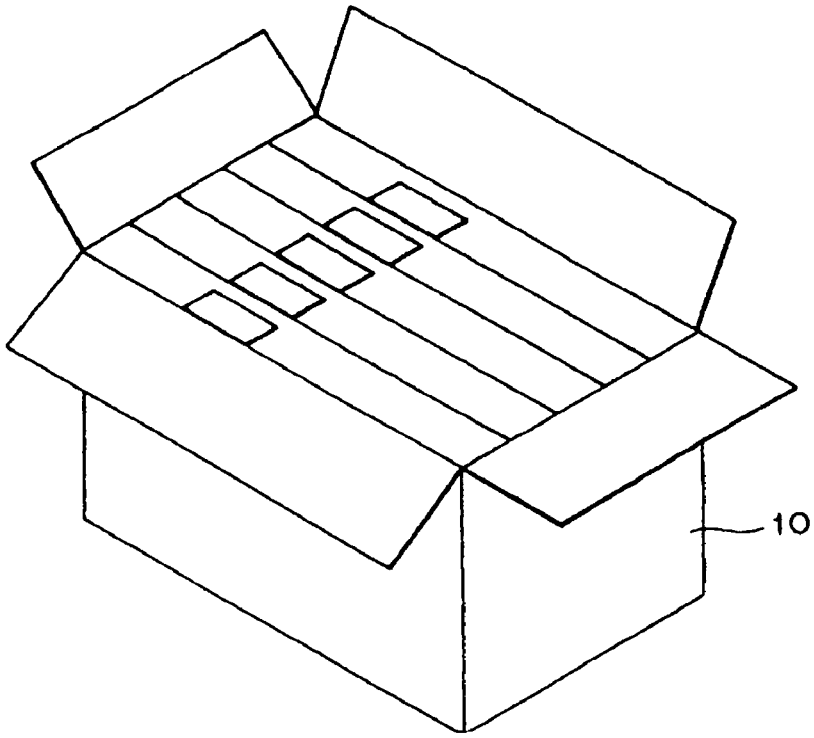
FIG. 10 is a perspective view of a state in which boxes each provided with a zip fastener are contained in a corrugated cardboard box.

Still further, as shown in FIG. 10, five boxes of these fancy boxes 6 each provided with a zip fastener were contained in a corrugated cardboard box 10 and, then, as shown in FIG. 9, a flap part of the corrugated cardboard box 10 was sealed by using a hotmelt-type adhesive and, thereafter, a product name, an expiry date, a production number, a short title of the product and the like are indicated on the box 10 to prepare a packaged body of the photothermographic material. A series of operations were performed at 23° C. 50% RH.

3. Evaluation Result of Performance

An evaluation was conducted in a same manner as in Example 1-5 and, as a result, it was found that sample according to the invention similarly exhibits excellent performance.

Example 1-8

Photothermographic materials were prepared in a same manner as in sample No. 1-27, except for using a same quantity in mol of each of F-116, F-404, F-514, F-709, F-803, F-805, and F-904 as that of F-444 in place of F-444 as a silver iodide complex forming agent and, then, evaluated. It was found that the sample according to the invention exhibits same excellent performance as that of sample No. 1-27.

Example 2-1

1. Preparation of Support

An undercoated support was prepared in a same manner as in Example 1-1.

2. Preparation of Material for Coating

1) Preparation of Silver Halide Emulsion

Preparation of Silver Halide Emulsion 2A

To 1,421 ml of distilled water, 4.3 ml of a 1% by mass potassium iodide solution was added and, further, 3.5 ml of sulfuric acid having a concentration of 0.5 mol/L, 36.5 g of phthalated gelatin, and 160 ml of a 5% by mass methanol solution of 2,2'-(ethylenedithio)diethanol were added. While being kept stirring at 75° C. in a reaction vessel made of stainless steel, the resultant mixture was added with both of a solution A which has been prepared by adding distilled water to 22.22 g of silver nitrate to make an entire volume up to 218 ml and a solution B which has been prepared by adding distilled water to 36.6 g of potassium iodide to make an entire volume up to 366 ml such that an entire quantity of the solution A was added at a constant flow-rate consuming 38 minutes and the solution B was added by a controlled-double-jet method while keeping a pAg value at 10.2 and, then, added with 10 ml of a 3.5% by mass aqueous solution of hydrogen peroxide and, thereafter, added with 10.8 ml of a 10% by mass aqueous solution of benzimidazole and, further, added with both of a solution C which has been prepared by adding distilled water to 51.86 g of silver nitrate to make an entire volume up to 508.2 ml and a solution D which has been prepared by adding distilled water to 63.9 g of potassium iodide to make an entire volume up to 639 ml such that an entire quantity of the solution C was added at a constant flow rate consuming 63 minutes and the solution D was added by a controlled-double-jet method while keeping a pAg value at 10.2. Then, 10 minutes after such additions of the solution C and the solution D were started, the resultant mixture was added with an entire quantity of potassium hexachloroiridate (III) so as to be $1\times10^{-4}$ mol, based on 1 mol of silver and, five seconds after the addition of the solution C was completed, added with an entire quantity of $3\times10^{-4}$ mol, based on 1 mol of silver, of an aqueous solution of potassium hexacyanoiron (II). A pH of the resultant mixture was adjusted to 3.8 by using sulfuric acid having a concentration of 0.5 mol/L and, then, a stirring operation was stopped to perform precipitation/desalination/washing steps. Subsequently, a pH of the mixture thus subjected to these steps was adjusted to 5.9 by using sodium hydroxide having a concentration of 1 mol/L, thereby preparing a silver halide dispersion having a pAg value of 11.0.

While being kept stirring at 38° C., the thus-prepared silver halide dispersion was added with 5 ml of a 0.34% by mass methanol solution of 1,2-benzisothiazolin-3-one and, after 40 minutes elapsed, heated to 47° C. and, 20 minutes after such heating, added with $7.6\times10^{-5}$ mol, based on 1 mol of silver, of a methanol solution of sodium benzene thiosulfonate and, after 5 minutes elapsed, added with $2.9\times10^{-4}$ mol, based on 1 mol of silver, of a methanol solution of a tellurium sensitizing agent C and, then, ripened for 91 minutes and, thereafter, added with $1.2\times10^{-3}$ mol, as a total of sensitizing dyes A and B based on 1 mol of silver, of a methanol solution of a 3:1 mixture in a molar ratio of the sensitizing dyes A and B and, after one minute elapsed, added with 1.3 ml of a 0.8% by mass methanol solution of N,N'-dihydroxy-N",N"-diethylmelamine and, after 4 minutes elapsed, added with $4.8\times10^{-3}$ mol, based on 1 mol of silver, of a methanol solution of 5-methyl-2-mercaptobenzimidazole, $5.4\times10^{-3}$ mol, based on 1 mol of silver, of a methanol solution of 1-phenyl-2-heptyl-5-mercapto-1,3,4-triazole, and $8.5\times10^{-3}$ mol, based on 1 mol of silver, of an aqueous solution of 1-(3-methylureidophenyl)-5-mercaptotetrazole, thereby preparing a silver halide emulsion 2A.

The thus-prepared silver halide emulsion 2A was a pure silver iodide emulsion in which tabular grains having an average projected area diameter of 1.369 μm, a variation coefficient of the average projected area diameter of 19.7%, an average thickness of 0.130 μm, and an average aspect ratio of 11:1 occupy 80% or more of an entire projected area. A sphere-equivalent diameter of the grain was 0.707 μm. As a result of an X-ray powder diffraction analysis, it was found that 90% or more of silver iodide was present in a form of γ phase.

Preparation of Silver Halide Emulsion 2B 1 mol of a tabular grain AgI emulsion prepared in the silver halide emulsion 2A was put in a reaction vessel. When a pAg value was measured at 38° C., it was 10.2. Subsequently, the emulsion was added with a 0.5 mol/L NaCl solution and a 0.5 mol/L $AgNO_3$ solution by a double-jet method at an addition rate of 10 ml/minute consuming 20 minutes to allow substantially 10 mol % of silver chloride to be deposited on an AgI host emulsion. During such addition operation, a pAg value was maintained at 10.2. Further, a pH of the resultant mixture was adjusted to 3.8 by using sulfuric acid having a concentration of 0.5 mol/L and, then, a stirring operation was stopped to perform precipitation/desalination/washing steps. Subsequently, a pH of the mixture thus subjected to these steps was adjusted to 5.9 by using sodium hydroxide having a concentration of 1 mol/L, thereby preparing a silver halide dispersion having a pAg value of 11.0.

While being kept stirring at 38° C., the thus-prepared silver halide dispersion was added with 5 ml of a 0.34% by mass methanol solution of 1,2-benzisothiazolin-3-one and, after 40 minutes elapsed, heated to 47° C. and, 20 minutes after such heating, added with $7.6\times10^{-5}$ mol, based on 1 mol of silver, of a methanol solution of sodium benzene thiosulfonate and, after 5 minutes elapsed, added with $2.9\times10^{-4}$ mol, based on 1 mol of silver, of a methanol solution of a tellurium sensitizing agent C and, then, ripened for 91 minutes and, thereafter, added with $1.2\times10^{-3}$ mol, as a total of sensitizing dyes A and B based on 1 mol of silver, of a methanol solution of a 3:1 mixture in a molar ratio of the sensitizing dyes A and B and, after one minute elapsed, added with 1.3 ml of a 0.8% by mass methanol solution of N,N'-dihydroxy-N"-diethylmelamine and, after 4 minutes elapsed, added with $4.8\times10^{-3}$ mol, based on 1 mol of silver, of a methanol solution of 5-methyl-2-mercaptobenzimidazole, $5.4\times10^{-3}$ mol, based on 1 mol of silver, of a methanol solution of 1-phenyl-2-heptyl-5-mercapto-1,3,4-triazole, and $8.5\times10^{-3}$ mol, based on 1 mol of silver, of an aqueous solution of 1-(3-methylureidophenyl)-5-mercaptotetrazole, thereby preparing a silver halide emulsion 2B.

Preparation of Silver Halide Emulsion 2C 1 mol of a tabular grain AgI emulsion prepared in the silver halide emulsion 2A was put in a reaction vessel. When a pAg value was measured at 38° C., it was 10.2. Subsequently, the emulsion was added with a 0.5 mol/L KBr solution and a 0.5 mol/L $AgNO_3$ solution by a double-jet method at an addition rate of 10 ml/minute consuming 20 minutes to allow substantially 10 mol % of silver bromide to be deposited on an AgI host emulsion. During such addition operation, a pAg value was maintained at 10.2. Further, a pH of the resultant mixture was adjusted to 3.8 by using sulfuric acid having a concentration of 0.5 mol/L and, then, a stirring operation was stopped to perform precipitation/desalination/washing steps. Subsequently, a pH of the mixture thus subjected to these steps was adjusted to 5.9 by using sodium hydroxide having a concentration of 1 mol/L, thereby preparing a silver halide dispersion having a pAg value of 11.0.

While being kept stirring at 38° C., the thus-prepared silver halide dispersion was added with 5 ml of a 0.34% by mass methanol solution of 1,2-benzisothiazolin-3-one and, after 40 minutes elapsed, heated to 47° C. and, 20 minutes after such heating, added with $7.6\times10^{-5}$ mol, based on 1 mol of silver, of a methanol solution of sodium benzene thiosulfonate and, after 5 minutes elapsed, added with $2.9\times10^{-4}$ mol, based on 1 mol of silver, of a methanol solution of a tellurium sensitizing agent C and, then, ripened for 91 minutes and, thereafter, added with $1.2\times10^{-3}$ mol, as a total of sensitizing dyes A and B based on 1 mol of silver, of a methanol solution of a 3:1 mixture in a molar ratio of the sensitizing dyes A and B and, after one minute elapsed, added with 1.3 ml of a 0.8% by mass methanol solution of N,N'-dihydroxy-N"-diethylmelamine and, after 4 minutes elapsed, added with $4.8\times10^{-3}$ mol, based on 1 mol of silver, of a methanol solution of 5-methyl-2-mercaptobenzimidazole, $5.4\times10^{-3}$ mol, based on 1 mol of silver, of a methanol solution of 1-phenyl-2-heptyl-5-mercapto-1,3,4-triazole, and $8.5\times10^{-3}$ mol, based on 1 mol of silver, of an aqueous solution of 1-(3-methylureidophenyl)-5-mercaptotetrazole, thereby preparing a silver halide emulsion 2C.

Preparation of Silver Halide Emulsion 2D 1 mol of a tabular grain AgI emulsion prepared in the silver halide emulsion 2A was put in a reaction vessel. When a pAg value was measured at 38° C., it was 10.2. Subsequently, the emulsion was added with a 0.5 mol/L KBr solution and a 0.5 mol/L $AgNO_3$ solution by a double-jet method at an addition rate of 10 ml/minute consuming 20 minutes to allow 10 mol % of silver bromide to be substantially deposited on an AgI host emulsion. During such addition operation, a pAg value was maintained at 10.2. Further, the resultant mixture was added with 200 ml of a 0.5 mol/L KI solution and, then, ripened for 20 minutes. Subsequently, a pH of the resultant mixture was adjusted to 3.8 by using sulfuric acid having a concentration of 0.5 mol/L and, then, a stirring operation was stopped to perform precipitation/desalination/washing steps. Subsequently, a pH of the mixture thus subjected to these steps was adjusted to 5.9 by using sodium hydroxide having a concentration of 1 mol/L, thereby preparing a silver halide dispersion having a pAg value of 11.0.

While being kept stirring at 38° C., the thus-prepared silver halide dispersion was added with 5 ml of a 0.34% by mass methanol solution of 1,2-benzisothiazolin-3-one and, after 40 minutes elapsed, heated to 47° C. and, 20 minutes after such heating, added with $7.6\times10^{-5}$ mol, based on 1 mol of silver, of a methanol solution of sodium benzene thiosulfonate and, after 5 minutes elapsed, added with $2.9\times10^{-4}$ mol, based on 1 mol of silver, of a methanol solution of a tellurium sensitizing agent C and, then, ripened for 91 minutes and, thereafter, added with $1.2\times10^{-3}$ mol, as a total of sensitizing dyes A and B based on 1 mol of silver, of a methanol solution of a 3:1 mixture in a molar ratio of the sensitizing dyes A and B and, after one minute elapsed, added with 1.3 ml of a 0.8% by mass methanol solution of N,N'-dihydroxy-N"-diethylmelamine and, after 4 minutes elapsed, added with $4.8\times10^{-3}$ mol, based on 1 mol of silver, of a methanol solution of 5-methyl-2-mercaptobenzimidazole, $5.4\times10^{-3}$ mol, based on 1 mol of silver, of a methanol solution of 1-phenyl-2-heptyl-5-mercapto-1,3,4-triazole, and $8.5\times10^{-3}$ mol, based on 1 mol of silver, of an aqueous solution of 1-(3-methylureidophenyl)-5-mercaptotetrazole, thereby preparing a silver halide emulsion 2D.

It was observed by TEM that a multitude of dislocation lines were introduced.

Preparation of Silver Halide Emulsion 2E

Silver iodobromide having 3.5 mol % of silver iodide was prepared by replacing the potassium iodide solution used at the time of preparation of the silver halide emulsion 1A by a 1:19 mixed solution in a mass ratio of potassium iodide to potassium bromide in a same quantity as that of the former solution.

Preparation of Silver Halide Emulsion 2F

In regard to a tabular grain AgBrI emulsion prepared by the silver halide emulsion 2E, substantially 10 mol % of silver chloride was deposited on an AgBrI host emulsion in a same manner as in the preparation of the silver halide emulsion 1B.

Preparation of Silver Halide Emulsion 2G

In regard to a tabular grain AgBrI emulsion prepared by the silver halide emulsion 2E, substantially 10 mol % of silver bromide was deposited on an AgBrI host emulsion in a same manner as in the preparation of the silver halide emulsion 1C.

Preparation of Silver Halide Emulsion 2H

In regard to a tabular grain AgBrI emulsion prepared by the silver halide emulsion 2E, a silver iodobrimide emulsion in which a multitude of dislocation lines were introduced was prepared in a same manner as in the preparation of the silver halide emulsion 1D.

6) Preparation of Organic Polyhalogen Compound Dispersion

Preparation of Organic Polyhalogen Compound-1 Dispersion 10 kg of an organic polyhalogen compound-1 (tribromomethane sulfonylbenzene), 10 kg of a 20% by mass aqueous solution of modified polyvinylalcohol (trade name: POVAL MP203; manufactured by Kuraray Co. Ltd.), 0.4 kg of a 20% by mass aqueous solution of sodium triisopropylnaphthalenesulfonate, and 14 kg of water were mixed. The resultant mixture was thoroughly mixed to form a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed therein for 5 hours. Then, 0.2 g of a sodium salt of benzisothiazolinone and water were added to the resultant dispersion so as to allow a concentration of the resultant organic polyhalogen compound to be 30% by mass, thereby obtaining an organic polyhalogen compound-1 dispersion. Organic polyhalogen compound grains contained in the polyhalogen compound dispersion had a median diameter of 0.41 μm and a maximum grain diameter of 2.0 μm or less. The thus-obtained organic polyhalogen compound dispersion was filtrated with a filter made of polypropylene having a pore diameter of 10.0 μm to remove foreign matters such as dust and, then, stored.

Preparation of Organic Polyhalogen Compound-2 Dispersion 10 kg of an organic polyhalogen compound-2 (N-butyl-3-tribromomethane sulfonylbenzamide), 20 kg of a 10% by mass aqueous solution of modified polyvinylalcohol (trade name: POVAL MP203; manufactured by Kuraray Co. Ltd.), and 0.4 kg of a 20% by mass aqueous solution of sodium triisopropylnaphthalenesulfonate were mixed. The resultant mixture was thoroughly mixed to form a slurry. The slurry was fed by means of a diaphragm pump into a horizontal-type sand mill (trade name: UVM-2; manufactured by Imex Co., Ltd.) filled with zirconia beads having an average diameter of 0.5 mm, and dispersed therein for 5 hours. Then, 0.2 g of a sodium salt of benzisothiazolinone and water were added to the resultant dispersion so as to allow a concentration of the organic polyhalogen compound to be 30% by mass. The resultant dispersion was heated at 40° C. for 5 hours, thereby obtaining an organic polyhalogen compound-2 dispersion. Organic polyhalogen compound grains contained in the thus-obtained polyhalogen compound dispersion had a median diameter of 0.40 μm and a maximum grain diameter of 1.3 μm or less. The thus-obtained organic polyhalogen compound dispersion was filtrated with a filter made of polypropylene having a pore diameter of 3.0 μm to remove foreign matters such as dust and, then, stored.

Preparation of Silver Halide Emulsion for Preparation of Coating Solution

Any one of the above-described silver halide emulsions 2A to 2H was dissolved at 40° C. and, then, added with $7\times10^{-3}$ mol, based on 1 mol of silver, of a 1% by mass aqueous solution of benzothiazolium iodide and, thereafter, added with water such that a silver halide content thereof, based on 1 kg of a mixed emulsion for a coating solution, is allowed to be 38.2 g in terms of silver and, then, added with 1-(3-methylureidophenyl)-5-mercaptotetrazole such that the content thereof is allowed to be 0.34 g based on 1 kg of the mixed emulsion for coating solution.

Further, in the case of Samples 2-29 to 2-36 shown in Table 10, each of compounds 2, 20 and 26, as "a compound in which a one-electron-oxidized form generated by oxidizing one electron therein can release one or more electrons" was added such that each of the compounds is allowed to be $2\times10^{-3}$ on 1 mol of silver of silver halide.

In the case of Samples 2-25 to 2-28 and 2-33 to 2-36 shown in Tables 10 and 11, each of compounds (19), (49) and (71) as a compound having an adsorptive group and a reducing group was added such that each of the compounds is allowed to be $8\times10^{-3}$ mol based on 1 mol of silver halide, thereby preparing silver halide coating solutions 2-1 to 2-36.

3. Preparation of Coating Solution

Preparation of Coating Solution for Image-Forming Layer 1,000 g of the above-described fatty acid silver salt dispersion A, 104 ml of water, 35 g of a pigment-1 dispersion, 6.3 g of an organic polyhalogen compound-1 dispersion, 20.7 g of an organic polyhalogen compound-2 dispersion, 1,060 g of SBR Latex (Tg: 23° C.) solution, 75 g of a reduction agent-1 dispersion, 75 g of a reduction agent-2 dispersion, 106 g of a hydrogen-bonding compound-1 dispersion, 4.8 g of a development accelerator-1 dispersion, 3.0 g of a development accelerator-2 dispersion, 2.0 g of a color toning agent-1 dispersion, 9 ml of a mercapto compound-1 aqueous solution, and 27 ml of a mercapto compound-2 aqueous solution were mixed by adding them in the stated order. The resultant mixture was further added with silver iodide complex forming agent (shown in Tables 10 and 11) and, immediately before coating, added with a silver halide coating solution (shown in Tables 10 and 11) such that a quantity thereof was allowed to be 0.25 mol in terms of silver, based on 1 mol of fatty acid silver salt and, thereafter, thoroughly mixed. The resulting coating solution for the image-forming layer was fed to a coating die as it was and, then, applied. A coated quantity of silver was allowed to be 1.65 g/m$^2$ as a sum of the fatty acid silver salt and the silver halide.

Samples 2-1 to 2-36 of the photothermographic material were prepared in a same manner as in Example 1-2 except for replacing the blue dye compound-1 in Example 1-2 by the blue dye compound-2 in the preparation of the coating solution for the antihalation layer used in the back layer.

A matting degree, in terms of Beck's degree of smoothness, of the thus-prepared photothermographic material was 550 second on the side of the image-forming layer surface and 130 seconds on the side of the back surface. Further, a pH of a film surface on the side of the image-forming layer surface was measured. As a result, the pH was 6.0.

Evaluation of Photographic Performance

Each of the thus-obtained samples was cut into pieces of a half-size, wrapped with the above-described wrapping material in an atmosphere of 25° C. 50% RH and, then, stored for 2 weeks at room temperature and, thereafter, assessed as mentioned below.

A semiconductor laser (trade name: NLHV3000E; manufactured by Nichia Corporation) was attached to an exposure part of The Fuji Medical Dry Laser Image FM-DP L as a laser light source and a beam diameter was restricted to 100 μm. The sample was irradiated for $10^{-6}$ second by the laser light emitted therefrom by varing luminance of the laser light on a surface of the photosensitive material in the range of 0 and from 1 mW/mm$^2$ to 1000 mW/mm$^2$. Thermal development was performed under conditions in which an oscillation wavelength of the laser light was 405 nm, temperatures of 4 panels of a panel-heater were set at 112° C., 119° C., 121° C., and 121° C., respectively, and a transportation speed was increased such that it was allowed to be 14 seconds in total. The resultant image was evaluated by using a densitometer.

Evaluation of Sample

Density of the thus-obtained image was measured by using a Macbeth densitometer to construct a characteristic curve of the density against a logarithm of exposed quantity.

1. Sensitivity

Sensitivity was exhibited in terms of a reciprocal number of an exposed quantity necessary for providing a blackening density which is density of Dmin plus 1.0 and shown as a relative value assuming the sensitivity of Sample No. 2-9 to be 100; it shows that, as the value becomes larger, the sensitivity becomes higher.

2. Fog (Dmin)

Density of a non-image part was measured by using a Macbeth densitometer.

3. Image Storability (Printout)

After the thus-thermally developed sample was exposed to fluorescent light having an intensity of 850 lux in an atmosphere of 40° C. 50% RH for 3 days, an increase of fog density in the Dmin part was evaluated. An optical density at that time was defined as $Dmin_2$ and that before such exposure to the fluorescent light was defined as $Dmin_1$. A difference (ΔDmin) was obtained by the following equation:

$$\Delta D\,\mathrm{min} = D\,\mathrm{min}_2 - D\,\mathrm{min}_1.$$

TABLE 10

Samples 2-1 to 2-20; Emulsions 2A to 2H

| Photothermographic material | Silver halide emulsion | | | Silver iodide complex forming agent | | Compound having adsorptive group and reducing group | Compound types 1 to 5 | Image | | | |
|---|---|---|---|---|---|---|---|---|---|---|---|
| | | AgI content | Shape | Compound No. | Addition quantity | | | Sensitivity | Fog | storability (ΔDmin) | Remark |
| 2-1 | 2A | 100 mol % | — | — | — | — | — | No image | 0.25 | 0.12 | CE |
| 2-2 | 2B | 100 mol % | AgCl ep. | — | — | — | — | No image | 0.25 | 0.12 | CE |
| 2-3 | 2C | 100 mol % | AgBr ep. | — | — | — | — | No image | 0.25 | 0.12 | CE |
| 2-4 | 2D | 100 mol % | DL | — | — | — | — | No image | 0.25 | 0.12 | CE |
| 2-5 | 2E | 3.5 mol % | — | — | — | — | — | No image | 0.27 | 0.50 | CE |
| 2-6 | 2F | 3.5 mol % | AgCl ep. | — | — | — | — | No image | 0.27 | 0.50 | CE |
| 2-7 | 2G | 3.5 mol % | AgBr ep. | — | — | — | — | No image | 0.27 | 0.50 | CE |
| 2-8 | 2H | 3.5 mol % | DL | — | — | — | — | No image | 0.27 | 0.50 | CE |

TABLE 10-continued

| Photothermo-graphic material | Samples 2-1 to 2-20; Emulsions 2A to 2H | Silver halide emulsion | | Silver iodide complex forming agent | | Compound having adsorptive group and reducing group | Compound types 1 to 5 | Sensitivity | Fog | Image storability (ΔDmin) | Remark |
|---|---|---|---|---|---|---|---|---|---|---|---|
| | | AgI content | Shape | Compound No. | Addition quantity | | | | | | |
| 2-9 | 2A | 100 mol % | — | F440 | 8 mol % | — | — | 100 | 0.18 | 0.02 | CE |
| 2-10 | 2B | 100 mol % | AgCl ep. | F440 | 8 mol % | — | — | 170 | 0.18 | 0.00 | Present Invention |
| 2-11 | 2C | 100 mol % | AgBr ep. | F440 | 8 mol % | — | — | 160 | 0.18 | 0.00 | Present Invention |
| 2-12 | 2D | 100 mol % | DL | F440 | 8 mol % | — | — | 150 | 0.18 | 0.00 | Present Invention |
| 2-13 | 2E | 3.5 mol % | — | F440 | 8 mol % | — | — | 80 | 0.18 | 0.80 | CE |
| 2-14 | 2F | 3.5 mol % | AgCl ep. | F440 | 8 mol % | — | — | 95 | 0.18 | 0.70 | CE |
| 2-15 | 2G | 3.5 mol % | AgBr ep. | F440 | 8 mol % | — | — | 90 | 0.18 | 0.75 | CE |
| 2-16 | 2H | 3.5 mol % | DL | F440 | 8 mol % | — | — | 88 | 0.18 | 0.85 | CE |
| 2-17 | 2A | 100 mol % | — | F431 | 10 mol % | — | — | 95 | 0.18 | 0.02 | CE |
| 2-18 | 2B | 100 mol % | AgCl ep. | F431 | 10 mol % | — | — | 165 | 0.18 | 0.00 | Present Invention |
| 2-19 | 2C | 100 mol % | AgBr ep. | F431 | 10 mol % | — | — | 155 | 0.18 | 0.00 | Present Invention |
| 2-20 | 2D | 100 mol % | DL | F431 | 10 mol % | — | — | 145 | 0.18 | 0.00 | Present Invention |

TABLE 11

| Photothermo-graphic material | Samples 2-21 to 2-36; Emulsion 2A to 2H | Silver halide emulsion | | Silver iodide complex forming agent | | Compound having adsorptive group and reducing group | Compound types 1 to 5 | Sensitivity | Fog | Image storability (ΔDmin) | Remark |
|---|---|---|---|---|---|---|---|---|---|---|---|
| | | AgI content | Shape | Compound No. | Addition quantity | | | | | | |
| 2-21 | 2E | 3.5 mol % | — | F431 | 10 mol % | — | — | 77 | 0.18 | 1.05 | CE |
| 2-22 | 2F | 3.5 mol % | AgCl ep. | F431 | 10 mol % | — | — | 92 | 0.18 | 1.00 | CE |
| 2-23 | 2G | 3.5 mol % | AgBr ep. | F431 | 10 mol % | — | — | 87 | 0.18 | 0.95 | CE |
| 2-24 | 2H | 3.5 mol % | DL | F431 | 10 mol % | — | — | 85 | 0.18 | 1.10 | CE |
| 2-25 | 2A | 100 mol % | — | F440 | 8 mol % | (19)(49)(71) | — | 140 | 0.19 | 0.03 | CE |
| 2-26 | 2B | 100 mol % | AgCl ep. | F440 | 8 mol % | (19)(49)(71) | — | 270 | 0.19 | 0.01 | Present Invention |
| 2-27 | 2C | 100 mol % | AgBr ep. | F440 | 8 mol % | (19)(49)(71) | — | 260 | 0.19 | 0.01 | Present Invention |
| 2-28 | 2D | 100 mol % | DL | F440 | 8 mol % | (19)(49)(71) | — | 250 | 0.19 | 0.01 | Present Invention |
| 2-29 | 2A | 100 mol % | — | F440 | 8 mol % | — | (2)(20)(26) | 130 | 0.19 | 0.03 | CE |
| 2-30 | 2B | 100 mol % | AgCl ep. | F440 | 8 mol % | — | (2)(20)(26) | 210 | 0.19 | 0.01 | Present Invention |
| 2-31 | 2C | 100 mol % | AgBr ep. | F440 | 8 mol % | — | (2)(20)(26) | 200 | 0.19 | 0.01 | Present Invention |
| 2-32 | 2D | 100 mol % | DL | F440 | 8 mol % | — | (2)(20)(26) | 190 | 0.19 | 0.01 | Present Invention |
| 2-33 | 2A | 100 mol % | — | F440 | 8 mol % | (19)(49)(71) | (2)(20)(26) | 180 | 0.19 | 0.03 | CE |
| 2-34 | 2B | 100 mol % | AgCl ep. | F440 | 8 mol % | (19)(49)(71) | (2)(20)(26) | 310 | 0.19 | 0.01 | Present Invention |
| 2-35 | 2C | 100 mol % | AgBr ep. | F440 | 8 mol % | (19)(49)(71) | (2)(20)(26) | 300 | 0.19 | 0.01 | Present Invention |
| 2-36 | 2D | 100 mol % | DL | F440 | 8 mol % | (19)(49)(71) | (2)(20)(26) | 290 | 0.19 | 0.01 | Present Invention |

(AgCl ep.: AgCl epitaxial
AgBr ep.: AgBr epitaxial
DL: Dislocation line
CE: Comparative Example)

As is apparent from the results in Tables 10 and 11, according to the photothermographic material of the invention, a favorable image storability having a high sensitivity and a low fog can be obtained.

Particularly, the photothermographic material which is prepared by performing an AgCl epitaxial growth on a silver halide grain, by performing an AgBr epitaxial growth on a silver halide grain, or by introducing a dislocation line gives a high sensitivity. However, while an intensity of such high sensitivity in silver iodobromide having 3.5 mol % of silver iodide is relatively low, that in the high silver iodide emulsion is remarkably high, namely, an effect of the latter is more than expectation.

Further, high sensitivity can also be obtained by a compound having an adsorptive group and a reducing group, or compound types 1 to 5 in each of which a one-electron-oxidized form generated by oxidizing one electron therein can release one or more electrons by a subsequent reaction. However, the effect is remarkably high in a silver halide emulsion in which an epitaxial structure or a dislocation line is introduced.

Example 2-2

1) Support

An undercoat of a prescription of Example 1-1 was applied on each side of a PET support, having a thickness of 175 μm, which has been colored in blue by using a blue dye (1,4-bis (2,6-diethylanilinoanthraquinone).

2) Preparation of Coated Sample

An image-forming layer (in which, however, sensitizing dyes-1, -2 and -3 were used instead of the spectral sensitizing dyes A and B of the silver halide emulsion 2B), an intermediate layer, a first layer for a protection layer of an emulsion layer, and a second layer for the protection layer of the emulsion layer having the same composition as that of the sample 2-10 of Example 2-1 were applied on each side of a support in a simultaneous manner and, then, dried. In other words, a photothermographic material, having a total coated quantity of silver of 3.3 g/m$^2$, in which an image-forming layer having a coated quantity of silver of 1.65 g/m$^2$ as a sum of a fatty acid silver salt and a silver halide was applied on each side of the support was prepared.

3) Evaluation of Performance

The thus-prepared double-side-type photosensitive material was treated in a same manner as in Example 1-3 and, then, comparison of photographic properties thereof was performed. As a result, it was found that the image obtained by using the photothermographic material according to the invention and the image obtained by using the wet-type developing system were equally favorable in performance.

Example 2-3

1) Preparation of Sample

A double-side-type photosensitive material was prepared in a same manner as in Example 2-2 except for two points. The two points of alterations from Example 2-3 are as follows:

(1) An emulsion 2C was used as a silver halide emulsion and an ortho spectral sensitization was optimally conducted by using sensitizing dyes 1, 2 and 3 instead of the spectral sensitizing dyes A and B; and (2) A cross-over cut layer was provided between an image-forming layer and a support in a same manner as in Example 1-4.

Preparation of Coated Sample

A cross-over cut layer, an image-forming layer, an intermediate layer, a first layer for a protective layer of an emulsion layer, and a second layer for the protective layer of the emulsion layer were applied on each side of a support in a simultaneous manner and, then, dried. A flow rate of the cross-over cut layer was adjusted such that a coated quantity of the solid content of the ortho thermally decolorizing dye was allowed to be 0.04 g/m$^2$. Coating quantities of other layers were allowed to be same as those in Example 2-2.

2) Evaluation of Performance

An X-ray exposure and thermal development were conducted in a same manner as in Example 2-2, except for using an X-ray ortho screen HG-M (trade name; manufactured by Fuji Photo Film Co., Ltd.) as a fluorescent screen (a terbium-activated gadolinium oxysulfide phosphor being used as a phosphor; a luminescent peak wavelength: 545 nm).

On the other hand, a photosensitive material SHR—S30 (trade name; manufactured by Fuji Photo Film Co., Ltd.) for an ortho system was exposed under same conditions as described above and, then, treated with a processing solution CE-DFI-M2 (trade name; manufactured by Fuji Photo Film Co., Ltd.) by using an automatic developing machine CEPROS-M2 (trade name; manufactured by Fuji Photo Film Co., Ltd.) for 45 seconds to form an image.

The photographic characteristics of the thus-formed image obtained by using the photosensitive material and those of the image obtained by using the former photosensitive material according to the invention were compared with each other. As a result, both of them are equally favorable.

A measurement of sensitivity was performed in a same manner as in Example 1 of Japanese Patent No. 3083647 except for performing development by thermal development processing. As a result, the sensitivity was 0.0076 lux·second.

A measurement of cross-over was performed in a same manner as in Example 1 of JP-A No. 11-142723 except for performing development by thermal development processing. As a result, the cross-over was 7%.

Example 2-4

1) Preparation of Sample

A single-side-type photosensitive material was prepared in a same manner as in Example 2-1.

However, the image-forming layer was applied in two layers, namely, an upper layer and a lower layer and coated silver quantity as an entire silver quantity of fatty acid silver halide) of each of these layers was allowed to be 0.8 g/m$^2$. The silver halide emulsion which were used for the upper layer and the lower layer were an emulsion 1B and an emulsion 1C, respectively. Ortho spectral sensitization of the upper layer and the lower layer was optimally performed by using the sensitizing dyes 1, 2 and 3 instead of the spectral sensitizing dyes A and B in each of the emulsions.

Further, the dye solid fine grain dispersion to be used in a coating solution for the antihalation layer which is a back layer was replaced by the dye solid dispersion of the ortho thermally decolorizing dye in Example 2-3.

2) Evaluation of Performance

The thus-obtained ortho sensitizing single-side-type photosensitive material was evaluated as described below.

A fluorescent screen for mammography UM MAMMO FINE (trade name; manufactured by Fuji Photo Film Co., Ltd.) (a terbium-activated gadolinium oxysulfide phosphor being used as a phosphor; a luminescent peak wavelength: 545 nm) was used as a fluorescent screen. Surfaces of the image-forming layer of the sample and the protective layer of the screen were allowed to be in contact with each other and a resultant combined body was inserted in a cassette ECMA (trade name; manufactured by Fuji Photo Film Co., Ltd.). The X-ray tube, an upper lid of the cassette, the film, and the screen were aligned in the stated order and were subjected to the X-ray irradiation.

A commercially available photographing machine for mammography DRX-B1356EC (trade name; manufactured by Toshiba Corporation) was used as an X-ray supply. The X-ray which was emitted from an Mo target tube operated by 26 kVp generated by means of three-phase electric supply and allowed to pass through 1 mm-thick Be, 0.03 mm-thick Mo and a 2 cm-thick filter made of acrylate was used. An exposure was conducted for one second in a stepwise manner at a width of log E=0.15 by varying the exposure quantity of the X-ray by means of a distance method.

After such exposure, thermal development processing was performed in a same manner as in Example 2-1.

On the other hand, a photosensitive material for mammography UM-MAHC (trade name; manufactured by Fuji Photo Film Co., Ltd.) was exposed under same conditions as described above and, then, treated with a processing solution CE-DFI (trade name; manufactured by Fuji Photo Film Co., Ltd.) by using an automatic developing machine CEPROS-M2 (trade name; manufactured by Fuji Photo Film Co., Ltd.) for 90 seconds to form an image.

The photographic characteristics of the thus-formed image obtained by using the photosensitive material for mammography and those of the image obtained by using the former single-side-type photosensitive material according to the invention were compared with each other. As a result, both of them are equally favorable.

Sensitivity of the resultant photothermographic material was measured in a same manner as in Example as described in JP-A No. 10-62881 except for performing development by thermal development processing. As a result, the sensitivity was 0.021 lux·second. Further, gradation between density points of fog plus 0.25 and fog plus 2.0 was also measured. As a result, the gradation was 4.1.

According to the invention, a photothermographic material using a high silver halide and an image-forming method using the photothermographic material, in which the photothermographic material has a high sensitivity, a low fog and an excellent image storability can be provided.

What is claimed is:

1. An image-forming combined system for medical diagnosis application comprising a combination of a photothermographic material and an X-ray intensifying screen, wherein the photothermographic material comprises: a support and, disposed on both sides of the support, image-forming layers, each of which comprises a non-photosensitive organic silver salt comprising silver behenate, a photosensitive silver halide comprising tabular grains, a binder, a bisphenol reduction agent, a color toning agent, an organic polyhalogen compound, and a silver iodide complex forming agent that, after thermal development, substantially reduces visible light absorption caused by the photosensitive silver halide;

the photosensitive silver halide tabular grains have an average sphere-equivalent diameter in a range from 0.3 μm to 5.0 μm and have a silver iodide content of 90 mol % to 100 mol %;

the silver iodide complex forming agent is contained in a range from 50 to 300 mol % relative to an amount of the photosensitive silver halide;

the silver iodide complex forming agent reduces a transition absorption of silver iodide of the photothermographic material after thermal development, which resides in the vicinity of 423 nm, to ½ or less than that before the thermal development; and the photothermographic material is capable of being recorded imagewise by using the X-ray intensifying screen.

2. The image-forming combined system of claim 1, wherein at least 50%, in terms of a projected area, of the photosensitive silver halide is occupied by tabular grains having an aspect ratio of from 2 to 100.

3. The image-forming combined system of claim 1, wherein at least 50%, in terms of a projected area, of the photosensitive silver halide is occupied by tabular silver halide grains having an aspect ratio of from 2 to 50 and being deposited with a silver salt in an epitaxial growth manner.

4. The image-forming combined system of claim 1, wherein at least 50%, in terms of a projected area, of the photosensitive silver halide is occupied by tabular silver halide grains having an aspect ratio of from 2 to 50 and having one or more dislocation lines respectively.

5. The image-forming combined system of claim 1, wherein the silver iodide complex forming agent is a compound represented by one of the following formulas (1) and (2):

Formula (1)

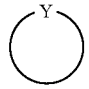

Formula (2)

$S(Z)_n$ wherein, in the formula (1), Y represents a non-metallic atomic group necessary for forming a 5- to 7-membered heterocycle containing at least one of a nitrogen atom and a sulfur atom;

the heterocycle formed by Y may be saturated or unsaturated, or may have a substituent; and substituents on the heterocycle formed by Y may be combined with each other to form a ring; and wherein, in the formula (2), Z represents a hydrogen atom or a substituent;

n represents an integer of 1 or 2, when n represents 1, S and Z are combined with each other by a double bond;

when n represents 2, S and each of two Zs are combined with each other by a single bond;

when n represents 1, Z does not represent a hydrogen atom; and when n represents 2, two Z's may be same as, or different from, each other, but neither of the two Zs represents a hydrogen atom.

6. The image-forming combined system of claim 3, wherein the silver salt is silver chloride or silver bromide.

7. The image-forming combined system of claim 1, wherein the average sphere-equivalent diameter of the photosensitive silver halide is in a range from 0.4 μm to 3.0 μm.

8. The image-forming combined system of claim 1, further comprising at least one compound having an adsorptive group to the photosensitive silver halide and a reducing group, or a precursor thereof.

9. The image-forming combined system of claim 8, further comprising a compound represented by the following formula (I) as the compound having an adsorptive group and a reducing group:

$A\text{-}(W)_n\text{—}B$ Formula (I)

wherein A represents a group adsorbable to silver halide (hereinafter referred to simply as "adsorptive group");

W represents a divalent linking group;

n represents 0 or 1; and

B represents a reducing group.

10. The image-forming combined system of claim 1, further comprising a compound in which a one-electron-oxidized form generated by an oxidizing of one electron therein can release one or more electrons.

11. The image-forming combined system of claim 1, further comprising a development accelerator.

12. The image-forming combined system of claim 1, further comprising at least one phthalic acid or a derivative thereof.

13. The image-forming combined system of claim 1, comprising the combination of the photothermographic material and the X-ray intensifying screen, wherein the photothermographic material is recorded imagewise by exposure using the X-ray intensifying screen, and wherein an exposure quantity, that is necessary for obtaining an image density of fog plus 0.5 after the steps of (1) exposing the photothermographic material with a monochromatic light having the same wavelength as the main emission peak wavelength of the X-ray intensifying screen and having a half bandwidth of 15 nm±5 nm and (2) thermally developing the photothermographic material and then (3) removing the image-forming layer provided on a side of the support opposite to an exposed face, is in a range from 0.005 lux·second to 0.07 lux·second.

14. The image-forming combined system of claim 1, further comprising an ultraviolet ray-absorbing agent.

15. The image-forming combined system of claim 1, exposed by using the X-ray intensifying screen having a luminescent peak in an ultraviolet region.

16. An image-forming combined system for medical diagnosis application comprising a combination of a photothermographic material and an X-ray intensifying screen, wherein the photothermographic material comprises: a support and, disposed only on one surface of the support, an image-forming layer, which comprises a non-photosensitive organic silver salt comprising silver behenate, a photosensitive silver halide comprising tabular grains, a binder, a bisphenol reduction agent, a color toning agent, an organic polyhalogen compound, and a silver iodide complex forming agent that, after thermal development, substantially reduces visible light absorption caused by the photosensitive silver halide;

the photosensitive silver halide tabular grains have an average sphere-equivalent diameter in a range from 0.3 μm to 5.0 μm and a silver iodide content of 90 mol % to 100 mol %;

the silver iodide complex forming agent is contained in a range from 50 to 300 mol % relative to an amount of the photosensitive silver halide;

the silver iodide complex forming agent reduces a transition absorption of silver iodide of the photothermographic material after thermal development, which resides in the vicinity of 423 nm, to ½ or less than that before the thermal development;

the photothermographic material is capable of being recorded imagewise by exposure using the X-ray intensifying screen, an exposure quantity, that is necessary for obtaining an image density of fog plus 0.5 after the steps of (1) exposing the photothermographic material with a monochromatic light having the same wavelength as the main emission peak wavelength of the X-ray intensifying screen and having a half bandwidth of 15 nm±5 nm and (2) thermally developing the photothermographic material, is in a range from 0.005 lux·second to 0.07 lux·second, and an image contrast after the thermal development is in a range from 3.0 to 5.0.

* * * * *